US009401243B2

(12) United States Patent
Park

(10) Patent No.: US 9,401,243 B2
(45) Date of Patent: Jul. 26, 2016

(54) PLANAR TRANSFORMER

(71) Applicant: LG INNOTEK CO., LTD., Seoul (KR)

(72) Inventor: Minsu Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/575,460

(22) Filed: Dec. 18, 2014

(65) Prior Publication Data

US 2015/0102883 A1 Apr. 16, 2015

Related U.S. Application Data

(63) Continuation of application No. 13/806,483, filed as application No. PCT/KR2011/002751 on Apr. 18, 2011, now Pat. No. 8,947,190.

(30) Foreign Application Priority Data

Jun. 21, 2010 (KR) ..... 10-2010-0058528

(51) Int. Cl.

| | |
|---|---|
| ***H01F 17/04*** | (2006.01) |
| ***H01F 27/28*** | (2006.01) |
| ***H01F 27/30*** | (2006.01) |
| ***H01F 27/24*** | (2006.01) |
| ***H01F 27/32*** | (2006.01) |
| ***H01F 27/00*** | (2006.01) |

(52) U.S. Cl.

CPC ..... *H01F 27/306* (2013.01); *H01F 27/00* (2013.01); *H01F 27/2804* (2013.01); *H01F 27/2847* (2013.01); *H01F 27/323* (2013.01); *H01F 27/325* (2013.01); *H01F 2027/2819* (2013.01)

(58) Field of Classification Search

CPC ..... H01F 2027/2819

USPC ..... 336/170, 192, 220, 232, 221, 212, 214, 336/215, 208, 198

See application file for complete search history.

(56) References Cited

U.S. PATENT DOCUMENTS 5,010,314 A 4/1991 Estrov
5,359,313 A 10/1994 Watanabe et al.

(Continued)

FOREIGN PATENT DOCUMENTS

CN 1930644 A 3/2007
EP 0820072 A1 1/1998

(Continued)

OTHER PUBLICATIONS

Office Action dated Mar. 16, 2015 in Chinese Application No. 201180040581.6.

(Continued)

*Primary Examiner* — Mangtin Lian

(74) *Attorney, Agent, or Firm* — Saliwanchik, Lloyd & Eisenschenk

(57) ABSTRACT

The present invention relates to a planar transformer, the transformer including a core provided to induce formation of a magnetic field, a bobbin coupled to a core, at least one primary winding interposed between the core and the bobbin to supply a power signal, a first insulation unit provided to the at least one primary winding to insulate the at least one primary winding, at least one secondary winding provided to the first insulation unit and insulated by the first insulation unit to transform the power signal, and a second insulation unit provided to the at least one secondary winding to insulate the at least one secondary winding.

18 Claims, 55 Drawing Sheets

(56) References Cited

U.S. PATENT DOCUMENTS

| | | | | |
|---|---|---|---|---|
| 5,463,303 | A * | 10/1995 | Hall | H01F 38/14 320/108 |
| 5,684,445 | A | 11/1997 | Kobayashi et al. | |
| 5,886,610 | A | 3/1999 | Canova | |
| 6,278,353 | B1 | 8/2001 | Downing et al. | |
| 6,281,779 | B1 | 8/2001 | Matsumoto et al. | |
| 6,522,233 | B1 | 2/2003 | Kyoso et al. | |
| 7,180,397 | B1 * | 2/2007 | Busletta | H05K 1/165 336/200 |
| 7,460,002 | B2 | 12/2008 | Estrov | |
| 7,956,714 | B2 | 6/2011 | Ackermann et al. | |
| 9,000,874 | B2 * | 4/2015 | Kim | H01F 3/14 336/170 |
| 2007/0046414 | A1 * | 3/2007 | Wu | H05B 41/2822 336/208 |
| 2007/0171022 | A1 | 7/2007 | Marui et al. | |
| 2008/0088401 | A1 * | 4/2008 | Wei | H01F 27/2804 336/182 |
| 2008/0284551 | A1 | 11/2008 | Chen et al. | |
| 2009/0231078 | A1 * | 9/2009 | Watanabe | H01F 5/02 336/192 |
| 2009/0289751 | A1 | 11/2009 | Nagano et al. | |

FOREIGN PATENT DOCUMENTS

| | | | |
|---|---|---|---|
| EP | 1536436 | A1 | 6/2005 |
| JP | 55-105310 | A | 8/1980 |
| JP | 03-283404 | A | 12/1991 |
| JP | 5-90929 | U | 12/1993 |
| JP | 06-013247 | A | 1/1994 |
| JP | 7-235426 | A | 9/1995 |
| KR | 10-2010-0023608 | A | 3/2010 |

OTHER PUBLICATIONS

European Search Report dated Jun. 30, 2015 in European Application No. 11798308.0.

International Search Report in International Application No. PCT/KR2011/002751, filed Apr. 18, 2011.

Notice of Allowance dated Dec. 15, 2011 in Korean Application No. 10-2010-0058528, filed Jun. 21, 2010.

Office Action dated Jul. 26, 2011 in Korean Application No. 10-2010-0058528, filed Jun. 21, 2010.

* cited by examiner

PLANAR TRANSFORMER

CROSS-REFERENCE TO RELATED APPLICATIONS

This application is a continuation of U.S. application Ser. No. 13/806,483, filed Jan. 7, 2013, which is the U.S. national stage application of International Patent Application No. PCT/KR2011/002751, filed Apr. 18, 2011, which claims priority to Korean Patent Application No. 10-2010-0058528, filed Jun. 21, 2010, which are hereby incorporated by reference in their entirety.

BACKGROUND

1. Technical Field

The teachings in accordance with the exemplary embodiments of this invention relate generally to a planar transformer.

2. Background of the Invention

Recently, power supply devices employing a Switch-Mode Power Supply (SMPS) are being focused, and the SMPS uses a switching device such as a Metal Oxide Semiconductor Field Effect Transistor (MOSFET) or a Bipolar Junction Transistor (BJT), or a transformer to stably provide a power source.

Meanwhile, concomitant with a trend toward development of miniaturization, reduced slim, light weight size of home electronic appliances, the SMPS is required to slim, and researches are continuously made to reduce volume or size of a transformer that takes the lion's share of a circuit component comprising the SMPS.

DISCLOSURE OF INVENTION

Technical Problem

The present invention is to provide a planar transformer configured to improve efficiency of a transformer that can be manufactured in a slim size and that can reduce the manufacturing cost.

Furthermore, the present invention provides a planar transformer configured to manufacture a power supply device in a slim size because the transformer can be manufactured in the slim size.

Technical problems to be solved by the present invention are not restricted to the above-mentioned, and any other technical problems not mentioned so far will be clearly appreciated from the following description by skilled in the art.

Solution to Problem

An object of the invention is to solve at least one or more of the above problems and/or disadvantages in a whole or in part and to provide at least the advantages described hereinafter. In order to achieve at least the above objects, in whole or in part, and in accordance with the purposes of the invention, as embodied and broadly described, and in one general aspect of the present invention, there is provided a planar transformer, the transformer characterized by: a core provided to induce formation of a magnetic field; a bobbin coupled to the core; at least one primary winding interposed between the core and the bobbin to supply a power signal; a first insulation unit provided to the at least one primary winding to insulate at least the one primary winding; at least one secondary winding provided to the first insulation unit and insulated by the first insulation unit to transform the power signal; and a second insulation unit provided to the at least one secondary winding to insulate the at least one secondary winding.

In another general aspect of the present invention, there is provided a planar transformer, the transformer characterized by: a core including a first fastening unit and provided to induce formation of a magnetic field; a bobbin coupled to the core by the first fastening unit; at least one primary winding interposed between the core and the bobbin and provided to an upper surface of the bobbin and coupled to the first fastening unit to supply a power signal; a first insulation unit provided to an upper surface of the at least one primary winding and coupled to the first fastening unit to insulate the at least one primary winding; at least one secondary winding provided to the upper surface of the first insulation unit and coupled to the first fastening unit to be insulated by the first insulation unit and to transform the power signal; and a second insulation unit provided to an upper surface of the at least one secondary winding and coupled to the first fastening unit to insulate the at least one secondary winding.

In still another general aspect of the present invention, there is provided a planar transformer, the transformer characterized by: a core including a first fastening unit and provided to induce formation of a magnetic field; a bobbin coupled to the core by the first fastening unit; at least one secondary winding interposed between the core and the bobbin and provided to a bottom surface of the bobbin and coupled to the first fastening unit to supply a transformed power signal; a first insulation unit provided to a bottom surface of the at least one secondary winding and coupled to the first fastening unit to insulate the at least one secondary winding; at least one primary winding provided to a bottom surface of the first insulation unit and coupled to the first fastening unit to be insulated by the first insulation unit and to supply a power signal; and a second insulation unit provided to a bottom surface of the at least one primary winding and coupled to the first fastening unit to insulate the at least one primary winding.

In still another general aspect of the present invention, there is provided a planar transformer, the transformer characterized by: a core including a first fastening unit and provided to induce formation of a magnetic field; a bobbin coupled to the core by the first fastening unit; at least one primary winding interposed between the core and the bobbin and provided to an upper surface of the bobbin and coupled to the first fastening unit to supply a power signal; a first insulation unit provided to an upper surface of the at least one primary winding and coupled to the first fastening unit to insulate the at least one primary winding; at least one secondary winding provided to the upper surface of the first insulation unit and coupled to the first fastening unit to be insulated by the first insulation unit and to transform the power signal; a second insulation unit provided to an upper surface of the at least one secondary winding and coupled to the first fastening unit to insulate the at least one secondary winding; at least another secondary winding interposed between the core and the bobbin, and provided to a bottom surface of the bobbin and coupled to the first fastening unit to transform the power signal; and a third insulation unit provided to a bottom surface of the at least another secondary winding, and coupled to the first fastening unit to insulate the at least another secondary winding.

In still another general aspect of the present invention, there is provided a planar transformer, the transformer characterized by: a core including a first fastening unit and provided to induce formation of a magnetic field; a bobbin coupled to the core by the first fastening unit; at least one secondary winding interposed between the core and the bobbin and provided to a bottom surface of the bobbin and coupled to the first fastening unit to supply a transformed power signal; a first insulation unit provided to a bottom surface of the at least one secondary winding and coupled to the first fastening unit to insulate the at least one secondary winding; at least one first winding provided to a bottom surface of the first insulation unit and coupled to the first fastening unit to be insulated by the first insulation unit and to supply a power signal; a second insulation unit provided to a bottom surface of the at least one primary winding and coupled to the first fastening unit to insulate the at least one primary winding; at least another secondary winding interposed between the core and the bobbin and provided to an upper surface of the bobbin and coupled to the first fastening unit to transform a power signal; and a third insulation unit provided to an upper surface of the at least another secondary winding and coupled to the first fastening unit to insulate the at least another secondary winding.

In still another general aspect of the present invention, there is provided a planar transformer, the transformer characterized by: a core including a first fastening unit and provided to induce formation of a magnetic field; a bobbin coupled to the core by the first fastening unit; at least one primary winding interposed between the core and the bobbin and provided to an upper surface of the bobbin and coupled to the first fastening unit to supply a power signal; a first insulation unit provided to an upper surface of the at least one primary winding and coupled to the first fastening unit to insulate the at least one primary winding; at least one secondary winding provided to the upper surface of the first insulation unit and coupled to the first fastening unit to be insulated by the first insulation unit and to transform the power signal; a second insulation unit provided to an upper surface of the at least one secondary winding and coupled to the first fastening unit to insulate the at least one secondary winding; at least another primary winding interposed between the core and the bobbin, and provided to a bottom surface of the bobbin and coupled to the first fastening unit to supply the power signal; and a fourth insulation unit provided to a bottom surface of the at least another primary winding, and coupled to the first fastening unit to insulate the at least another primary winding.

In still another general aspect of the present invention, there is provided a planar transformer, the transformer characterized by: a core including a first fastening unit and provided to induce formation of a magnetic field; a bobbin coupled to the core by the first fastening unit; at least one secondary winding interposed between the core and the bobbin and provided to a bottom surface of the bobbin and coupled to the first fastening unit to supply a transformed power signal; a first insulation unit provided to a bottom surface of the at least one secondary winding and coupled to the first fastening unit to insulate the at least one secondary winding; at least one primary winding provided to a bottom surface of the first insulation unit and coupled to the first fastening unit to be insulated by the first insulation unit and to supply a power signal; a second insulation unit provided to a bottom surface of the at least one first winding and coupled to the first fastening unit to insulate the at least one primary winding; at least another primary winding interposed between the core and the bobbin and provided to an upper surface of the bobbin and coupled to the first fastening unit to supply the power signal; and a fourth insulation unit provided to an upper surface of the at least another primary winding and coupled to the first fastening unit to insulate the at least another primary winding.

In still another general aspect of the present invention, there is provided a planar transformer, the transformer characterized by: a core including a first fastening unit and provided to induce formation of a magnetic field; a bobbin coupled to the core by the first fastening unit; at least one primary winding interposed between the core and the bobbin and provided to an upper surface of the bobbin and coupled to the first fastening unit to supply a power signal; a first insulation unit provided to an upper surface of the at least one primary winding and coupled to the first fastening unit to insulate the at least one primary winding; at least one secondary winding provided to the upper surface of the first insulation unit and coupled to the first fastening unit to be insulated by the first insulation unit and to transform the power signal; a second insulation unit provided to an upper surface of the at least one secondary winding and coupled to the first fastening unit to insulate the at least one secondary winding; at least another secondary winding interposed between the core and the bobbin, and provided to a bottom surface of the bobbin and coupled to the first fastening unit to transform the power signal; a third insulation unit provided to a bottom surface of the at least another secondary winding, and coupled to the first fastening unit to insulate the at least another secondary winding; at least another primary winding provided to a bottom surface of the third insulation unit and coupled to the first fastening unit to be insulated by the third insulation unit and to supply the power signal; and a fourth insulation unit provided to a bottom surface of the at least another primary winding and coupled to the first fastening unit to insulate the at least another primary winding.

Advantageous Effects of Invention

The planar transformer according to the present invention has an advantageous effect in that a transformer can be manufactured in a slim size, whereby a power supply unit including a planar transformer can be manufactured in a slim size.

The planar transformer according to the present invention has an advantageous effect in that a manufacturing cost of a transformer can be reduced to enhance an efficiency of transformation.

BRIEF DESCRIPTION OF DRAWINGS

The teachings of the present invention can be readily understood by considering the following detailed description in conjunction with the accompanying drawings, in which.

MODE FOR THE INVENTION

Figure 1:
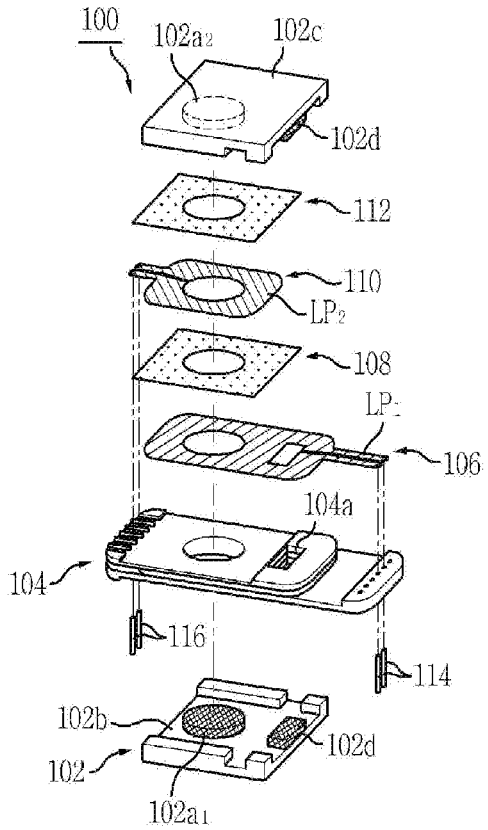
FIG. 1 is an exploded perspective view illustrating a planar transformer according to a first exemplary embodiment of the present invention.

In describing the present invention, detailed descriptions of constructions or processes known in the art may be omitted to avoid obscuring appreciation of the invention by a person of ordinary skill in the art with unnecessary detail regarding such known constructions and functions. Accordingly, the meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification.

Hereinafter, implementations of the present invention are described in detail with reference to the accompanying drawings. Detailed descriptions of well-known functions, configurations or constructions are omitted for brevity and clarity so as not to obscure the description of the present disclosure with unnecessary detail.

In the drawings, the size and relative sizes of layers, regions and/or other elements may be exaggerated or reduced for clarity. Like numbers refer to like elements throughout and explanations that duplicate one another will be omitted. Now, the present invention will be described in detail with reference to the accompanying drawings.

The terminology used herein is for the purpose of describing particular implementations only and is not intended to be limiting of the invention. As used herein, the singular forms "a", "an" and "the" are intended to include the plural forms as well, unless the context clearly indicates otherwise.

The terms "including", "includes", "having", "has", "with", or variants thereof are used in the detailed description and/or the claims to denote non-exhaustive inclusion in a manner similar to the term "comprising".

Furthermore, "exemplary" is merely meant to mean an example, rather than the best. Still furthermore, the terms "another" and "other" may be interchangeably used in describing certain areas.

A planar transformer according to exemplary embodiments of the present invention includes a core, a bobbin, at least one primary winding, a first insulation unit, at least one secondary winding and a second insulation unit. The core provides to induce formation of a magnetic field. At this time, the core may include a bottom core and an upper core. The bobbin is provided between cores. At least one primary winding is provided between the core and the bobbin to supply a power signal.

At this time, the at least one primary winding may include a metal thin film pattern layer having an inductance component, and the metal thin film pattern layer having an inductance component may be provided with a metal material having a high conductivity and can smoothly and efficiently provide a power signal through a power signal supply unit (described later).

Meanwhile, the at least one primary winding may include a metal thin film pattern layer having at least two or more inductance components, and at least one primary insulation layer provided to the metal thin film pattern layer having the at least two or more inductance components to insulate the metal thin film pattern layer having the at least two or more inductance components.

At this time, the metal thin film pattern layer having at least two or more inductance components may include a metal material having a high conductivity, whereby a power signal can be efficiently and smoothly supplied. The at least one primary winding may be provided in at least one of a circular shape, an oval shape and a polygon shape. The first insulation unit may be provided to the at least one primary winding to insulate the at least one primary winding. The first insulation unit may be provided in an insulation sheet and provided in at least one of a circular shape, an oval shape and a polygon shape.

The at least one secondary winding is provided to the first insulation unit and insulated by the first insulation unit, and provided to transform a power signal.

At this time, at least one secondary winding may include a metal thin film pattern layer having an inductance component, where the metal thin film pattern layer having an inductance component may be provided with a metal material having a high conductivity, whereby a power signal transformed by at least one secondary winding can be outputted smoothly and efficiently.

Meanwhile, at least one secondary winding may include a metal thin film pattern layer having at least two or more inductance components, and at least one secondary insulation layer provided to the metal thin film pattern layer having at least two or more inductance components to insulate the metal thin film pattern layer having at least two or more inductance components.

At this time, the metal thin film pattern layer having at least two or more inductance components may include a metal material having a high conductivity, whereby the transformed power signal can be outputted smoothly and efficiently. The at least one secondary winding may be provided in at least one of a circular shape, an oval shape and a polygon shape. A second insulation unit may be provided to at least one secondary winding to insulate at least one secondary winding.

At this time, the second insulation unit may be provided in an insulation sheet and provided in at least one of a circular shape, an oval shape and a polygon shape. Furthermore, at least another secondary winding may be provided between the core and the bobbin, distanced from at least one primary winding and at least one secondary winding, and coupled to a first fastening unit to transform a power signal.

At this time, at least another secondary winding may include a metal thin film pattern layer having an inductance component, and the metal thin film pattern layer having an inductance component may be provided with a metal material having a high conductivity, whereby a power signal transformed by at least another secondary winding can be outputted smoothly and efficiently. The at least another secondary winding may be provided in at least one of a circular shape, an oval shape and a polygon shape.

Meanwhile, at least another secondary winding may include a metal thin film pattern layer having at least two or more inductance components and another secondary Insulation layer provided to a metal thin film pattern layer having at least two or more inductance components to insulate a metal thin film pattern layer having at least two or more conductance components. At this time, the metal thin film pattern layer having at least two or more inductance components may include a metal material having a high conductivity, whereby a transformed power signal can be outputted smoothly and efficiently.

A third insulation unit may be provided to at least another secondary winding, and may be coupled to a first fastening unit to insulate the at least another secondary winding. The third insulation unit may be provided in an insulation sheet and provided in at least one of a circular shape, an oval shape and a polygon shape. Furthermore, at least another primary winding may be provided between the core and the bobbin, distanced from at least one primary winding and at least one secondary winding, and coupled to a first fastening unit to provide a power signal.

At this time, at least another primary winding may include a metal thin film pattern layer having an inductance component, and the metal thin film pattern layer having an inductance component may be provided with a metal material having a high conductivity, whereby a power signal provided by a power signal supply unit (described later) can be provided smoothly and efficiently. The at least another primary winding may be provided in at least one of a circular shape, an oval shape and a polygon shape.

Meanwhile, at least another primary winding may include a metal thin film pattern layer having at least two or more inductance components and another primary insulation layer provided to a metal thin film pattern layer having at least two or more inductance components to insulate a metal thin film pattern layer having at least two or more conductance components. At this time, the metal thin film pattern layer having at least two or more inductance components may include a metal material having a high conductivity to efficiently and smoothly provide a power signal.

A fourth insulation unit provided to at least another primary winding to insulate at least another primary winding by being coupled to the first fastening unit. At this time, the fourth insulation unit may be provided in an insulation sheet and provided in at least one of a circular shape, an oval shape and a polygon shape.

The power signal supply unit may be coupled to one side of the bobbin to be electrically connected to at least one primary winding, whereby a power signal can be provided to at least one primary winding. At this time, the power signal supply unit may be provided in a terminal lug, and may be provided in a metal material having a high conductivity to efficiently and smoothly supply a power signal to at least one primary winding. Furthermore, the power signal supply unit may be coupled to another side of the bobbin to be electrically connected to at least another primary winding, whereby the power signal can be provided to at least another primary winding.

At this time, the power signal supply unit may be provided in a terminal lug, and may be provided in a metal material having a high conductivity to efficiently and smoothly supply a power signal to at least another primary winding.

Furthermore, a power signal output unit may be coupled to the other side of the bobbin to be electrically connected to at least one secondary winding, whereby a power signal transformed by at least one secondary winding can be outputted. At this time, the power signal output unit may be provided in a metal material having a high conductivity to efficiently and smoothly output a power signal transformed by at least one secondary winding.

At this time, the power signal output unit may be coupled to the other side of the bobbin to be electrically connected to at least another secondary winding, whereby a power signal transformed by at least another secondary winding can be outputted.

At this time, the power signal output unit may be in a terminal lug, and may be provided in a metal material having a high conductivity to efficiently and smoothly output a power signal transformed by at least another secondary winding.

Now, the planar transformer according to exemplary embodiments of the present invention will be described in detail with reference to FIGS. 1 through 110.

First Exemplary Embodiment

Figure 2:
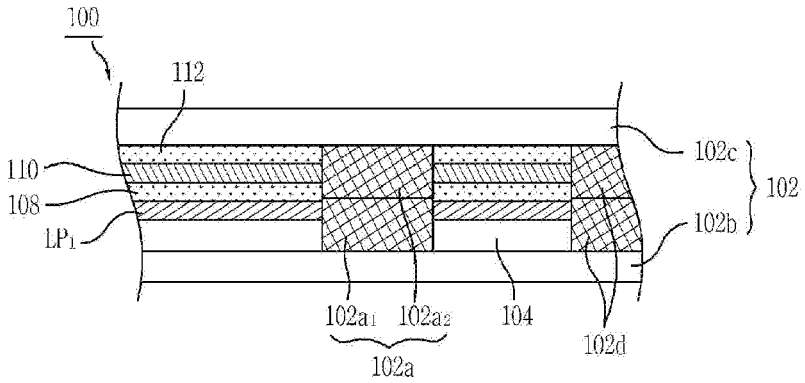
FIG. 2 is a coupled cross-sectional view illustrating a planar transformer according to a first exemplary embodiment of the present invention.

FIG. 1 is an exploded perspective view illustrating a planar transformer according to a first exemplary embodiment of the present invention, and FIG. 2 is a coupled cross-sectional view illustrating a planar transformer according to a first exemplary embodiment of the present invention.

First, referring to FIGS. 1 and 2, a planar transformer (100) according to a first exemplary embodiment of the present invention includes a core (102), a bobbin (104), at least one primary winding (106), a first insulation unit (108), at least one secondary winding (110) and a second insulation unit (112).

The core (102) includes a first fastening unit (102*a*) and is provided to induce formation of a magnetic field, where the core (102) may include a bottom core (102*b*) and an upper core (102*c*). The bobbin (104) is provided to be coupled to the core (102) by the first fastening unit (102*a*). The first fastening unit (102*a*) may include first lugs (102*a*1, 102*a*2).

The bobbin (104) may include a second fastening unit (104*a*) discrete from the first fastening unit (102*a*), and the core (102) may include a third fastening unit (102*d*) to be coupled to a second fastening unit (104*a*). At this time, the second fastening unit (104*a*) may be provided in a second fastening hole (104*a*), and the third fastening unit (102*d*) may be provided to the bottom core (102*b*) and the upper core (102*c*), and may be provided in a third fastening lug (102*d*) to be coupled to the second fastening hole (104*a*).

The at least one primary winding (106) is provided between the core (102) and the bobbin (104), and provided at an upper surface of the bobbin (104) to be coupled to the first fastening unit (102*a*) for supply of a power signal. At this time, the at least one primary winding (106) may include a metal thin film pattern layer (LP1) having an inductance component.

Furthermore, the metal thin film pattern layer (LP1) having an inductance component may be provided with a metal material having a high conductivity to efficiently and smoothly output a power signal supplied through a power signal supply unit (114, described later)

At this time, the metal thin film pattern layer (LP1) having an inductance component may be formed by at least one engineering method of a photo-lithography method using a photo mask and an etching solution, or an injection molding method using a compression press (hereinafter referred to as press). The at least one primary winding (106) may be provided in at least one of a circular shape, an oval shape and a polygon shape.

The first insulation unit (108) is provided to an upper surface of the at least one primary winding (106) to be coupled to the first fastening unit (102*a*) and to insulate the at least one primary winding (106). At this time, the first insulation unit (108) may be provided in an insulation sheet, and may be provided in at least one of a circular shape, an oval shape and a polygon shape.

The at least one secondary winding (110) is provided to an upper surface of the first insulation unit (108) to be coupled to the first fastening unit (102*a*), and insulated by the first insulation unit (108) for transformation of a power signal. At this time, the at least one secondary winding (110) may include a metal thin film pattern layer (LP2) having an inductance component.

Furthermore, the metal thin film pattern layer (LP2) having the inductance component may be formed by at least one engineering method of a photo-lithography method using a photo mask and an etching solution, or an injection molding method using a press. The at least one secondary winding (110) may be provided in at least one of a circular shape, an oval shape and a polygon shape.

The second insulation unit (112) is provided to an upper surface of the at least one secondary winding (110) and coupled to the first fastening unit (102*a*) to insulate the at least one secondary winding (110). At this time, the second insulation unit (112) may be provided in an insulation sheet, and may be provided in at least one of a circular shape, an oval shape and a polygon shape.

The power signal supply unit (114) may be coupled to one side of the bobbin (104) to be electrically connected to the at least one primary winding (106), whereby a power signal can be supplied to the at least one primary winding (106). At this time, the power signal supply unit (114) may be electrically connected to a distal end of the one side of the bobbin (104) and a distal end of the at least one primary winding (106).

The power signal supply unit (114) may be provided in a metal material having a high conductivity to supply a power signal to the at least one primary winding (106) smoothly and efficiently. At this time, the power signal supply unit (114) may be provided in a terminal lug.

A power signal output unit (116) may be coupled to the other side of the bobbin (104) to be electrically connected to the at least one secondary winding (110), whereby a power signal transformed by the at least one secondary winding (110) can be outputted. At this time, the power signal output unit (116) may be electrically connected to a distal end of the other side of the bobbin (104) and a distal end of the at least one secondary winding (110).

Furthermore, the power signal output unit (116) may be provided in a metal material having a high conductivity to output a power signal transformed by the at least one secondary winding (106) smoothly and efficiently. At this time, the power signal output unit (116) may be provided in a terminal lug.

As apparent from the foregoing, the planar transformer (100) according to the first exemplary embodiment of the present invention includes the core (102), the bobbin (104), the at least one primary winding (106), the first insulation unit (108), the at least one secondary winding (110) and the second insulation unit (112).

Therefore, a planar transformer (100) can be manufactured in a slim size using the technical feature of the planar transformer (100) according to the first exemplary embodiment of the present invention, such that a power supply unit (not shown) that is manufactured along with the planar transformer (100) can be manufactured in a slim size. Furthermore, the planar transformer (100) according to the first exemplary embodiment of the present invention can reduce the manufacturing cost of the planar transformer (100) to enhance the efficiency of transformation.

Second Exemplary Embodiment

Figure 3:
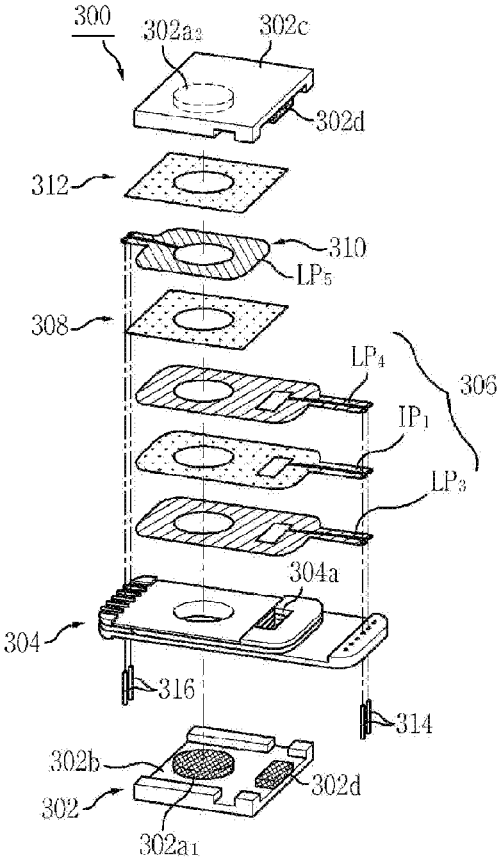
FIG. 3 is an exploded perspective view illustrating a planar transformer according to a second exemplary embodiment of the present invention.
Figure 4:
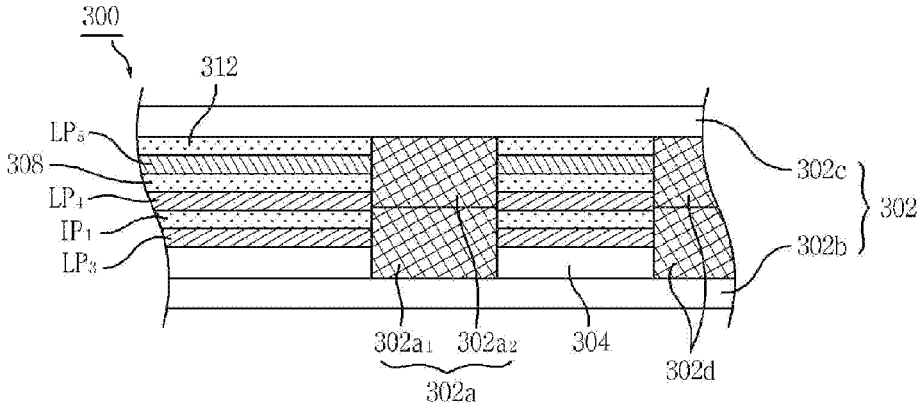
FIG. 4 is a coupled cross-sectional view illustrating a planar transformer according to a second exemplary embodiment of the present invention.

FIG. 3 is an exploded perspective view illustrating a planar transformer according to a second exemplary embodiment of the present invention, and FIG. 4 is a coupled cross-sectional view illustrating a planar transformer according to a second exemplary embodiment of the present invention.

First, referring to FIGS. 3 and 4, a planar transformer (300) according to a second exemplary embodiment of the present invention includes a core (302), a bobbin (304), at least one primary winding (306), a first insulation unit (308), at least one secondary winding (310) and a second insulation unit (312).

The core (302) includes a first fastening unit (302*a*) and is provided to induce formation of a magnetic field, where the core (302) may include a bottom core (302*b*) and an upper core (302*c*). The bobbin (304) is so provided as to be coupled to the core (302) by the first fastening unit (302*a*). The first fastening unit (302*a*) may include first lugs (302*a*1, 302*a*2).

The bobbin (304) may include a second fastening unit (304*a*) discrete from the first fastening unit (302*a*), and the core (102) may include a third fastening unit (302*d*) to be coupled to a second fastening unit (304*a*). At this time, the second fastening unit (304*a*) may be provided in a second fastening hole (304*a*), and the third fastening unit (302*d*) may be provided to the bottom core (302*b*) and the upper core (302*c*), and may be provided in a third fastening lug (302*d*) to be coupled to the second fastening hole (304*a*).

The at least one primary winding (306) is provided between the core (302) and the bobbin (304), and provided at an upper surface of the bobbin (304) to be coupled to the first fastening unit (302*a*) for supply of a power signal.

At least one primary winding (306) may include metal thin film pattern layers (LP3, LP4) having at least two or more inductance components, and at least one primary insulation layer (IP1) provided between the metal thin film pattern layers (LP3, LP4) having at least two or more inductance components to insulate metal thin film pattern layers (LP3, LP4) having at least two or more inductance components.

At this time, the metal thin film pattern layers (LP3, LP4) having at least two or more inductance components are provided in a metal material having a high conductivity to smoothly and efficiently supply a power signal supplied through a power signal supply unit (314, described later).

Furthermore, the metal thin film pattern layers (LP3, LP4) having at least two or more inductance components may be formed by at least one engineering method of a photo-lithography method using a photo mask and an etching solution, or an injection molding method using a press. The at least one primary winding (306) may be provided in at least one of a circular shape, an oval shape and a polygon shape.

The first insulation unit (308) is provided to an upper surface of the at least one primary winding (306) and coupled to the first fastening unit (302*a*) to insulate the at least one primary winding (306). At this time, the first insulation unit (308) may be provided in an insulation sheet, and may be provided in at least one of a circular shape, an oval shape and a polygon shape.

The at least one secondary winding (310) is provided to an upper surface of the first insulation unit (308), coupled to the first fastening unit (302*a*) and insulated by the first insulation unit (308) to transform the a power signal. At this time, the at least one secondary winding (310) may include a metal thin film pattern layer (LP5) having an inductance component.

The metal thin film pattern layer (LP5) having an inductance component is provided in a metal material having a high conductivity to output a power signal transformed by the at least one secondary winding (310). At this time, the metal thin film pattern layer (LP5) having an inductance component may be formed by at least one engineering method of a photo-lithography method using a photo mask and an etching solution, or an injection molding method using a press. The at least one secondary winding (310) may be provided in at least one of a circular shape, an oval shape and a polygon shape.

The second insulation unit (312) is provided to an upper surface of the at least one secondary winding (310) and coupled to the first fastening unit (302*a*) to insulate at least one secondary winding (310).

At this time, the second insulation unit (312) may be provided as an insulation sheet, and may be provided in at least one of a circular shape, an oval shape and a polygon shape.

The power signal supply unit (314) may be coupled to one side of the bobbin (304) to be electrically connected to the at least one primary winding (306), whereby a power signal can be supplied to the at least one primary winding (306). At this time, the power signal supply unit (314) may be electrically connected to a distal end of the side of the bobbin (304) and a distal end of the at least one primary winding (306).

The power signal supply unit (314) may be provided in a metal material having a high conductivity to supply a power signal to the at least one primary winding (306) smoothly and efficiently. At this time, the power signal supply unit (314) may be provided in a terminal lug.

A power signal output unit (316) may be coupled to the other side of the bobbin (304) to be electrically connected to the at least one secondary winding (310), whereby a power signal transformed by the at least one secondary winding (310) can be outputted. At this time, the power signal output unit (316) may be electrically connected to a distal end of the other side of the bobbin (304) and a distal end of the at least one secondary winding (310).

Furthermore, the power signal output unit (316) may be provided in a metal material having a high conductivity to output a power signal transformed by the at least one secondary winding (310) smoothly and efficiently. At this time, the power signal output unit (316) may be provided in a terminal lug.

As apparent from the foregoing, the planar transformer (300) according to the second exemplary embodiment of the present invention includes the core (302), the bobbin (304), the at least one primary winding (306), the first insulation unit (308), the at least one secondary winding (310) and the second insulation unit (312).

Therefore, a planar transformer (300) can be manufactured in a slim size using the technical feature of the planar transformer (300) according to the second exemplary embodiment of the present invention, such that a power supply unit (not shown) that is manufactured along with the planar transformer (300) can be manufactured in a slim size. Furthermore, the planar transformer (300) according to the second exemplary embodiment of the present invention can reduce the manufacturing cost of the planar transformer (300) to enhance the efficiency of transformation.

Third Exemplary Embodiment

Figure 5:
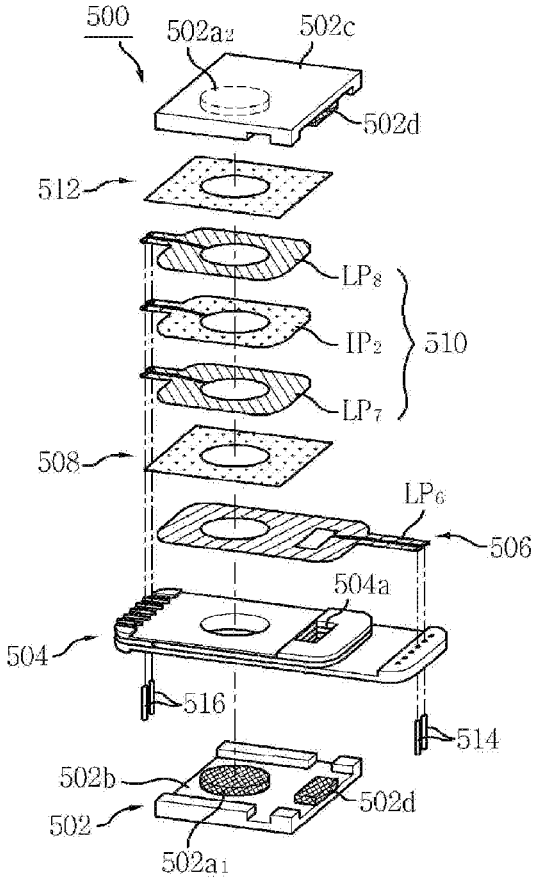
FIG. 5 is an exploded perspective view illustrating a planar transformer according to a third exemplary embodiment of the present invention.
Figure 6:
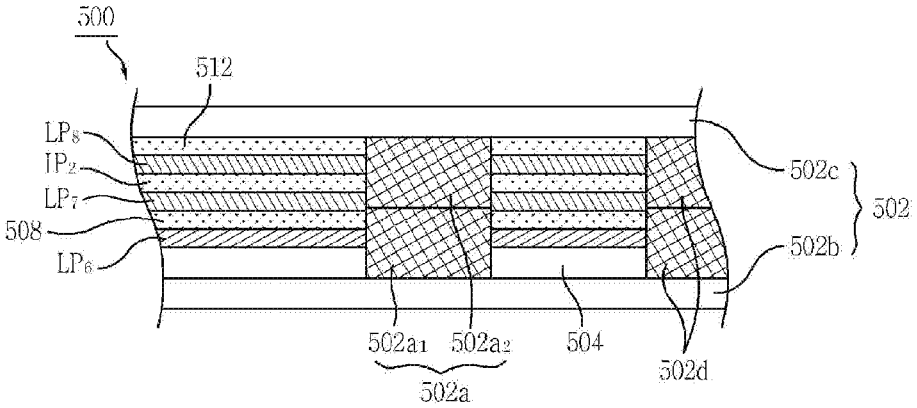
FIG. 6 is a coupled cross-sectional view illustrating a planar transformer according to a third exemplary embodiment of the present invention.

FIG. 5 is an exploded perspective view illustrating a planar transformer according to a third exemplary embodiment of the present invention, and FIG. 6 is a coupled cross-sectional view illustrating a planar transformer according to a third exemplary embodiment of the present invention.

First, referring to FIGS. 5 and 6, a planar transformer (500) according to a third exemplary embodiment of the present invention includes a core (502), a bobbin (504), at least one primary winding (506), a first insulation unit (508), at least one secondary winding (510) and a second insulation unit (512).

The core (502) includes a first fastening unit (502*a*) and is provided to induce formation of a magnetic field, where the core (502) may include a bottom core (502*b*) and an upper core (502*c*). The bobbin (504) is so provided as to be coupled to the core (502) by the first fastening unit (502*a*). The first fastening unit (502*a*) may include first fastening lugs (502*a*1, 502*a*2).

The bobbin (504) may include a second fastening unit (504*a*) discrete from the first fastening unit (502*a*), and the core (502) may include a third fastening unit (502*d*) to be coupled to a second fastening unit (504*a*). At this time, the second fastening unit (504*a*) may be provided in a second fastening hole (504*a*), and the third fastening unit (502*d*) may be provided to the bottom core (502*b*) and the upper core (502*c*), and may be provided in a third fastening lug (502*d*) to be coupled to the second fastening hole (504*a*).

The at least one primary winding (506) is provided between the core (502) and the bobbin (504), and provided at an upper surface of the bobbin (504) to be coupled to the first fastening unit (502*a*) for supply of a power signal.

At least one primary winding (506) may include a metal thin film pattern layer (LP6) having an inductance component, and the metal thin film pattern layer (LP6) having an inductance component is provided in a metal material having a high conductivity to smoothly and efficiently supply a power signal to the at least one primary winding (506).

At this time, the a metal thin film pattern layers (LP6) having an inductance component may be formed by at least one engineering method of a photo-lithography method using a photo mask and an etching solution, or an injection molding method using a press. The at least one primary winding (506) may be provided in at least one of a circular shape, an oval shape and a polygon shape.

The first insulation unit (508) is provided to an upper surface of the at least one primary winding (506) and coupled to the first fastening unit (502*a*) to insulate the at least one primary winding (506). At this time, the first insulation unit (508) may be provided in an insulation sheet, and may be provided in at least one of a circular shape, an oval shape and a polygon shape.

The at least one secondary winding (510) is provided to an upper surface of the first insulation unit (508), coupled to the first fastening unit (502*a*) and insulated by the first insulation unit (508) to transform the a power signal. At this time, the at least one secondary winding (510) may include metal thin film pattern layers (LP7, LP8) having at least two or more inductance components, and at least one secondary insulation layer (IP2) provided between the metal thin film pattern layers (LP7, LP8) having at least two or more inductance components to insulate the metal thin film pattern layers (LP7, LP8) having at least two or more inductance components.

Furthermore, the metal thin film pattern layers (LP7, LP8) having at least two or more inductance components may be provided in a metal material having a high conductivity to smoothly and efficiently output a power signal transformed by the at least one secondary winding (510).

At this time, the metal thin film pattern layers (LP7, LP8) having at least two or more inductance components may be formed by at least one engineering method of a photo-lithography method using a photo mask and an etching solution, or an injection molding method using a press. The at least one secondary winding (510) may be provided in at least one of a circular shape, an oval shape and a polygon shape.

The second insulation unit (512) is provided to an upper surface of the at least one secondary winding (510) and coupled to the first fastening unit (502*a*) to insulate the at least one secondary winding (510). At this time, the second insulation unit (512) may be provided in an insulation sheet, and may be provided in at least one of a circular shape, an oval shape and a polygon shape.

A power signal supply unit (514) may be coupled to one side of the bobbin (504) to be electrically connected to the at least one primary winding (506), whereby a power signal can be supplied to the at least one primary winding (506). At this time, the power signal supply unit (514) may be electrically connected to a distal end of one side of the bobbin (504) and a distal end of the at least one primary winding (506).

The power signal supply unit (514) may be provided in a metal material having a high conductivity to supply a power signal to the at least one primary winding (506) smoothly and efficiently. At this time, the power signal supply unit (514) may be provided in a terminal lug.

A power signal output unit (516) may be coupled to the other side of the bobbin (504) to be electrically connected to the at least one secondary winding (510), whereby a power signal transformed by the at least one secondary winding (510) can be outputted. At this time, the power signal output unit (516) may be electrically connected to a distal end of the other side of the bobbin (504) and a distal end of the at least one secondary winding (510).

Furthermore, the power signal output unit (516) may be provided in a metal material having a high conductivity to output a power signal transformed by the at least one secondary winding (510) smoothly and efficiently. At this time, the power signal output unit (516) may be provided in a terminal lug.

As apparent from the foregoing, the planar transformer (500) according to the third exemplary embodiment of the present invention includes the core (502), the bobbin (504), the at least one primary winding (506), the first insulation unit (508), the at least one secondary winding (510) and the second insulation unit (512).

Therefore, a planar transformer (500) can be manufactured in a slim size using the technical feature of the planar transformer (500) according to the third exemplary embodiment of the present invention, such that a power supply unit (not shown) that is manufactured along with the planar transformer (500) can be manufactured in a slim size. Furthermore, the planar transformer (500) according to the third exemplary embodiment of the present invention can reduce the manufacturing cost of the planar transformer (500) to enhance the efficiency of transformation.

Fourth Exemplary Embodiment

Figure 7:
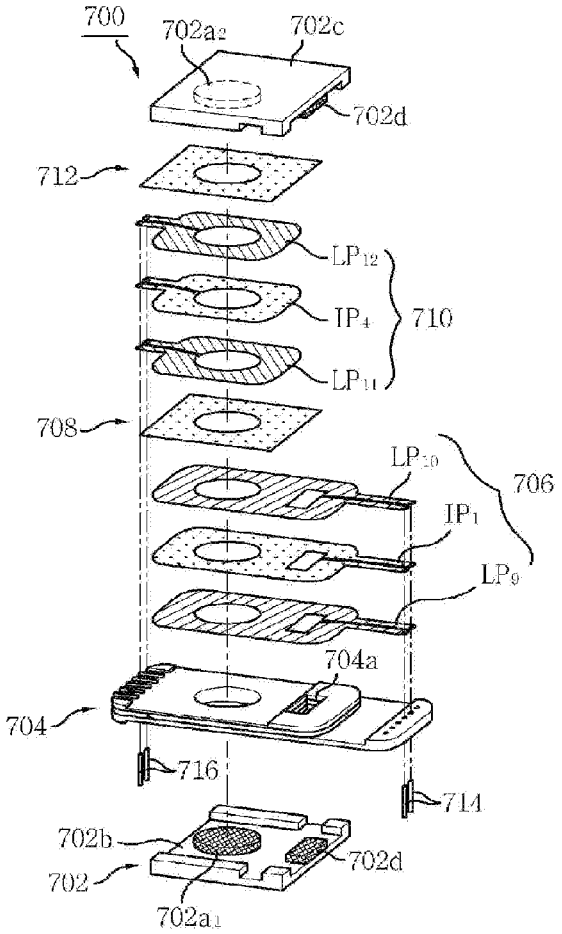
FIG. 7 is an exploded perspective view illustrating a planar transformer according to a fourth exemplary embodiment of the present invention.
Figure 8:
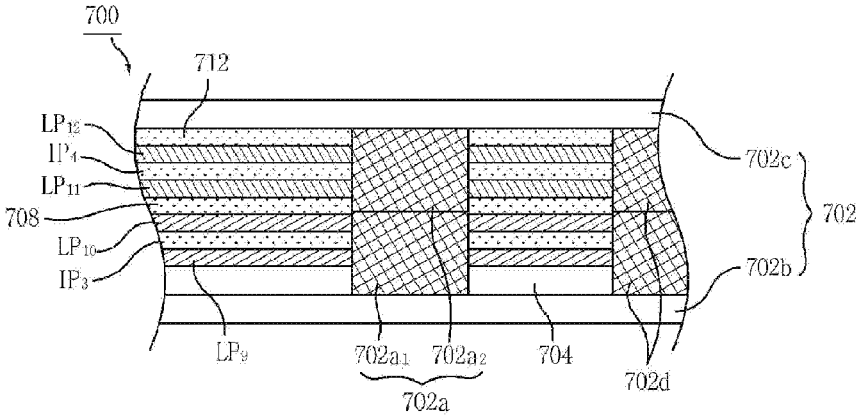
FIG. 8 is a coupled cross-sectional view illustrating a planar transformer according to a fourth exemplary embodiment of the present invention.

FIG. 7 is an exploded perspective view illustrating a planar transformer according to a fourth exemplary embodiment of the present invention, and FIG. 8 is a coupled cross-sectional view illustrating a planar transformer according to a fourth exemplary embodiment of the present invention.

First, referring to FIGS. 7 and 8, a planar transformer (700) according to a fourth exemplary embodiment of the present invention includes a core (702), a bobbin (704), at least one primary winding (706), a first insulation unit (708), at least one secondary winding (710) and a second insulation unit (712).

The core (702) includes a first fastening unit (702*a*) and is provided to induce formation of a magnetic field, where the core (702) may include a bottom core (702*b*) and an upper core (702*c*). The bobbin (704) is so provided as to be coupled to the core (702) by the first fastening unit (702*a*). The first fastening unit (702*a*) may include first fastening lugs (702*a*1, 702*a*2).

The bobbin (704) may include a second fastening unit (704*a*) discrete from the first fastening unit (702*a*), and the core (702) may include a third fastening unit (702*d*) to be coupled to a second fastening unit (704*a*). At this time, the second fastening unit (704*a*) may be provided in a second fastening hole (704*a*), and the third fastening unit (702*d*) may be provided to the bottom core (702*b*) and the upper core (702*c*), and may be provided in a third fastening lug (702*d*) to be coupled to the second fastening hole (704*a*).

The at least one primary winding (706) is provided between the core (702) and the bobbin (704), and provided at an upper surface of the bobbin (704) to be coupled to the first fastening unit (702*a*) for supply of a power signal.

At least one primary winding (706) may include metal thin film pattern layers (LP9, LP10) having at least two or more inductance components, and at least one primary insulation layer (IP3) provided between the metal thin film pattern layers (LP9, LP10) having at least two or more inductance components to insulate the metal thin film pattern layers (LP9, LP10) having at least two or more inductance components.

At this time, the metal thin film pattern layers (LP9, LP10) having at least two inductance components may be provided in a metal material having a high conductivity to smoothly and efficiently supply a power signal supplied through a power signal supply unit (714, described later). The metal thin film pattern layers (LP9, LP10) having at least two inductance components may be formed by at least one engineering method of a photo-lithography method using a photo mask and an etching solution, or an injection molding method using a press. The at least one primary winding (706) may be provided in at least one of a circular shape, an oval shape and a polygon shape.

The first insulation unit (708) is provided to an upper surface of the at least one primary winding (706) and coupled to the first fastening unit (702*a*) to insulate the at least one primary winding (706). At this time, the first insulation unit (708) may be provided in an insulation sheet, and may be provided in at least one of a circular shape, an oval shape and a polygon shape.

The at least one secondary winding (710) is provided to an upper surface of the first insulation unit (708), coupled to the first fastening unit (702*a*) and insulated by the first insulation unit (708) to transform the a power signal. At this time, the at least one secondary winding (710) may include metal thin film pattern layers (LP11, LP128) having at least two or more inductance components, and at least one secondary insulation layer (IP4) provided between the metal thin film pattern layers (LP11, LP12) having at least two or more inductance components to insulate the metal thin film pattern layers (LP11, LP12) having at least two or more inductance components.

Furthermore, the metal thin film pattern layers (LP11, LP12) having at least two or more inductance components may be provided in a metal material having a high conductivity to smoothly and efficiently output a power signal transformed by the at least one secondary winding (710).

At this time, the metal thin film pattern layers (LP11, LP12) having at least two or more inductance components may be formed by at least one engineering method of a photo-lithography method using a photo mask and an etching solution, or an injection molding method using a press. The at least one secondary winding (710) may be provided in at least one of a circular shape, an oval shape and a polygon shape.

The second insulation unit (712) is provided to an upper surface of the at least one secondary winding (710) and coupled to the first fastening unit (702*a*) to insulate the at least one secondary winding (710). At this time, the second insulation unit (712) may be provided in an insulation sheet, and may be provided in at least one of a circular shape, an oval shape and a polygon shape.

A power signal supply unit (714) may be coupled to one side of the bobbin (704) to be electrically connected to the at least one primary winding (706), whereby a power signal can be supplied to the at least one primary winding (706). At this time, the power signal supply unit (714) may be electrically connected to a distal end of one side of the bobbin (704) and a distal end of the at least one primary winding (706).

Furthermore, the power signal supply unit (714) may be provided in a metal material having a high conductivity to supply a power signal to the at least one primary winding (706) smoothly and efficiently. At this time, the power signal supply unit (714) may be provided in a terminal lug.

A power signal output unit (716) may be coupled to the other side of the bobbin (704) to be electrically connected to the at least one secondary winding (710), whereby a power signal transformed by the at least one secondary winding (710) can be outputted. At this time, the power signal output unit (716) may be electrically connected to a distal end of the other side of the bobbin (504) and a distal end of the at least one secondary winding (710).

Furthermore, the power signal output unit (716) may be provided in a metal material having a high conductivity to output a power signal transformed by the at least one secondary winding (710) smoothly and efficiently. At this time, the power signal output unit (716) may be provided in a terminal lug.

As apparent from the foregoing, the planar transformer (700) according to the fourth exemplary embodiment of the present invention includes the core (702), the bobbin (704), the at least one primary winding (706), the first insulation unit (708), the at least one secondary winding (710) and the second insulation unit (712).

Therefore, a planar transformer (700) can be manufactured in a slim size using the technical feature of the planar transformer (700) according to the fourth exemplary embodiment of the present invention, such that a power supply unit (not shown) that is manufactured along with the planar transformer (700) can be manufactured in a slim size. Furthermore, the planar transformer (700) according to the fourth exemplary embodiment of the present invention can reduce the manufacturing cost of the planar transformer (700) to enhance the efficiency of transformation.

Fifth Exemplary Embodiment

Figure 9:
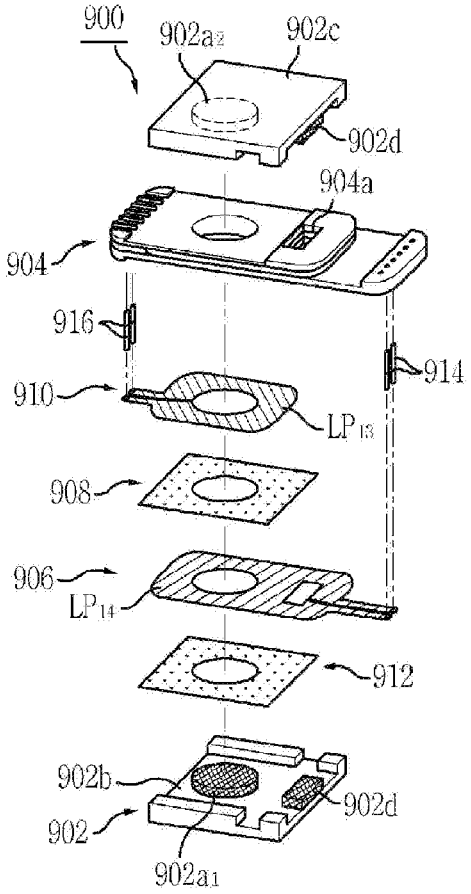
FIG. 9 is an exploded perspective view illustrating a planar transformer according to a fifth exemplary embodiment of the present invention.
Figure 10:
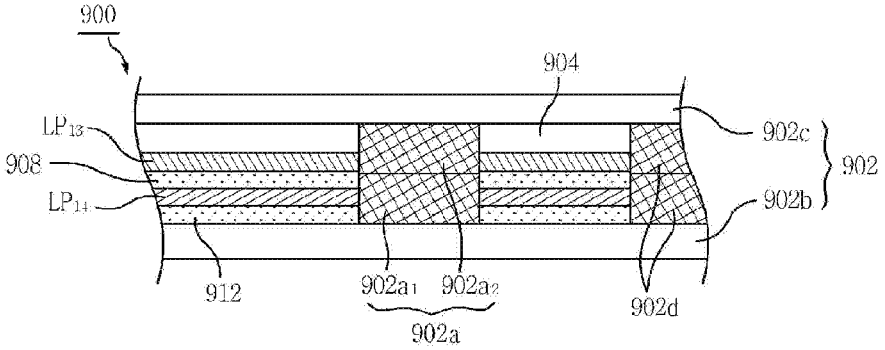
FIG. 10 is a coupled cross-sectional view illustrating a planar transformer according to a fifth exemplary embodiment of the present invention.

FIG. 9 is an exploded perspective view illustrating a planar transformer according to a fifth exemplary embodiment of the present invention, and FIG. 10 is a coupled cross-sectional view illustrating a planar transformer according to a fifth exemplary embodiment of the present invention.

First, referring to FIGS. 9 and 10, a planar transformer (900) according to a firth exemplary embodiment of the present invention includes a core (902), a bobbin (904), at least one primary winding (906), a first insulation unit (908), at least one secondary winding (910) and a second insulation unit (912).

The core (902) includes a first fastening unit (902*a*) and is provided to induce formation of a magnetic field, where the core (902) may include a bottom core (902*b*) and an upper core (902*c*). The bobbin (904) is so provided as to be coupled to the core (902) by the first fastening unit (902*a*). The first fastening unit (902*a*) may include first fastening lugs (902*a*1, 902*a*2).

The bobbin (904) may include a second fastening unit (904*a*) discrete from the first fastening unit (902*a*), and the core (902) may include a third fastening unit (902*d*) to be coupled to a second fastening unit (904*a*). At this time, the second fastening unit (904*a*) may be provided in a second fastening hole (904*a*), and the third fastening unit (902*d*) may be provided to the bottom core (902*b*) and the upper core (902*c*), and may be provided as a third fastening lug (902*d*) to be coupled to the second fastening hole (904*a*).

The at least one secondary winding (910) is provided between the core (902) and the bobbin (904), and provided at a bottom surface of the bobbin (904) to be coupled to the first fastening unit (902*a*) for supply of a power signal.

At least one secondary winding (910) may include a metal thin film pattern layer (LP13) having an inductance component, and at this time, the metal thin film pattern layer (LP13) having an inductance component is provided in a metal material having a high conductivity to smoothly and efficiently supply a power signal transformed through the at least one secondary winding (910).

Furthermore, the metal thin film pattern layer (LP13) having an inductance component may be formed by at least one engineering method of a photo-lithography method using a photo mask and an etching solution, or an injection molding method using a press. The at least one secondary winding (910) may be provided in at least one of a circular shape, an oval shape and a polygon shape.

A first insulation unit (908) is provided to a bottom surface of the at least one secondary winding (910) and coupled to the first fastening unit (902*a*) to insulate the at least one secondary winding (910). At this time, the first insulation unit (908)

may be provided in an insulation sheet, and may be provided in at least one of a circular shape, an oval shape and a polygon shape.

The at least one primary winding (906) is provided to a bottom surface of the first insulation unit (908), coupled to the first fastening unit (902*a*) and to be insulated by the first insulation unit (908) to supply a power signal.

At this time, the at least one primary winding (906) may include a metal thin film pattern layer (LP14) having an inductance component.

At this time, the metal thin film pattern layer (LP14) having an inductance component is provided in a metal material having a high conductivity to smoothly and efficiently supply a power signal supplied through a power signal supply unit (914, described later).

Furthermore, the metal thin film pattern layers (LP14) having an inductance component may be formed by at least one engineering method of a photo-lithography method using a photo mask and an etching solution, or an injection molding method using a press. The at least one primary winding (906) may be provided in at least one of a circular shape, an oval shape and a polygon shape.

The second insulation unit (912) is provided to a bottom surface of the at least one primary winding (906) and coupled to the first fastening unit (902*a*) to insulate the at least one primary winding (906). At this time, the second insulation unit (912) may be provided as an insulation sheet, and may be provided in at least one of a circular shape, an oval shape and a polygon shape.

The power signal supply unit (914) may be coupled to one side of the bobbin (904) to be electrically connected to the at least one primary winding (906), whereby a power signal can be supplied to the at least one primary winding (906). At this time, the power signal supply unit (914) may be electrically connected to a distal end of one side of the bobbin (904) and a distal end of the at least one primary winding (906).

The power signal supply unit (914) may be provided in a metal material having a high conductivity to supply a power signal to the at least one primary winding (906) smoothly and efficiently. At this time, the power signal supply unit (914) may be as a terminal lug.

A power signal output unit (916) may be coupled to the other side of the bobbin (904) to be electrically connected to the at least one secondary winding (910), whereby a power signal transformed by the at least one secondary winding (910) can be outputted. At this time, the power signal output unit (916) may be electrically connected to a distal end of the other side of the bobbin (904) and a distal end of the at least one secondary winding (910).

Furthermore, the power signal output unit (916) may be provided in a metal material having a high conductivity to output a power signal transformed by the at least one secondary winding (910) smoothly and efficiently. At this time, the power signal output unit (916) may be provided as a terminal lug.

As apparent from the foregoing, the planar transformer (900) according to the fifth exemplary embodiment of the present invention includes the core (902), the bobbin (904), the at least one primary winding (906), the first insulation unit (908), the at least one secondary winding (910) and the second insulation unit (912).

Therefore, a planar transformer (900) can be manufactured in a slim size using the technical feature of the planar transformer (900) according to the fifth exemplary embodiment of the present invention, such that a power supply unit (not shown) that is manufactured along with the planar transformer (900) can be manufactured in a slim size. Furthermore, the planar transformer (900) according to the fifth exemplary embodiment of the present invention can reduce the manufacturing cost of the planar transformer (900) to enhance the efficiency of transformation.

Sixth Exemplary Embodiment

Figure 11:
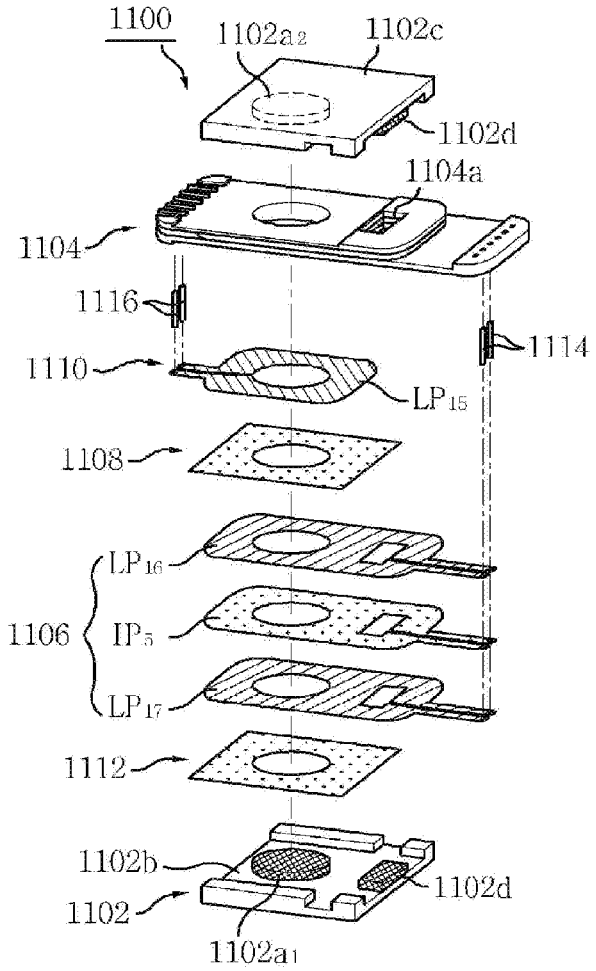
FIG. 11 is an exploded perspective view illustrating a planar transformer according to a sixth exemplary embodiment of the present invention.
Figure 12:
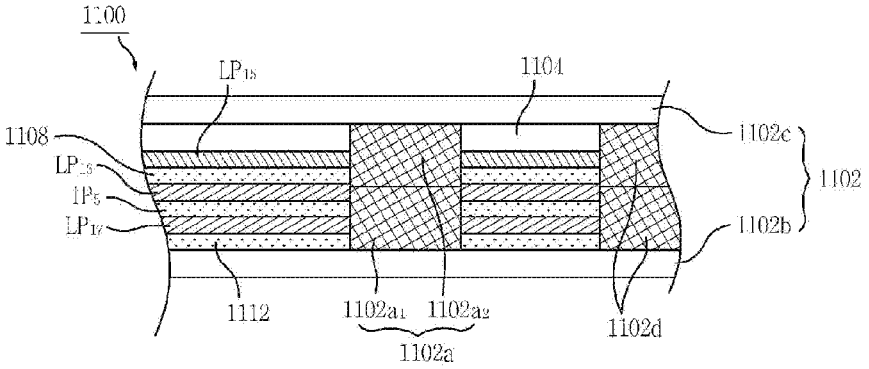
FIG. 12 is a coupled cross-sectional view illustrating a planar transformer according to a sixth exemplary embodiment of the present invention.

FIG. 11 is an exploded perspective view illustrating a planar transformer according to a sixth exemplary embodiment of the present invention, and FIG. 12 is a coupled cross-sectional view illustrating a planar transformer according to a sixth exemplary embodiment of the present invention.

First, referring to FIGS. 11 and 12, a planar transformer (1100) according to a sixth exemplary embodiment of the present invention includes a core (1102), a bobbin (1104), at least one primary winding (1106), a first insulation unit (1108), at least one secondary winding (1110) and a second insulation unit (1112).

The core (1102) includes a first fastening unit (1102*a*) and is provided to induce formation of a magnetic field, where the core (1102) may include a bottom core (1102*b*) and an upper core (1102*c*). The bobbin (1104) is so provided as to be coupled to the core (1102) by the first fastening unit (1102*a*). The first fastening unit (1102*a*) may include first fastening lugs (1102*a*1, 1102*a*2).

The bobbin (1104) may include a second fastening unit (1104*a*) discrete from the first fastening unit (1102*a*), and the core (1102) may include a third fastening unit (1102*d*) to be coupled to a second fastening unit (1104*a*). At this time, the second fastening unit (1104*a*) may be provided as a second fastening hole (1104*a*), and the third fastening unit (1102*d*) may be provided to the bottom core (1102*b*) and the upper core (1102*c*), and may be provided as a third fastening lug (1102*d*) to be coupled to the second fastening hole (1104*a*).

The at least one secondary winding (1110) is provided between the core (1102) and the bobbin (1104), and provided at a bottom surface of the bobbin (1104) to be coupled to the first fastening unit (1102*a*) for supply of a power signal.

At least one secondary winding (1110) may include a metal thin film pattern layer (LP15) having an inductance component, and at this time, the metal thin film pattern layer (LP15) having an inductance component is provided in a metal material having a high conductivity to smoothly and efficiently output a power signal transformed through the at least one secondary winding (1110).

Furthermore, the metal thin film pattern layer (LP15) having an inductance component may be formed by at least one engineering method of a photo-lithography method using a photo mask and an etching solution, or an injection molding method using a press. The at least one secondary winding (1110) may be provided in at least one of a circular shape, an oval shape and a polygon shape.

A first insulation unit (1108) is provided to a bottom surface of the at least one secondary winding (1110) and coupled to the first fastening unit (1102*a*) to insulate the at least one secondary winding (1100). At this time, the first insulation unit (1108) may be provided in an insulation sheet, and may be provided in at least one of a circular shape, an oval shape and a polygon shape.

The at least one primary winding (1106) is provided to a bottom surface of the first insulation unit (1108), coupled to the first fastening unit (1102*a*) and insulated by the first insulation unit (1108) to supply a power signal.

At this time, the at least one primary winding (1106) may include metal thin film pattern layers (LP16, LP17) having at least two or more inductance components, and at least one primary insulation layer (IP5) provided between the metal thin film pattern layers (LP16, LP17) having at least two or more inductance components to insulate the metal thin film pattern layers (LP16, LP17) having at least two or more inductance components.

Furthermore, the metal thin film pattern layers (LP16, LP17) having at least two or more inductance components are provided in a metal material having a high conductivity to smoothly and efficiently supply a power signal supplied through a power signal supply unit (1114, described later).

At this time, the metal thin film pattern layers (LP16, LP17) having at least two or more inductance components may be formed by at least one engineering method of a photo-lithography method using a photo mask and an etching solution, or an injection molding method using a press. The at least one primary winding (1106) may be provided in at least one of a circular shape, an oval shape and a polygon shape.

The second insulation unit (1112) is provided to a bottom surface of the at least one primary winding (1106) and coupled to the first fastening unit (1102*a*) to insulate the at least one primary winding (1106). At this time, the second insulation unit (1112) may be provided as an insulation sheet, and may be provided in at least one of a circular shape, an oval shape and a polygon shape.

The power signal supply unit (1114) may be coupled to one side of the bobbin (1104) to be electrically connected to the at least one primary winding (1106), whereby a power signal can be supplied to the at least one primary winding (1106). At this time, the power signal supply unit (1114) may be electrically connected to a distal end of one side of the bobbin (1104) and a distal end of the at least one primary winding (1106).

The power signal supply unit (1114) may be provided in a metal material having a high conductivity to supply a power signal to the at least one primary winding (1106) smoothly and efficiently. At this time, the power signal supply unit (1114) may be provided as a terminal lug.

A power signal output unit (1116) may be coupled to the other side of the bobbin (1104) to be electrically connected to the at least one secondary winding (1110), whereby a power signal transformed by the at least one secondary winding (1110) can be outputted. At this time, the power signal output unit (1116) may be electrically connected to a distal end of the other side of the bobbin (1104) and a distal end of the at least one secondary winding (1110).

Furthermore, the power signal output unit (1116) may be provided in a metal material having a high conductivity to output a power signal transformed by the at least one secondary winding (1110) smoothly and efficiently. At this time, the power signal output unit (1116) may be provided as a terminal lug.

As apparent from the foregoing, the planar transformer (1100) according to the sixth exemplary embodiment of the present invention includes the core (1102), the bobbin (1104), the at least one primary winding (1106), the first insulation unit (1108), the at least one secondary winding (1110) and the second insulation unit (1112).

Therefore, a planar transformer (1100) can be manufactured in a slim size using the technical feature of the planar transformer (1100) according to the sixth exemplary embodiment of the present invention, such that a power supply unit (not shown) that is manufactured along with the planar transformer (1100) can be manufactured in a slim size. Furthermore, the planar transformer (1100) according to the sixth exemplary embodiment of the present invention can reduce the manufacturing cost of the planar transformer (1100) to enhance the efficiency of transformation.

Seventh Exemplary Embodiment

Figure 13:
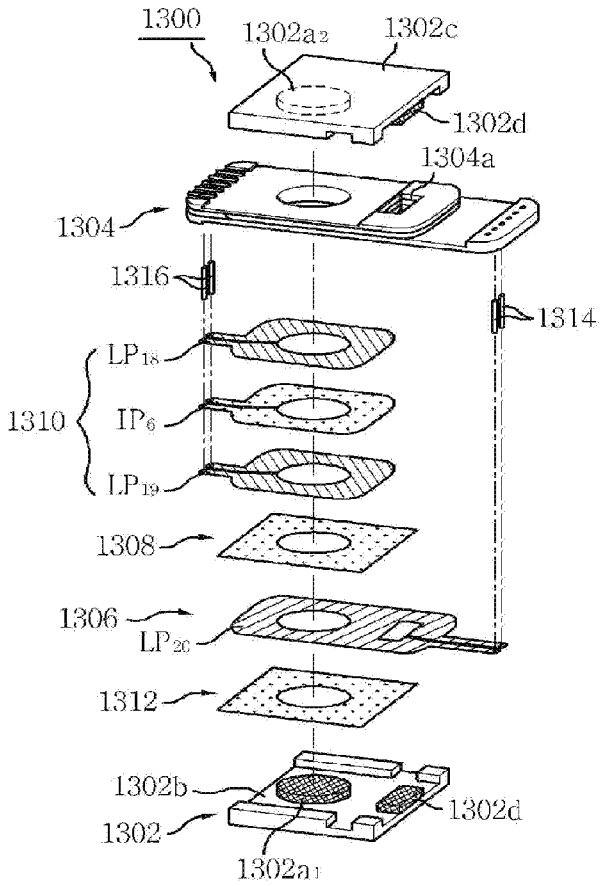
FIG. 13 is an exploded perspective view illustrating a planar transformer according to a seventh exemplary embodiment of the present invention.
Figure 14:
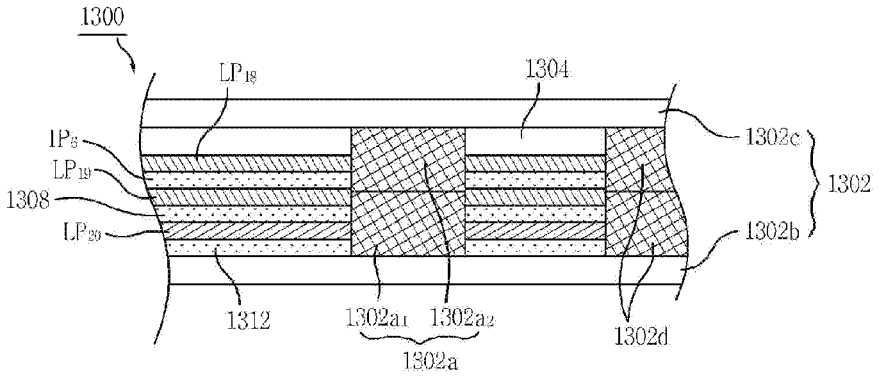
FIG. 14 is a coupled cross-sectional view illustrating a planar transformer according to a seventh exemplary embodiment of the present invention.

FIG. 13 is an exploded perspective view illustrating a planar transformer according to a seventh exemplary embodiment of the present invention, and FIG. 14 is a coupled cross-sectional view illustrating a planar transformer according to a seventh exemplary embodiment of the present invention.

First, referring to FIGS. 13 and 14, a planar transformer (1300) according to a seventh exemplary embodiment of the present invention includes a core (1302), a bobbin (1304), at least one primary winding (1306), a first insulation unit (1308), at least one secondary winding (1310) and a second insulation unit (1312).

The core (1302) includes a first fastening unit (1302*a*) and is provided to induce formation of a magnetic field, where the core (1302) may include a bottom core (1302*b*) and an upper core (1302*c*). The bobbin (1304) is so provided as to be coupled to the core (1302) by the first fastening unit (1302*a*). The first fastening unit (1302*a*) may include first fastening lugs (1302*a*1, 1302*a*2).

The bobbin (1304) may include a second fastening unit (1304*a*) discrete from the first fastening unit (1302*a*), and the core (1302) may include a third fastening unit (1302*d*) to be coupled to a second fastening unit (1304*a*). At this time, the second fastening unit (1304*a*) may be provided as a second fastening hole (1304*a*), and the third fastening unit (1302*d*) may be provided to the bottom core (1302*b*) and the upper core (1302*c*), and may be provided as a third fastening lug (1302*d*) to be coupled to the second fastening hole (1304*a*).

The at least one secondary winding (1310) may be provided between the core (1302) and the bobbin (1304), and provided at a bottom surface of the bobbin (1304) to be coupled to the first fastening unit (1302*a*) for supply of a power signal.

At this time, the at least one secondary winding (1310) may include metal thin film pattern layers (LP18. LP19) having at least two or more inductance components, and at least one secondary insulation layer (IP6) provided to the metal thin film pattern layers (LP18. LP19) having at least two or more inductance components to insulate the metal thin film pattern layers (LP18. LP19) having at least two or more inductance components.

Furthermore, the metal thin film pattern layers (LP18. LP19) having at least two or more inductance components may be formed by at least one engineering method of a photo-lithography method using a photo mask and an etching solution, or an injection molding method using a press. The at least one secondary winding (1310) may be provided in at least one of a circular shape, an oval shape and a polygon shape.

A first insulation unit (1308) is provided to a bottom surface of the at least one primary winding (1306) and coupled to the first fastening unit (1302*a*) to insulate the at least one primary winding (1306). At this time, the first insulation unit (1308) may be provided in an insulation sheet, and may be provided in at least one of a circular shape, an oval shape and a polygon shape.

The at least one primary winding (1306) is provided to a bottom surface of the first insulation unit (1308), coupled to the first fastening unit (1302*a*) and insulated by the first insulation unit (1308) to supply a power signal.

At this time, the at least one primary winding (1306) may include a metal thin film pattern layer (LP20) having an inductance component, and the metal thin film pattern layer (LP20) having an inductance component may be provided in a metal material having a high conductivity to smoothly and efficiently supply a power signal supplied through a power signal supply unit (1314, described later).

At this time, the metal thin film pattern layer (LP20) having an inductance component may be formed by at least one engineering method of a photo-lithography method using a photo mask and an etching solution, or an injection molding method using a press. The at least one primary winding (1306) may be provided in at least one of a circular shape, an oval shape and a polygon shape.

The second insulation unit (1312) is provided to a bottom surface of the at least one primary winding (1306) and coupled to the first fastening unit (1302*a*) to insulate the at least one primary winding (1306). At this time, the second insulation unit (1312) may be provided as an insulation sheet, and may be provided in at least one of a circular shape, an oval shape and a polygon shape.

The power signal supply unit (1314) may be coupled to one side of the bobbin (1304) to be electrically connected to the at least one primary winding (1306), whereby a power signal can be supplied to the at least one primary winding (1306). At this time, the power signal supply unit (1314) may be electrically connected to a distal end of one side of the bobbin (1304) and a distal end of the at least one primary winding (1306).

The power signal supply unit (1314) may be provided in a metal material having a high conductivity to supply a power signal to the at least one primary winding (1306) smoothly and efficiently. At this time, the power signal supply unit (1314) may be provided as a terminal lug.

A power signal output unit (1316) may be coupled to the other side of the bobbin (1304) to be electrically connected to the at least one secondary winding (1310), whereby a power signal transformed by the at least one secondary winding (1310) can be outputted. At this time, the power signal output unit (1316) may be electrically connected to a distal end of the other side of the bobbin (1304) and a distal end of the at least one secondary winding (1310).

Furthermore, the power signal output unit (1316) may be provided in a metal material having a high conductivity to output a power signal transformed by the at least one secondary winding (1310) smoothly and efficiently. At this time, the power signal output unit (1316) may be provided as a terminal lug.

As apparent from the foregoing, the planar transformer (1300) according to the seventh exemplary embodiment of the present invention includes the core (1302), the bobbin (1304), the at least one primary winding (1306), the first insulation unit (1308), the at least one secondary winding (1310) and the second insulation unit (1312).

Therefore, a planar transformer (1300) can be manufactured in a slim size using the technical feature of the planar transformer (1300) according to the seventh exemplary embodiment of the present invention, such that a power supply unit (not shown) that is manufactured along with the planar transformer (1300) can be manufactured in a slim size. Furthermore, the planar transformer (1300) according to the seventh exemplary embodiment of the present invention can reduce the manufacturing cost of the planar transformer (1300) to enhance the efficiency of transformation.

Eighth Exemplary Embodiment

Figure 15:
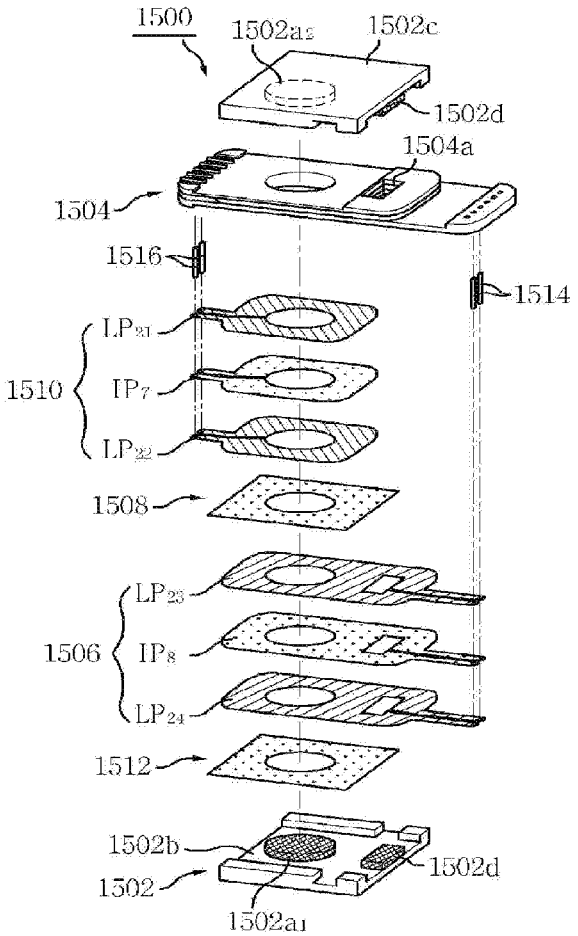
FIG. 15 is an exploded perspective view illustrating a planar transformer according to an eighth exemplary embodiment of the present invention.
Figure 16:
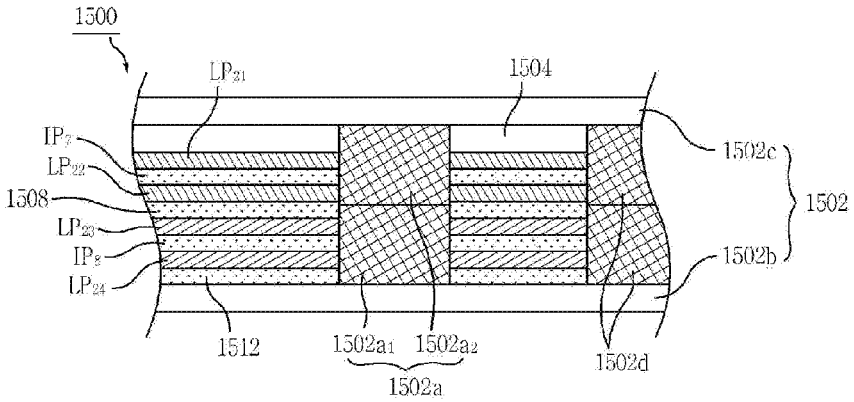
FIG. 16 is a coupled cross-sectional view illustrating a planar transformer according to an eighth exemplary embodiment of the present invention.

FIG. 15 is an exploded perspective view illustrating a planar transformer according to an eighth exemplary embodiment of the present invention, and FIG. 16 is a coupled cross-sectional view illustrating a planar transformer according to an eighth exemplary embodiment of the present invention.

First, referring to FIGS. 15 and 16, a planar transformer (1500) according to an eighth exemplary embodiment of the present invention includes a core (1502), a bobbin (1504), at least one primary winding (1506), a first insulation unit (1508), at least one secondary winding (1510) and a second insulation unit (1512).

The core (1502) includes a first fastening unit (1502*a*) and is provided to induce formation of a magnetic field, where the core (1502) may include a bottom core (1502*b*) and an upper core (1502*c*). The bobbin (1504) is so provided as to be coupled to the core (1502) by the first fastening unit (1502*a*). The first fastening unit (1502*a*) may include first fastening lugs (1502*a*1, 1502*a*2).

The bobbin (1504) may include a second fastening unit (1504*a*) discrete from the first fastening unit (1502*a*), and the core (1502) may include a third fastening unit (1502*d*) to be coupled to the second fastening unit (1504*a*). At this time, the second fastening unit (1504*a*) may be provided as a second fastening hole (1504*a*), and the third fastening unit (1502*d*) may be provided to the bottom core (1502*b*) and the upper core (1502*c*), and may be provided as a third fastening lug (1502*d*) to be coupled to the second fastening hole (1504*a*).

The at least one secondary winding (1510) may be provided between the core (1502) and the bobbin (1504), and provided at a bottom surface of the bobbin (1504) to be coupled to the first fastening unit (1502*a*) for supply of a power signal.

At this time, the at least one secondary winding (1510) may include metal thin film pattern layers (LP21. LP22) having at least two or more inductance components, and at least one secondary insulation layer (IP7) provided between the metal thin film pattern layers (LP21. having at least two or more inductance components to insulate the metal thin film pattern layers (LP21. LP22 having at least two or more inductance components.

Furthermore, the metal thin film pattern layers (LP21. LP22) having at least two or more inductance components may be provided in a metal material having a high conductivity to smoothly and efficiently output a power signal transformed by the at least one secondary winding (1510).

At this time, the metal thin film pattern layers (LP21. LP22) having at least two or more inductance components may be formed by at least one engineering method of a photo-lithography method using a photo mask and an etching solution, or an injection molding method using a press. The at least one secondary winding (1510) may be provided in at least one of a circular shape, an oval shape and a polygon shape.

The first insulation unit (1508) is provided to a bottom surface of the at least one secondary winding (1510) and coupled to the first fastening unit (1502*a*) to insulate the at least one secondary winding (1510). At this time, the first insulation unit (1508) may be provided in an insulation sheet, and may be provided in at least one of a circular shape, an oval shape and a polygon shape.

The at least one primary winding (1506) is provided to a bottom surface of the first insulation unit (1508), coupled to the first fastening unit (1502*a*) and insulated by the first insulation unit (1508) to supply a power signal.

At this time, the at least one primary winding (1506) may include metal thin film pattern layers (LP23, LP24) having at least two or more inductance components, and at least one primary insulation layer (IP8) provided between the metal thin film pattern layers (LP23, LP24) having at least two or more inductance components to insulate the metal thin film pattern layers (LP23, LP24) having at least two or more inductance components.

Furthermore, the metal thin film pattern layers (LP23, LP24) having at least two or more inductance components may be provided in a metal material having a high conductivity to smoothly and efficiently supply a power signal supplied through a power signal supply unit (1514, described later).

At this time, the metal thin film pattern layers (LP23, LP24) having at least two or more inductance components may be formed by at least one engineering method of a photo-lithography method using a photo mask and an etching solution, or an injection molding method using a press. The at least one primary winding (1506) may be provided in at least one of a circular shape, an oval shape and a polygon shape.

The second insulation unit (1512) is provided to a bottom surface of the at least one primary winding (1506) and coupled to the first fastening unit (1502*a*) to insulate the at least one primary winding (1506). At this time, the second insulation unit (1512) may be provided as an insulation sheet, and may be provided in at least one of a circular shape, an oval shape and a polygon shape.

The power signal supply unit (1514) may be coupled to one side of the bobbin (1504) to be electrically connected to the at least one primary winding (1506), whereby a power signal can be supplied to the at least one primary winding (1506). At this time, the power signal supply unit (1514) may be electrically connected to a distal end of one side of the bobbin (1504) and a distal end of the at least one primary winding (1506).

The power signal supply unit (1514) may be provided in a metal material having a high conductivity to supply a power signal to the at least one primary winding (1506) smoothly and efficiently. At this time, the power signal supply unit (1514) may be provided as a terminal lug.

A power signal output unit (1516) may be coupled to the other side of the bobbin (1504) to be electrically connected to the at least one secondary winding (1510), whereby a power signal transformed by the at least one secondary winding (1510) can be outputted. At this time, the power signal output unit (1516) may be electrically connected to a distal end of the other side of the bobbin (1504) and a distal end of the at least one secondary winding (1510).

Furthermore, the power signal output unit (1516) may be provided in a metal material having a high conductivity to output a power signal transformed by the at least one secondary winding (1510) smoothly and efficiently. At this time, the power signal output unit (1516) may be provided as a terminal lug.

As apparent from the foregoing, the planar transformer (1500) according to the eighth exemplary embodiment of the present invention includes the core (1502), the bobbin (1504), the at least one primary winding (1506), the first insulation unit (1508), the at least one secondary winding (1510) and the second insulation unit (1512).

Therefore, a planar transformer (1500) can be manufactured in a slim size using the technical feature of the planar transformer (1500) according to the eighth exemplary embodiment of the present invention, such that a power supply unit (not shown) that is manufactured along with the planar transformer (1500) can be manufactured in a slim size. Furthermore, the planar transformer (1500) according to the eighth exemplary embodiment of the present invention can reduce the manufacturing cost of the planar transformer (1500) to enhance the efficiency of transformation.

Ninth Exemplary Embodiment

Figure 17:
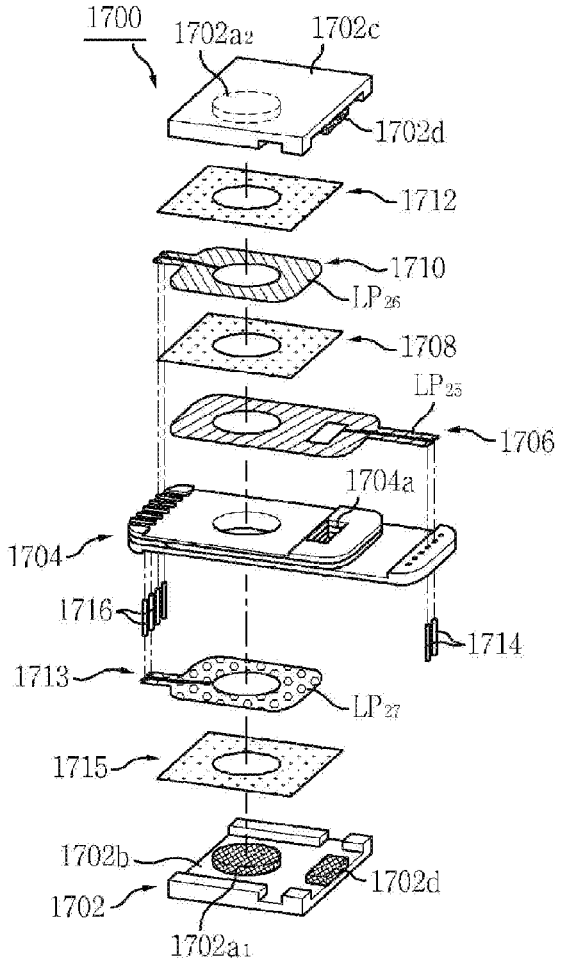
FIG. 17 is an exploded perspective view illustrating a planar transformer according to a ninth exemplary embodiment of the present invention.
Figure 18:
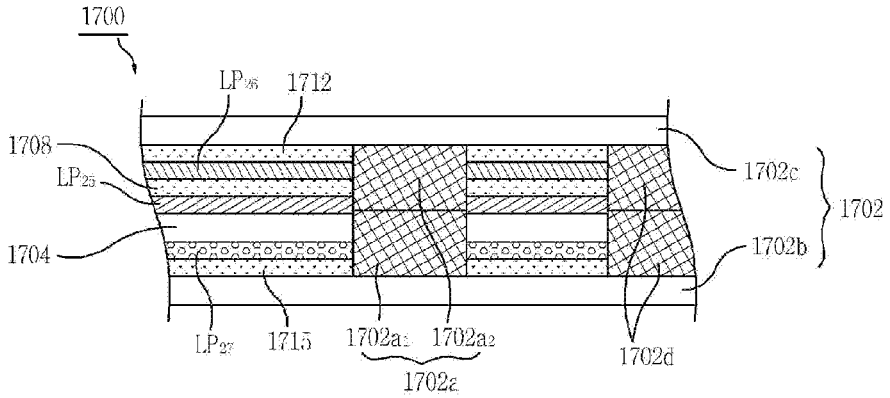
FIG. 18 is a coupled cross-sectional view illustrating a planar transformer according to a ninth exemplary embodiment of the present invention.

FIG. 17 is an exploded perspective view illustrating a planar transformer according to a ninth exemplary embodiment of the present invention, and FIG. 18 is a coupled cross-sectional view illustrating a planar transformer according to a ninth exemplary embodiment of the present invention.

First, referring to FIGS. 17 and 18, a planar transformer (1700) according to the ninth exemplary embodiment of the present invention includes a core (1702), a bobbin (1704), at least one primary winding (1706), a first insulation unit (1708), at least one secondary winding (1710), a second insulation unit (1712), at least another secondary winding (1713) and a third insulation unit (1715).

The core (1702) includes a first fastening unit (1702*a*) and is provided to induce formation of a magnetic field, where the core (1702) may include a bottom core (1702*b*) and an upper core (1702*c*). The bobbin (1704) is so provided as to be coupled to the core (1702) by the first fastening unit (1702*a*). The first fastening unit (1702*a*) may include first fastening lugs (1702*a*1, 1702*a*2).

The bobbin (1704) may include a second fastening unit (1704*a*) discrete from the first fastening unit (1702*a*), and the core (1702) may include a third fastening unit (1702*d*) to be coupled to the second fastening unit (1704*a*). At this time, the second fastening unit (1704*a*) may be provided in a second fastening hole (1704*a*), and the third fastening unit (1702*d*) may be provided to the bottom core (1702*b*) and the upper core (1702*c*), and may be provided as a third fastening lug (1702*d*) to be coupled to the second fastening hole (1704*a*).

The at least one primary winding (1706) is provided between the core (1702) and the bobbin (1704), and provided at an upper surface of the bobbin (1704) to be coupled to the first fastening unit (1702*a*) for supply of a power signal.

At this time, the least one primary winding (1706) may include a metal thin film pattern layer (LP25) having an inductance component, and at this time, the metal thin film pattern layer (LP25) having an inductance component may be provided in a metal material having a high conductivity to smoothly and efficiently supply a power signal supplied through a power signal supply unit (1714, described later).

Furthermore, the metal thin film pattern layer (LP25) having an inductance component may be formed by at least one engineering method of a photo-lithography method using a photo mask and an etching solution, or an injection molding method using a press. The at least one primary winding (1706) may be provided in at least one of a circular shape, an oval shape and a polygon shape.

The first insulation unit (1708) is provided to an upper surface of the at least one primary winding (1706) and coupled to the first fastening unit (1702*a*) to insulate the at least one primary winding (1706). At this time, the first insulation unit (1708) may be provided in an insulation sheet, and may be provided in at least one of a circular shape, an oval shape and a polygon shape.

The at least one secondary winding (1710) is provided to an upper surface of the first insulation unit (1708), coupled to the first fastening unit (1702*a*) and insulated by the first insulation unit (1708) to transform a power signal.

At this time, the at least one secondary winding (1710) may include a metal thin film pattern layer (LP26) having an inductance component.

Furthermore, the metal thin film pattern layer (LP26) having an inductance component is provided in a metal material having a high conductivity to smoothly and efficiently output a power signal transformed through the at least one secondary winding (1710).

At this time, the metal thin film pattern layer (LP26) having an inductance component may be formed by at least one engineering method of a photo-lithography method using a photo mask and an etching solution, or an injection molding method using a press. The at least one secondary winding (1710) may be provided in at least one of a circular shape, an oval shape and a polygon shape.

The second insulation unit (1712) is provided to an upper surface of the at least one secondary winding (1710) and coupled to the first fastening unit (1702*a*) to insulate the at least one secondary winding (1710). At this time, the second insulation unit (1712) may be provided as an insulation sheet, and may be provided in at least one of a circular shape, an oval shape and a polygon shape.

The at least another secondary winding (1713) is provided between the core (1702) and the bobbin (1704), and provided to a bottom surface of the bobbin (1704) to be coupled to the first fastening unit (1702*a*) for transformation of a power signal. At this time, the at least another secondary winding (1713) may include a metal thin film pattern layer (LP27) having an inductance component. Furthermore, the metal thin film pattern layer (LP27) having an inductance component may be provided in a metal material having a high conductivity to smoothly and efficiently output a power signal transformed by the at least another secondary winding (1713).

At this time, the metal thin film pattern layer (LP27) having an inductance component may be formed by at least one engineering method of a photo-lithography method using a photo mask and an etching solution, or an injection molding method using a press. The at least another secondary winding (1713) may be provided in at least one of a circular shape, an oval shape and a polygon shape.

The third insulation unit (1715) is provided at a bottom surface of at least another secondary winding (1713), and is coupled to the first fastening unit (1702*a*) to insulate at least another secondary winding (1713).

At this time, the third insulation unit (1715) may be provided in an insulation sheet, and may be provided in at least one of a circular shape, an oval shape and a polygon shape.

A power signal supply unit (1714) may be coupled to one side of the bobbin (1704) to be electrically connected to the at least one primary winding (1706), whereby a power signal can be supplied to the at least one primary winding (1706). At this time, the power signal supply unit (1714) may be electrically connected to a distal end of one side of the bobbin (1704) and a distal end of the at least one primary winding (1706).

The power signal supply unit (1714) may be provided in a metal material having a high conductivity to supply a power signal to the at least one primary winding (1706) smoothly and efficiently. At this time, the power signal supply unit (1714) may be provided as a terminal lug.

A power signal output unit (1716) may be coupled to the other side of the bobbin (1704) to be electrically connected to the at least one secondary winding (1710), whereby a power signal transformed by the at least one secondary winding (1710) can be outputted. At this time, the power signal output unit (1716) may be electrically connected to a distal end of the other side of the bobbin (1704) and a distal end of the at least one secondary winding (1710).

Furthermore, the power signal output unit (1716) may be electrically coupled to a distal end of still other side of the bobbin (1704) and a distal end of at least another secondary winding (1713). At this time, the power signal output unit (1716) may be provided in a metal material having a high conductivity to output a power signal transformed by the at least one secondary winding (1710) or the at least another secondary winding (1713) smoothly and efficiently. The power signal output unit (1716) may be provided as a terminal lug.

As apparent from the foregoing, the planar transformer (1700) according to the ninth exemplary embodiment of the present invention includes the core (1702), the bobbin (1704), the at least one primary winding (1706), the first insulation unit (1708), the at least one secondary winding (1710), the second insulation unit (1712), the at least another secondary winding (1713) and the third insulation unit (1715).

Therefore, a planar transformer (1700) can be manufactured in a slim size using the technical feature of the planar transformer (1700) according to the ninth exemplary embodiment of the present invention, such that a power supply unit (not shown) that is manufactured along with the planar transformer (1700) can be manufactured in a slim size. Furthermore, the planar transformer (1700) according to the ninth exemplary embodiment of the present invention can reduce the manufacturing cost of the planar transformer (1700) to enhance the efficiency of transformation.

Tenth Exemplary Embodiment

Figure 19:
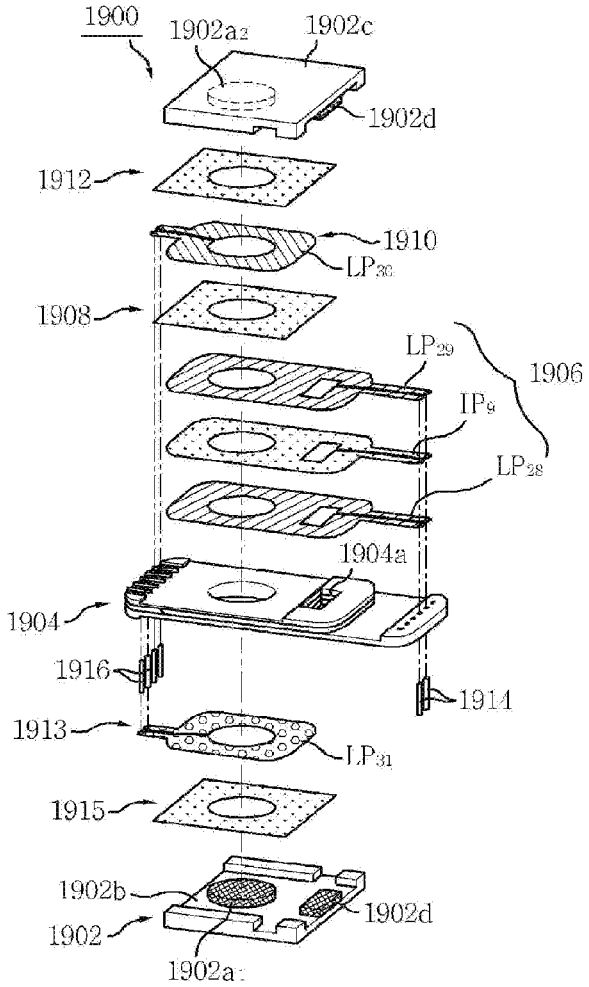
FIG. 19 is an exploded perspective view illustrating a planar transformer according to a tenth exemplary embodiment of the present invention.
Figure 20:
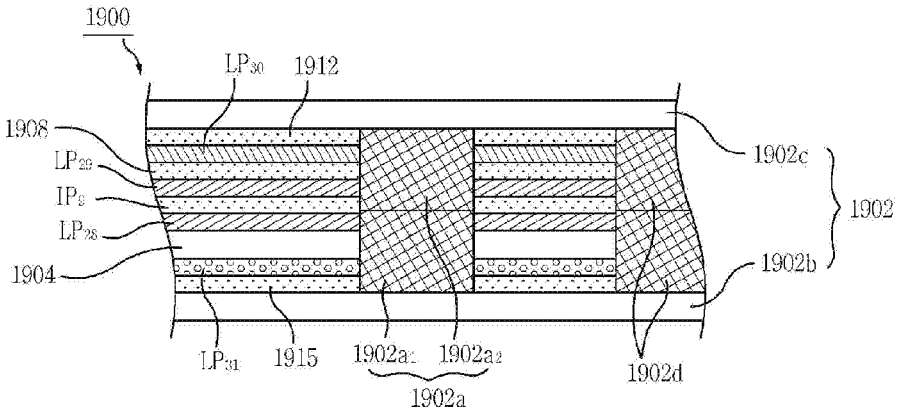
FIG. 20 is a coupled cross-sectional view illustrating a planar transformer according to a tenth exemplary embodiment of the present invention.

FIG. 19 is an exploded perspective view illustrating a planar transformer according to a tenth exemplary embodiment of the present invention, and FIG. 20 is a coupled cross-sectional view illustrating a planar transformer according to a tenth exemplary embodiment of the present invention.

First, referring to FIGS. 19 and 20, a planar transformer (1900) according to the tenth exemplary embodiment of the present invention includes a core (1902), a bobbin (1904), at least one primary winding (1906), a first insulation unit (1908), at least one secondary winding (1910), a second insulation unit (1912), at least another secondary winding (1913) and a third insulation unit (1915).

The core (1902) includes a first fastening unit (1902*a*) and is provided to induce formation of a magnetic field, and the core (1902) may include a bottom core (1902*b*) and an upper core (1902*c*). The bobbin (1904) is so provided as to be coupled to the core (1902) by the first fastening unit (1902*a*). The first fastening unit (1902*a*) may include first fastening lugs (1902*a*1, 1902*a*2).

The bobbin (1904) may include a second fastening unit (1904*a*) discrete from the first fastening unit (1902*a*), where the core (1902) may include a third fastening unit (1902*d*) to be coupled to the second fastening unit (1904*a*). At this time, the second fastening unit (1904*a*) may be provided as a second fastening hole (1904*a*), and the third fastening unit (1902*d*) may be provided to the bottom core (1902*b*) and the upper core (1902*c*), and may be provided as a third fastening lug (1902*d*) to be coupled to the second fastening hole (1904*a*).

The at least one primary winding (1906) is provided between the core (1902) and the bobbin (1904), and provided at an upper surface of the bobbin (1904) to be coupled to the first fastening unit (1902*a*) for supply of a power signal.

At this time, the least one primary winding (1906) may include metal thin film pattern layers (LP28, LP29) having at least two or more inductance components, and at least one primary insulation layer (IP9) provided between the metal thin film pattern layers (LP28, LP29) having at least two or more inductance components to insulate the metal thin film pattern layers (LP28, LP29) having at least two or more inductance components.

At this time, the metal thin film pattern layers (LP28, LP29) having at least two or more inductance components may be provided in a metal material having a high conductivity to smoothly and efficiently supply a power signal supplied through a power signal supply unit (1914, described later).

Furthermore, the metal thin film pattern layers (LP28, LP29) having at least two or more inductance components may be formed by at least one engineering method of a photo-lithography method using a photo mask and an etching solution, or an injection molding method using a press. The at least one primary winding (1906) may be provided in at least one of a circular shape, an oval shape and a polygon shape.

The first insulation unit (1908) is provided to an upper surface of the at least one primary winding (1906) and coupled to the first fastening unit (1902*a*) to insulate the at least one primary winding (1906). At this time, the first insulation unit (1908) may be provided as an insulation sheet, and may be provided in at least one of a circular shape, an oval shape and a polygon shape.

The at least one secondary winding (1910) is provided to an upper surface of the first insulation unit (1908), coupled to the first fastening unit (1902*a*) and to be insulated by the first insulation unit (1908) to transform a power signal.

At this time, the at least one secondary winding (1910) may include a metal thin film pattern layer (LP30) having an inductance component.

Furthermore, the metal thin film pattern layer (LP30) having an inductance component is provided in a metal material having a high conductivity to smoothly and efficiently output a power signal transformed by the at least one secondary winding (1910).

At this time, the metal thin film pattern layer (LP30) having an inductance component may be formed by at least one engineering method of a photo-lithography method using a photo mask and an etching solution, or an injection molding method using a press. The at least one secondary winding (1910) may be provided in at least one of a circular shape, an oval shape and a polygon shape.

The second insulation unit (1912) is provided to an upper surface of the at least one secondary winding (1910) and coupled to the first fastening unit (1902*a*) to insulate the at least one secondary winding (1910). At this time, the second insulation unit (1912) may be provided as an insulation sheet, and may be provided in at least one of a circular shape, an oval shape and a polygon shape.

The at least another secondary winding (1913) is provided between the core (1902) and the bobbin (1904), and provided to a bottom surface of the bobbin (1904) to be coupled to the first fastening unit (1902*a*) for transformation of a power signal. At this time, the at least another secondary winding (1913) may include a metal thin film pattern layer (LP31) having an inductance component. Furthermore, the metal thin film pattern layer (LP31) having an inductance component may be provided in a metal material having a high conductivity to smoothly and efficiently output a power signal transformed by the at least another secondary winding (1913).

At this time, the metal thin film pattern layer (LP31) having an inductance component may be formed by at least one engineering method of a photo-lithography method using a photo mask and an etching solution, or an injection molding method using a press. The at least another secondary winding (1913) may be provided in at least one of a circular shape, an oval shape and a polygon shape.

The third insulation unit (1915) is provided at a bottom surface of at least another secondary winding (1913), and is coupled to the first fastening unit (1902*a*) to insulate at least another secondary winding (1913).

At this time, the third insulation unit (1915) may be provided in an insulation sheet, and may be provided in at least one of a circular shape, an oval shape and a polygon shape.

A power signal supply unit (1914) may be coupled to one side of the bobbin (1904) to be electrically connected to the at least one primary winding (1906), whereby a power signal can be supplied to the at least one primary winding (1906). At this time, the power signal supply unit (1914) may be electrically connected to a distal end of one side of the bobbin (1904) and a distal end of the at least one primary winding (1906).

The power signal supply unit (1914) may be provided in a metal material having a high conductivity to supply a power signal to the at least one primary winding (1906) smoothly and efficiently. At this time, the power signal supply unit (1914) may be provided as a terminal lug.

A power signal output unit (1916) may be coupled to the other side of the bobbin (1904) to be electrically connected to the at least one secondary winding (1910), whereby a power signal transformed by the at least one secondary winding (1910) can be outputted. At this time, the power signal output unit (1916) may be electrically connected to a distal end of the other side of the bobbin (1904) and a distal end of the at least one secondary winding (1910).

Furthermore, the power signal output unit (1916) may be coupled to a still other side of the bobbin (1904) to be electrically connected to the at least another secondary winding (1913), whereby a power signal transformed by the at least another secondary winding (1913) can be outputted.

At this time, the power signal output unit (1916) may be electrically connected to a distal end of still other side of the bobbin (1904) and a distal end of the at least another secondary winding (1913).

Additionally, the power signal output unit (1916) may be provided in a metal material having a high conductivity to output a power signal transformed by the at least one secondary winding (1910) or the at least another secondary winding (1913) smoothly and efficiently. The power signal output unit (1916) may be provided as a terminal lug.

As apparent from the foregoing, the planar transformer (1900) according to the tenth exemplary embodiment of the present invention includes the core (1902), the bobbin (1904), the at least one primary winding (1906), the first insulation unit (1908), the at least one secondary winding (1910), the second insulation unit (1912), the at least another secondary winding (1913) and the third insulation unit (1915).

Therefore, a planar transformer (1900) can be manufactured in a slim size using the technical feature of the planar transformer (1900) according to the tenth exemplary embodiment of the present invention, such that a power supply unit (not shown) that is manufactured along with the planar transformer (1900) can be manufactured in a slim size. Furthermore, the planar transformer (1900) according to the tenth exemplary embodiment of the present invention can reduce the manufacturing cost of the planar transformer (1900) to enhance the efficiency of transformation.

Eleventh Exemplary Embodiment

Figure 21:
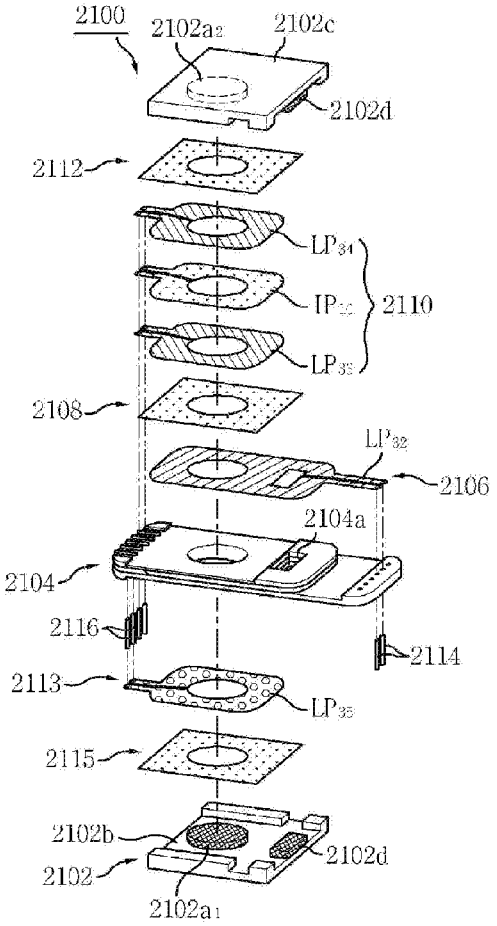
FIG. 21 is an exploded perspective view illustrating a planar transformer according to an eleventh exemplary embodiment of the present invention.
Figure 22:
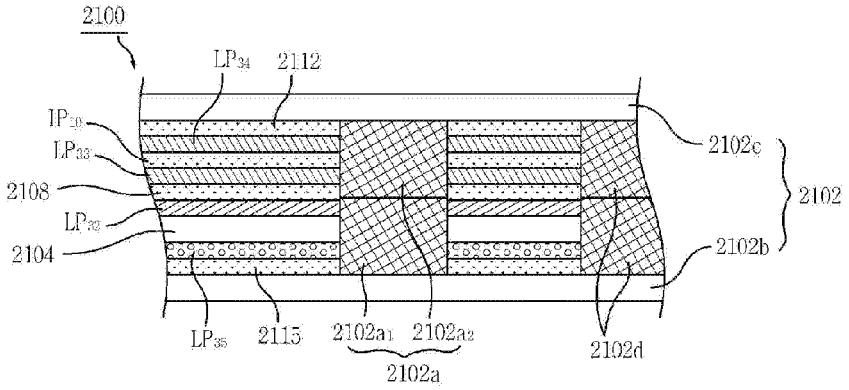
FIG. 22 is a coupled cross-sectional view illustrating a planar transformer according to an eleventh exemplary embodiment of the present invention.

FIG. 21 is an exploded perspective view illustrating a planar transformer according to an eleventh exemplary embodiment of the present invention, and FIG. 22 is a coupled cross-sectional view illustrating a planar transformer according to an eleventh exemplary embodiment of the present invention.

First, referring to FIGS. 21 and 22, a planar transformer (2100) according to the eleventh exemplary embodiment of the present invention includes a core (2102), a bobbin (2104), at least one primary winding (2106), a first insulation unit (2108), at least one secondary winding a second insulation unit (2112), at least another secondary winding (2113) and a third insulation unit (2115).

The core (2102) includes a first fastening unit (2102*a*) and is provided to induce formation of a magnetic field, where the core (2102) may include a bottom core (2102*b*) and an upper core (2102*c*). The bobbin (2104) is so provided as to be coupled to the core (2102) by the first fastening unit (2102*a*). The first fastening unit (2102*a*) may include first fastening lugs (2102*a*1, 2102*a*2).

The bobbin (2104) may include a second fastening unit (2104*a*) discrete from the first fastening unit (2102*a*), and the core (2102) may include a third fastening unit (2102*d*) to be coupled to the second fastening unit (2104*a*). At this time, the second fastening unit (2104*a*) may be provided as a second fastening hole (2104*a*), and the third fastening unit (2102*d*) may be provided to the bottom core (2102*b*) and the upper core (2102*c*), and may be provided as a third fastening lug (2102*d*) to be coupled to the second fastening hole (2104*a*).

The at least one primary winding (2106) is provided between the core (2102) and the bobbin (2104), and provided at an upper surface of the bobbin (2104) to be coupled to the first fastening unit (2102*a*) for supply of a power signal.

At this time, the least one primary winding (2106) may include a metal thin film pattern layer (LP32) having an inductance component, and the metal thin film pattern layer (LP32) having an inductance component may be provided in a metal material having a high conductivity to supply a power signal supplied by a power signal supply unit (2114, described later) smoothly and efficiently.

Furthermore, the metal thin film pattern layer (LP32) having an inductance component may be formed by at least one engineering method of a photo-lithography method using a photo mask and an etching solution, or an injection molding method using a press. The at least one primary winding (2106) may be provided in at least one of a circular shape, an oval shape and a polygon shape.

The first insulation unit (2108) is provided to an upper surface of the at least one primary winding (2106) and coupled to the first fastening unit (2102*a*) to insulate the at least one primary winding (2106). At this time, the first insulation unit (2108) may be provided as an insulation sheet, and may be provided in at least one of a circular shape, an oval shape and a polygon shape.

The at least one secondary winding (2110) is provided to an upper surface of the first insulation unit (2108), coupled to the first fastening unit (2102*a*) and to be insulated by the first insulation unit (2108) to transform a power signal.

At this time, the at least one secondary winding (2110) may include metal thin film pattern layers (LP33, LP34) having at least two or more inductance components, and at least one secondary insulation layer (IP10) provided between the metal thin film pattern layers (LP33, LP34) having at least two or more inductance components to insulate the metal thin film pattern layers (LP33, LP34) having at least two or more inductance components.

Furthermore, the metal thin film pattern layers (LP33, LP34) having at least two or more inductance components are provided in a metal material having a high conductivity to smoothly and efficiently output a power signal transformed by the at least one secondary winding (2110).

At this time, the metal thin film pattern layers (LP33, LP34) having at least two or more inductance components may be formed by at least one engineering method of a photo-lithography method using a photo mask and an etching solution, or an injection molding method using a press. The at least one secondary winding (2110) may be provided in at least one of a circular shape, an oval shape and a polygon shape.

The second insulation unit (2112) is provided to an upper surface of the at least one secondary winding (2110) and coupled to the first fastening unit (2102*a*) to insulate the at least one secondary winding (2110). At this time, the second insulation unit (2112) may be provided as an insulation sheet, and may be provided in at least one of a circular shape, an oval shape and a polygon shape.

The at least another secondary winding (2113) is provided between the core (2102) and the bobbin (2104), and provided to a bottom surface of the bobbin (2104) to be coupled to the first fastening unit (2102*a*) for transformation of a power signal.

At this time, the at least another secondary winding (2113) may include a metal thin film pattern layer (LP35) having an inductance component. Furthermore, the metal thin film pattern layer (LP35) having an inductance component may be provided in a metal material having a high conductivity to smoothly and efficiently output a power signal transformed by the at least another secondary winding (2113).

At this time, the metal thin film pattern layer (LP35) having an inductance component may be formed by at least one engineering method of a photo-lithography method using a photo mask and an etching solution, or an injection molding method using a press. The at least another secondary winding (2113) may be provided in at least one of a circular shape, an oval shape and a polygon shape.

The third insulation unit (2115) is provided at a bottom surface of at least another secondary winding (2113), and is coupled to the first fastening unit (2102*a*) to insulate at least another secondary winding (2113).

At this time, the third insulation unit (2115) may be provided in an insulation sheet, and may be provided in at least one of a circular shape, an oval shape and a polygon shape.

A power signal supply unit (2114) may be coupled to one side of the bobbin (2104) to be electrically connected to the at least one primary winding (2106), whereby a power signal can be supplied to the at least one primary winding (2106). At this time, the power signal supply unit (2114) may be electrically connected to a distal end of one side of the bobbin (2104) and a distal end of the at least one primary winding (2106).

The power signal supply unit (2114) may be provided in a metal material having a high conductivity to supply a power signal to the at least one primary winding (2106) smoothly and efficiently. At this time, the power signal supply unit (2114) may be provided as a terminal lug.

A power signal output unit (2116) may be coupled to the other side of the bobbin (2104) to be electrically connected to the at least one secondary winding (2110), whereby a power signal transformed by the at least one secondary winding (2110) can be outputted. At this time, the power signal output unit (2116) may be electrically connected to a distal end of the other side of the bobbin (2104) and a distal end of the at least one secondary winding (2110).

Furthermore, the power signal output unit (2116) may be coupled to a still other side of the bobbin (2104) to be electrically connected to the at least another secondary winding (2113), whereby a power signal transformed by the at least another secondary winding (2113) can be outputted.

At this time, the power signal output unit (2116) may be electrically connected to a distal end of still other side of the bobbin (2104) and a distal end of the at least another secondary winding (2113).

Additionally, the power signal output unit (2116) may be provided in a metal material having a high conductivity to output a power signal transformed by the at least one secondary winding (2110) or the at least another secondary winding (2113) smoothly and efficiently. The power signal output unit (2116) may be provided as a terminal lug.

As apparent from the foregoing, the planar transformer (2100) according to the eleventh exemplary embodiment of the present invention includes the core (2102), the bobbin (2104), the at least one primary winding (2106), the first insulation unit (2108), the at least one secondary winding (2110), the second insulation unit (2112), the at least another secondary winding (2113) and the third insulation unit (2115).

Therefore, a planar transformer (2100) can be manufactured in a slim size using the technical feature of the planar transformer (2100) according to the eleventh exemplary embodiment of the present invention, such that a power supply unit (not shown) that is manufactured along with the planar transformer (2100) can be manufactured in a slim size. Furthermore, the planar transformer (2100) according to the eleventh exemplary embodiment of the present invention can reduce the manufacturing cost of the planar transformer (2100) to enhance the efficiency of transformation.

Twelfth Exemplary Embodiment

Figure 23:
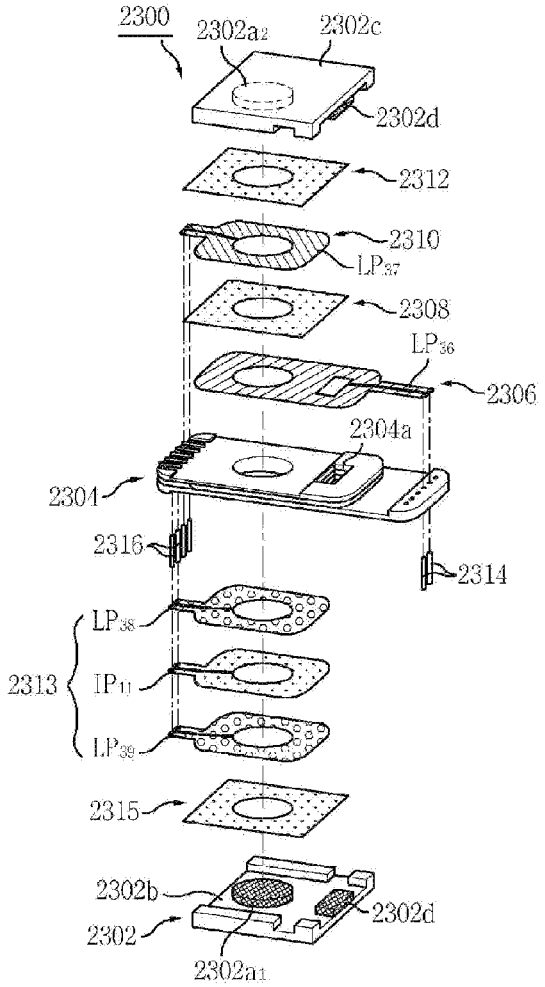
FIG. 23 is an exploded perspective view illustrating a planar transformer according to a twelfth exemplary embodiment of the present invention.
Figure 24:
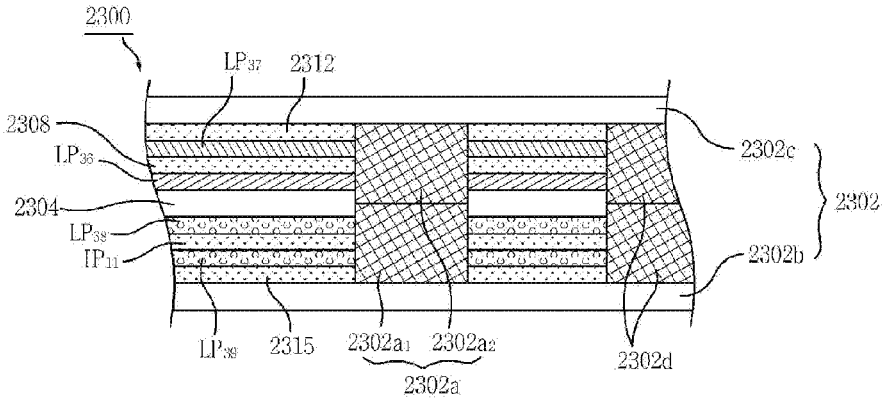
FIG. 24 is a coupled cross-sectional view illustrating a planar transformer according to a twelfth exemplary embodiment of the present invention.

FIG. 23 is an exploded perspective view illustrating a planar transformer according to a twelfth exemplary embodiment of the present invention, and FIG. 24 is a coupled cross-sectional view illustrating a planar transformer according to a twelfth exemplary embodiment of the present invention.

First, referring to FIGS. 23 and 24, a planar transformer (2300) according to the twelfth exemplary embodiment of the present invention includes a core (2302), a bobbin (2304), at least one primary winding (2306), a first insulation unit (2308), at least one secondary winding (2310), a second insulation unit (2312), at least another secondary winding (2313) and a third insulation unit (2315).

The core (2302) includes a first fastening unit (2302*a*) and is provided to induce formation of a magnetic field, where the core (2302) may include a bottom core (2302*b*) and an upper core (2302*c*). The bobbin (2304) is so provided as to be coupled to the core (2302) by the first fastening unit (2302*a*). The first fastening unit (2302*a*) may include first fastening lugs (2302*a*1, 2302*a*2).

The bobbin (2304) may include a second fastening unit (2304*a*) discrete from the first fastening unit (2302*a*), and the core (2302) may include a third fastening unit (2302*d*) to be coupled to the second fastening unit (2304*a*). At this time, the second fastening unit (2304*a*) may be provided as a second fastening hole (2304*a*), and the third fastening unit (2302*d*) may be provided to the bottom core (2302*b*) and the upper core (2302*c*), and may be provided as a third fastening lug (2302*d*) to be coupled to the second fastening hole (2304*a*).

The at least one primary winding (2306) is provided between the core (2302) and the bobbin (2304), and provided at an upper surface of the bobbin (2304) to be coupled to the first fastening unit (2302*a*) for supply of a power signal.

At this time, the least one primary winding (2306) may include a metal thin film pattern layer (LP36) having an inductance component, and the metal thin film pattern layer (LP36) having an inductance component may be provided in a metal material having a high conductivity to supply a power signal supplied by a power signal supply unit (2314, described later) smoothly and efficiently.

Furthermore, the metal thin film pattern layer (LP36) having an inductance component may be formed by at least one engineering method of a photo-lithography method using a photo mask and an etching solution, or an injection molding method using a press. The at least one primary winding (2306) may be provided in at least one of a circular shape, an oval shape and a polygon shape.

The first insulation unit (2308) is provided to an upper surface of the at least one primary winding (2306) and coupled to the first fastening unit (2302*a*) to insulate the at least one primary winding (2306). At this time, the first insulation unit (2308) may be provided as an insulation sheet, and may be provided in at least one of a circular shape, an oval shape and a polygon shape.

The at least one secondary winding (2310) is provided to an upper surface of the first insulation unit (2308), coupled to the first fastening unit (2302*a*) and to be insulated by the first insulation unit (2308) to transform a power signal.

At this time, the at least one secondary winding (2310) may include a metal thin film pattern layer (LP37) having an inductance component. The metal thin film pattern layer (LP37) having an inductance component may be provided in a metal material having a high conductivity to smoothly and efficiently output a power signal transformed by the at least one secondary winding (2310).

At this time, the metal thin film pattern layer (LP37) having an inductance component may be formed by at least one engineering method of a photo-lithography method using a photo mask and an etching solution, or an injection molding method using a press. The at least one secondary winding (2310) may be provided in at least one of a circular shape, an oval shape and a polygon shape.

The second insulation unit (2312) is provided to an upper surface of the at least one secondary winding (2310), and coupled to the first fastening unit (2302*a*) to insulate the at least one secondary winding (2310). At this time, the second insulation unit (2312) may be provided in an insulation sheet, and may be provided in at least one of a circular shape, an oval shape and a polygon shape.

The at least another secondary winding (2313) is provided between the core (2302) and the bobbin (2304), and provided to a bottom surface of the bobbin (2304) to be coupled to the first fastening unit (2302*a*) for transformation of a power signal.

At this time, the at least another secondary winding (2313) may include metal thin film pattern layers (LP38, LP39) having at least two or more inductance components, and at least another secondary insulation layer (IP11) provided between the metal thin film pattern layers (LP38, LP39) having at least two or more inductance components to insulate the metal thin film pattern layers (LP38, LP39) having at least two or more inductance components.

Furthermore, the metal thin film pattern layers (LP38, LP39) having at least two or more inductance components are provided in a metal material having a high conductivity to smoothly and efficiently output a power signal transformed by the at least another secondary winding (2313).

At this time, the metal thin film pattern layers (LP38, LP39) having at least two or more inductance components may be formed by at least one engineering method of a photo-lithography method using a photo mask and an etching solution, or an injection molding method using a press. The at least another secondary winding (2313) may be provided in at least one of a circular shape, an oval shape and a polygon shape.

The third insulation unit (2315) is provided to a bottom surface of the at least another secondary winding (2313), and coupled to the first fastening unit (2302*a*) to insulate the at least another secondary winding (2313). The third insulation unit (2315) may be provided as an insulation sheet, and may be provided in at least one of a circular shape, an oval shape and a polygon shape.

A power signal supply unit (2314) may be coupled to one side of the bobbin (2304) to be electrically connected to the at least one primary winding (2306), whereby a power signal can be supplied to the at least one primary winding (2306). At this time, the power signal supply unit (2314) may be electrically connected to a distal end of one side of the bobbin (2304) and a distal end of the at least one primary winding (2306).

The power signal supply unit (2314) may be provided in a metal material having a high conductivity to supply a power signal to the at least one primary winding (2306) smoothly and efficiently. At this time, the power signal supply unit (2314) may be provided as a terminal lug.

A power signal output unit (2316) may be coupled to the other side of the bobbin (2304) to be electrically connected to the at least one secondary winding (2310), whereby a power signal transformed by the at least one secondary winding (2310) can be outputted. At this time, the power signal output unit (2316) may be electrically connected to a distal end of the other side of the bobbin (2304) and a distal end of the at least one secondary winding (2310).

Furthermore, the power signal output unit (2316) may be coupled to a still other side of the bobbin (2304) to be electrically connected to the at least another secondary winding (2313), whereby a power signal transformed by the at least another secondary winding (2313) can be outputted.

At this time, the power signal output unit (2316) may be electrically connected to a distal end of still other side of the bobbin (2304) and a distal end of the at least another secondary winding (2313).

Additionally, the power signal output unit (2316) may be provided in a metal material having a high conductivity to output a power signal transformed by the at least one secondary winding (2310) or the at least another secondary winding (2313) smoothly and efficiently. The power signal output unit (2316) may be provided as a terminal lug.

As apparent from the foregoing, the planar transformer (2300) according to the twelfth exemplary embodiment of the present invention includes the core (2302), the bobbin (2304), the at least one primary winding (2306), the first insulation unit (2308), the at least one secondary winding (2310), the second insulation unit (2312), the at least another secondary winding (2313) and the third insulation unit (2315).

Therefore, a planar transformer (2300) can be manufactured in a slim size using the technical feature of the planar transformer (2300) according to the twelfth exemplary embodiment of the present invention, such that a power supply unit (not shown) that is manufactured along with the planar transformer (2300) can be manufactured in a slim size. Furthermore, the planar transformer (2300) according to the twelfth exemplary embodiment of the present invention can reduce the manufacturing cost of the planar transformer (2300) to enhance the efficiency of transformation.

Thirteenth Exemplary Embodiment

Figure 25:
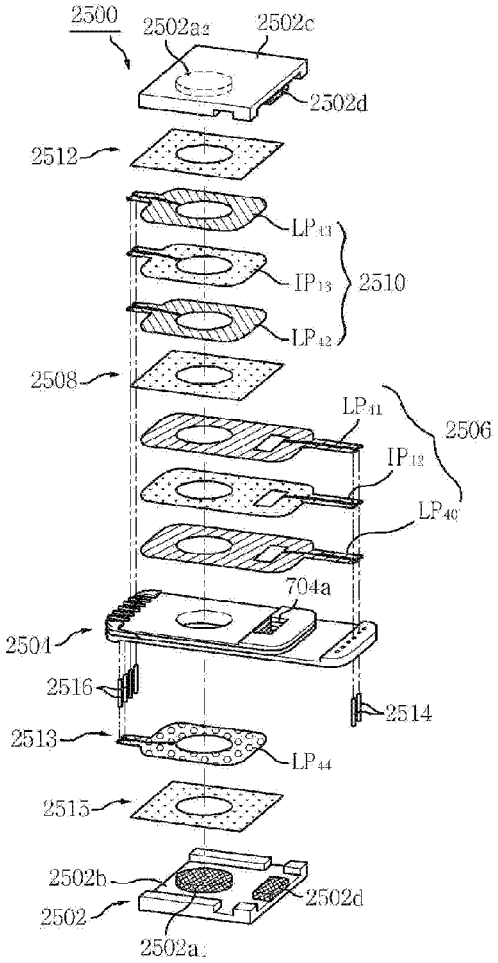
FIG. 25 is an exploded perspective view illustrating a planar transformer according to a thirteenth exemplary embodiment of the present invention.
Figure 26:
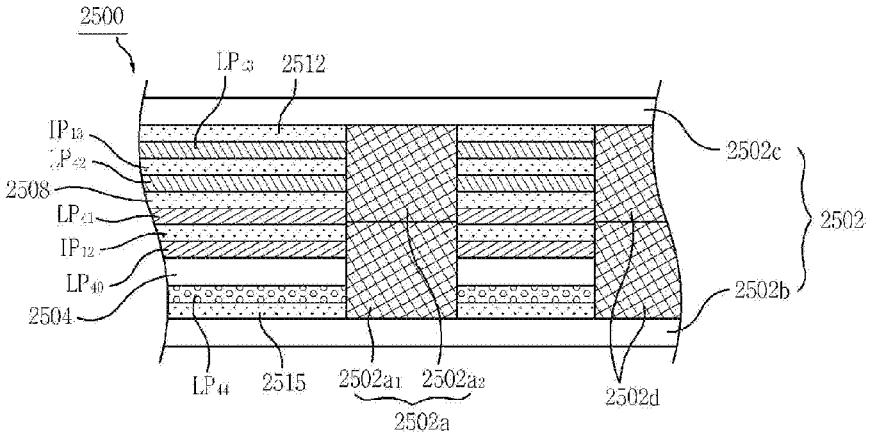
FIG. 26 is a coupled cross-sectional view illustrating a planar transformer according to a thirteenth exemplary embodiment of the present invention.

FIG. 25 is an exploded perspective view illustrating a planar transformer according to a thirteenth exemplary embodiment of the present invention, and FIG. 26 is a coupled cross-sectional view illustrating a planar transformer according to a thirteenth exemplary embodiment of the present invention.

First, referring to FIGS. 25 and 26, a planar transformer (2500) according to the thirteenth exemplary embodiment of the present invention includes a core (2502), a bobbin (2504), at least one primary winding (2506), a first insulation unit (2508), at least one secondary winding (2510), a second insulation unit (2512), at least another secondary winding (2513) and a third insulation unit (2515).

The core (2502) includes a first fastening unit (2502*a*) and is provided to induce formation of a magnetic field, where the core (2502) may include a bottom core (2502*b*) and an upper core (2502*c*). The bobbin (2504) is so provided as to be coupled to the core (2502) by the first fastening unit (2502*a*). The first fastening unit (2502*a*) may include first fastening lugs (2502*a*1, 2502*a*2).

The bobbin (2504) may include a second fastening unit (2504*a*) discrete from the first fastening unit (2502*a*), and the core (2502) may include a third fastening unit (2502*d*) to be coupled to the second fastening unit (2504*a*). At this time, the second fastening unit (2504*a*) may be provided as a second fastening hole (2504*a*), and the third fastening unit (2502*d*) may be provided to the bottom core (2502*b*) and the upper core (2502*c*), and may be provided as a third fastening lug (2502*d*) to be coupled to the second fastening hole (2504*a*).

The at least one primary winding (2506) is provided between the core (2502) and the bobbin (2504), and provided at an upper surface of the bobbin (2504) to be coupled to the first fastening unit (2502*a*) for supply of a power signal.

At this time, the least one primary winding (2506) may include metal thin film pattern layers (LP40, LP41) having at least two or more inductance components, and at least one primary insulation layer (IP12) provided between the metal thin film pattern layers (LP40, LP41) having at least two or more inductance components to insulate the metal thin film pattern layers (LP40, LP41) having at least two or more inductance components.

The metal thin film pattern layers (LP40, LP41) having at least two or more inductance components may be provided in a metal material having a high conductivity to supply a power signal supplied by a power signal supply unit (2514, described later) smoothly and efficiently.

Furthermore, metal thin film pattern layers (LP40, LP41) having at least two or more inductance components may be formed by at least one engineering method of a photo-lithography method using a photo mask and an etching solution, or an injection molding method using a press. The at least one primary winding (2506) may be provided in at least one of a circular shape, an oval shape and a polygon shape.

The first insulation unit (2508) is provided to an upper surface of the at least one primary winding (2506) and coupled to the first fastening unit (2502*a*) to insulate the at least one primary winding (2506). At this time, the first insulation unit (2508) may be provided as an insulation sheet, and may be provided in at least one of a circular shape, an oval shape and a polygon shape.

The at least one secondary winding (2510) is provided to an upper surface of the first insulation unit (2508), coupled to the first fastening unit (2502*a*) and to be insulated by the first insulation unit (2508) to transform a power signal.

At this time, the at least one secondary winding (2510) may include metal thin film pattern layers (LP42, LP43) having at least two or more inductance components, and at least one secondary insulation layer (IP13) provided between the metal thin film pattern layers (LP42, LP43) having at least two or more inductance components to insulate the metal thin film pattern layers (LP42, LP43) having at least two or more inductance components.

The metal thin film pattern layers (LP42, LP43) having at least two or more inductance components may be provided in a metal material having a high conductivity to smoothly and efficiently output a power signal transformed by the at least one secondary winding (2510).

At this time, the metal thin film pattern layers (LP42, LP43) having at least two or more inductance components may be formed by at least one engineering method of a photo-lithography method using a photo mask and an etching solution, or an injection molding method using a press. The at least one secondary winding (2510) may be provided in at least one of a circular shape, an oval shape and a polygon shape.

The second insulation unit (2512) is provided to an upper surface of the at least one secondary winding (2510), and coupled to the first fastening unit (2502*a*) to insulate the at least one secondary winding (2510). At this time, the second insulation unit (2512) may be provided in an insulation sheet, and may be provided in at least one of a circular shape, an oval shape and a polygon shape.

The at least another secondary winding (2513) is provided between the core (2502) and the bobbin (2504), and provided to a bottom surface of the bobbin (2504) to be coupled to the first fastening unit (2502*a*) for transformation of a power signal.

At this time, the at least another secondary winding (2513) may include a metal thin film pattern layer (LP44) having an inductance component. Furthermore, the metal thin film pattern layer (LP44) having an inductance component may be provided in a metal material having a high conductivity to smoothly and efficiently output a power signal transformed by the at least another secondary winding (2513).

At this time, the metal thin film pattern layer (LP44) having an inductance component may be formed by at least one engineering method of a photo-lithography method using a photo mask and an etching solution, or an injection molding method using a press. The at least another secondary winding (2513) may be provided in at least one of a circular shape, an oval shape and a polygon shape.

The third insulation unit (2515) is provided to a bottom surface of the at least another secondary winding (2513), and coupled to the first fastening unit (2502*a*) to insulate the at least another secondary winding (2513). The third insulation unit (2515) may be provided as an insulation sheet, and may be provided in at least one of a circular shape, an oval shape and a polygon shape.

A power signal supply unit (2514) may be coupled to one side of the bobbin (2504) to be electrically connected to the at least one primary winding (2506), whereby a power signal can be supplied to the at least one primary winding (2506). At this time, the power signal supply unit (2514) may be electrically connected to a distal end of one side of the bobbin (2504) and a distal end of the at least one primary winding (2506).

The power signal supply unit (2514) may be provided in a metal material having a high conductivity to supply a power signal to the at least one primary winding (2506) smoothly and efficiently. At this time, the power signal supply unit (2514) may be provided as a terminal lug.

A power signal output unit (2516) may be coupled to the other side of the bobbin (2504) to be electrically connected to the at least one secondary winding (2510), whereby a power signal transformed by the at least one secondary winding (2510) can be outputted. At this time, the power signal output unit (2516) may be electrically connected to a distal end of the other side of the bobbin (2504) and a distal end of the at least one secondary winding (2510).

Furthermore, the power signal output unit (2516) may be coupled to a still other side of the bobbin (2504) to be electrically connected to the at least another secondary winding (2513), whereby a power signal transformed by the at least another secondary winding (2513) can be outputted.

At this time, the power signal output unit (2516) may be electrically connected to a distal end of still other side of the bobbin (2504) and a distal end of the at least another secondary winding (2513).

Additionally, the power signal output unit (2516) may be provided in a metal material having a high conductivity to output a power signal transformed by the at least one secondary winding (2510) or the at least another secondary winding (2513) smoothly and efficiently. The power signal output unit (2516) may be provided as a terminal lug.

As apparent from the foregoing, the planar transformer (2500) according to the thirteenth exemplary embodiment of the present invention includes the core (2502), the bobbin (2504), the at least one primary winding (2506), the first insulation unit (2508), the at least one secondary winding (2510), the second insulation unit (2512), the at least another secondary winding (2513) and the third insulation unit (2515).

Therefore, a planar transformer (2500) can be manufactured in a slim size using the technical feature of the planar transformer (2500) according to the thirteenth exemplary embodiment of the present invention, such that a power supply unit (not shown) that is manufactured along with the planar transformer (2500) can be manufactured in a slim size. Furthermore, the planar transformer (2500) according to the thirteenth exemplary embodiment of the present invention can reduce the manufacturing cost of the planar transformer (2500) to enhance the efficiency of transformation.

Fourteenth Exemplary Embodiment

Figure 27:
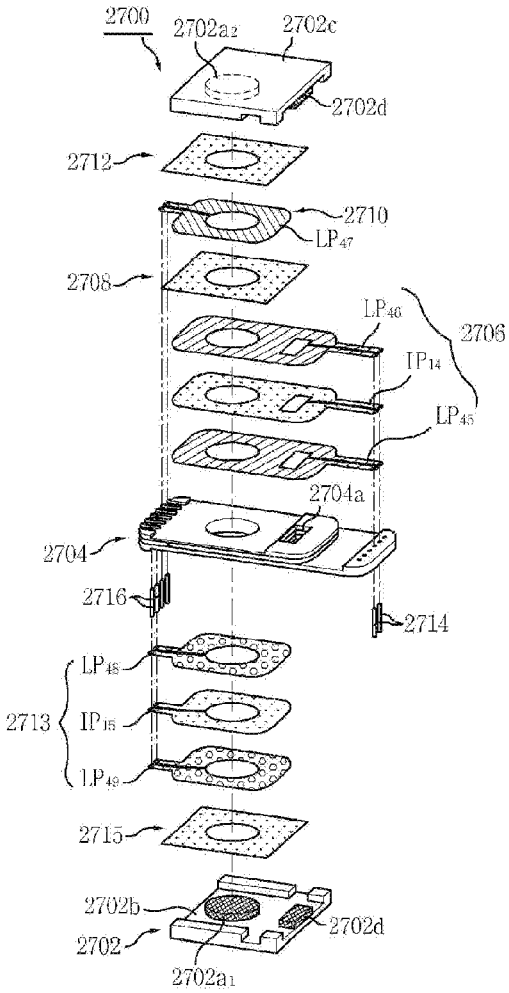
FIG. 27 is an exploded perspective view illustrating a planar transformer according to a fourteenth exemplary embodiment of the present invention.
Figure 28:
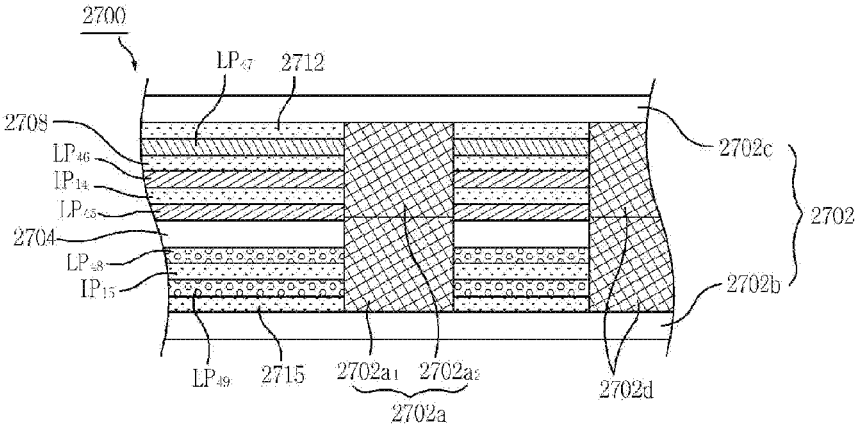
FIG. 28 is a coupled cross-sectional view illustrating a planar transformer according to a fourteenth exemplary embodiment of the present invention.

FIG. 27 is an exploded perspective view illustrating a planar transformer according to a fourteenth exemplary embodiment of the present invention, and FIG. 28 is a coupled cross-sectional view illustrating a planar transformer according to a fourteenth exemplary embodiment of the present invention.

First, referring to FIGS. 27 and 28, a planar transformer (2700) according to the fourteenth exemplary embodiment of the present invention includes a core (2702), a bobbin (2704), at least one primary winding (2706), a first insulation unit (2708), at least one secondary winding (2710), a second insulation unit (2712), at least another secondary winding (2713) and a third insulation unit (2715).

The core (2702) includes a first fastening unit (2702*a*) and is provided to induce formation of a magnetic field, where the core (2702) may include a bottom core (2702*b*) and an upper core (2702*c*). The bobbin (2704) is so provided as to be coupled to the core (2702) by the first fastening unit (2702*a*). The first fastening unit (2702*a*) may include first fastening lugs (2702*a*1, 2702*a*2).

The bobbin (2704) may include a second fastening unit (2704*a*) discrete from the first fastening unit (2702*a*), and the core (2702) may include a third fastening unit (2702*d*) to be coupled to the second fastening unit (2704*a*). At this time, the second fastening unit (2704*a*) may be provided as a second fastening hole (2704*a*), and the third fastening unit (2702*d*) may be provided to the bottom core (2702*b*) and the upper core (2702*c*), and may be provided as a third fastening lug (2702*d*) to be coupled to the second fastening hole (2704*a*).

The at least one primary winding (2706) is provided between the core (2702) and the bobbin (2704), and provided at an upper surface of the bobbin (2704) to be coupled to the first fastening unit (2702*a*) for supply of a power signal.

At this time, the least one primary winding (2706) may include metal thin film pattern layers (LP45, LP46) having at least two or more inductance components, and at least one primary insulation layer (IP14) provided between the metal thin film pattern layers (LP45, LP46) having at least two or more inductance components to insulate the metal thin film pattern layers (LP45, LP46) having at least two or more inductance components.

The metal thin film pattern layers (LP45, LP46) having at least two or more inductance components may be provided in a metal material having a high conductivity to supply a power signal supplied by a power signal supply unit (2714, described later) smoothly and efficiently.

Furthermore, the metal thin film pattern layers (LP45, LP46) having at least two or more inductance components may be formed by at least one engineering method of a photo-lithography method using a photo mask and an etching solution, or an injection molding method using a press. The at least one primary winding (2706) may be provided in at least one of a circular shape, an oval shape and a polygon shape.

The first insulation unit (2708) is provided to an upper surface of the at least one primary winding (2706) and coupled to the first fastening unit (2702*a*) to insulate the at least one primary winding (2706). At this time, the first insulation unit (2708) may be provided as an insulation sheet, and may be provided in at least one of a circular shape, an oval shape and a polygon shape.

The at least one secondary winding (2710) is provided to an upper surface of the first insulation unit (2708), coupled to the first fastening unit (2702*a*) and to be insulated by the first insulation unit (2708) to transform a power signal.

At this time, the at least one secondary winding (2710) may include a metal thin film pattern layer (LP47) having an inductance component. The a metal thin film pattern layer (LP47) having an inductance component may be provided in a metal material having a high conductivity to smoothly and efficiently output a power signal transformed by the at least one secondary winding (2710).

At this time, the metal thin film pattern layer (LP47) having an inductance component may be formed by at least one engineering method of a photo-lithography method using a photo mask and an etching solution, or an injection molding method using a press. The at least one secondary winding (2710) may be provided in at least one of a circular shape, an oval shape and a polygon shape.

The second insulation unit (2712) is provided to an upper surface of the at least one secondary winding (2710), and coupled to the first fastening unit (2702*a*) to insulate the at least one secondary winding (2710). At this time, the second insulation unit (2712) may be provided in an insulation sheet, and may be provided in at least one of a circular shape, an oval shape and a polygon shape.

The at least another secondary winding (2713) is provided between the core (2702) and the bobbin (2704), and provided to a bottom surface of the bobbin (2704) to be coupled to the first fastening unit (2702*a*) for transformation of a power signal.

At this time, the at least another secondary winding (2713) may include metal thin film pattern layers (LP48, LP49) having at least two or more inductance components, and at least another secondary insulation layer (IP15) provided between the metal thin film pattern layers (LP48, LP49) having at least two or more inductance components to insulate the metal thin film pattern layers (LP48, LP49) having at least two or more inductance components.

At this time, the metal thin film pattern layers (LP48, LP49) having at least two or more inductance components may be provided in a metal material having a high conductivity to smoothly and efficiently output a power signal transformed by the at least another secondary winding (2713).

At this time, the metal thin film pattern layers (LP48, LP49) having at least two or more inductance components may be formed by at least one engineering method of a photo-lithography method using a photo mask and an etching solution, or an injection molding method using a press. The at least another secondary winding (2713) may be provided in at least one of a circular shape, an oval shape and a polygon shape.

The third insulation unit (2715) is provided to a bottom surface of the at least another secondary winding (2713), and coupled to the first fastening unit (2702*a*) to insulate the at least another secondary winding (2713). The third insulation unit (2715) may be provided as an insulation sheet, and may be provided in at least one of a circular shape, an oval shape and a polygon shape.

A power signal supply unit (2714) may be coupled to one side of the bobbin (2704) to be electrically connected to the at least one primary winding (2706), whereby a power signal can be supplied to the at least one primary winding (2706). At this time, the power signal supply unit (2714) may be electrically connected to a distal end of one side of the bobbin (2704) and a distal end of the at least one primary winding (2706).

The power signal supply unit (2714) may be provided in a metal material having a high conductivity to supply a power signal to the at least one primary winding (2706) smoothly and efficiently. At this time, the power signal supply unit (2714) may be provided as a terminal lug.

A power signal output unit (2716) may be coupled to the other side of the bobbin (2704) to be electrically connected to the at least one secondary winding (2710), whereby a power signal transformed by the at least one secondary winding (2710) can be outputted. At this time, the power signal output unit (2716) may be electrically connected to a distal end of the other side of the bobbin (2704) and a distal end of the at least one secondary winding (2710).

Furthermore, the power signal output unit (2716) may be coupled to a still other side of the bobbin (2704) to be electrically connected to the at least another secondary winding (2713), whereby a power signal transformed by the at least another secondary winding (2713) can be outputted.

At this time, the power signal output unit (2716) may be electrically connected to a distal end of still other side of the bobbin (2704) and a distal end of the at least another secondary winding (2713).

Additionally, the power signal output unit (2716) may be provided in a metal material having a high conductivity to output a power signal transformed by the at least one secondary winding (2710) or the at least another secondary winding (2713) smoothly and efficiently. The power signal output unit (2716) may be provided as a terminal lug.

As apparent from the foregoing, the planar transformer (2700) according to the fourteenth exemplary embodiment of the present invention includes the core (2702), the bobbin (2704), the at least one primary winding (2706), the first insulation unit (2708), the at least one secondary winding (2710), the second insulation unit (2712), the at least another secondary winding (2713) and the third insulation unit (2715).

Therefore, a planar transformer (2700) can be manufactured in a slim size using the technical feature of the planar transformer (2700) according to the fourteenth exemplary embodiment of the present invention, such that a power supply unit (not shown) that is manufactured along with the planar transformer (2700) can be manufactured in a slim size. Furthermore, the planar transformer (2700) according to the fourteenth exemplary embodiment of the present invention can reduce the manufacturing cost of the planar transformer (2700) to enhance the efficiency of transformation.

Fifteenth Exemplary Embodiment

Figure 29:
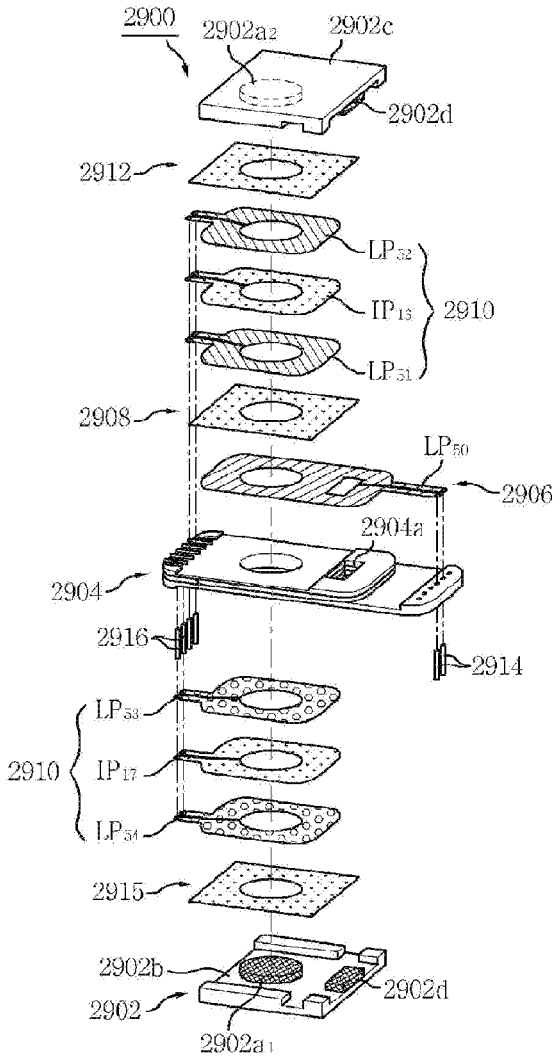
FIG. 29 is an exploded perspective view illustrating a planar transformer according to a fifteenth exemplary embodiment of the present invention.
Figure 30:
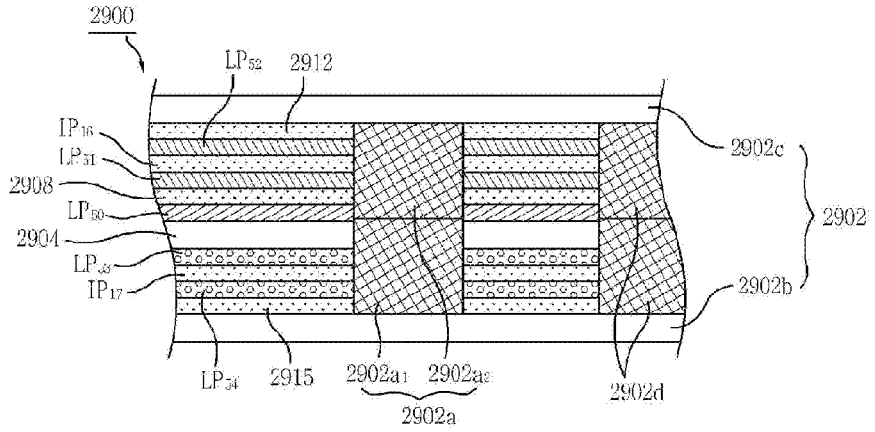
FIG. 30 is a coupled cross-sectional view illustrating a planar transformer according to a fifteenth exemplary embodiment of the present invention.

FIG. 29 is an exploded perspective view illustrating a planar transformer according to a fifteenth exemplary embodiment of the present invention, and FIG. 30 is a coupled cross-sectional view illustrating a planar transformer according to a fifteenth exemplary embodiment of the present invention.

First, referring to FIGS. 29 and 30, a planar transformer (2900) according to the fifteenth exemplary embodiment of the present invention includes a core (2902), a bobbin (2904), at least one primary winding (2906), a first insulation unit (2908), at least one secondary winding (2910), a second insulation unit (2912), at least another secondary winding (2913) and a third insulation unit (2915).

The core (2902) includes a first fastening unit (2902*a*) and is provided to induce formation of a magnetic field, where the core (2902) may include a bottom core (2902*b*) and an upper core (2902*c*). The bobbin (2904) is so provided as to be coupled to the core (2902) by the first fastening unit (2902*a*). The first fastening unit (2902*a*) may include first fastening lugs (2902*a*1, 2902*a*2).

The bobbin (2904) may include a second fastening unit (2904*a*) discrete from the first fastening unit (2902*a*), and the core (2902) may include a third fastening unit (2902*d*) to be coupled to the second fastening unit (2904*a*). At this time, the second fastening unit (2904*a*) may be provided as a second fastening hole (2904*a*), and the third fastening unit (2902*d*) may be provided to the bottom core (2902*b*) and the upper core (2902*c*), and may be provided as a third fastening lug (2902*d*) to be coupled to the second fastening hole (2904*a*).

The at least one primary winding (2906) is provided between the core (2902) and the bobbin (2904), and provided at an upper surface of the bobbin (2904) to be coupled to the first fastening unit (2902*a*) for supply of a power signal.

At this time, the least one primary winding (2906) may include a metal thin film pattern layer (LP50) having an inductance component. The metal thin film pattern layer (LP50) having an inductance component may be provided in a metal material having a high conductivity to supply a power signal supplied by a power signal supply unit (2914, described later) smoothly and efficiently.

At this time, the metal thin film pattern layer (LP50) having an inductance component may be formed by at least one engineering method of a photo-lithography method using a photo mask and an etching solution, or an injection molding method using a press. The at least one primary winding (2906) may be provided in at least one of a circular shape, an oval shape and a polygon shape.

The first insulation unit (2908) is provided to an upper surface of the at least one primary winding (2906) and coupled to the first fastening unit (2902*a*) to insulate the at least one primary winding (2906). At this time, the first insulation unit (2908) may be provided as an insulation sheet, and may be provided in at least one of a circular shape, an oval shape and a polygon shape.

The at least one secondary winding (2910) is provided to an upper surface of the first insulation unit (2908), coupled to the first fastening unit (2902*a*) and to be insulated by the first insulation unit (2908) to transform a power signal.

At this time, the at least one secondary winding (2910) may include metal thin film pattern layers (LP51, LP52) having at least two or more inductance components, and at least one secondary insulation layer (IP16) provided between the metal thin film pattern layers (LP51, LP52) having at least two or more inductance components to insulate the metal thin film pattern layers (LP51, LP52) having at least two or more inductance components.

The metal thin film pattern layers (LP51, LP52) having at least two or more inductance components may be provided in a metal material having a high conductivity to smoothly and efficiently output a power signal transformed by the at least one secondary winding (2910).

At this time, the metal thin film pattern layers (LP51, LP52) having at least two or more inductance components may be formed by at least one engineering method of a photo-lithography method using a photo mask and an etching solution, or an injection molding method using a press. The at least one secondary winding (2910) may be provided in at least one of a circular shape, an oval shape and a polygon shape.

The second insulation unit (2912) is provided to an upper surface of the at least one secondary winding (2910), and coupled to the first fastening unit (2902*a*) to insulate the at least one secondary winding (2910). At this time, the second insulation unit (2912) may be provided in an insulation sheet, and may be provided in at least one of a circular shape, an oval shape and a polygon shape.

The at least another secondary winding (2913) is provided between the core (2902) and the bobbin (2904), and provided to a bottom surface of the bobbin (2904) to be coupled to the first fastening unit (2902*a*) for transformation of a power signal.

At this time, the at least another secondary winding (2913) may include metal thin film pattern layers (LP53, LP54) having at least two or more inductance components, and at least another secondary insulation layer (IP17) provided between the metal thin film pattern layers (LP53, LP54) having at least two or more inductance components to insulate the metal thin film pattern layers (LP53, LP54) having at least two or more inductance components.

At this time, the metal thin film pattern layers (LP53, LP54) having at least two or more inductance components may be provided in a metal material having a high conductivity to smoothly and efficiently output a power signal transformed by the at least another secondary winding (2913).

At this time, the metal thin film pattern layers (LP53, LP54) having at least two or more inductance components may be formed by at least one engineering method of a photo-lithography method using a photo mask and an etching solution, or an injection molding method using a press. The at least another secondary winding (2913) may be provided in at least one of a circular shape, an oval shape and a polygon shape.

The third insulation unit (2915) is provided to a bottom surface of the at least another secondary winding (2913), and coupled to the first fastening unit (2902*a*) to insulate the at least another secondary winding (2913). The third insulation unit (2915) may be provided as an insulation sheet, and may be provided in at least one of a circular shape, an oval shape and a polygon shape.

A power signal supply unit (2914) may be coupled to one side of the bobbin (2904) to be electrically connected to the at least one primary winding (2906), whereby a power signal can be supplied to the at least one primary winding (2906). At this time, the power signal supply unit (2914) may be electrically connected to a distal end of one side of the bobbin (2904) and a distal end of the at least one primary winding (2906).

The power signal supply unit (2914) may be provided in a metal material having a high conductivity to supply a power signal to the at least one primary winding (2906) smoothly and efficiently. At this time, the power signal supply unit (2914) may be provided as a terminal lug.

A power signal output unit (2916) may be coupled to the other side of the bobbin (2904) to be electrically connected to the at least one secondary winding (2910), whereby a power signal transformed by the at least one secondary winding (2910) can be outputted. At this time, the power signal output unit (2916) may be electrically connected to a distal end of the other side of the bobbin (2904) and a distal end of the at least one secondary winding (2910).

Furthermore, the power signal output unit (2916) may be coupled to a still other side of the bobbin (2904) to be electrically connected to the at least another secondary winding (2913), whereby a power signal transformed by the at least another secondary winding (2913) can be outputted.

At this time, the power signal output unit (2916) may be electrically connected to a distal end of still other side of the bobbin (2904) and a distal end of the at least another secondary winding (2913).

Additionally, the power signal output unit (2916) may be provided in a metal material having a high conductivity to output a power signal transformed by the at least one secondary winding (2910) or the at least another secondary winding (2913) smoothly and efficiently. The power signal output unit (2916) may be provided as a terminal lug.

As apparent from the foregoing, the planar transformer (2900) according to the fifteenth exemplary embodiment of the present invention includes the core (2902), the bobbin (2904), the at least one primary winding (2906), the first insulation unit (2908), the at least one secondary winding (2910), the second insulation unit (2912), the at least another secondary winding (2913) and the third insulation unit (2915).

Therefore, a planar transformer (2900) can be manufactured in a slim size using the technical feature of the planar transformer (2900) according to the fifteenth exemplary embodiment of the present invention, such that a power supply unit (not shown) that is manufactured along with the planar transformer (2900) can be manufactured in a slim size. Furthermore, the planar transformer (2900) according to the fifteenth exemplary embodiment of the present invention can reduce the manufacturing cost of the planar transformer (2900) to enhance the efficiency of transformation.

Sixteenth Exemplary Embodiment

Figure 31:
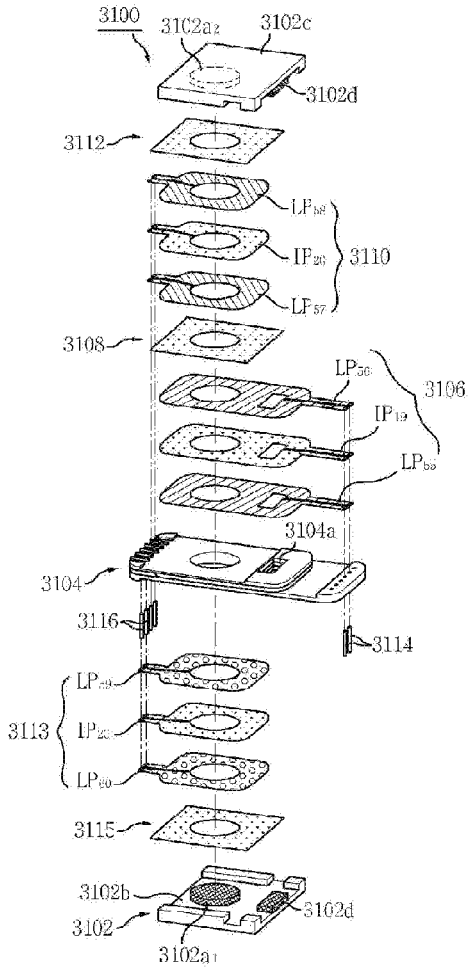
FIG. 31 is an exploded perspective view illustrating a planar transformer according to a sixteenth exemplary embodiment of the present invention.
Figure 32:
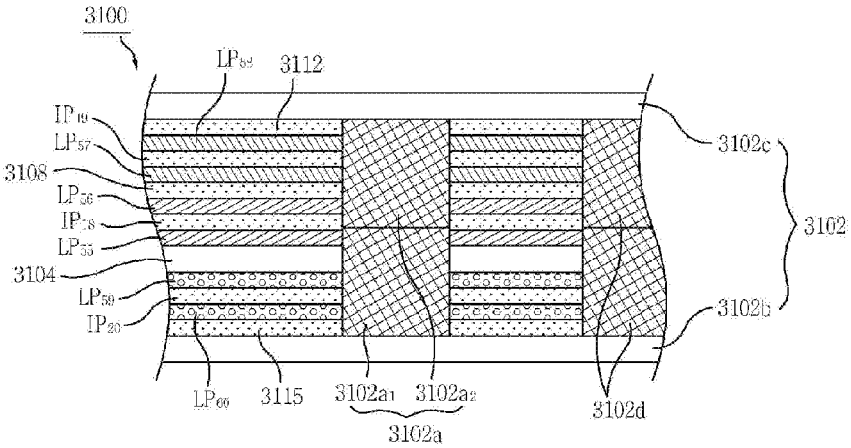
FIG. 32 is a coupled cross-sectional view illustrating a planar transformer according to a sixteenth exemplary embodiment of the present invention.

FIG. 31 is an exploded perspective view illustrating a planar transformer according to a sixteenth exemplary embodiment of the present invention, and FIG. 32 is a coupled cross-sectional view illustrating a planar transformer according to a sixteenth exemplary embodiment of the present invention.

First, referring to FIGS. 31 and 32, a planar transformer (3100) according to the sixteenth exemplary embodiment of the present invention includes a core (3102), a bobbin (3104), at least one primary winding (3106), a first insulation unit (3108), at least one secondary winding (3110), a second insulation unit (3112), at least another secondary winding (3113) and a third insulation unit (3115).

The core (3102) includes a first fastening unit (3102*a*) and is provided to induce formation of a magnetic field, where the core (3102) may include a bottom core (3102*b*) and an upper core (3102*c*). The bobbin (3104) is so provided as to be coupled to the core (3102) by the first fastening unit (3102*a*). The first fastening unit (3102*a*) may include first fastening lugs (3102*a*1, 3102*a*2).

The bobbin (3104) may include a second fastening unit (3104*a*) discrete from the first fastening unit (3102*a*), and the core (3102) may include a third fastening unit (3102*d*) to be coupled to the second fastening unit (3104*a*). At this time, the second fastening unit (3104*a*) may be provided as a second fastening hole (3104*a*), and the third fastening unit (3102*d*) may be provided to the bottom core (3102*b*) and the upper core (3102*c*), and may be provided as a third fastening lug (3102*d*) to be coupled to the second fastening hole (3104*a*).

The at least one primary winding (3106) is provided between the core (3102) and the bobbin (3104), and provided at an upper surface of the bobbin (3104) to be coupled to the first fastening unit (3102*a*) for supply of a power signal.

At this time, the at least one primary winding (3106) may include metal thin film pattern layers (LP55, LP56) having at least two or more inductance components, and at least one primary insulation layer (IP18) provided between the metal thin film pattern layers (LP55, LP56) having at least two or more inductance components to insulate the metal thin film pattern layers (LP55, LP56) having at least two or more inductance components.

The metal thin film pattern layers (LP55, LP56) having at least two or more inductance components may be provided in a metal material having a high conductivity to smoothly and efficiently supply a power signal supplied by a power signal supply unit (3114, described later).

At this time, the metal thin film pattern layers (LP55, LP56) having at least two or more inductance components may be formed by at least one engineering method of a photo-lithography method using a photo mask and an etching solution, or an injection molding method using a press. The at least one primary winding (3106) may be provided in at least one of a circular shape, an oval shape and a polygon shape.

The first insulation unit (3108) is provided to an upper surface of the at least one primary winding (3106) and coupled to the first fastening unit (3102*a*) to insulate the at least one primary winding (3106). At this time, the first insulation unit (3108) may be provided as an insulation sheet, and may be provided in at least one of a circular shape, an oval shape and a polygon shape.

The at least one secondary winding (3110) is provided to an upper surface of the first insulation unit (3108), coupled to the first fastening unit (3102*a*) and insulated by the first insulation unit (3108) to transform a power signal.

At this time, the at least one secondary winding (3110) may include metal thin film pattern layers (LP57, LP58) having at least two or more inductance components, and at least one secondary insulation layer (IP19) provided between the metal thin film pattern layers (LP57, LP58) having at least two or more inductance components to insulate the metal thin film pattern layers (LP57, LP58) having at least two or more inductance components.

The metal thin film pattern layers (LP57, LP58) having at least two or more inductance components may be provided in a metal material having a high conductivity to smoothly and efficiently output a power signal transformed by the at least one secondary winding (3110).

At this time, the metal thin film pattern layers (LP57, LP58) having at least two or more inductance components may be formed by at least one engineering method of a photo-lithography method using a photo mask and an etching solution, or an injection molding method using a press. The at least one secondary winding (3110) may be provided in at least one of a circular shape, an oval shape and a polygon shape.

The second insulation unit (3112) is provided to an upper surface of the at least one secondary winding (3110), and coupled to the first fastening unit (3102*a*) to insulate the at least one secondary winding (3110). At this time, the second insulation unit (3112) may be provided in an insulation sheet, and may be provided in at least one of a circular shape, an oval shape and a polygon shape.

The at least another secondary winding (3113) is provided between the core (3102) and the bobbin (3104), and provided to a bottom surface of the bobbin (3104) to be coupled to the first fastening unit (3102*a*) for transformation of a power signal.

At this time, the at least another secondary winding (3113) may include metal thin film pattern layers (LP59, LP60) having at least two or more inductance components, and at least another secondary insulation layer (IP20) provided between the metal thin film pattern layers (LP59, LP60) having at least two or more inductance components to insulate the metal thin film pattern layers (LP59, LP60) having at least two or more inductance components.

At this time, the metal thin film pattern layers (LP59, LP60) having at least two or more inductance components may be provided in a metal material having a high conductivity to smoothly and efficiently output a power signal transformed by the at least another secondary winding (3113).

At this time, the metal thin film pattern layers (LP59, LP60) having at least two or more inductance components may be formed by at least one engineering method of a photo-lithography method using a photo mask and an etching solution, or an injection molding method using a press. The at least another secondary winding (3113) may be provided in at least one of a circular shape, an oval shape and a polygon shape.

The third insulation unit (3115) is provided to a bottom surface of the at least another secondary winding (3113), and coupled to the first fastening unit (3102*a*) to insulate the at least another secondary winding (3113). The third insulation unit (3115) may be provided as an insulation sheet, and may be provided in at least one of a circular shape, an oval shape and a polygon shape.

A power signal supply unit (3114) may be coupled to one side of the bobbin (3104) to be electrically connected to the at least one primary winding (3106), whereby a power signal can be supplied to the at least one primary winding (3106). At this time, the power signal supply unit (3114) may be electrically connected to a distal end of one side of the bobbin (3104) and a distal end of the at least one primary winding (3106).

The power signal supply unit (3114) may be provided in a metal material having a high conductivity to supply a power signal to the at least one primary winding (3106) smoothly and efficiently. At this time, the power signal supply unit (3114) may be provided as a terminal lug.

A power signal output unit (3116) may be coupled to the other side of the bobbin (3104) to be electrically connected to the at least one secondary winding (3110), whereby a power signal transformed by the at least one secondary winding (3110) can be outputted. At this time, the power signal output unit (3116) may be electrically connected to a distal end of the other side of the bobbin (3104) and a distal end of the at least one secondary winding (3110).

Furthermore, the power signal output unit (3116) may be coupled to a still other side of the bobbin (3104) to be electrically connected to the at least another secondary winding (3113), whereby a power signal transformed by the at least another secondary winding (3113) can be outputted.

At this time, the power signal output unit (3116) may be electrically connected to a distal end of still other side of the bobbin (3104) and a distal end of the at least another secondary winding (3113).

Additionally, the power signal output unit (3116) may be provided in a metal material having a high conductivity to output a power signal transformed by the at least one secondary winding (3110) or the at least another secondary winding (3113) smoothly and efficiently. The power signal output unit (3116) may be provided as a terminal lug.

As apparent from the foregoing, the planar transformer (3100) according to the sixteenth exemplary embodiment of the present invention includes the core (3102), the bobbin (3104), the at least one primary winding (3106), the first insulation unit (3108), the at least one secondary winding (3110), the second insulation unit (3112), the at least another secondary winding (3113) and the third insulation unit (3115).

Therefore, a planar transformer (3100) can be manufactured in a slim size using the technical feature of the planar transformer (3100) according to the sixteenth exemplary embodiment of the present invention, such that a power supply unit (not shown) that is manufactured along with the planar transformer (3100) can be manufactured in a slim size. Furthermore, the planar transformer (3100) according to the sixteenth exemplary embodiment of the present invention can reduce the manufacturing cost of the planar transformer (3100) to enhance the efficiency of transformation.

Seventeenth Exemplary Embodiment

Figure 33:
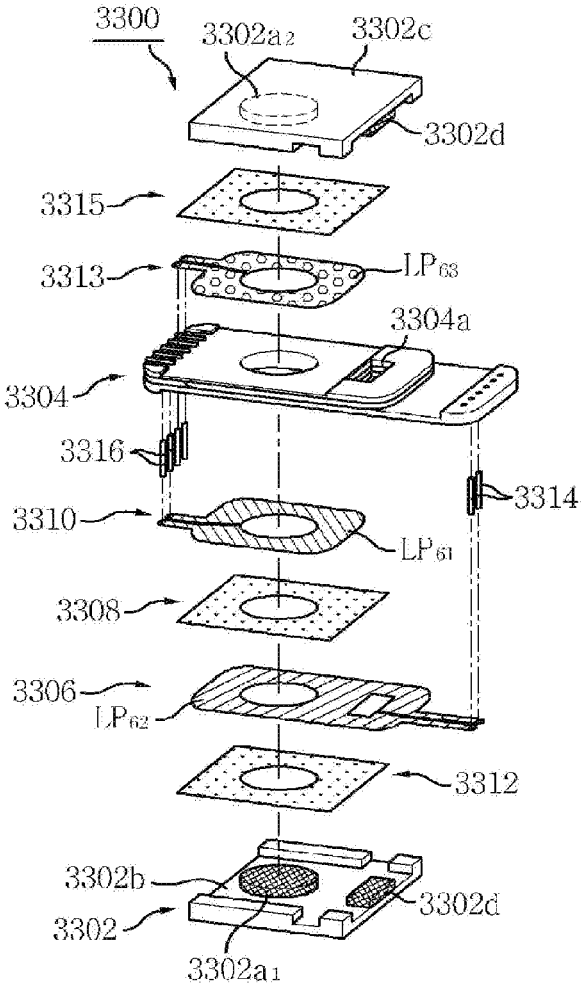
FIG. 33 is an exploded perspective view illustrating a planar transformer according to a seventeenth exemplary embodiment of the present invention.
Figure 34:
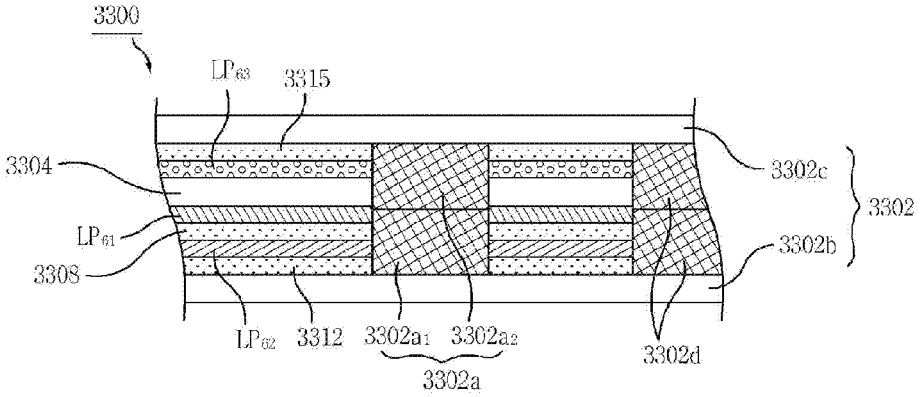
FIG. 34 is a coupled cross-sectional view illustrating a planar transformer according to a seventeenth exemplary embodiment of the present invention.

FIG. 33 is an exploded perspective view illustrating a planar transformer according to a seventeenth exemplary embodiment of the present invention, and FIG. 34 is a coupled cross-sectional view illustrating a planar transformer according to a seventeenth exemplary embodiment of the present invention.

First, referring to FIGS. 33 and 34, a planar transformer (3300) according to the seventeenth exemplary embodiment of the present invention includes a core (3302), a bobbin (3304), at least one primary winding (3306), a first insulation unit (3308), at least one secondary winding (3310), a second insulation unit (3312), at least another secondary winding (3313) and a third insulation unit (3315).

The core (3302) includes a first fastening unit (3302*a*) and is provided to induce formation of a magnetic field, where the core (3302) may include a bottom core (3302*b*) and an upper core (3302*c*). The bobbin (3304) is so provided as to be coupled to the core (3302) by the first fastening unit (3302*a*). The first fastening unit (3302*a*) may include first fastening lugs (3302*a*1, 3302*a*2).

The bobbin (3304) may include a second fastening unit (3304*a*) discrete from the first fastening unit (3302*a*), and the core (3302) may include a third fastening unit (3302*d*) to be coupled to the second fastening unit (3304*a*). At this time, the second fastening unit (3304*a*) may be provided as a second fastening hole (3304*a*), and the third fastening unit (3302*d*) may be provided to the bottom core (3302*b*) and the upper core (3302*c*), and may be provided as a third fastening lug (3302*d*) to be coupled to the second fastening hole (3304*a*).

The at least one secondary winding (3310) is provided between the core (3302) and the bobbin (3304), and provided at a bottom surface of the bobbin (3304) to be coupled to the first fastening unit (3302*a*) for supply of a transformed power signal.

At this time, the at least one secondary winding (3310) may include a metal thin film pattern layer (LP61) having an inductance component. The metal thin film pattern layer (LP61) having an inductance component may be provided in a metal material having a high conductivity to smoothly and efficiently output a power signal transformed by the at least one secondary winding (3310).

At this time, the metal thin film pattern layer (LP61) having an inductance component may be formed by at least one engineering method of a photo-lithography method using a photo mask and an etching solution, or an injection molding method using a press. The at least one secondary winding (3310) may be provided in at least one of a circular shape, an oval shape and a polygon shape.

The first insulation unit (3308) is provided to a bottom surface of the at least one secondary winding (3310) and coupled to the first fastening unit (3302*a*) to insulate the at least one secondary winding (3310). At this time, the first insulation unit (3308) may be provided as an insulation sheet, and may be provided in at least one of a circular shape, an oval shape and a polygon shape.

The at least one primary winding (3306) is provided to a bottom surface of the first insulation unit (3308), coupled to the first fastening unit (3302*a*) and insulated by the first insulation unit (3308) to supply a power signal.

At this time, the at least one primary winding (3306) may include a metal thin film pattern layer (LP62) having an inductance component. The metal thin film pattern layer (LP62) having an inductance component may be provided in a metal material having a high conductivity to smoothly and efficiently output a power signal supplied by a power signal supply unit (3314, described later).

At this time, the metal thin film pattern layer (LP62) having an inductance component may be formed by at least one engineering method of a photo-lithography method using a photo mask and an etching solution, or an injection molding method using a press. The at least one primary winding (3306) may be provided in at least one of a circular shape, an oval shape and a polygon shape.

The second insulation unit (3312) is provided to a bottom surface of the at least one primary winding (3306), and coupled to the first fastening unit (3302*a*) to insulate the at least one primary winding (3306). At this time, the second insulation unit (3312) may be provided in an insulation sheet, and may be provided in at least one of a circular shape, an oval shape and a polygon shape.

The at least another secondary winding (3313) is provided between the core (3302) and the bobbin (3304), and provided to an upper surface of the bobbin (3304) to be coupled to the first fastening unit (3302*a*) for transformation of a power signal.

At this time, the at least another secondary winding (3313) may include a metal thin film pattern layer (LP63) having an inductance component. The metal thin film pattern layer (LP63) having an inductance component may be provided in a metal material having a high conductivity to smoothly and efficiently output a power signal transformed by the at least another secondary winding (3313).

At this time, the metal thin film pattern layer (LP63) having an inductance component may be formed by at least one engineering method of a photo-lithography method using a photo mask and an etching solution, or an injection molding method using a press. The at least another secondary winding (3313) may be provided in at least one of a circular shape, an oval shape and a polygon shape.

The third insulation unit (3315) is provided to an upper surface of the at least another secondary winding (3313), and coupled to the first fastening unit (3302*a*) to insulate the at least another secondary winding (3313). The third insulation unit (3315) may be provided as an insulation sheet, and may be provided in at least one of a circular shape, an oval shape and a polygon shape.

A power signal supply unit (3314) may be coupled to one side of the bobbin (3304) to be electrically connected to the at least one primary winding (3306), whereby a power signal can be supplied to the at least one primary winding (3306). At this time, the power signal supply unit (3314) may be electrically connected to a distal end of one side of the bobbin (3304) and a distal end of the at least one primary winding (3306).

The power signal supply unit (3314) may be provided in a metal material having a high conductivity to supply a power signal to the at least one primary winding (3306) smoothly and efficiently. At this time, the power signal supply unit (3314) may be provided as a terminal lug.

A power signal output unit (3316) may be coupled to the other side of the bobbin (3304) to be electrically connected to the at least one secondary winding (3310), whereby a power signal transformed by the at least one secondary winding (3310) can be outputted. At this time, the power signal output unit (3316) may be electrically connected to a distal end of the other side of the bobbin (3304) and a distal end of the at least one secondary winding (3310).

Furthermore, the power signal output unit (3316) may be coupled to a still other side of the bobbin (3304) to be electrically connected to the at least another secondary winding (3313), whereby a power signal transformed by the at least another secondary winding (3313) can be outputted.

At this time, the power signal output unit (3316) may be electrically connected to a distal end of still other side of the bobbin (3304) and a distal end of the at least another secondary winding (3313).

Additionally, the power signal output unit (3316) may be provided in a metal material having a high conductivity to output a power signal transformed by the at least one secondary winding (3310) or the at least another secondary winding (3313) smoothly and efficiently. The power signal output unit (3316) may be provided as a terminal lug.

As apparent from the foregoing, the planar transformer (3300) according to the seventeenth exemplary embodiment of the present invention includes the core (3302), the bobbin (3304), the at least one primary winding (3306), the first insulation unit (3308), the at least one secondary winding (3310), the second insulation unit (3312), the at least another secondary winding (3313) and the third insulation unit (3315).

Therefore, a planar transformer (3300) can be manufactured in a slim size using the technical feature of the planar transformer (3300) according to the seventeenth exemplary embodiment of the present invention, such that a power supply unit (not shown) that is manufactured along with the planar transformer (3300) can be manufactured in a slim size. Furthermore, the planar transformer (3300) according to the seventeenth exemplary embodiment of the present invention can reduce the manufacturing cost of the planar transformer (3300) to enhance the efficiency of transformation.

Eighteenth Exemplary Embodiment

Figure 35:
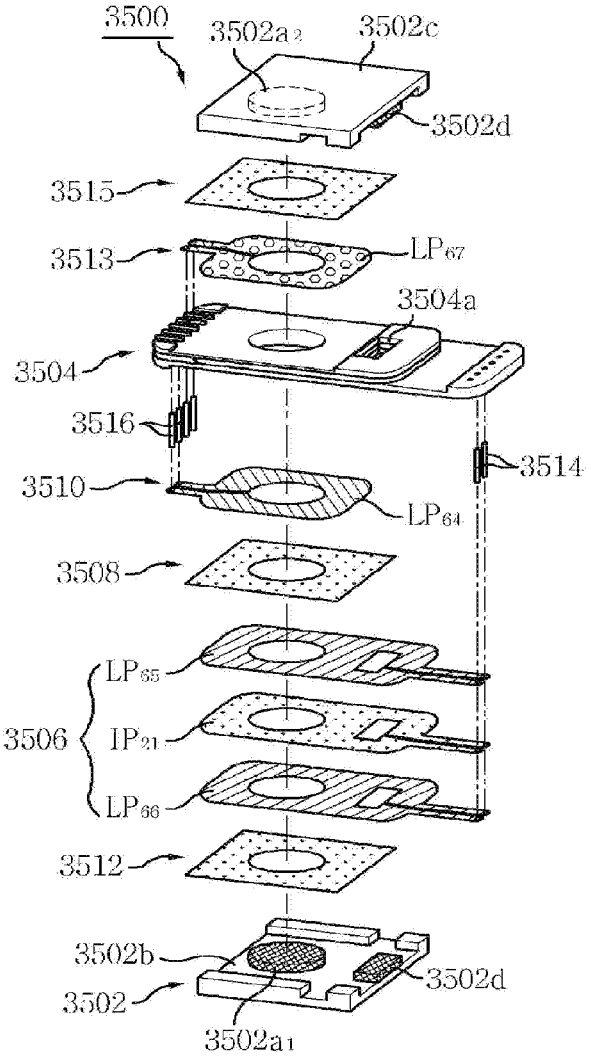
FIG. 35 is an exploded perspective view illustrating a planar transformer according to an eighteenth exemplary embodiment of the present invention.
Figure 36:
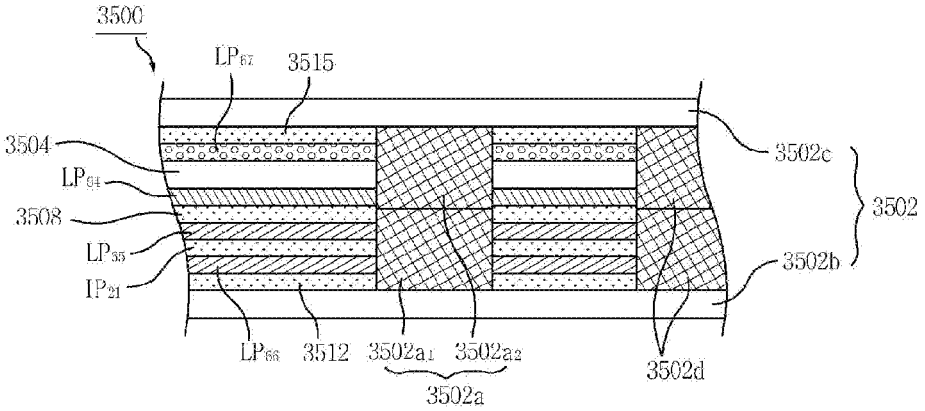
FIG. 36 is a coupled cross-sectional view illustrating a planar transformer according to an eighteenth exemplary embodiment of the present invention.

FIG. 35 is an exploded perspective view illustrating a planar transformer according to an eighteenth exemplary embodiment of the present invention, and FIG. 36 is a coupled cross-sectional view illustrating a planar transformer according to an eighteenth exemplary embodiment of the present invention.

First, referring to FIGS. 35 and 36, a planar transformer (3500) according to the eighteenth exemplary embodiment of the present invention includes a core (3502), a bobbin (3504), at least one primary winding (3506), a first insulation unit (3508), at least one secondary winding (3510), a second insulation unit (3512), at least another secondary winding (3513) and a third insulation unit (3515).

The core (3502) includes a first fastening unit (3502*a*) and is provided to induce formation of a magnetic field, where the core (3502) may include a bottom core (3502*b*) and an upper core (3502*c*). The bobbin (3504) is so provided as to be coupled to the core (3502) by the first fastening unit (3502*a*). The first fastening unit (3502*a*) may include first fastening lugs (3502*a*1, 3502*a*2).

The bobbin (3504) may include a second fastening unit (3504*a*) discrete from the first fastening unit (3502*a*), and the core (3502) may include a third fastening unit (3502*d*) to be coupled to the second fastening unit (3504*a*). At this time, the second fastening unit (3504*a*) may be provided as a second fastening hole (3504*a*), and the third fastening unit (3502*d*) may be provided to the bottom core (3502*b*) and the upper core (3502*c*), and may be provided as a third fastening lug (3502*d*) to be coupled to the second fastening hole (3504*a*).

The at least one secondary winding (3510) is provided between the core (3502) and the bobbin (3504), and provided at a bottom surface of the bobbin (3504) to be coupled to the first fastening unit (3502*a*) for supply of a power signal.

At this time, the at least one secondary winding (3510) may include a metal thin film pattern layer (LP64) having an inductance component. The metal thin film pattern layer (LP64) having an inductance component may be provided in a metal material having a high conductivity to smoothly and efficiently output a power signal transformed by the at least one secondary winding (3510).

At this time, metal thin film pattern layer (LP64) having an inductance component may be formed by at least one engineering method of a photo-lithography method using a photo mask and an etching solution, or an injection molding method using a press. The at least one secondary winding (3510) may be provided in at least one of a circular shape, an oval shape and a polygon shape.

The first insulation unit (3508) is provided to a bottom surface of the at least one secondary winding (3510) and coupled to the first fastening unit (3502*a*) to insulate the at least one secondary winding (3510). At this time, the first insulation unit (3508) may be provided as an insulation sheet, and may be provided in at least one of a circular shape, an oval shape and a polygon shape.

The at least one primary winding (3506) is provided to a bottom surface of the first insulation unit (3508), coupled to the first fastening unit (3502*a*) and insulated by the first insulation unit (3508) to supply a power signal.

At this time, the at least one primary winding (3506) may include metal thin film pattern layers (LP65, LP66) having at least two or more inductance components, and at least one primary insulation layer (IP21) provided between the metal thin film pattern layers (LP65, LP66) having at least two or more inductance components to insulate the metal thin film pattern layers (LP65, LP66) having at least two or more inductance components.

The metal thin film pattern layers (LP65, LP66) having at least two or more inductance components may be provided in a metal material having a high conductivity to smoothly and efficiently supply a power signal supplied by a power signal supply unit (3514, described later).

At this time, the metal thin film pattern layers (LP65, LP66) having at least two or more inductance components may be formed by at least one engineering method of a photo-lithography method using a photo mask and an etching solution, or an injection molding method using a press. The at least one primary winding (3506) may be provided in at least one of a circular shape, an oval shape and a polygon shape.

The second insulation unit (3512) is provided to a bottom surface of the at least one primary winding (3506), and coupled to the first fastening unit (3502*a*) to insulate the at least one primary winding (3506). At this time, the second insulation unit (3512) may be provided in an insulation sheet, and may be provided in at least one of a circular shape, an oval shape and a polygon shape.

The at least another secondary winding (3513) is provided between the core (3502) and the bobbin (3504), and provided to an upper surface of the bobbin (3504) to be coupled to the first fastening unit (3502*a*) for transformation of a power signal.

At this time, the at least another secondary winding (3513) may include a metal thin film pattern layer (LP67) having an inductance component. The metal thin film pattern layer (LP67) having an inductance component may be provided in a metal material having a high conductivity to smoothly and efficiently output a power signal transformed by the at least another secondary winding (3513).

At this time, the metal thin film pattern layer (LP67) having an inductance component may be formed by at least one engineering method of a photo-lithography method using a photo mask and an etching solution, or an injection molding method using a press. The at least another secondary winding (3513) may be provided in at least one of a circular shape, an oval shape and a polygon shape.

The third insulation unit (3515) is provided to an upper surface of the at least another secondary winding (3513), and coupled to the first fastening unit (3502*a*) to insulate the at least another secondary winding (3513). The third insulation unit (3515) may be provided as an insulation sheet, and may be provided in at least one of a circular shape, an oval shape and a polygon shape.

A power signal supply unit (3514) may be coupled to one side of the bobbin (3504) to be electrically connected to the at least one primary winding (3506), whereby a power signal can be supplied to the at least one primary winding (3506). At this time, the power signal supply unit (3514) may be electrically connected to a distal end of one side of the bobbin (3504) and a distal end of the at least one primary winding (3506).

The power signal supply unit (3514) may be provided in a metal material having a high conductivity to supply a power signal to the at least one primary winding (3506) smoothly and efficiently. At this time, the power signal supply unit (3514) may be provided as a terminal lug.

A power signal output unit (3516) may be coupled to the other side of the bobbin (3504) to be electrically connected to the at least one secondary winding (3510), whereby a power signal transformed by the at least one secondary winding (3510) can be outputted. At this time, the power signal output unit (3516) may be electrically connected to a distal end of the other side of the bobbin (3504) and a distal end of the at least one secondary winding (3510).

Furthermore, the power signal output unit (3516) may be coupled to a still other side of the bobbin (3504) to be electrically connected to the at least another secondary winding (3513), whereby a power signal transformed by the at least another secondary winding (3513) can be supplied.

At this time, the power signal output unit (3516) may be electrically connected to a distal end of still other side of the bobbin (3504) and a distal end of the at least another secondary winding (3513).

Additionally, the power signal output unit (3516) may be provided in a metal material having a high conductivity to output a power signal transformed by the at least one secondary winding (3510) or the at least another secondary winding (3513) smoothly and efficiently. The power signal output unit (3516) may be provided as a terminal lug.

As apparent from the foregoing, the planar transformer (3500) according to the eighteenth exemplary embodiment of the present invention includes the core (3502), the bobbin (3504), the at least one primary winding (3506), the first insulation unit (3508), the at least one secondary winding (3510), the second insulation unit (3512), the at least another secondary winding (3513) and the third insulation unit (3515).

Therefore, a planar transformer (3500) can be manufactured in a slim size using the technical feature of the planar transformer (3500) according to the eighteenth exemplary embodiment of the present invention, such that a power supply unit (not shown) that is manufactured along with the planar transformer (3500) can be manufactured in a slim size. Furthermore, the planar transformer (3500) according to the eighteenth exemplary embodiment of the present invention can reduce the manufacturing cost of the planar transformer (3500) to enhance the efficiency of transformation.

Nineteenth Exemplary Embodiment

Figure 37:
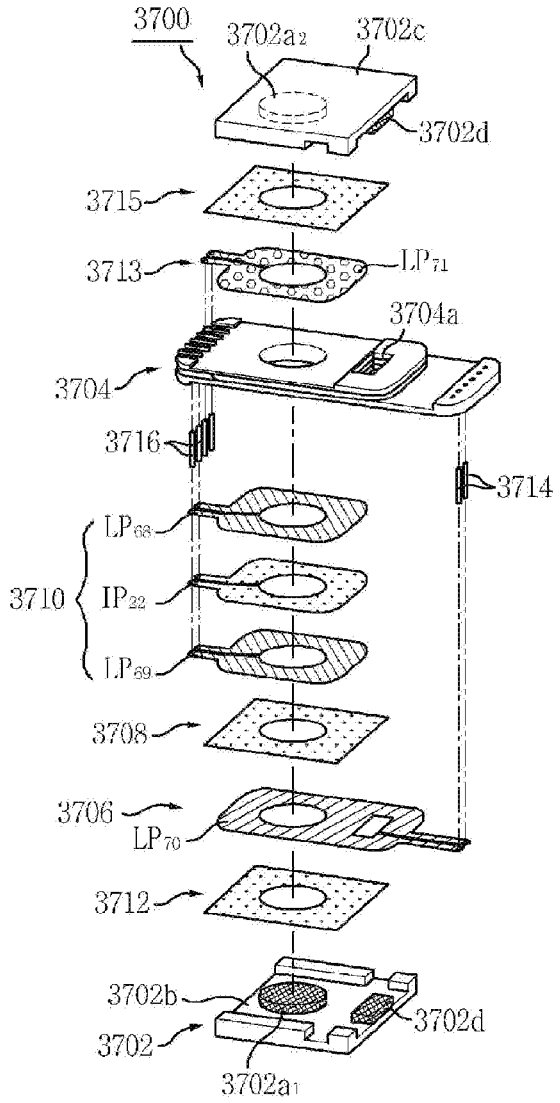
FIG. 37 is an exploded perspective view illustrating a planar transformer according to a nineteenth exemplary embodiment of the present invention.
Figure 38:
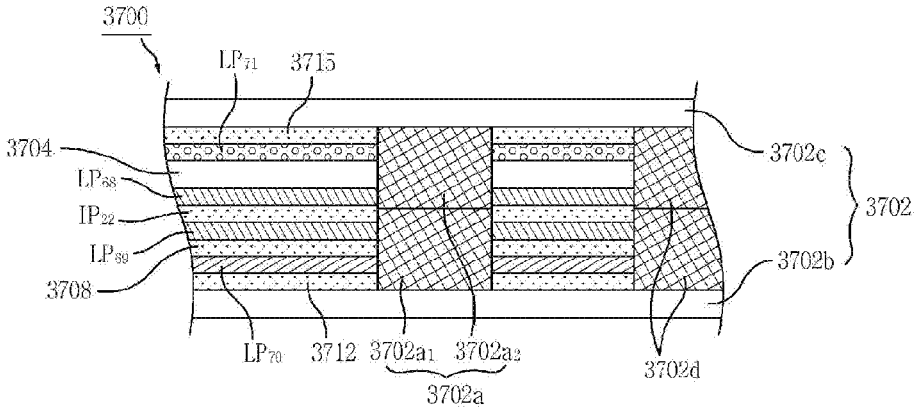
FIG. 38 is a coupled cross-sectional view illustrating a planar transformer according to a nineteenth exemplary embodiment of the present invention.

FIG. 37 is an exploded perspective view illustrating a planar transformer according to a nineteenth exemplary embodiment of the present invention, and FIG. 38 is a coupled cross-sectional view illustrating a planar transformer according to a nineteenth exemplary embodiment of the present invention.

First, referring to FIGS. 37 and 38, a planar transformer (3700) according to the nineteenth exemplary embodiment of the present invention includes a core (3702), a bobbin (3704), at least one primary winding (3706), a first insulation unit (3708), at least one secondary winding (3710), a second insulation unit (3712), at least another secondary winding (3713) and a third insulation unit (3715).

The core (3702) includes a first fastening unit (3702*a*) and is provided to induce formation of a magnetic field, where the core (3702) may include a bottom core (3702*b*) and an upper core (3702*c*). The bobbin (3704) is so provided as to be coupled to the core (3702) by the first fastening unit (3702*a*). The first fastening unit (3702*a*) may include first fastening lugs (3702*a*1, 3702*a*2).

The bobbin (3704) may include a second fastening unit (3704*a*) discrete from the first fastening unit (3702*a*), and the core (3702) may include a third fastening unit (3702*d*) to be coupled to the second fastening unit (3704*a*). At this time, the second fastening unit (3704*a*) may be provided as a second fastening hole (3704*a*), and the third fastening unit (3702*d*) may be provided to the bottom core (3702*b*) and the upper core (3702*c*), and may be provided as a third fastening lug (3702*d*) to be coupled to the second fastening hole (3704*a*).

The at least one secondary winding (3710) is provided between the core (3702) and the bobbin (3704), and provided at a bottom surface of the bobbin (3704) to be coupled to the first fastening unit (3702*a*) for supply of a transformed power signal.

At this time, the at least one secondary winding (3710) may include metal thin film pattern layers (LP68, LP69) having at least two or more inductance components, and at least one secondary insulation layer (IP22) provided between the metal thin film pattern layers (LP68, LP69) having at least two or more inductance components to insulate the metal thin film pattern layers (LP68, LP69) having at least two or more inductance components.

Furthermore, the metal thin film pattern layers (LP68, LP69) having at least two or more inductance components may be provided in a metal material having a high conductivity to smoothly and efficiently output a power signal transformed by the at least one secondary winding (3710).

At this time, the metal thin film pattern layers (LP68, LP69) having at least two or more inductance components may be formed by at least one engineering method of a photo-lithography method using a photo mask and an etching solution, or an injection molding method using a press. The at least one secondary winding (3710) may be provided in at least one of a circular shape, an oval shape and a polygon shape.

The first insulation unit (3708) is provided to a bottom surface of the at least one secondary winding (3710) and coupled to the first fastening unit (3702*a*) to insulate the at least one secondary winding (3710). At this time, the first insulation unit (3708) may be provided as an insulation sheet, and may be provided in at least one of a circular shape, an oval shape and a polygon shape.

The at least one primary winding (3706) is provided to a bottom surface of the first insulation unit (3708), coupled to the first fastening unit (3702*a*) and insulated by the first insulation unit (3708) to supply a power signal.

At this time, the at least one primary winding (3706) may include a metal thin film pattern layer (LP70) having an inductance component. The metal thin film pattern layer (LP70) having an inductance component may be provided in a metal material having a high conductivity to smoothly and efficiently supply a power signal supplied by a power signal supply unit (3714, described later).

At this time, the metal thin film pattern layer (LP70) having an inductance component may be formed by at least one engineering method of a photo-lithography method using a photo mask and an etching solution, or an injection molding method using a press. The at least one primary winding (3706) may be provided in at least one of a circular shape, an oval shape and a polygon shape.

The second insulation unit (3712) is provided to a bottom surface of the at least one primary winding (3706), and coupled to the first fastening unit (3702*a*) to insulate the at least one primary winding (3706). At this time, the second insulation unit (3712) may be provided as an insulation sheet, and may be provided in at least one of a circular shape, an oval shape and a polygon shape.

The at least another secondary winding (3713) is provided between the core (3702) and the bobbin (3704), and provided to an upper surface of the bobbin (3704) to be coupled to the first fastening unit (3702*a*) for transformation of a power signal.

At this time, the at least another secondary winding (3713) may include a metal thin film pattern layer (LP71) having an inductance component. The metal thin film pattern layer (LP71) having an inductance component may be provided in a metal material having a high conductivity to smoothly and efficiently output a power signal transformed by the at least another secondary winding (3713).

At this time, the metal thin film pattern layer (LP71) having an inductance component may be formed by at least one engineering method of a photo-lithography method using a photo mask and an etching solution, or an injection molding method using a press. The at least another secondary winding (3713) may be provided in at least one of a circular shape, an oval shape and a polygon shape.

The third insulation unit (3715) is provided to an upper surface of the at least another secondary winding (3713), and coupled to the first fastening unit (3702*a*) to insulate the at least another secondary winding (3713). The third insulation unit (3715) may be provided as an insulation sheet, and may be provided in at least one of a circular shape, an oval shape and a polygon shape.

A power signal supply unit (3714) may be coupled to one side of the bobbin (3704) to be electrically connected to the at least one primary winding (3706), whereby a power signal can be supplied to the at least one primary winding (3706). At this time, the power signal supply unit (3714) may be electrically connected to a distal end of one side of the bobbin (3704) and a distal end of the at least one primary winding (3706).

The power signal supply unit (3714) may be provided in a metal material having a high conductivity to supply a power signal to the at least one primary winding (3706) smoothly and efficiently. At this time, the power signal supply unit (3714) may be provided as a terminal lug.

A power signal output unit (3716) may be coupled to the other side of the bobbin (3704) to be electrically connected to the at least one secondary winding (3710), whereby a power signal transformed by the at least one secondary winding (3710) can be outputted. At this time, the power signal output unit (3716) may be electrically connected to a distal end of the other side of the bobbin (3704) and a distal end of the at least one secondary winding (3710).

Furthermore, the power signal output unit (3716) may be coupled to a still other side of the bobbin (3704) to be electrically connected to the at least another secondary winding (3713), whereby a power signal transformed by the at least another secondary winding (3713) can be outputted.

At this time, the power signal output unit (3716) may be electrically connected to a distal end of still other side of the bobbin (3704) and a distal end of the at least another secondary winding (3713).

Additionally, the power signal output unit (3716) may be provided in a metal material having a high conductivity to output a power signal transformed by the at least one secondary winding (3710) or the at least another secondary winding (3713) smoothly and efficiently. The power signal output unit (3716) may be provided as a terminal lug.

As apparent from the foregoing, the planar transformer (3700) according to the nineteenth exemplary embodiment of the present invention includes the core (3702), the bobbin (3704), the at least one primary winding (3706), the first insulation unit (3708), the at least one secondary winding (3710), the second insulation unit (3712), the at least another secondary winding (3713) and the third insulation unit (3715).

Therefore, a planar transformer (3700) can be manufactured in a slim size using the technical feature of the planar transformer (3300) according to the nineteenth exemplary embodiment of the present invention, such that a power supply unit (not shown) that is manufactured along with the planar transformer (3700) can be manufactured in a slim size. Furthermore, the planar transformer (3700) according to the nineteenth exemplary embodiment of the present invention can reduce the manufacturing cost of the planar transformer (3700) to enhance the efficiency of transformation.

Twentieth Exemplary Embodiment

Figure 39:
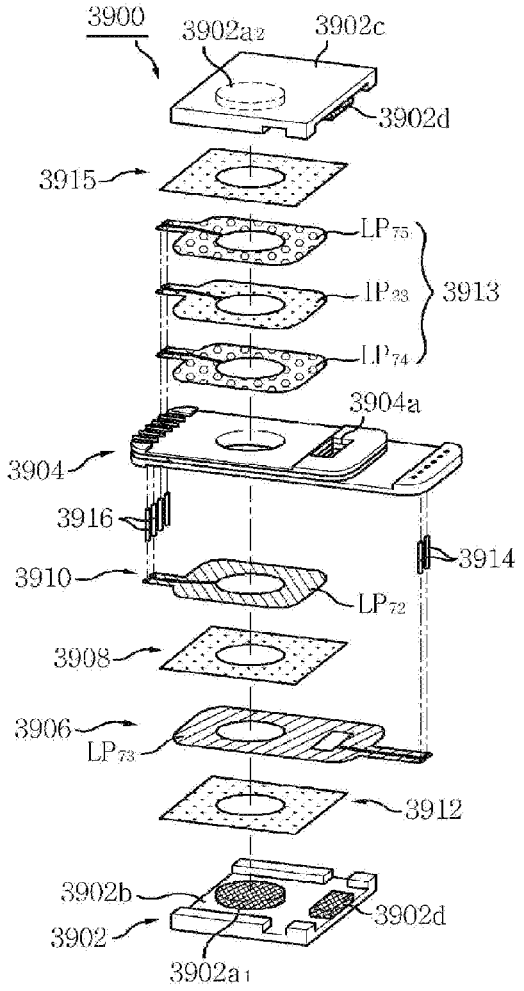
FIG. 39 is an exploded perspective view illustrating a planar transformer according to a twentieth exemplary embodiment of the present invention.
Figure 40:
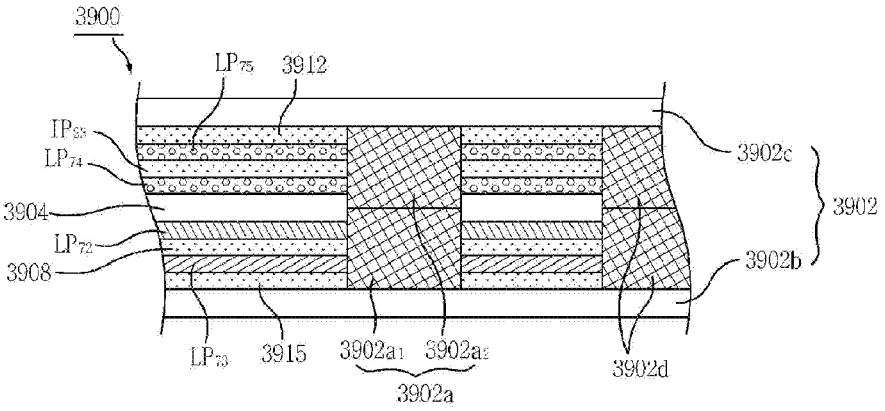
FIG. 40 is a coupled cross-sectional view illustrating a planar transformer according to a twentieth exemplary embodiment of the present invention.

FIG. 39 is an exploded perspective view illustrating a planar transformer according to a twentieth exemplary embodiment of the present invention, and FIG. 40 is a coupled cross-sectional view illustrating a planar transformer according to a twentieth exemplary embodiment of the present invention.

First, referring to FIGS. 39 and 40, a planar transformer (3900) according to the twentieth exemplary embodiment of the present invention includes a core (3902), a bobbin (3904), at least one primary winding (3906), a first insulation unit (3908), at least one secondary winding (3910), a second insulation unit (3912), at least another secondary winding (3913) and a third insulation unit (3915).

The core (3902) includes a first fastening unit (3902*a*) and is provided to induce formation of a magnetic field, where the core (3902) may include a bottom core (3902*b*) and an upper core (3902*c*). The bobbin (3904) is so provided as to be coupled to the core (3902) by the first fastening unit (3902*a*). The first fastening unit (3902*a*) may include first fastening lugs (3902*a*1, 3902*a*2).

The bobbin (3904) may include a second fastening unit (3904*a*) discrete from the first fastening unit (3902*a*), and the core (3902) may include a third fastening unit (3902*d*) to be coupled to the second fastening unit (3904*a*). At this time, the second fastening unit (3904*a*) may be provided as a second fastening hole (3904*a*), and the third fastening unit (3902*d*) may be provided to the bottom core (3902*b*) and the upper core (3902*c*), and may be provided as a third fastening lug (3902*d*) to be coupled to the second fastening hole (3904*a*).

The at least one secondary winding (3910) is provided between the core (3902) and the bobbin (3904), and provided at a bottom surface of the bobbin (3904) to be coupled to the first fastening unit (3902*a*) for supply of a transformed power signal.

At this time, the at least one secondary winding (3910) may include a metal thin film pattern layer (LP72) having an inductance component. The metal thin film pattern layer (LP72) having an inductance component may be provided in a metal material having a high conductivity to smoothly and efficiently output a power signal transformed by the at least one secondary winding (3910).

At this time, the metal thin film pattern layer (LP72) having an inductance component may be formed by at least one engineering method of a photo-lithography method using a photo mask and an etching solution, or an injection molding method using a press. The at least one secondary winding (3910) may be provided in at least one of a circular shape, an oval shape and a polygon shape.

The first insulation unit (3908) is provided to a bottom surface of the at least one secondary winding (3910) and coupled to the first fastening unit (3902*a*) to insulate the at least one secondary winding (3910). At this time, the first insulation unit (3908) may be provided as an insulation sheet, and may be provided in at least one of a circular shape, an oval shape and a polygon shape.

The at least one primary winding (3906) is provided to a bottom surface of the first insulation unit (3908), coupled to the first fastening unit (3902*a*) and insulated by the first insulation unit (3908) to supply a power signal.

At this time, the at least one primary winding (3906) may include a metal thin film pattern layer (LP73) having an inductance component. The metal thin film pattern layer (LP73) having an inductance component may be provided in a metal material having a high conductivity to smoothly and efficiently supply a power signal supplied by a power signal supply unit (3914, described later).

At this time, the metal thin film pattern layer (LP73) having an inductance component may be formed by at least one engineering method of a photo-lithography method using a photo mask and an etching solution, or an injection molding method using a press. The at least one primary winding (3906) may be provided in at least one of a circular shape, an oval shape and a polygon shape.

The second insulation unit (3912) is provided to a bottom surface of the at least one primary winding (3906), and coupled to the first fastening unit (3902*a*) to insulate the at least one primary winding (3906). At this time, the second insulation unit (3912) may be provided as an insulation sheet, and may be provided in at least one of a circular shape, an oval shape and a polygon shape.

The at least another secondary winding (3913) is provided between the core (3902) and the bobbin (3904), and provided to an upper surface of the bobbin (3904) to be coupled to the first fastening unit (3902*a*) for transformation of a power signal.

At this time, the at least another secondary winding (3913) may include metal thin film pattern layers (LP74, LP75) having at least two or more inductance components, and at least another secondary insulation layer (IP23) provided between the metal thin film pattern layers (LP74, LP75) having at least two or more inductance components to insulate the metal thin film pattern layers (LP74, LP75) having at least two or more inductance components.

The metal thin film pattern layers (LP74, LP75) having at least two or more inductance components may be provided in a metal material having a high conductivity to smoothly and efficiently output a power signal transformed by the at least another secondary winding (3913).

At this time, the metal thin film pattern layers (LP74, LP75) having at least two or more inductance components may be formed by at least one engineering method of a photo-lithography method using a photo mask and an etching solution, or an injection molding method using a press. The at least another secondary winding (3913) may be provided in at least one of a circular shape, an oval shape and a polygon shape.

The third insulation unit (3915) is provided to an upper surface of the at least another secondary winding (3913), and coupled to the first fastening unit (3902*a*) to insulate the at least another secondary winding (3913). The third insulation unit (3915) may be provided as an insulation sheet, and may be provided in at least one of a circular shape, an oval shape and a polygon shape.

A power signal supply unit (3914) may be coupled to one side of the bobbin (3904) to be electrically connected to the at least one primary winding (3906), whereby a power signal can be supplied to the at least one primary winding (3906). At this time, the power signal supply unit (3914) may be electrically connected to a distal end of one side of the bobbin (3904) and a distal end of the at least one primary winding (3906).

The power signal supply unit (3914) may be provided in a metal material having a high conductivity to supply a power signal to the at least one primary winding (3906) smoothly and efficiently. At this time, the power signal supply unit (3914) may be provided as a terminal lug.

A power signal output unit (3916) may be coupled to the other side of the bobbin (3904) to be electrically connected to the at least one secondary winding (3910), whereby a power signal transformed by the at least one secondary winding (3910) can be outputted. At this time, the power signal output unit (3916) may be electrically connected to a distal end of the other side of the bobbin (3904) and a distal end of the at least one secondary winding (3910).

Furthermore, the power signal output unit (3916) may be coupled to a still other side of the bobbin (3904) to be electrically connected to the at least another secondary winding (3913), whereby a power signal transformed by the at least another secondary winding (3913) can be outputted.

At this time, the power signal output unit (3916) may be electrically connected to a distal end of still other side of the bobbin (3904) and a distal end of the at least another secondary winding (3913).

Additionally, the power signal output unit (3916) may be provided in a metal material having a high conductivity to output a power signal transformed by the at least one secondary winding (3910) or the at least another secondary winding (3913) smoothly and efficiently. The power signal output unit (3916) may be provided as a terminal lug.

As apparent from the foregoing, the planar transformer (3900) according to the twentieth exemplary embodiment of the present invention includes the core (3902), the bobbin (3904), the at least one primary winding (3906), the first insulation unit (3908), the at least one secondary winding (3910), the second insulation unit (3912), the at least another secondary winding (3913) and the third insulation unit (3915).

Therefore, a planar transformer (3900) can be manufactured in a slim size using the technical feature of the planar transformer (3900) according to the twentieth exemplary embodiment of the present invention, such that a power supply unit (not shown) that is manufactured along with the planar transformer (3900) can be manufactured in a slim size. Furthermore, the planar transformer (3900) according to the twentieth exemplary embodiment of the present invention can reduce the manufacturing cost of the planar transformer (3900) to enhance the efficiency of transformation.

Twenty First Exemplary Embodiment

Figure 41:
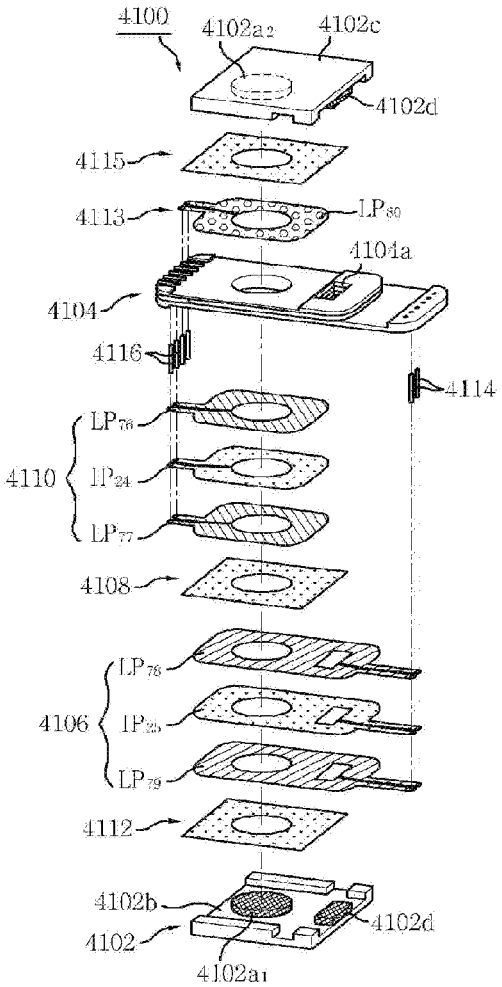
FIG. 41 is an exploded perspective view illustrating a planar transformer according to a twenty first exemplary embodiment of the present invention.
Figure 42:
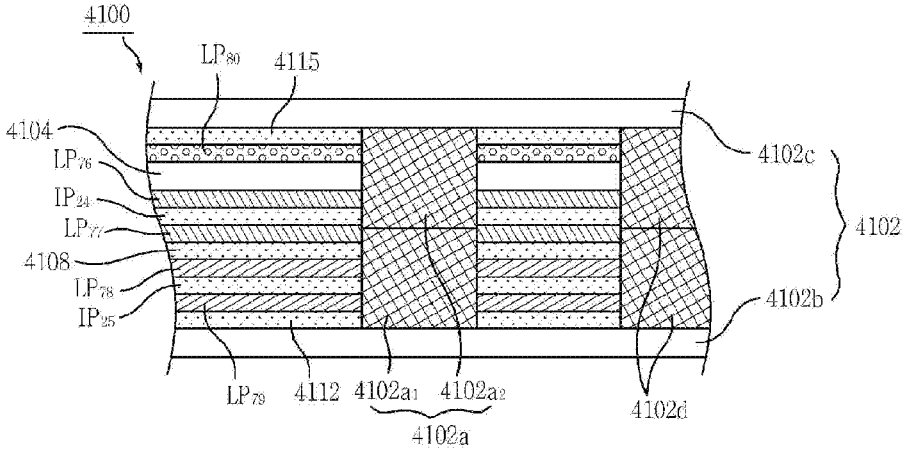
FIG. 42 is a coupled cross-sectional view illustrating a planar transformer according to a twenty first exemplary embodiment of the present invention.

FIG. 41 is an exploded perspective view illustrating a planar transformer according to a twenty first exemplary embodiment of the present invention, and FIG. 42 is a coupled cross-sectional view illustrating a planar transformer according to a twenty first exemplary embodiment of the present invention.

First, referring to FIGS. 41 and 42, a planar transformer (4100) according to the twenty first exemplary embodiment of the present invention includes a core (4102), a bobbin (4104), at least one primary winding (4106), a first insulation unit (4108), at least one secondary winding (4110), a second insulation unit (4112), at least another secondary winding (4113) and a third insulation unit (4115).

The core (4102) includes a first fastening unit (4102*a*) and is provided to induce formation of a magnetic field, where the core (4102) may include a bottom core (4102*b*) and an upper core (4102*c*). The bobbin (4104) is so provided as to be coupled to the core (4102) by the first fastening unit (4102*a*). The first fastening unit (4102*a*) may include first fastening lugs (4102*a*1, 4102*a*2).

The bobbin (4104) may include a second fastening unit (4104*a*) discrete from the first fastening unit (4102*a*), and the core (4102) may include a third fastening unit (4102*d*) to be coupled to the second fastening unit (4104*a*). At this time, the second fastening unit (4104*a*) may be provided as a second fastening hole (4104*a*), and the third fastening unit (4102*d*) may be provided to the bottom core (4102*b*) and the upper core (4102*c*), and may be provided as a third fastening lug (4102*d*) to be coupled to the second fastening hole (4104*a*).

The at least one secondary winding (4110) is provided between the core (4102) and the bobbin (4104), and provided at a bottom surface of the bobbin (4104) to be coupled to the first fastening unit (4102*a*) for supply of a transformed power signal.

At this time, the at least one secondary winding (4110) may include metal thin film pattern layers (LP76, LP77) having at least two or more inductance components, and at least one secondary insulation unit (IP24) provided between the metal thin film pattern layers (LP76, LP77) having at least two or more inductance components to insulate the metal thin film pattern layers (LP76, LP77) having at least two or more inductance components.

The metal thin film pattern layers (LP76, LP77) having at least two or more inductance components may be provided in a metal material having a high conductivity to smoothly and efficiently output a power signal transformed by the at least one secondary winding (4110).

At this time, the metal thin film pattern layers (LP76, LP77) having at least two or more inductance components may be formed by at least one engineering method of a photo-lithography method using a photo mask and an etching solution, or an injection molding method using a press. The at least one secondary winding (4110) may be provided in at least one of a circular shape, an oval shape and a polygon shape.

The first insulation unit (4108) is provided to a bottom surface of the at least one secondary winding (4110) and coupled to the first fastening unit (4102*a*) to insulate the at least one secondary winding (4110). At this time, the first insulation unit (4108) may be provided as an insulation sheet, and may be provided in at least one of a circular shape, an oval shape and a polygon shape.

The at least one primary winding (4106) is provided to a bottom surface of the first insulation unit (4108), coupled to the first fastening unit (4102*a*) and insulated by the first insulation unit (4108) to supply a power signal.

At this time, the at least one primary winding (4106) may include metal thin film pattern layers (LP78, LP79) having at least two or more inductance components, and at one primary insulation unit (IP25) provided between the metal thin film pattern layers (LP78, LP79) having at least two or more inductance components to insulate the metal thin film pattern layers (LP78, LP79) having at least two or more inductance components.

At this time, the metal thin film pattern layers (LP78, LP79) having at least two or more inductance components may be provided in a metal material having a high conductivity to smoothly and efficiently supply a power signal supplied by a power signal supply unit (4114, described later).

At this time, the metal thin film pattern layers (LP78, LP79) having at least two or more inductance components may be formed by at least one engineering method of a photo-lithography method using a photo mask and an etching solution, or an injection molding method using a press. The at least one primary winding (4106) may be provided in at least one of a circular shape, an oval shape and a polygon shape.

The second insulation unit (4112) is provided to a bottom surface of the at least one primary winding (4106), and coupled to the first fastening unit (4102*a*) to insulate the at least one primary winding (4106). At this time, the second insulation unit (4112) may be provided as an insulation sheet, and may be provided in at least one of a circular shape, an oval shape and a polygon shape.

The at least another secondary winding (4113) is provided between the core (4102) and the bobbin (4104), and provided to an upper surface of the bobbin (4104) to be coupled to the first fastening unit (4102*a*) for transformation of a power signal.

At this time, the at least another secondary winding (4113) may include a metal thin film pattern layer (LP80) having an inductance component. The metal thin film pattern layer (LP80) having an inductance component may be provided in a metal material having a high conductivity to smoothly and efficiently output a power signal transformed by the at least another secondary winding (4113).

At this time, the metal thin film pattern layer (LP80) having an inductance component may be formed by at least one engineering method of a photo-lithography method using a photo mask and an etching solution, or an injection molding method using a press. The at least another secondary winding (4113) may be provided in at least one of a circular shape, an oval shape and a polygon shape.

The third insulation unit (4115) is provided to an upper surface of the at least another secondary winding (4113), and coupled to the first fastening unit (4102*a*) to insulate the at least another secondary winding (4113). The third insulation unit (4115) may be provided as an insulation sheet, and may be provided in at least one of a circular shape, an oval shape and a polygon shape.

A power signal supply unit (4114) may be coupled to one side of the bobbin (4104) to be electrically connected to the at least one primary winding (4106), whereby a power signal can be supplied to the at least one primary winding (4106). At this time, the power signal supply unit (4114) may be electrically connected to a distal end of one side of the bobbin (4104) and a distal end of the at least one primary winding (4106).

The power signal supply unit (4114) may be provided in a metal material having a high conductivity to supply a power signal to the at least one primary winding (4106) smoothly and efficiently. At this time, the power signal supply unit (4114) may be provided as a terminal lug.

A power signal output unit (4116) may be coupled to the other side of the bobbin (4104) to be electrically connected to the at least one secondary winding (4110), whereby a power signal transformed by the at least one secondary winding (4110) can be outputted. At this time, the power signal output unit (4116) may be electrically connected to a distal end of the other side of the bobbin (4104) and a distal end of the at least one secondary winding (4110).

Furthermore, the power signal output unit (4116) may be coupled to the still other side of the bobbin (4104) to be electrically connected to the at least another secondary winding (4113), whereby a power signal transformed by the at least another secondary winding (4113) can be outputted.

At this time, the power signal output unit (4116) may be electrically connected to a distal end of still other side of the bobbin (4104) and a distal end of the at least another secondary winding (4113).

Additionally, the power signal output unit (4116) may be provided in a metal material having a high conductivity to smoothly and efficiently output a power signal transformed by the at least one secondary winding (4110) or the at least another secondary winding (4113). The power signal output unit (4116) may be provided as a terminal lug.

As apparent from the foregoing, the planar transformer (4100) according to the twenty first exemplary embodiment of the present invention includes the core (4102), the bobbin (4104), the at least one primary winding (4106), the first insulation unit (4108), the at least one secondary winding (4110), the second insulation unit (4112), the at least another secondary winding (4113) and the third insulation unit (4115).

Therefore, a planar transformer (4100) can be manufactured in a slim size using the technical feature of the planar transformer (4100) according to the twenty first exemplary embodiment of the present invention, such that a power supply unit (not shown) that is manufactured along with the planar transformer (4100) can be manufactured in a slim size. Furthermore, the planar transformer (4100) according to the twenty first exemplary embodiment of the present invention can reduce the manufacturing cost of the planar transformer (4100) to enhance the efficiency of transformation.

Twenty Second Exemplary Embodiment

Figure 43:
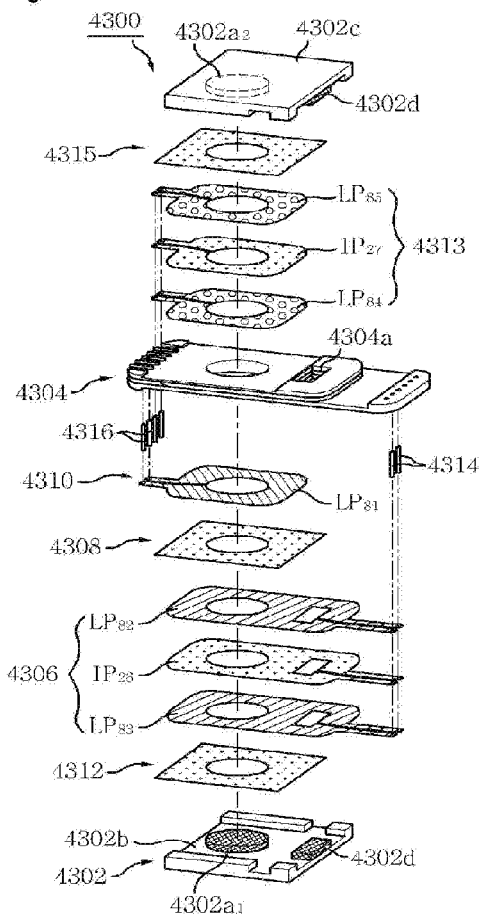
FIG. 43 is an exploded perspective view illustrating a planar transformer according to a twenty second exemplary embodiment of the present invention.
Figure 44:
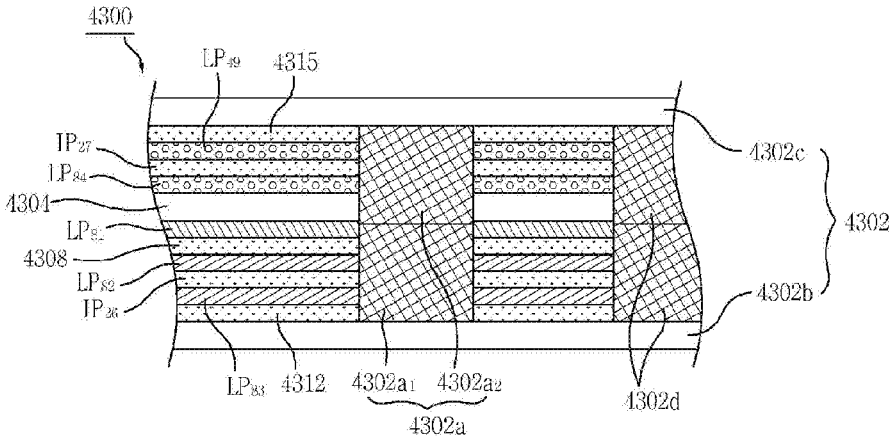
FIG. 44 is a coupled cross-sectional view illustrating a planar transformer according to a twenty second exemplary embodiment of the present invention.

FIG. 43 is an exploded perspective view illustrating a planar transformer according to a twenty second exemplary embodiment of the present invention, and FIG. 44 is a coupled cross-sectional view illustrating a planar transformer according to a twenty second exemplary embodiment of the present invention.

First, referring to FIGS. 43 and 44, a planar transformer (4300) according to the twenty second exemplary embodiment of the present invention includes a core (4302), a bobbin (4304), at least one primary winding (4306), a first insulation unit (4308), at least one secondary winding (4310), a second insulation unit (4312), at least another secondary winding (4313) and a third insulation unit (4315).

The core (4302) includes a first fastening unit (4302*a*) and is provided to induce formation of a magnetic field, where the core (4302) may include a bottom core (4302*b*) and an upper core (4302*c*). The bobbin (4304) is so provided as to be coupled to the core (4302) by the first fastening unit (4302*a*). The first fastening unit (4302*a*) may include first fastening lugs (4302*a*1, 4302*a*2).

The bobbin (4304) may include a second fastening unit (4304*a*) discrete from the first fastening unit (4302*a*), and the core (4302) may include a third fastening unit (4302*d*) to be coupled to the second fastening unit (4304*a*). At this time, the second fastening unit (4304*a*) may be provided as a second fastening hole (4304*a*), and the third fastening unit (4302*d*) may be provided to the bottom core (4302*b*) and the upper core (4302*c*), and may be provided as a third fastening lug (4302*d*) to be coupled to the second fastening hole (4304*a*).

The at least one secondary winding (4310) is provided between the core (4302) and the bobbin (4304), and provided at a bottom surface of the bobbin (4304) to be coupled to the first fastening unit (4302*a*) for supply of a transformed power signal.

At this time, the at least one secondary winding (4310) may include a metal thin film pattern layer (LP81) having an inductance component. The metal thin film pattern layer (LP81) having an inductance component may be provided in a metal material having a high conductivity to smoothly and efficiently output a power signal transformed by the at least one secondary winding (4310).

At this time, the metal thin film pattern layer (LP81) having an inductance component may be formed by at least one engineering method of a photo-lithography method using a photo mask and an etching solution, or an injection molding method using a press. The at least one secondary winding (4310) may be provided in at least one of a circular shape, an oval shape and a polygon shape.

The first insulation unit (4308) is provided to a bottom surface of the at least one secondary winding (4310) and coupled to the first fastening unit (4302*a*) to insulate the at least one secondary winding (4310). At this time, the first insulation unit (4308) may be provided as an insulation sheet, and may be provided in at least one of a circular shape, an oval shape and a polygon shape.

The at least one primary winding (4306) is provided to a bottom surface of the first insulation unit (4308), coupled to the first fastening unit (4302*a*) and insulated by the first insulation unit (4308) to supply a power signal.

At this time, the at least one primary winding (4306) may include metal thin film pattern layers (LP82, LP83) having at least two or more inductance components, and at one primary insulation unit (IP26) provided between the metal thin film pattern layers (LP82, LP83) having at least two or more inductance components to insulate the metal thin film pattern layers (LP82, LP83) having at least two or more inductance components.

At this time, the metal thin film pattern layers (LP82, LP83) having at least two or more inductance components may be provided in a metal material having a high conductivity to smoothly and efficiently supply a power signal supplied by a power signal supply unit (4314, described later).

At this time, the metal thin film pattern layers (LP82, LP83) having at least two or more inductance components may be formed by at least one engineering method of a photo-lithography method using a photo mask and an etching solution, or an injection molding method using a press. The at least one primary winding (4306) may be provided in at least one of a circular shape, an oval shape and a polygon shape.

The second insulation unit (4312) is provided to a bottom surface of the at least one primary winding (4306), and coupled to the first fastening unit (4302*a*) to insulate the at least one primary winding (4306). At this time, the second insulation unit (4312) may be provided as an insulation sheet, and may be provided in at least one of a circular shape, an oval shape and a polygon shape.

The at least another secondary winding (4313) is provided between the core (4302) and the bobbin (4304), and provided to an upper surface of the bobbin (4304) to be coupled to the first fastening unit (4302*a*) for transformation of a power signal.

At this time, the at least another secondary winding (4313) may include metal thin film pattern layers (LP84, LP85) having at least two or more inductance components, and at least another secondary insulation layer (IP27) provided between the metal thin film pattern layers (LP84, LP85) having at least two or more inductance components to insulate the metal thin film pattern layers (LP84, LP85) having at least two or more inductance components.

The metal thin film pattern layers (LP84, LP85) having at least two or more inductance components may be provided in a metal material having a high conductivity to smoothly and efficiently output a power signal transformed by the at least another secondary winding (4313).

At this time, the metal thin film pattern layers (LP84, LP85) having at least two or more inductance components may be formed by at least one engineering method of a photo-lithography method using a photo mask and an etching solution, or an injection molding method using a press. The at least another secondary winding (4313) may be provided in at least one of a circular shape, an oval shape and a polygon shape.

The third insulation unit (4315) is provided to an upper surface of the at least another secondary winding (4313), and coupled to the first fastening unit (4302*a*) to insulate the at least another secondary winding (4313). The third insulation unit (4315) may be provided as an insulation sheet, and may be provided in at least one of a circular shape, an oval shape and a polygon shape.

A power signal supply unit (4314) may be coupled to one side of the bobbin (4304) to be electrically connected to the at least one primary winding (4306), whereby a power signal can be supplied to the at least one primary winding (4306). At this time, the power signal supply unit (4314) may be electrically connected to a distal end of one side of the bobbin (4304) and a distal end of the at least one primary winding (4306).

The power signal supply unit (4314) may be provided in a metal material having a high conductivity to smoothly and efficiently supply a power signal to the at least one primary winding (4306). At this time, the power signal supply unit (4314) may be provided as a terminal lug.

A power signal output unit (4316) may be coupled to the other side of the bobbin (4304) to be electrically connected to the at least one secondary winding (4310), whereby a power signal transformed by the at least one secondary winding (4310) can be outputted. At this time, the power signal output unit (4316) may be electrically connected to a distal end of the other side of the bobbin (4304) and a distal end of the at least one secondary winding (4310).

Furthermore, the power signal output unit (4316) may be coupled to the still other side of the bobbin (4304) to be electrically connected to the at least another secondary winding (4313), whereby a power signal transformed by the at least another secondary winding (4313) can be outputted.

At this time, the power signal output unit (4316) may be electrically connected to a distal end of still other side of the bobbin (4304) and a distal end of the at least another secondary winding (4313).

Additionally, the power signal output unit (4316) may be provided in a metal material having a high conductivity to smoothly and efficiently output a power signal transformed by the at least one secondary winding (4310) or the at least another secondary winding (4313). The power signal output unit (4316) may be provided as a terminal lug.

As apparent from the foregoing, the planar transformer (4300) according to the twenty second exemplary embodiment of the present invention includes the core (4302), the bobbin (4304), the at least one primary winding (4306), the first insulation unit (4308), the at least one secondary winding (4310), the second insulation unit (4312), the at least another secondary winding (4313) and the third insulation unit (4315).

Therefore, a planar transformer (4300) can be manufactured in a slim size using the technical feature of the planar transformer (4300) according to the twenty second exemplary embodiment of the present invention, such that a power supply unit (not shown) that is manufactured along with the planar transformer (4300) can be manufactured in a slim size. Furthermore, the planar transformer (4300) according to the twenty second exemplary embodiment of the present invention can reduce the manufacturing cost of the planar transformer (4300) to enhance the efficiency of transformation.

Twenty Third Exemplary Embodiment

Figure 45:
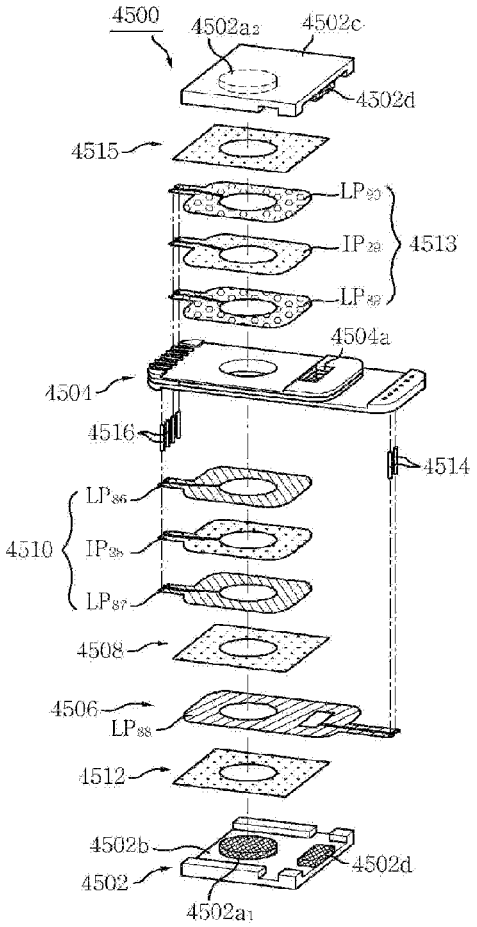
FIG. 45 is an exploded perspective view illustrating a planar transformer according to a twenty third exemplary embodiment of the present invention.
Figure 46:
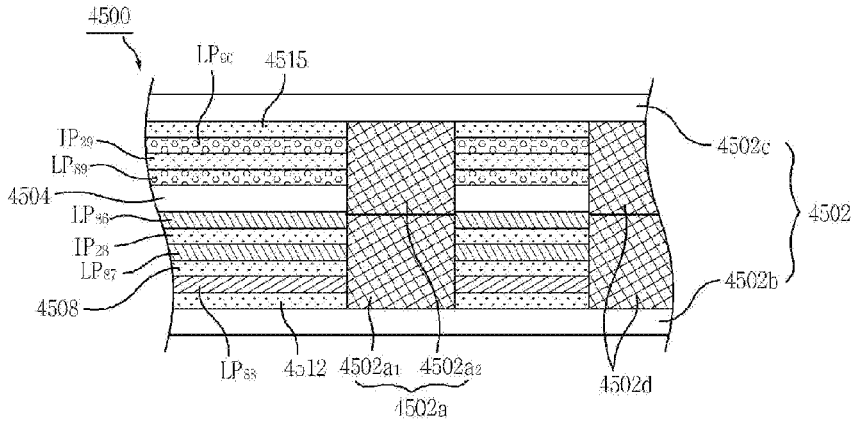
FIG. 46 is a coupled cross-sectional view illustrating a planar transformer according to a twenty third exemplary embodiment of the present invention.

FIG. 45 is an exploded perspective view illustrating a planar transformer according to a twenty third exemplary embodiment of the present invention, and FIG. 46 is a coupled cross-sectional view illustrating a planar transformer according to a twenty third exemplary embodiment of the present invention.

First, referring to FIGS. 45 and 46, a planar transformer (4500) according to the twenty third exemplary embodiment of the present invention includes a core (4502), a bobbin (4504), at least one primary winding (4506), a first insulation unit (4508), at least one secondary winding (4510), a second insulation unit (4512), at least another secondary winding (4513) and a third insulation unit (4515).

The core (4502) includes a first fastening unit (4502*a*) and is provided to induce formation of a magnetic field, where the core (4502) may include a bottom core (4502*b*) and an upper core (4502*c*). The bobbin (4504) is so provided as to be coupled to the core (4502) by the first fastening unit (4502*a*). The first fastening unit (4502*a*) may include first fastening lugs (4502*a*1, 4502*a*2).

The bobbin (4504) may include a second fastening unit (4504*a*) discrete from the first fastening unit (4502*a*), and the core (4502) may include a third fastening unit (4502*d*) to be coupled to the second fastening unit (4504*a*). At this time, the second fastening unit (4504*a*) may be provided as a second fastening hole (4504*a*), and the third fastening unit (4502*d*) may be provided to the bottom core (4502*b*) and the upper core (4502*c*), and may be provided as a third fastening lug (4502*d*) to be coupled to the second fastening hole (4504*a*).

The at least one secondary winding (4510) is provided between the core (4502) and the bobbin (4504), and provided at a bottom surface of the bobbin (4504) to be coupled to the first fastening unit (4502*a*) for supply of a transformed power signal.

At this time, the at least one secondary winding (4510) may include metal thin film pattern layers (LP86, LP87) having at least two or more inductance components, and at least one secondary insulation unit (IP28) provided between the metal thin film pattern layers (LP86, having at least two or more inductance components to insulate the metal thin film pattern layers (LP86, LP87). The metal thin film pattern layers (LP86, LP87) having at least two or more inductance components may be provided in a metal material having a high conductivity to smoothly and efficiently output a power signal transformed by the at least one secondary winding (4510).

At this time, the metal thin film pattern layers (LP86, LP87) having at least two or more inductance components may be formed by at least one engineering method of a photo-lithography method using a photo mask and an etching solution, or an injection molding method using a press. The at least one secondary winding (4510) may be provided in at least one of a circular shape, an oval shape and a polygon shape.

The first insulation unit (4508) is provided to a bottom surface of the at least one secondary winding (4510) and coupled to the first fastening unit (4502*a*) to insulate the at least one secondary winding (4510). At this time, the first insulation unit (4508) may be provided as an insulation sheet, and may be provided in at least one of a circular shape, an oval shape and a polygon shape.

The at least one primary winding (4506) is provided to a bottom surface of the first insulation unit (4508), coupled to the first fastening unit (4502*a*) and insulated by the first insulation unit (4508) to supply a power signal.

At this time, the at least one primary winding (4506) may include a metal thin film pattern layer (LP88) having an inductance component. The metal thin film pattern layer (LP88) having an inductance component may be provided in a metal material having a high conductivity to smoothly and efficiently supply a power signal supplied by a power signal supply unit (4514, described later).

At this time, the metal thin film pattern layer (LP88) having an inductance component may be formed by at least one engineering method of a photo-lithography method using a photo mask and an etching solution, or an injection molding method using a press. The at least one primary winding (4506) may be provided in at least one of a circular shape, an oval shape and a polygon shape.

The second insulation unit (4512) is provided to a bottom surface of the at least one primary winding (4506), and coupled to the first fastening unit (4502*a*) to insulate the at least one primary winding (4506). At this time, the second insulation unit (4512) may be provided as an insulation sheet, and may be provided in at least one of a circular shape, an oval shape and a polygon shape.

The at least another secondary winding (4513) is provided between the core (4502) and the bobbin (4504), and provided to an upper surface of the bobbin (4504) to be coupled to the first fastening unit (4502*a*) for transformation of a power signal.

At this time, the at least another secondary winding (4513) may include metal thin film pattern layers (LP89, LP90) having at least two or more inductance components, and at least another secondary insulation layer (IP29) provided between the metal thin film pattern layers (LP89, LP90) having at least two or more inductance components to insulate the metal thin film pattern layers (LP89, LP90) having at least two or more inductance components.

The metal thin film pattern layers (LP89, LP90) having at least two or more inductance components may be provided in a metal material having a high conductivity to smoothly and efficiently output a power signal transformed by the at least another secondary winding (4513).

At this time, the metal thin film pattern layers (LP89, LP90) having at least two or more inductance components may be formed by at least one engineering method of a photo-lithography method using a photo mask and an etching solution, or an injection molding method using a press. The at least another secondary winding (4513) may be provided in at least one of a circular shape, an oval shape and a polygon shape.

The third insulation unit (4515) is provided to an upper surface of the at least another secondary winding (4513), and coupled to the first fastening unit (4502*a*) to insulate the at least another secondary winding (4513). The third insulation unit (4515) may be provided as an insulation sheet, and may be provided in at least one of a circular shape, an oval shape and a polygon shape.

A power signal supply unit (4514) may be coupled to one side of the bobbin (4504) to be electrically connected to the at least one primary winding (4506), whereby a power signal can be supplied to the at least one primary winding (4506). At this time, the power signal supply unit (4514) may be electrically connected to a distal end of one side of the bobbin (4504) and a distal end of the at least one primary winding (4506).

The power signal supply unit (4514) may be provided in a metal material having a high conductivity to smoothly and efficiently supply a power signal to the at least one primary winding (4506). At this time, the power signal supply unit (4514) may be provided as a terminal lug.

A power signal output unit (4516) may be coupled to the other side of the bobbin (4504) to be electrically connected to the at least one secondary winding (4510), whereby a power signal transformed by the at least one secondary winding (4510) can be outputted. At this time, the power signal output unit (4516) may be electrically connected to a distal end of the other side of the bobbin (4504) and a distal end of the at least one secondary winding (4510).

Furthermore, the power signal output unit (4516) may be coupled to the still other side of the bobbin (4504) to be electrically connected to the at least another secondary winding (4513), whereby a power signal transformed by the at least another secondary winding (4513) can be outputted.

At this time, the power signal output unit (4516) may be electrically connected to a distal end of still other side of the bobbin (4504) and a distal end of the at least another secondary winding (4513).

Additionally, the power signal output unit (4516) may be provided in a metal material having a high conductivity to smoothly and efficiently output a power signal transformed by the at least one secondary winding (4510) or the at least another secondary winding (4513). The power signal output unit (4516) may be provided as a terminal lug.

As apparent from the foregoing, the planar transformer (4500) according to the twenty third exemplary embodiment of the present invention includes the core (4502), the bobbin (4504), the at least one primary winding (4506), the first insulation unit (4508), the at least one secondary winding (4510), the second insulation unit (4512), the at least another secondary winding (4513) and the third insulation unit (4515).

Therefore, a planar transformer (4500) can be manufactured in a slim size using the technical feature of the planar transformer (4300) according to the twenty third exemplary embodiment of the present invention, such that a power supply unit (not shown) that is manufactured along with the planar transformer (4500) can be manufactured in a slim size. Furthermore, the planar transformer (4500) according to the twenty third exemplary embodiment of the present invention can reduce the manufacturing cost of the planar transformer (4500) to enhance the efficiency of transformation.

Twenty Fourth Exemplary Embodiment

Figure 47:
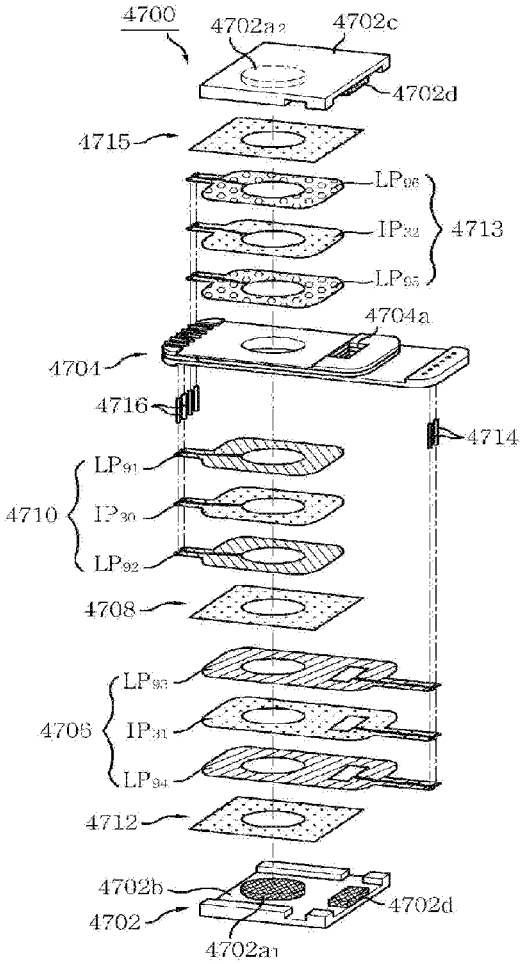
FIG. 47 is an exploded perspective view illustrating a planar transformer according to a twenty fourth exemplary embodiment of the present invention.
Figure 48:
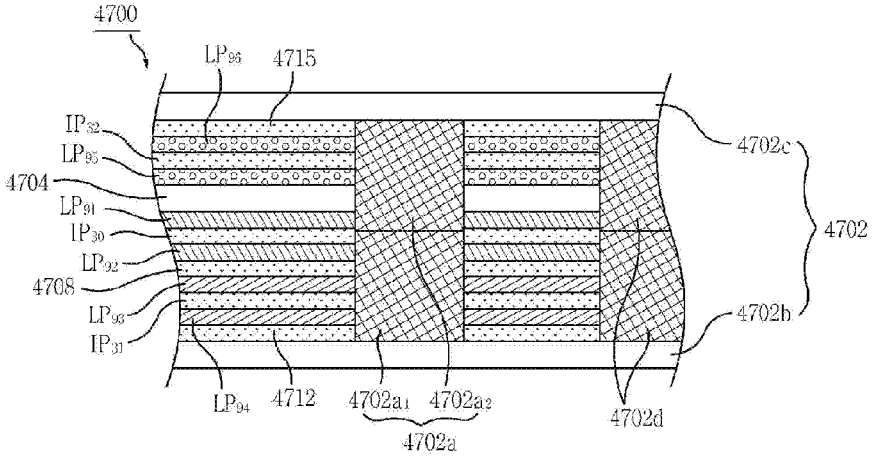
FIG. 48 is a coupled cross-sectional view illustrating a planar transformer according to a twenty fourth exemplary embodiment of the present invention.

FIG. 47 is an exploded perspective view illustrating a planar transformer according to a twenty fourth exemplary embodiment of the present invention, and FIG. 48 is a coupled cross-sectional view illustrating a planar transformer according to a twenty fourth exemplary embodiment of the present invention.

First, referring to FIGS. 47 and 48, a planar transformer (4700) according to the twenty fourth exemplary embodiment of the present invention includes a core (4702), a bobbin (4704), at least one primary winding (4706), a first insulation unit (4708), at least one secondary winding (4710), a second insulation unit (4712), at least another secondary winding (4713) and a third insulation unit (4715).

The core (4702) includes a first fastening unit (4702*a*) and is provided to induce formation of a magnetic field, where the core (4702) may include a bottom core (4702*b*) and an upper core (4702*c*). The bobbin (4704) is so provided as to be coupled to the core (4702) by the first fastening unit (4702*a*). The first fastening unit (4702*a*) may include first fastening lugs (4702*a*1, 4702*a*2).

The bobbin (4704) may include a second fastening unit (4704*a*) discrete from the first fastening unit (4702*a*), and the core (4702) may include a third fastening unit (4702*d*) to be coupled to the second fastening unit (4704*a*). At this time, the second fastening unit (4704*a*) may be provided as a second fastening hole (4704*a*), and the third fastening unit (4702*d*) may be provided to the bottom core (4702*b*) and the upper core (4702*c*), and may be provided as a third fastening lug (4702*d*) to be coupled to the second fastening hole (4704*a*).

The at least one secondary winding (4710) is provided between the core (4702) and the bobbin (4704), and provided at a bottom surface of the bobbin (4704) to be coupled to the first fastening unit (4702*a*) for supply of a transformed power signal.

At this time, the at least one secondary winding (4710) may include metal thin film pattern layers (LP91, LP92) having at least two or more inductance components, and at least one secondary insulation unit (IP30) provided between the metal thin film pattern layers (LP91, having at least two or more inductance components to insulate the metal thin film pattern layers (LP91, LP92). The metal thin film pattern layers (LP91, LP92) having at least two or more inductance components may be provided in a metal material having a high conductivity to smoothly and efficiently output a power signal transformed by the at least one secondary winding (4710).

At this time, the metal thin film pattern layers (LP91, LP92) having at least two or more inductance components may be formed by at least one engineering method of a photo-lithography method using a photo mask and an etching solution, or an injection molding method using a press. The at least one secondary winding (4710) may be provided in at least one of a circular shape, an oval shape and a polygon shape.

The first insulation unit (4708) is provided to a bottom surface of the at least one secondary winding (4710) and coupled to the first fastening unit (4702*a*) to insulate the at least one secondary winding (4710). At this time, the first insulation unit (4708) may be provided as an insulation sheet, and may be provided in at least one of a circular shape, an oval shape and a polygon shape.

The at least one primary winding (4706) is provided to a bottom surface of the first insulation unit (4708), coupled to the first fastening unit (4702*a*) and insulated by the first insulation unit (4708) to supply a power signal.

At this time, the at least one primary winding (4706) may include metal thin film pattern layers (LP93, LP94) having at least two or more inductance components, and at least one primary insulation unit (IP31) provided between the metal thin film pattern layers (LP93, LP94) having at least two or more inductance components to insulate the metal thin film pattern layers (LP93, LP94) having at least two or more inductance components.

The metal thin film pattern layers (LP93, LP94) having at least two or more inductance components may be provided in a metal material having a high conductivity to smoothly and efficiently supply a power signal supplied by a power signal supply unit (4714, described later).

At this time, the metal thin film pattern layers (LP93, LP94) having at least two or more inductance components may be formed by at least one engineering method of a photo-lithography method using a photo mask and an etching solution, or an injection molding method using a press. The at least one primary winding (4706) may be provided in at least one of a circular shape, an oval shape and a polygon shape.

The second insulation unit (4712) is provided to a bottom surface of the at least one primary winding (4706), and coupled to the first fastening unit (4702*a*) to insulate the at least one primary winding (4706). At this time, the second insulation unit (4712) may be provided as an insulation sheet, and may be provided in at least one of a circular shape, an oval shape and a polygon shape.

The at least another secondary winding (4713) is provided between the core (4702) and the bobbin (4704), and provided to an upper surface of the bobbin (4704) to be coupled to the first fastening unit (4702*a*) for transformation of a power signal.

At this time, the at least another secondary winding (4713) may include metal thin film pattern layers (LP95, LP96) having at least two or more inductance components, and at least another secondary insulation layer (IP32) provided between the metal thin film pattern layers (LP95, LP96) having at least two or more inductance components to insulate the metal thin film pattern layers (LP95, LP96) having at least two or more inductance components.

The metal thin film pattern layers (LP95, LP96) having at least two or more inductance components may be provided in a metal material having a high conductivity to smoothly and efficiently output a power signal transformed by the at least another secondary winding (4713).

At this time, the metal thin film pattern layers (LP95, LP96) having at least two or more inductance components may be formed by at least one engineering method of a photo-lithography method using a photo mask and an etching solution, or an injection molding method using a press. The at least another secondary winding (4713) may be provided in at least one of a circular shape, an oval shape and a polygon shape.

The third insulation unit (4715) is provided to an upper surface of the at least another secondary winding (4713), and coupled to the first fastening unit (4702*a*) to insulate the at least another secondary winding (4713). The third insulation unit (4715) may be provided as an insulation sheet, and may be provided in at least one of a circular shape, an oval shape and a polygon shape.

A power signal supply unit (4714) may be coupled to one side of the bobbin (4704) to be electrically connected to the at least one primary winding (4706), whereby a power signal can be supplied to the at least one primary winding (4706). At this time, the power signal supply unit (4714) may be electrically connected to a distal end of one side of the bobbin (4704) and a distal end of the at least one primary winding (4706).

The power signal supply unit (4714) may be provided in a metal material having a high conductivity to smoothly and efficiently supply a power signal to the at least one primary winding (4706). At this time, the power signal supply unit (4714) may be provided as a terminal lug.

A power signal output unit (4716) may be coupled to the other side of the bobbin (4704) to be electrically connected to the at least one secondary winding (4710), whereby a power signal transformed by the at least one secondary winding (4710) can be outputted. At this time, the power signal output unit (4716) may be electrically connected to a distal end of the other side of the bobbin (4704) and a distal end of the at least one secondary winding (4710).

Furthermore, the power signal output unit (4716) may be coupled to the still other side of the bobbin (4704) to be electrically connected to the at least another secondary winding (4713), whereby a power signal transformed by the at least another secondary winding (4713) can be outputted.

At this time, the power signal output unit (4716) may be electrically connected to a distal end of still other side of the bobbin (4704) and a distal end of the at least another secondary winding (4713).

Additionally, the power signal output unit (4716) may be provided in a metal material having a high conductivity to smoothly and efficiently output a power signal transformed by the at least one secondary winding (4710) or the at least another secondary winding (4713). The power signal output unit (4716) may be provided as a terminal lug.

As apparent from the foregoing, the planar transformer (4700) according to the twenty fourth exemplary embodiment of the present invention includes the core (4702), the bobbin (4704), the at least one primary winding (4706), the first insulation unit (4708), the at least one secondary winding (4710), the second insulation unit (4712), the at least another secondary winding (4713) and the third insulation unit (4715).

Therefore, a planar transformer (4700) can be manufactured in a slim size using the technical feature of the planar transformer (4700) according to the twenty fourth exemplary embodiment of the present invention, such that a power supply unit (not shown) that is manufactured along with the planar transformer (4700) can be manufactured in a slim size. Furthermore, the planar transformer (4700) according to the twenty fourth exemplary embodiment of the present invention can reduce the manufacturing cost of the planar transformer (4700) to enhance the efficiency of transformation.

Twenty Fifth Exemplary Embodiment

Figure 49:
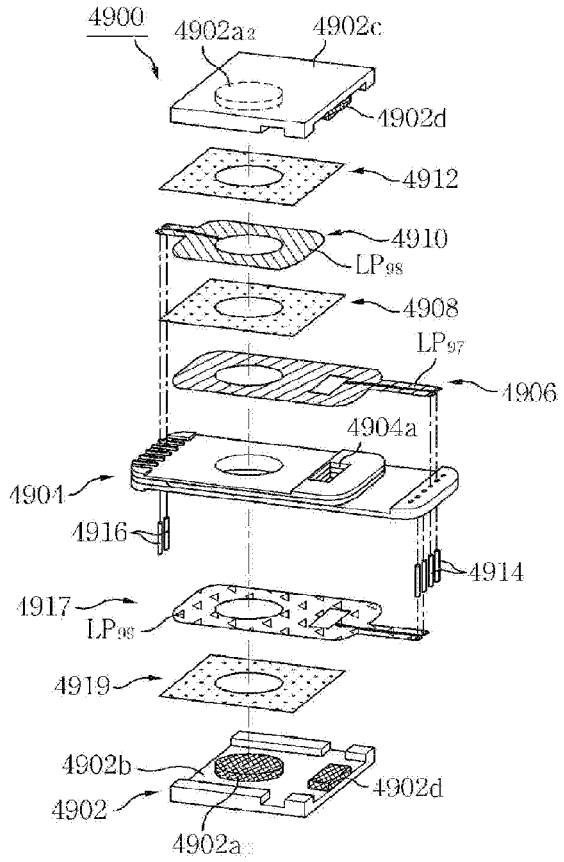
FIG. 49 is an exploded perspective view illustrating a planar transformer according to a twenty fifth exemplary embodiment of the present invention.
Figure 50:
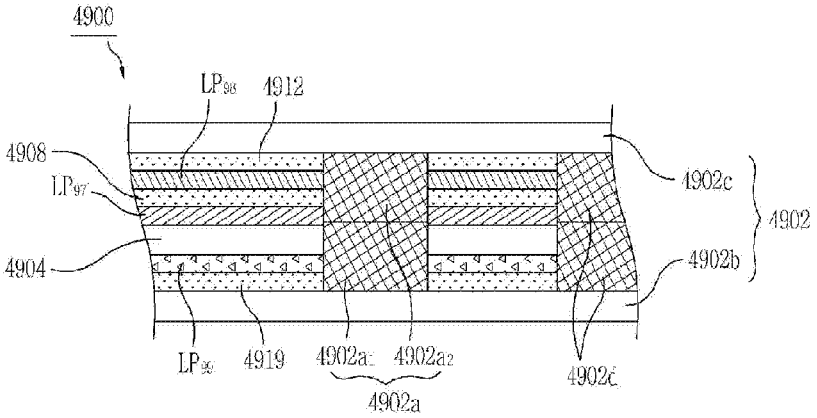
FIG. 50 is a coupled cross-sectional view illustrating a planar transformer according to a twenty fifth exemplary embodiment of the present invention.

FIG. 49 is an exploded perspective view illustrating a planar transformer according to a twenty fifth exemplary embodiment of the present invention, and FIG. 50 is a coupled cross-sectional view illustrating a planar transformer according to a twenty fifth exemplary embodiment of the present invention.

First, referring to FIGS. 49 and 50, a planar transformer (4900) according to the twenty fifth exemplary embodiment of the present invention includes a core (4902), a bobbin (4904), at least one primary winding (4906), a first insulation unit (4908), at least one secondary winding (4910), a second insulation unit (4912), at least another primary winding (4917) and a fourth insulation unit (4919).

The core (4902) includes a first fastening unit (4902*a*) and is provided to induce formation of a magnetic field, and the core (4902) may include a bottom core (4902*b*) and an upper core (4902*c*). The bobbin (4904) is so provided as to be coupled to the core (4902) by the first fastening unit (4902*a*). The first fastening unit (4902*a*) may include first fastening lugs (4902*a*1, 4902*a*2).

The bobbin (4904) may include a second fastening unit (4904*a*) discrete from the first fastening unit (4902*a*), where the core (4902) may include a third fastening unit (4902*d*) to be coupled to the second fastening unit (4904*a*). At this time, the second fastening unit (4904*a*) may be provided as a second fastening hole (4904*a*), and the third fastening unit (4902*d*) may be provided to the bottom core (4902*b*) and the upper core (4902*c*), and may be provided as a third fastening lug (4902*d*) to be coupled to the second fastening hole (4904*a*).

The at least one primary winding (4906) is provided between the core (4902) and the bobbin (4904), and provided at an upper surface of the bobbin (4904) to be coupled to the first fastening unit (4902*a*) for supply of a power signal.

At this time, the at least one primary winding (4906) may include a metal thin film pattern layer (LP97) having an inductance component. The metal thin film pattern layer (LP97) having an inductance component may be provided in a metal material having a high conductivity to smoothly and efficiently supply a power signal supplied by a power signal supply unit (4914, described later).

The metal thin film pattern layer (LP97) having an inductance component may be formed by at least one engineering method of a photo-lithography method using a photo mask and an etching solution, or an injection molding method using a press. The at least one primary winding (4906) may be provided in at least one of a circular shape, an oval shape and a polygon shape.

The first insulation unit (4908) is provided to an upper surface of the at least one primary winding (4906) and coupled to the first fastening unit (4902*a*) to insulate the at least one primary winding (4906). At this time, the first insulation unit (4908) may be provided as an insulation sheet, and may be provided in at least one of a circular shape, an oval shape and a polygon shape.

The at least one secondary winding (4910) is provided to an upper surface of the first insulation unit (4908), coupled to the first fastening unit (4902*a*) and insulated by the first insulation unit (4908) to transform a power signal.

At this time, the at least one secondary winding (4910) may include a metal thin film pattern layer (LP98) having an inductance component. The metal thin film pattern layer (LP98) having an inductance component may be provided in a metal material having a high conductivity to smoothly and efficiently output a power signal transformed by the at least secondary winding (4910).

At this time, the metal thin film pattern layer (LP98) having an inductance component may be formed by at least one engineering method of a photo-lithography method using a photo mask and an etching solution, or an injection molding method using a press. The at least one secondary winding (4910) may be provided in at least one of a circular shape, an oval shape and a polygon shape.

The second insulation unit (4912) is provided to an upper surface of the at least one secondary winding (4910), and coupled to the first fastening unit (4902*a*) to insulate the at least one secondary winding (4910). At this time, the second insulation unit (4912) may be provided as an insulation sheet, and may be provided in at least one of a circular shape, an oval shape and a polygon shape.

The at least another primary winding (4917) is provided between the core (4902) and the bobbin (4904), and provided to a bottom surface of the bobbin (4904) to be coupled to the first fastening unit (4902*a*) for supply of a power signal.

At this time, the at least another primary winding (4917) may include a metal thin film pattern layer (LP99) having an inductance component. The metal thin film pattern layer (LP99) having an inductance component may be provided in a metal material having a high conductivity to smoothly and efficiently supply a power signal supplied by a power signal supply unit (4914, described later).

The metal thin film pattern layer (LP99) having an inductance component may be formed by at least one engineering method of a photo-lithography method using a photo mask and an etching solution, or an injection molding method using a press. The at least another primary winding (4917) may be provided in at least one of a circular shape, an oval shape and a polygon shape.

The fourth insulation unit (4919) is provided to a bottom surface of the at least another primary winding (4917), and coupled to the first fastening unit (4902*a*) to insulate the at least another primary winding (4917). The fourth insulation unit (4919) may be provided as an insulation sheet, and may be provided in at least one of a circular shape, an oval shape and a polygon shape.

A power signal supply unit (4914) may be coupled to one side of the bobbin (4904) to be electrically connected to the at least one primary winding (4906), whereby a power signal can be supplied to the at least one primary winding (4906). At this time, the power signal supply unit (4914) may be electrically connected to a distal end of one side of the bobbin (4904) and a distal end of the at least one primary winding (4906).

Furthermore, the power signal supply unit (4914) may be coupled to another side of the bobbin (4904) to be electrically connected to the at least another primary winding (4917), whereby a power signal can be supplied to the at least another primary winding (4917). At this time, the power signal supply unit (4914) may be electrically connected to a distal end of another side of the bobbin (4904) and a distal end of the at least another primary winding (4917).

The power signal supply unit (4914) may be provided in a metal material having a high conductivity to smoothly and efficiently supply a power signal to the at least one primary winding (4906) or the at least another primary winding (4917). At this time, the power signal supply unit (4914) may be provided as a terminal lug.

A power signal output unit (4916) may be coupled to the other side of the bobbin (4904) to be electrically connected to the at least one secondary winding (4910), whereby a power signal transformed by the at least one secondary winding (4910) can be outputted. At this time, the power signal output unit (4916) may be electrically connected to a distal end of the other side of the bobbin (4904) and a distal end of the at least one secondary winding (4910).

Furthermore, the power signal output unit (4916) may be provided in a metal material having a high conductivity to smoothly and efficiently output a power signal transformed by the at least one secondary winding (4910). The power signal output unit (4916) may be provided as a terminal lug.

As apparent from the foregoing, the planar transformer (4900) according to the twenty fifth exemplary embodiment of the present invention includes the core (4902), the bobbin (4904), the at least one primary winding (4906), the first insulation unit (4908), the at least one secondary winding (4910), the second insulation unit (4912), at least another primary winding (4917) and the fourth insulation unit (4919).

Therefore, a planar transformer (4900) can be manufactured in a slim size using the technical feature of the planar transformer (4900) according to the twenty fifth exemplary embodiment of the present invention, such that a power supply unit (not shown) that is manufactured along with the planar transformer (4900) can be manufactured in a slim size. Furthermore, the planar transformer (4900) according to the twenty fifth exemplary embodiment of the present invention can reduce the manufacturing cost of the planar transformer (4900) to enhance the efficiency of transformation.

Twenty Sixth Exemplary Embodiment

Figure 51:
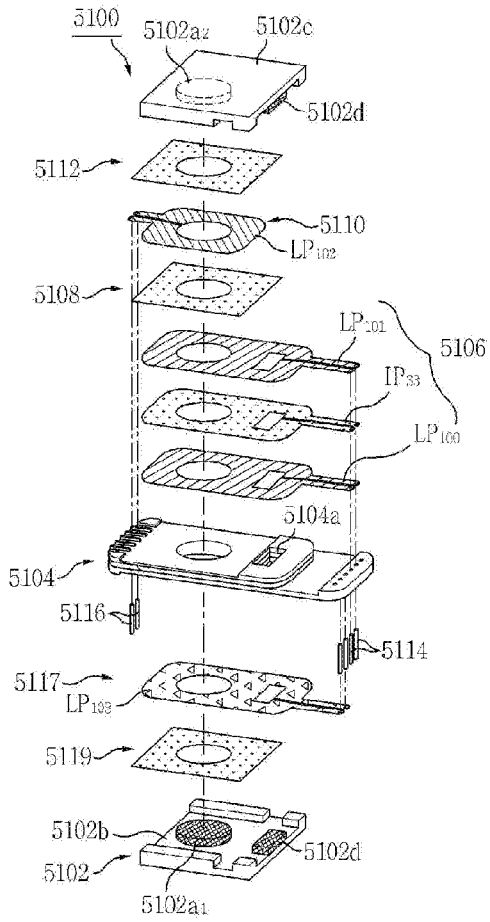
FIG. 51 is an exploded perspective view illustrating a planar transformer according to a twenty sixth exemplary embodiment of the present invention.
Figure 52:
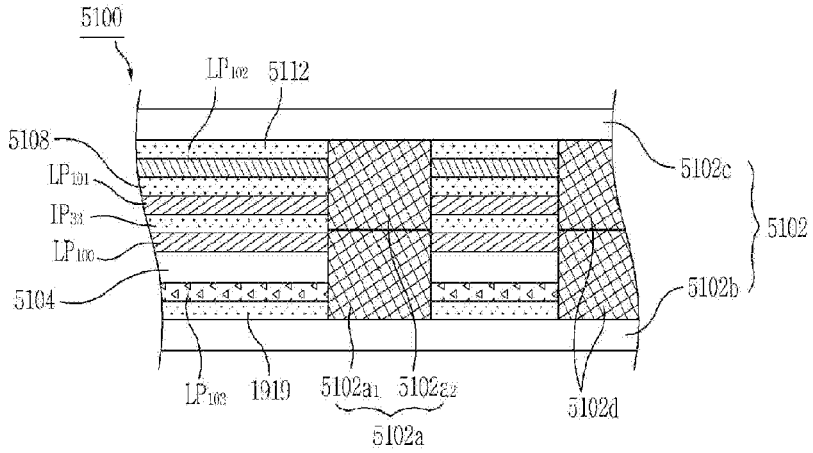
FIG. 52 is a coupled cross-sectional view illustrating a planar transformer according to a twenty sixth exemplary embodiment of the present invention.

FIG. 51 is an exploded perspective view illustrating a planar transformer according to a twenty sixth exemplary embodiment of the present invention, and FIG. 52 is a coupled cross-sectional view illustrating a planar transformer according to a twenty sixth exemplary embodiment of the present invention.

First, referring to FIGS. 51 and 52, a planar transformer (5100) according to the twenty sixth exemplary embodiment of the present invention includes a core (5102), a bobbin (5104), at least one primary winding (5106), a first insulation unit (5108), at least one secondary winding (5110), a second insulation unit (5112), at least another primary winding (5117) and a fourth insulation unit (5119).

The core (5102) includes a first fastening unit (5102*a*) and is provided to induce formation of a magnetic field, where the core (5102) may include a bottom core (5102*b*) and an upper core (5102*c*). The bobbin (5104) is so provided as to be coupled to the core (5102) by the first fastening unit (5102*a*). The first fastening unit (5102*a*) may include first fastening lugs (5102*a*1, 5102*a*2).

The bobbin (5104) may include a second fastening unit (5104*a*) discrete from the first fastening unit (5102*a*), and the core (5102) may include a third fastening unit (5102*d*) to be coupled to the second fastening unit (5104*a*). At this time, the second fastening unit (5104*a*) may be provided as a second fastening hole (5104*a*), and the third fastening unit (5102*d*) may be provided to the bottom core (5102*b*) and the upper core (5102*c*), and may be provided as a third fastening lug (5102*d*) to be coupled to the second fastening hole (5104*a*).

The at least one primary winding (5106) is provided between the core (5102) and the bobbin (5104), and provided at an upper surface of the bobbin (5104) to be coupled to the first fastening unit (5102*a*) for supply of a power signal.

At this time, the at least one primary winding (5106) may include metal thin film pattern layers (LP100, LP101) having at least two or more inductance components, and at least one primary insulation unit (IP33) provided between the metal thin film pattern layers (LP100, LP101) having at least two or more inductance components to insulate the metal thin film pattern layers (LP100, LP101) having at least two or more inductance components.

The metal thin film pattern layers (LP100, LP101) having at least two or more inductance components may be provided in a metal material having a high conductivity to smoothly and efficiently supply a power signal supplied by a power signal supply unit (5114, described later).

The metal thin film pattern layers (LP100, LP101) having at least two or more inductance components may be formed by at least one engineering method of a photo-lithography method using a photo mask and an etching solution, or an injection molding method using a press. The at least one primary winding (5106) may be provided in at least one of a circular shape, an oval shape and a polygon shape.

The first insulation unit (5108) is provided to an upper surface of the at least one primary winding (5106) and coupled to the first fastening unit (5102*a*) to insulate the at least one primary winding (5106). At this time, the first insulation unit (5108) may be provided as an insulation sheet, and may be provided in at least one of a circular shape, an oval shape and a polygon shape.

The at least one secondary winding (5110) is provided to an upper surface of the first insulation unit (5108), coupled to the first fastening unit (5102*a*) and insulated by the first insulation unit (5108) to transform a power signal.

At this time, the at least one secondary winding (5110) may include a metal thin film pattern layer (LP102) having an inductance component. Furthermore, the metal thin film pattern layer (LP102) having an inductance component may be provided in a metal material having a high conductivity to smoothly and efficiently output a power signal transformed by the at least secondary winding (5110).

At this time, the metal thin film pattern layer (LP102) having an inductance component may be formed by at least one engineering method of a photo-lithography method using a photo mask and an etching solution, or an injection molding method using a press. The at least one secondary winding (5110) may be provided in at least one of a circular shape, an oval shape and a polygon shape.

The second insulation unit (5112) is provided to an upper surface of the at least one secondary winding (5110), and coupled to the first fastening unit (5102*a*) to insulate the at least one secondary winding (5110). At this time, the second insulation unit (5112) may be provided as an insulation sheet, and may be provided in at least one of a circular shape, an oval shape and a polygon shape.

The at least another primary winding (5117) is provided between the core (5102) and the bobbin (5104), and provided to a bottom surface of the bobbin (5104) to be coupled to the first fastening unit (5102*a*) for supply of a power signal.

At this time, the at least another primary winding (5117) may include a metal thin film pattern layer (LP103) having an inductance component. The metal thin film pattern layer having an inductance component may be provided in a metal material having a high conductivity to smoothly and efficiently supply a power signal supplied by a power signal supply unit (5114, described later).

The metal thin film pattern layer (LP103) having an inductance component may be formed by at least one engineering method of a photo-lithography method using a photo mask and an etching solution, or an injection molding method using a press. The at least another primary winding (5117) may be provided in at least one of a circular shape, an oval shape and a polygon shape.

The fourth insulation unit (5119) is provided to a bottom surface of the at least another primary winding (5117), and coupled to the first fastening unit (5102*a*) to insulate the at least another primary winding (5117). The fourth insulation unit (5119) may be provided as an insulation sheet, and may be provided in at least one of a circular shape, an oval shape and a polygon shape.

A power signal supply unit (5114) may be coupled to one side of the bobbin (5104) to be electrically connected to the at least one primary winding (5106), whereby a power signal can be supplied to the at least one primary winding (5106). At this time, the power signal supply unit (5114) may be electrically connected to a distal end of one side of the bobbin (5104) and a distal end of the at least one primary winding (5106).

Furthermore, the power signal supply unit (5114) may be coupled to another side of the bobbin (5104) to be electrically connected to the at least another primary winding (5117), whereby a power signal can be supplied to the at least another primary winding (5117). At this time, the power signal supply unit (5114) may be electrically connected to a distal end of another side of the bobbin (5104) and a distal end of the at least another primary winding (5117).

The power signal supply unit (5114) may be provided in a metal material having a high conductivity to smoothly and efficiently supply a power signal to the at least one primary winding (5106) or the at least another primary winding (5117). At this time, the power signal supply unit (5114) may be provided as a terminal lug.

A power signal output unit (5116) may be coupled to the other side of the bobbin (5104) to be electrically connected to the at least one secondary winding (5110), whereby a power signal transformed by the at least one secondary winding (5110) can be outputted. At this time, the power signal output unit (5116) may be electrically connected to a distal end of the other side of the bobbin (5104) and a distal end of the at least one secondary winding (5110).

Furthermore, the power signal output unit (5116) may be provided in a metal material having a high conductivity to smoothly and efficiently output a power signal transformed by the at least one secondary winding (5110). The power signal output unit (5116) may be provided as a terminal lug.

As apparent from the foregoing, the planar transformer (5100) according to the twenty sixth exemplary embodiment of the present invention includes the core (5102), the bobbin (5104), the at least one primary winding (5106), the first insulation unit (5108), the at least one secondary winding (5110), the second insulation unit (5112), the at least another primary winding (5117) and the fourth insulation unit (5119).

Therefore, a planar transformer (5100) can be manufactured in a slim size using the technical feature of the planar transformer (5100) according to the twenty sixth exemplary embodiment of the present invention, such that a power supply unit (not shown) that is manufactured along with the planar transformer (5100) can be manufactured in a slim size.

Furthermore, the planar transformer (5100) according to the twenty sixth exemplary embodiment of the present invention can reduce the manufacturing cost of the planar transformer (5100) to enhance the efficiency of transformation.

Twenty Seventh Exemplary Embodiment

Figure 53:
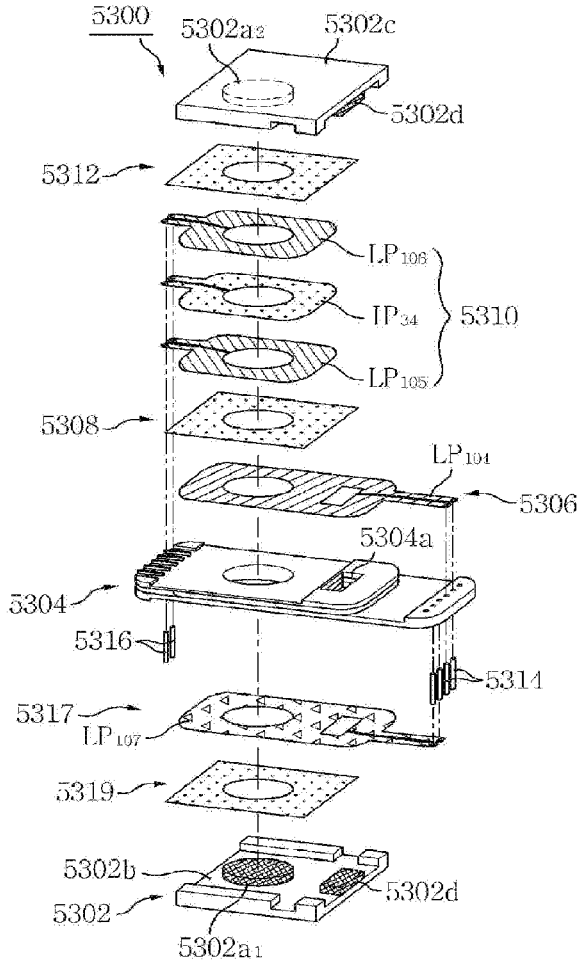
FIG. 53 is an exploded perspective view illustrating a planar transformer according to a twenty seventh exemplary embodiment of the present invention.
Figure 54:
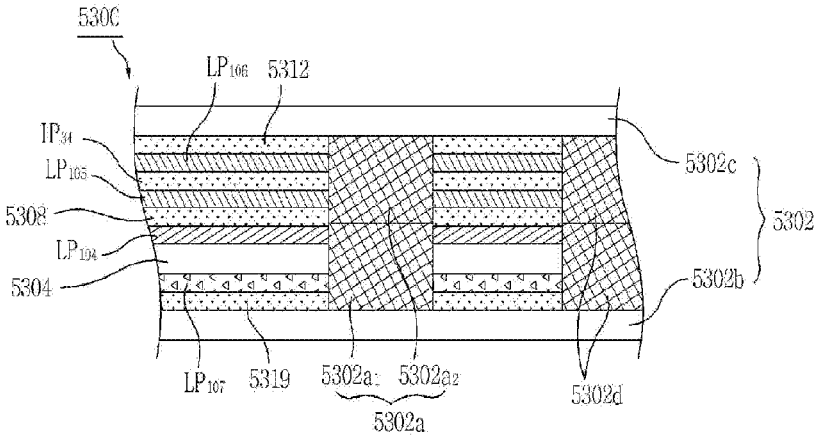
FIG. 54 is a coupled cross-sectional view illustrating a planar transformer according to a twenty seventh exemplary embodiment of the present invention.

FIG. 53 is an exploded perspective view illustrating a planar transformer according to a twenty seventh exemplary embodiment of the present invention, and FIG. 54 is a coupled cross-sectional view illustrating a planar transformer according to a twenty seventh exemplary embodiment of the present invention.

First, referring to FIGS. 53 and 54, a planar transformer (5300) according to the twenty seventh exemplary embodiment of the present invention includes a core (5302), a bobbin (5304), at least one primary winding (5306), a first insulation unit (5308), at least one secondary winding (5310), a second insulation unit (5312), at least another primary winding (5317) and a fourth insulation unit (5319).

The core (5302) includes a first fastening unit (5302*a*) and is provided to induce formation of a magnetic field, where the core (5302) may include a bottom core (5302*b*) and an upper core (5302*c*). The bobbin (5304) is so provided as to be coupled to the core (5302) by the first fastening unit (5302*a*). The first fastening unit (5302*a*) may include first fastening lugs (5302*a*1, 5302*a*2).

The bobbin (5304) may include a second fastening unit (5304*a*) discrete from the first fastening unit (5302*a*), and the core (5302) may include a third fastening unit (5302*d*) to be coupled to the second fastening unit (5304*a*). At this time, the second fastening unit (5304*a*) may be provided as a second fastening hole (5304*a*), and the third fastening unit (5302*d*) may be provided to the bottom core (5302*b*) and the upper core (5302*c*), and may be provided as a third fastening lug (5302*d*) to be coupled to the second fastening hole (5304*a*).

The at least one primary winding (5306) is provided between the core (5302) and the bobbin (5304), and provided at an upper surface of the bobbin (5304) to be coupled to the first fastening unit (5302*a*) for supply of a power signal.

At this time, the at least one primary winding (5306) may include a metal thin film pattern layer (LP104) having an inductance component. The metal thin film pattern layer (LP104) having an inductance component may be provided in a metal material having a high conductivity to smoothly and efficiently supply a power signal supplied by a power signal supply unit (5314, described later).

The metal thin film pattern layer (LP104) having an inductance component may be formed by at least one engineering method of a photo-lithography method using a photo mask and an etching solution, or an injection molding method using a press. The at least one primary winding (5306) may be provided in at least one of a circular shape, an oval shape and a polygon shape.

The first insulation unit (5308) is provided to an upper surface of the at least one primary winding (5306) and coupled to the first fastening unit (5302*a*) to insulate the at least one primary winding (5306). At this time, the first insulation unit (5308) may be provided as an insulation sheet, and may be provided in at least one of a circular shape, an oval shape and a polygon shape.

The at least one secondary winding (5310) is provided to an upper surface of the first insulation unit (5308), coupled to the first fastening unit (5302*a*) and insulated by the first insulation unit (5308) to transform a power signal.

At this time, the at least one secondary winding (5310) may include metal thin film pattern layers (LP105, LP106) having at least two or more inductance components, and at least one secondary insulation layer (IP34) provided between the metal thin film pattern layers (LP105, LP106) having at least two or more inductance components to insulate the metal thin film pattern layers (LP105, LP106) having at least two or more inductance components.

Furthermore, the metal thin film pattern layers (LP105, LP106) having at least two or more inductance components may be provided in a metal material having a high conductivity to smoothly and efficiently output a power signal transformed by the at least secondary winding (5310).

At this time, the metal thin film pattern layers (LP105, LP106) having at least two or more inductance components may be formed by at least one engineering method of a photo-lithography method using a photo mask and an etching solution, or an injection molding method using a press. The at least one secondary winding (5310) may be provided in at least one of a circular shape, an oval shape and a polygon shape.

The second insulation unit (5312) is provided to an upper surface of the at least one secondary winding (5310), and coupled to the first fastening unit (5302*a*) to insulate the at least one secondary winding (5310). At this time, the second insulation unit (5312) may be provided as an insulation sheet, and may be provided in at least one of a circular shape, an oval shape and a polygon shape.

The at least another primary winding (5317) is provided between the core (5302) and the bobbin (5304), and provided to a bottom surface of the bobbin (5304) to be coupled to the first fastening unit (5302*a*) for supply of a power signal.

At this time, the at least another primary winding (5317) may include a metal thin film pattern layer (LP107) having an inductance component. The metal thin film pattern layer (LP107) having an inductance component may be provided in a metal material having a high conductivity to smoothly and efficiently supply a power signal supplied by a power signal supply unit (5314, described later).

The metal thin film pattern layer (LP107) having an inductance component may be formed by at least one engineering method of a photo-lithography method using a photo mask and an etching solution, or an injection molding method using a press. The at least another primary winding (5317) may be provided in at least one of a circular shape, an oval shape and a polygon shape.

The fourth insulation unit (5319) is provided to a bottom surface of the at least another primary winding (5317), and coupled to the first fastening unit (5302*a*) to insulate the at least another primary winding (5317). The fourth insulation unit (5319) may be provided as an insulation sheet, and may be provided in at least one of a circular shape, an oval shape and a polygon shape.

A power signal supply unit (5314) may be coupled to one side of the bobbin (5304) to be electrically connected to the at least one primary winding (5306), whereby a power signal can be supplied to the at least one primary winding (5306). At this time, the power signal supply unit (5314) may be electrically connected to a distal end of one side of the bobbin (5304) and a distal end of the at least one primary winding (5306).

Furthermore, the power signal supply unit (5314) may be coupled to another side of the bobbin (5304) to be electrically connected to the at least another primary winding (5317), whereby a power signal can be supplied to the at least another primary winding (5317). At this time, the power signal supply unit (5314) may be electrically connected to a distal end of another side of the bobbin (5304) and a distal end of the at least another primary winding (5317).

The power signal supply unit (5314) may be provided in a metal material having a high conductivity to smoothly and efficiently supply a power signal to the at least one primary winding (5306) or the at least another primary winding (5317). At this time, the power signal supply unit (5314) may be provided as a terminal lug.

A power signal output unit (5316) may be coupled to the other side of the bobbin (5304) to be electrically connected to the at least one secondary winding (5310), whereby a power signal transformed by the at least one secondary winding (5310) can be outputted. At this time, the power signal output unit (5316) may be electrically connected to a distal end of the other side of the bobbin (5304) and a distal end of the at least one secondary winding (5310).

Furthermore, the power signal output unit (5316) may be provided in a metal material having a high conductivity to smoothly and efficiently output a power signal transformed by the at least one secondary winding (5310). The power signal output unit (5316) may be provided as a terminal lug.

As apparent from the foregoing, the planar transformer (5300) according to the twenty seventh exemplary embodiment of the present invention includes the core (5302), the bobbin (5304), the at least one primary winding (5306), the first insulation unit (5308), the at least one secondary winding (5310), the second insulation unit (5312), the at least another primary winding (5317) and the fourth insulation unit (5319).

Therefore, a planar transformer (5300) can be manufactured in a slim size using the technical feature of the planar transformer (5300) according to the twenty seventh exemplary embodiment of the present invention, such that a power supply unit (not shown) that is manufactured along with the planar transformer (5300) can be manufactured in a slim size. Furthermore, the planar transformer (5300) according to the twenty seventh exemplary embodiment of the present invention can reduce the manufacturing cost of the planar transformer (5300) to enhance the efficiency of transformation.

Twenty Eighth Exemplary Embodiment

Figure 55:
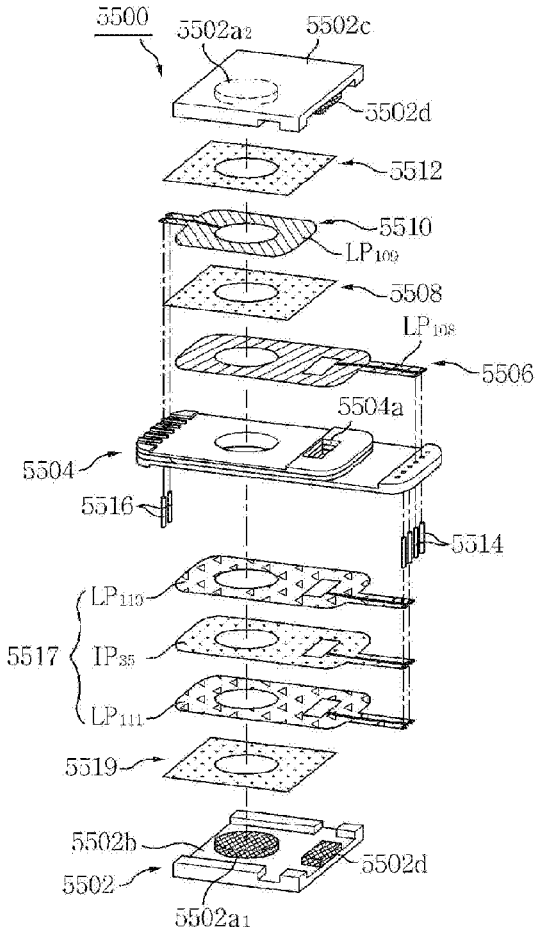
FIG. 55 is an exploded perspective view illustrating a planar transformer according to a twenty eighth exemplary embodiment of the present invention.
Figure 56:
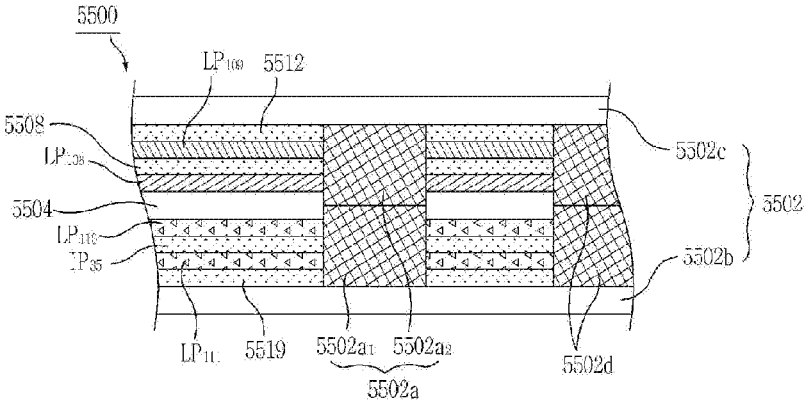
FIG. 56 is a coupled cross-sectional view illustrating a planar transformer according to a twenty eighth exemplary embodiment of the present invention.

FIG. 55 is an exploded perspective view illustrating a planar transformer according to a twenty eighth exemplary embodiment of the present invention, and FIG. 56 is a coupled cross-sectional view illustrating a planar transformer according to a twenty eighth exemplary embodiment of the present invention.

First, referring to FIGS. 55 and 56, a planar transformer (5500) according to the twenty eighth exemplary embodiment of the present invention includes a core (5502), a bobbin (5504), at least one primary winding (5506), a first insulation unit (5508), at least one secondary winding (5510), a second insulation unit (5512), at least another primary winding (5517) and a fourth insulation unit (5519).

The core (5502) includes a first fastening unit (5502*a*) and is provided to induce formation of a magnetic field, where the core (5502) may include a bottom core (5502*b*) and an upper core (5502*c*). The bobbin (5504) is so provided as to be coupled to the core (5502) by the first fastening unit (5502*a*). The first fastening unit (5502*a*) may include first fastening lugs (5502*a*1, 5502*a*2).

The bobbin (5504) may include a second fastening unit (5504*a*) discrete from the first fastening unit (5502*a*), and the core (5502) may include a third fastening unit (5502*d*) to be coupled to the second fastening unit (5504*a*). At this time, the second fastening unit (5504*a*) may be provided as a second fastening hole (5504*a*), and the third fastening unit (5502*d*) may be provided to the bottom core (5502*b*) and the upper core (5502*c*), and may be provided as a third fastening lug (5502*d*) to be coupled to the second fastening hole (5504*a*).

The at least one primary winding (5506) is provided between the core (5502) and the bobbin (5504), and provided at an upper surface of the bobbin (5504) to be coupled to the first fastening unit (5502*a*) for supply of a power signal.

At this time, the at least one primary winding (5506) may include a metal thin film pattern layer (LP108) having an inductance component. The metal thin film pattern layer (LP108) having an inductance component may be provided in a metal material having a high conductivity to smoothly and efficiently supply a power signal supplied by a power signal supply unit (5514, described later).

The metal thin film pattern layer (LP108) having an inductance component may be formed by at least one engineering method of a photo-lithography method using a photo mask and an etching solution, or an injection molding method using a press. The at least one primary winding (5506) may be provided in at least one of a circular shape, an oval shape and a polygon shape.

The first insulation unit (5508) is provided to an upper surface of the at least one primary winding (5506) and coupled to the first fastening unit (5502*a*) to insulate the at least one primary winding (5506). At this time, the first insulation unit (5508) may be provided as an insulation sheet, and may be provided in at least one of a circular shape, an oval shape and a polygon shape.

The at least one secondary winding (5510) is provided to an upper surface of the first insulation unit (5508), coupled to the first fastening unit (5502*a*) and insulated by the first insulation unit (5508) to transform a power signal.

At this time, the at least one secondary winding (5510) may include a metal thin film pattern layer (LP109) having an inductance component. The metal thin film pattern layer (LP109) having an inductance component may be provided in a metal material having a high conductivity to smoothly and efficiently output a power signal transformed by the at least one secondary winding (5510).

The metal thin film pattern layer (LP109) having an inductance component may be formed by at least one engineering method of a photo-lithography method using a photo mask and an etching solution, or an injection molding method using a press. The at least one secondary winding (5510) may be provided in at least one of a circular shape, an oval shape and a polygon shape.

The second insulation unit (5512) is provided to an upper surface of the at least one secondary winding (5510), and coupled to the first fastening unit (5502*a*) to insulate the at least one secondary winding (5510). At this time, the second insulation unit (5512) may be provided as an insulation sheet, and may be provided in at least one of a circular shape, an oval shape and a polygon shape.

The at least another primary winding (5517) is provided between the core (5502) and the bobbin (5504), and provided to a bottom surface of the bobbin (5504) to be coupled to the first fastening unit (5502*a*) for supply of a power signal.

At this time, the at least another primary winding (5517) may include metal thin film pattern layers (LP110, LP101) having at least two more inductance components, and at least one primary insulation layer (IP35) provided between the metal thin film pattern layers (LP110, LP101) having at least two more inductance components to insulate the metal thin film pattern layers (LP110, LP101) having at least two more inductance components.

Furthermore, the metal thin film pattern layers (LP110, LP101) having at least two more inductance components may be provided in a metal material having a high conductivity to smoothly and efficiently supply a power signal supplied by a power signal supply unit (5514, described later).

The metal thin film pattern layers (LP110, LP101) having at least two more inductance components may be formed by at least one engineering method of a photo-lithography method using a photo mask and an etching solution, or an injection molding method using a press. The at least another primary winding (5517) may be provided in at least one of a circular shape, an oval shape and a polygon shape.

The fourth insulation unit (5519) is provided to a bottom surface of the at least another primary winding (5517), and coupled to the first fastening unit (5502*a*) to insulate the at least another primary winding (5517). The fourth insulation unit (5519) may be provided as an insulation sheet, and may be provided in at least one of a circular shape, an oval shape and a polygon shape.

A power signal supply unit (5514) may be coupled to one side of the bobbin (5504) to be electrically connected to the at least one primary winding (5506), whereby a power signal can be supplied to the at least one primary winding (5506). At this time, the power signal supply unit (5514) may be electrically connected to a distal end of one side of the bobbin (5504) and a distal end of the at least one primary winding (5506).

Furthermore, the power signal supply unit (5514) may be coupled to another side of the bobbin (5504) to be electrically connected to the at least another primary winding (5517), whereby a power signal can be supplied to the at least another primary winding (5517). At this time, the power signal supply unit (5514) may be electrically connected to a distal end of another side of the bobbin (5504) and a distal end of the at least another primary winding (5517).

The power signal supply unit (5514) may be provided in a metal material having a high conductivity to smoothly and efficiently supply a power signal to the at least one primary winding (5506) or to the at least another primary winding (5517). At this time, the power signal supply unit (5514) may be provided as a terminal lug.

A power signal output unit (5516) may be coupled to the other side of the bobbin (5504) to be electrically connected to the at least one secondary winding (5510), whereby a power signal transformed by the at least one secondary winding (5510) can be outputted. At this time, the power signal output unit (5516) may be electrically connected to a distal end of the other side of the bobbin (5504) and a distal end of the at least one secondary winding (5510).

Furthermore, the power signal output unit (5516) may be provided in a metal material having a high conductivity to smoothly and efficiently output a power signal transformed by the at least one secondary winding (5510). The power signal output unit (5516) may be provided as a terminal lug.

As apparent from the foregoing, the planar transformer (5500) according to the twenty eighth exemplary embodiment of the present invention includes the core (5502), the bobbin (5504), the at least one primary winding (5506), the first insulation unit (5508), the at least one secondary winding (5510), the second insulation unit (5512), the at least another primary winding (5517) and the fourth insulation unit (5519).

Therefore, a planar transformer (5500) can be manufactured in a slim size using the technical feature of the planar transformer (5500) according to the twenty eighth exemplary embodiment of the present invention, such that a power supply unit (not shown) that is manufactured along with the planar transformer (5500) can be manufactured in a slim size. Furthermore, the planar transformer (5500) according to the twenty eighth exemplary embodiment of the present invention can reduce the manufacturing cost of the planar transformer (5500) to enhance the efficiency of transformation.

Twenty Ninth Exemplary Embodiment

Figure 57:
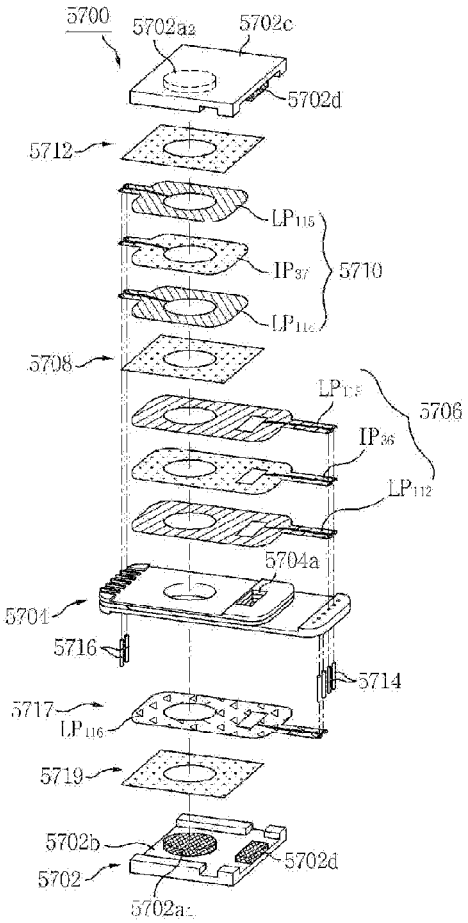
FIG. 57 is an exploded perspective view illustrating a planar transformer according to a twenty ninth exemplary embodiment of the present invention.
Figure 58:
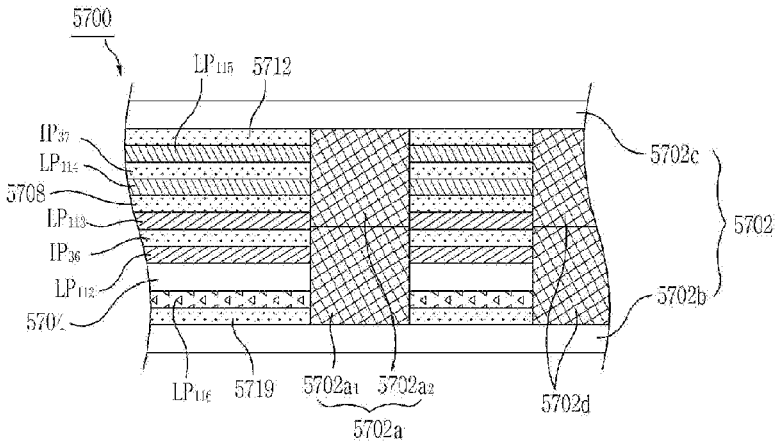
FIG. 58 is a coupled cross-sectional view illustrating a planar transformer according to a twenty ninth exemplary embodiment of the present invention.

FIG. 57 is an exploded perspective view illustrating a planar transformer according to a twenty ninth exemplary embodiment of the present invention, and FIG. 58 is a coupled cross-sectional view illustrating a planar transformer according to a twenty ninth exemplary embodiment of the present invention.

First, referring to FIGS. 57 and 58, a planar transformer (5700) according to the twenty ninth exemplary embodiment of the present invention includes a core (5702), a bobbin (5704), at least one primary winding (5706), a first insulation unit (5708), at least one secondary winding (5710), a second insulation unit (5712), at least another primary winding (5717) and a fourth insulation unit (5719).

The core (5702) includes a first fastening unit (5702*a*) and is provided to induce formation of a magnetic field, where the core (5702) may include a bottom core (5702*b*) and an upper core (5702*c*). The bobbin (5704) is so provided as to be coupled to the core (5702) by the first fastening unit (5702*a*). The first fastening unit (5702*a*) may include first fastening lugs (5702*a*1, 5702*a*2).

The bobbin (5704) may include a second fastening unit (5704*a*) discrete from the first fastening unit (5702*a*), and the core (5702) may include a third fastening unit (5702*d*) to be coupled to the second fastening unit (5704*a*). At this time, the second fastening unit (5704*a*) may be provided as a second fastening hole (5704*a*), and the third fastening unit (5702*d*) may be provided to the bottom core (5702*b*) and the upper core (5702*c*), and may be provided as a third fastening lug (5702*d*) to be coupled to the second fastening hole (5704*a*).

The at least one primary winding (5706) is provided between the core (5702) and the bobbin (5704), and provided at an upper surface of the bobbin (5704) to be coupled to the first fastening unit (5702*a*) for supply of a power signal.

At this time, the at least one primary winding (5706) may include metal thin film pattern layers (LP112, LP113) having at least two or more inductance components, and at least one primary insulation layer (IP36) provided between the metal thin film pattern layers (LP112, LP113) having at least two or more inductance components to insulate the metal thin film pattern layers (LP112, LP113) having at least two or more inductance components.

The metal thin film pattern layers (LP112, LP113) having at least two or more inductance components may be provided in a metal material having a high conductivity to smoothly and efficiently supply a power signal supplied by a power signal supply unit (5714, described later).

The metal thin film pattern layers (LP112, LP113) having at least two or more inductance components may be formed by at least one engineering method of a photo-lithography method using a photo mask and an etching solution, or an injection molding method using a press. The at least one primary winding (5706) may be provided in at least one of a circular shape, an oval shape and a polygon shape.

The first insulation unit (5708) is provided to an upper surface of the at least one primary winding (5706) and coupled to the first fastening unit (5702*a*) to insulate the at least one primary winding (5706). At this time, the first insulation unit (5708) may be provided as an insulation sheet, and may be provided in at least one of a circular shape, an oval shape and a polygon shape.

The at least one secondary winding (5710) is provided to an upper surface of the first insulation unit (5708), coupled to the first fastening unit (5702*a*) and insulated by the first insulation unit (5708) to transform a power signal.

At this time, the at least one secondary winding (5710) may include metal thin film pattern layers (LP114, LP115) having at least two or more inductance components, and at least one secondary insulation layer (IP37) provided between the metal thin film pattern layers (LP114, LP115) having at least two or more inductance components to insulate the metal thin film pattern layers (LP114, LP115) having at least two or more inductance components.

The metal thin film pattern layers (LP114, LP115) having at least two or more inductance components may be provided in a metal material having a high conductivity to smoothly and efficiently output a power signal transformed by the at least one secondary winding (5710).

The metal thin film pattern layers (LP114, LP115) having at least two or more inductance components may be formed by at least one engineering method of a photo-lithography method using a photo mask and an etching solution, or an injection molding method using a press. The at least one secondary winding (5710) may be provided in at least one of a circular shape, an oval shape and a polygon shape.

The second insulation unit (5712) is provided to an upper surface of the at least one secondary winding (5710), and coupled to the first fastening unit (5702*a*) to insulate the at least one secondary winding (5710). At this time, the second insulation unit (5712) may be provided as an insulation sheet, and may be provided in at least one of a circular shape, an oval shape and a polygon shape.

The at least another primary winding (5717) is provided between the core (5702) and the bobbin (5704), and provided to a bottom surface of the bobbin (5704) to be coupled to the first fastening unit (5702*a*) for supply of a power signal.

At this time, the at least another primary winding (5717) may include a metal thin film pattern layer (LP116) having an inductance component. The metal thin film pattern layer (LP116) having an inductance component may be provided in a metal material having a high conductivity to smoothly and efficiently supply a power signal supplied by a power signal supply unit (5714, described later).

The metal thin film pattern layer (LP116) having an inductance component may be formed by at least one engineering method of a photo-lithography method using a photo mask and an etching solution, or an injection molding method using a press. The at least another primary winding (5717) may be provided in at least one of a circular shape, an oval shape and a polygon shape.

The fourth insulation unit (5719) is provided to a bottom surface of the at least another primary winding (5717), and coupled to the first fastening unit (5702*a*) to insulate the at least another primary winding (5717). The fourth insulation unit (5719) may be provided as an insulation sheet, and may be provided in at least one of a circular shape, an oval shape and a polygon shape.

A power signal supply unit (5714) may be coupled to one side of the bobbin (5704) to be electrically connected to the at least one primary winding (5706), whereby a power signal can be supplied to the at least one primary winding (5706). At this time, the power signal supply unit (5714) may be electrically connected to a distal end of one side of the bobbin (5704) and a distal end of the at least one primary winding (5706).

Furthermore, the power signal supply unit (5714) may be coupled to another side of the bobbin (5704) to be electrically connected to the at least another primary winding (5717), whereby a power signal can be supplied to the at least another primary winding (5717). At this time, the power signal supply unit (5714) may be electrically connected to a distal end of another side of the bobbin (5704) and a distal end of the at least another primary winding (5717).

The power signal supply unit (5714) may be provided in a metal material having a high conductivity to smoothly and efficiently supply a power signal to the at least one primary winding (5706) or to the at least another primary winding (5717). At this time, the power signal supply unit (5714) may be provided as a terminal lug.

A power signal output unit (5716) may be coupled to the other side of the bobbin (5704) to be electrically connected to the at least one secondary winding (5710), whereby a power signal transformed by the at least one secondary winding (5710) can be outputted. At this time, the power signal output unit (5716) may be electrically connected to a distal end of the other side of the bobbin (5704) and a distal end of the at least one secondary winding (5710).

Furthermore, the power signal output unit (5716) may be provided in a metal material having a high conductivity to smoothly and efficiently output a power signal transformed by the at least one secondary winding (5710). The power signal output unit (5716) may be provided as a terminal lug.

As apparent from the foregoing, the planar transformer (5700) according to the twenty ninth exemplary embodiment of the present invention includes the core (5702), the bobbin (5704), the at least one primary winding (5706), the first insulation unit (5708), the at least one secondary winding (5710), the second insulation unit (5712), the at least another primary winding (5717) and the fourth insulation unit (5719).

Therefore, a planar transformer (5700) can be manufactured in a slim size using the technical feature of the planar transformer (5700) according to the twenty ninth exemplary embodiment of the present invention, such that a power supply unit (not shown) that is manufactured along with the planar transformer (5700) can be manufactured in a slim size. Furthermore, the planar transformer (5700) according to the twenty ninth exemplary embodiment of the present invention can reduce the manufacturing cost of the planar transformer (5700) to enhance the efficiency of transformation.

Thirtieth Exemplary Embodiment

Figure 59:
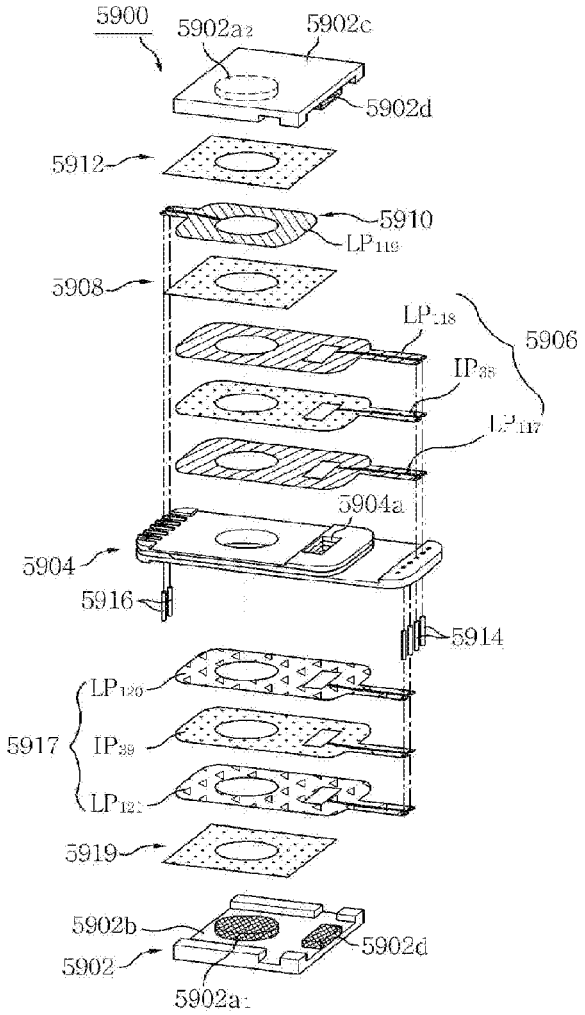
FIG. 59 is an exploded perspective view illustrating a planar transformer according to a thirtieth exemplary embodiment of the present invention.
Figure 60:
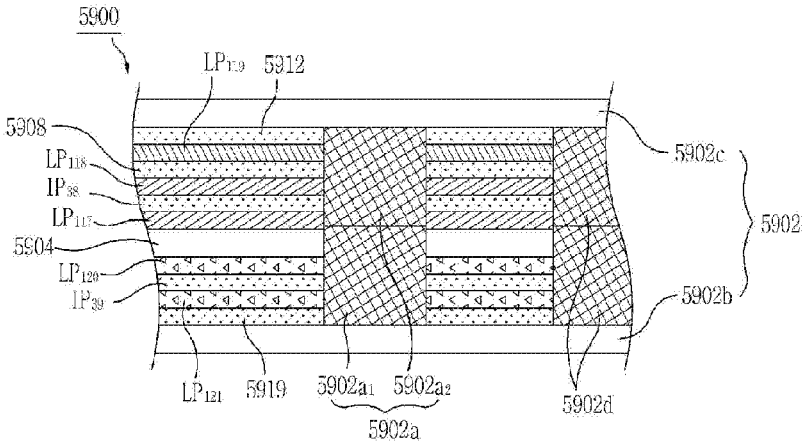
FIG. 60 is a coupled cross-sectional view illustrating a planar transformer according to a thirtieth exemplary embodiment of the present invention.

FIG. 59 is an exploded perspective view illustrating a planar transformer according to a thirtieth exemplary embodiment of the present invention, and FIG. 60 is a coupled cross-sectional view illustrating a planar transformer according to a thirtieth exemplary embodiment of the present invention.

First, referring to FIGS. 59 and 60, a planar transformer (5900) according to the thirtieth exemplary embodiment of the present invention includes a core (5902), a bobbin (5904), at least one primary winding (5906), a first insulation unit (5908), at least one secondary winding (5910), a second insulation unit (5912), at least another primary winding (5917) and a fourth insulation unit (5919).

The core (5902) includes a first fastening unit (5902*a*) and is provided to induce formation of a magnetic field, where the core (5902) may include a bottom core (5902*b*) and an upper core (5902*c*). The bobbin (5904) is so provided as to be coupled to the core (5902) by the first fastening unit (5902*a*). The first fastening unit (5902*a*) may include first fastening lugs (5902*a*1, 5902*a*2).

The bobbin (5904) may include a second fastening unit (5904*a*) discrete from the first fastening unit (5902*a*), and the core (5902) may include a third fastening unit (5902*d*) to be coupled to the second fastening unit (5904*a*). At this time, the second fastening unit (5904*a*) may be provided as a second fastening hole (5904*a*), and the third fastening unit (5902*d*) may be provided to the bottom core (5902*b*) and the upper core (5902*c*), and may be provided as a third fastening lug (5902*d*) so as to be coupled to the second fastening hole (5904*a*).

The at least one primary winding (5906) is provided between the core (5902) and the bobbin (5904), and provided at an upper surface of the bobbin (5904) to be coupled to the first fastening unit (5902*a*) for supply of a power signal.

At this time, the at least one primary winding (5906) may include metal thin film pattern layers (LP117, LP118) having at least two or more inductance components, and at least one primary insulation layer (IP38) provided between the metal thin film pattern layers (LP117, LP118) having at least two or more inductance components to insulate the metal thin film pattern layers (LP117, LP118) having at least two or more inductance components.

The metal thin film pattern layers (LP117, LP118) having at least two or more inductance components may be provided in a metal material having a high conductivity to smoothly and efficiently supply a power signal supplied by a power signal supply unit (5914, described later).

The metal thin film pattern layers (LP117, LP118) having at least two or more inductance components may be formed by at least one engineering method of a photo-lithography method using a photo mask and an etching solution, or an injection molding method using a press. The at least one primary winding (5906) may be provided in at least one of a circular shape, an oval shape and a polygon shape.

The first insulation unit (5908) is provided to an upper surface of the at least one primary winding (5906) and coupled to the first fastening unit (5902*a*) to insulate the at least one primary winding (5906). At this time, the first insulation unit (5908) may be provided as an insulation sheet, and may be provided in at least one of a circular shape, an oval shape and a polygon shape.

The at least one secondary winding (5910) is provided to an upper surface of the first insulation unit (5908), coupled to the first fastening unit (5902*a*) and insulated by the first insulation unit (5908) to transform a power signal.

At this time, the at least one secondary winding (5910) may include a metal thin film pattern layer (LP119) having an inductance component. The metal thin film pattern layer (LP119) having an inductance component may be provided in a metal material having a high conductivity to smoothly and efficiently output a power signal transformed by the at least one secondary winding (5910).

The metal thin film pattern layer (LP119) having an inductance component may be formed by at least one engineering method of a photo-lithography method using a photo mask and an etching solution, or an injection molding method using a press. The at least one secondary winding (5910) may be provided in at least one of a circular shape, an oval shape and a polygon shape.

The second insulation unit (5912) is provided to an upper surface of the at least one secondary winding (5910), and coupled to the first fastening unit (5902*a*) to insulate the at least one secondary winding (5910). At this time, the second insulation unit (5912) may be provided as an insulation sheet, and may be provided in at least one of a circular shape, an oval shape and a polygon shape.

The at least another primary winding (5917) is provided between the core (5902) and the bobbin (5904), and provided to a bottom surface of the bobbin (5904) to be coupled to the first fastening unit (5902*a*) for supply of a power signal.

At this time, the at least another primary winding (5917) may include metal thin film pattern layers (LP120, LP121) having at least two or more inductance components, and at least another primary insulation layer (IP39) provided between the metal thin film pattern layers (LP120, LP121) having at least two or more inductance components to insulate the metal thin film pattern layers (LP120, LP121) having at least two or more inductance components.

The metal thin film pattern layers (LP120, LP121) having at least two or more inductance components may be provided in a metal material having a high conductivity to smoothly and efficiently supply a power signal supplied by a power signal supply unit (5914, described later).

The metal thin film pattern layers (LP120, LP121) having at least two or more inductance components may be formed by at least one engineering method of a photo-lithography method using a photo mask and an etching solution, or an injection molding method using a press. The at least another primary winding (5917) may be provided in at least one of a circular shape, an oval shape and a polygon shape.

The fourth insulation unit (5919) is provided to a bottom surface of the at least another primary winding (5917), and coupled to the first fastening unit (5902*a*) to insulate the at least another primary winding (5917). The fourth insulation unit (5919) may be provided as an insulation sheet, and may be provided in at least one of a circular shape, an oval shape and a polygon shape.

A power signal supply unit (5914) may be coupled to one side of the bobbin (5904) to be electrically connected to the at least one primary winding (5906), whereby a power signal can be supplied to the at least one primary winding (5906). At this time, the power signal supply unit (5914) may be electrically connected to a distal end of one side of the bobbin (5904) and a distal end of the at least one primary winding (5906).

Furthermore, the power signal supply unit (5914) may be coupled to another side of the bobbin (5904) to be electrically connected to the at least another primary winding (5917), whereby a power signal can be supplied to the at least another primary winding (5917). At this time, the power signal supply unit (5914) may be electrically connected to a distal end of another side of the bobbin (5904) and a distal end of the at least another primary winding (5917).

The power signal supply unit (5914) may be provided in a metal material having a high conductivity to smoothly and efficiently supply a power signal to the at least one primary winding (5906) or to the at least another primary winding (5917). At this time, the power signal supply unit (5914) may be provided as a terminal lug.

A power signal output unit (5916) may be coupled to the other side of the bobbin (5904) to be electrically connected to the at least one secondary winding (5910), whereby a power signal transformed by the at least one secondary winding (5910) can be outputted. At this time, the power signal output unit (5916) may be electrically connected to a distal end of the other side of the bobbin (5904) and a distal end of the at least one secondary winding (5910).

Furthermore, the power signal output unit (5916) may be provided in a metal material having a high conductivity to smoothly and efficiently output a power signal transformed by the at least one secondary winding (5910). The power signal output unit (5916) may be provided as a terminal lug.

As apparent from the foregoing, the planar transformer (5900) according to the thirtieth exemplary embodiment of the present invention includes the core (5902), the bobbin (5904), the at least one primary winding (5906), the first insulation unit (5908), the at least one secondary winding (5910), the second insulation unit (5912), the at least another primary winding (5917) and the fourth insulation unit (5919).

Therefore, a planar transformer (5900) can be manufactured in a slim size using the technical feature of the planar transformer (5900) according to the thirtieth exemplary embodiment of the present invention, such that a power supply unit (not shown) that is manufactured along with the planar transformer (5900) can be manufactured in a slim size. Furthermore, the planar transformer (5900) according to the thirtieth exemplary embodiment of the present invention can reduce the manufacturing cost of the planar transformer (5900) to enhance the efficiency of transformation.

Thirty First Exemplary Embodiment

Figure 61:
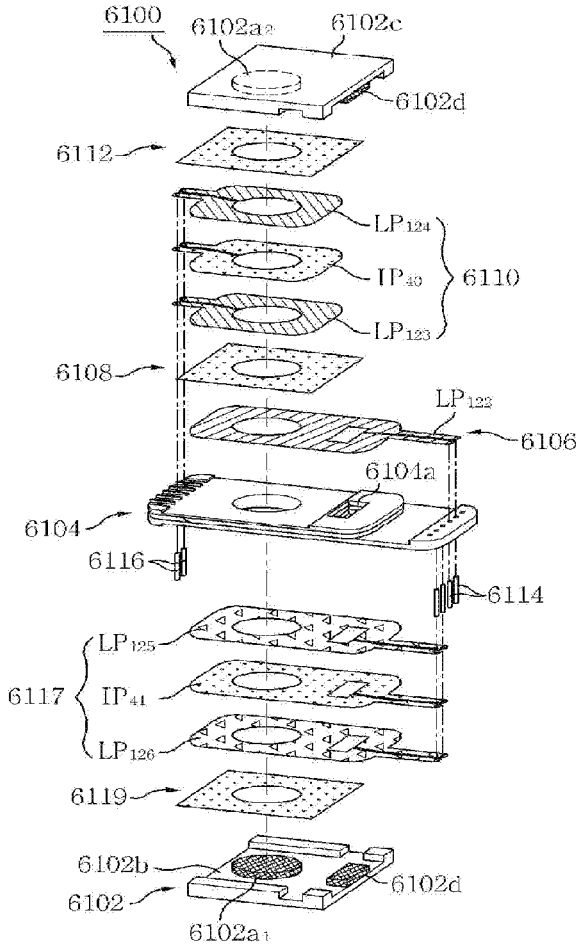
FIG. 61 is an exploded perspective view illustrating a planar transformer according to a thirty first exemplary embodiment of the present invention.
Figure 62:
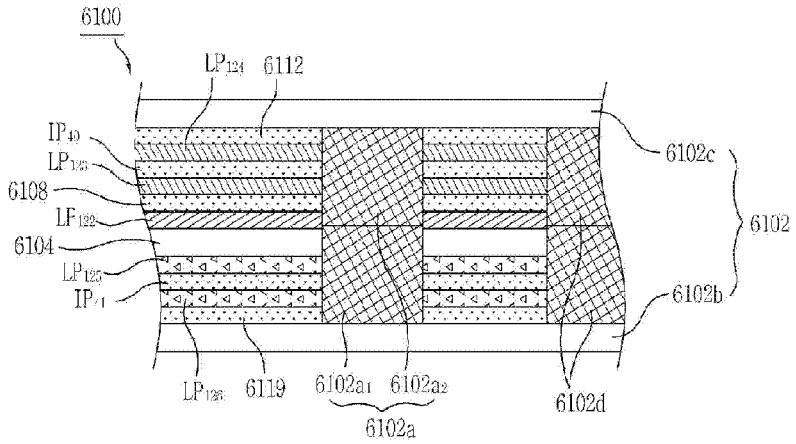
FIG. 62 is a coupled cross-sectional view illustrating a planar transformer according to a thirty first exemplary embodiment of the present invention.

FIG. 61 is an exploded perspective view illustrating a planar transformer according to a thirty first exemplary embodiment of the present invention, and FIG. 62 is a coupled cross-sectional view illustrating a planar transformer according to a thirty first exemplary embodiment of the present invention.

First, referring to FIGS. 61 and 62, a planar transformer (6100) according to the thirty first exemplary embodiment of the present invention includes a core (6102), a bobbin (6104), at least one primary winding (6106), a first insulation unit (6108), at least one secondary winding (6110), a second insulation unit (6112), at least another primary winding (6117) and a fourth insulation unit (6119).

The core (6102) includes a first fastening unit (6102*a*) and is provided to induce formation of a magnetic field, where the core (6102) may include a bottom core (6102*b*) and an upper core (6102*c*). The bobbin (6104) is so provided as to be coupled to the core (6102) by the first fastening unit (6102*a*). The first fastening unit (6102*a*) may include first fastening lugs (6102*a*1, 6102*a*2).

The bobbin (6104) may include a second fastening unit (6104*a*) discrete from the first fastening unit (6102*a*), and the core (6102) may include a third fastening unit (6102*d*) to be coupled to the second fastening unit (6104*a*). At this time, the second fastening unit (6104*a*) may be provided as a second fastening hole (6104*a*), and the third fastening unit (6102*d*) may be provided to the bottom core (6102*b*) and the upper core (6102*c*), and may be provided as a third fastening lug (6102*d*) so as to be coupled to the second fastening hole (6104*a*).

The at least one primary winding (6106) is provided between the core (6102) and the bobbin (6104), and provided at an upper surface of the bobbin (6104) to be coupled to the first fastening unit (6102*a*) for supply of a power signal.

At this time, the at least one primary winding (6106) may include a metal thin film pattern layer (LP122) having an inductance component. The metal thin film pattern layer (LP122) having an inductance component may be provided in a metal material having a high conductivity to smoothly and efficiently supply a power signal supplied by a power signal supply unit (6114, described later).

The metal thin film pattern layer (LP122) having an inductance component may be formed by at least one engineering method of a photo-lithography method using a photo mask and an etching solution, or an injection molding method using a press. The at least one primary winding (6106) may be provided in at least one of a circular shape, an oval shape and a polygon shape.

The first insulation unit (6108) is provided to an upper surface of the at least one primary winding (6106) and coupled to the first fastening unit (6102*a*) to insulate the at least one primary winding (6106). At this time, the first insulation unit (6108) may be provided as an insulation sheet, and may be provided in at least one of a circular shape, an oval shape and a polygon shape.

The at least one secondary winding (6110) is provided to an upper surface of the first insulation unit (6108), coupled to the first fastening unit (6102*a*) and insulated by the first insulation unit (6108) to transform a power signal.

At this time, the at least one secondary winding (6110) may include metal thin film pattern layers (LP123, LP124) having at least two or more inductance components, and at least one secondary insulation layer (IP40) provided between the metal thin film pattern layers (LP123, LP124) having at least two or more inductance components to insulate the metal thin film pattern layers (LP123, LP124) having at least two or more inductance components.

Furthermore, the metal thin film pattern layers (LP123, LP124) having at least two or more inductance components may be provided in a metal material having a high conductivity to smoothly and efficiently output a power signal transformed by the at least one secondary winding (6110).

The metal thin film pattern layers (LP123, LP124) having at least two or more inductance components may be formed by at least one engineering method of a photo-lithography method using a photo mask and an etching solution, or an injection molding method using a press. The at least one secondary winding (6110) may be provided in at least one of a circular shape, an oval shape and a polygon shape.

The second insulation unit (6112) is provided to an upper surface of the at least one secondary winding (6110), and coupled to the first fastening unit (6102*a*) to insulate the at least one secondary winding (6110). At this time, the second insulation unit (6112) may be provided as an insulation sheet, and may be provided in at least one of a circular shape, an oval shape and a polygon shape.

The at least another primary winding (6117) is provided between the core (6102) and the bobbin (6104), and provided to a bottom surface of the bobbin (6104) to be coupled to the first fastening unit (6102*a*) for supply of a power signal.

At this time, the at least another primary winding (6117) may include metal thin film pattern layers (LP125, LP126) having at least two or more inductance components, and at least another primary insulation layer (IP41) provided between the metal thin film pattern layers (LP125, LP126) having at least two or more inductance components to insulate the metal thin film pattern layers (LP125, LP126) having at least two or more inductance components.

The metal thin film pattern layers (LP125, LP126) having at least two or more inductance components may be provided in a metal material having a high conductivity to smoothly and efficiently supply a power signal supplied by a power signal supply unit (6114, described later).

The metal thin film pattern layers (LP125, LP126) having at least two or more inductance components may be formed by at least one engineering method of a photo-lithography method using a photo mask and an etching solution, or an injection molding method using a press. The at least another primary winding (6117) may be provided in at least one of a circular shape, an oval shape and a polygon shape.

The fourth insulation unit (6119) is provided to a bottom surface of the at least another primary winding (6117), and coupled to the first fastening unit (6102*a*) to insulate the at least another primary winding (6117). The fourth insulation unit (6119) may be provided as an insulation sheet, and may be provided in at least one of a circular shape, an oval shape and a polygon shape.

A power signal supply unit (6114) may be coupled to one side of the bobbin (6104) to be electrically connected to the at least one primary winding (6106), whereby a power signal can be supplied to the at least one primary winding (6106). At this time, the power signal supply unit (6114) may be electrically connected to a distal end of one side of the bobbin (6104) and a distal end of the at least one primary winding (6106).

Furthermore, the power signal supply unit (6114) may be coupled to another side of the bobbin (6104) to be electrically connected to the at least another primary winding (6117), whereby a power signal can be supplied to the at least another primary winding (6117). At this time, the power signal supply unit (6114) may be electrically connected to a distal end of another side of the bobbin (6104) and a distal end of the at least another primary winding (6117).

The power signal supply unit (6114) may be provided in a metal material having a high conductivity to smoothly and efficiently supply a power signal to the at least one primary winding (6106) or to the at least another primary winding (6117). At this time, the power signal supply unit (6114) may be provided as a terminal lug.

A power signal output unit (6116) may be coupled to the other side of the bobbin (6104) to be electrically connected to the at least one secondary winding (6110), whereby a power signal transformed by the at least one secondary winding (6110) can be outputted. At this time, the power signal output unit (6116) may be electrically connected to a distal end of the other side of the bobbin (6104) and a distal end of the at least one secondary winding (6110).

Furthermore, the power signal output unit (6116) may be provided in a metal material having a high conductivity to smoothly and efficiently output a power signal transformed by the at least one secondary winding (6110). The power signal output unit (6116) may be provided as a terminal lug.

As apparent from the foregoing, the planar transformer (6100) according to the thirty first exemplary embodiment of the present invention includes the core (6102), the bobbin (6104), the at least one primary winding (6106), the first insulation unit (6108), the at least one secondary winding (6110), the second insulation unit (6112), the at least another primary winding (6117) and the fourth insulation unit (6119).

Therefore, a planar transformer (6100) can be manufactured in a slim size using the technical feature of the planar transformer (6100) according to the thirty first exemplary embodiment of the present invention, such that a power supply unit (not shown) that is manufactured along with the planar transformer (6100) can be manufactured in a slim size. Furthermore, the planar transformer (6100) according to the thirty first exemplary embodiment of the present invention can reduce the manufacturing cost of the planar transformer (6100) to enhance the efficiency of transformation.

Thirty Second Exemplary Embodiment

Figure 63:
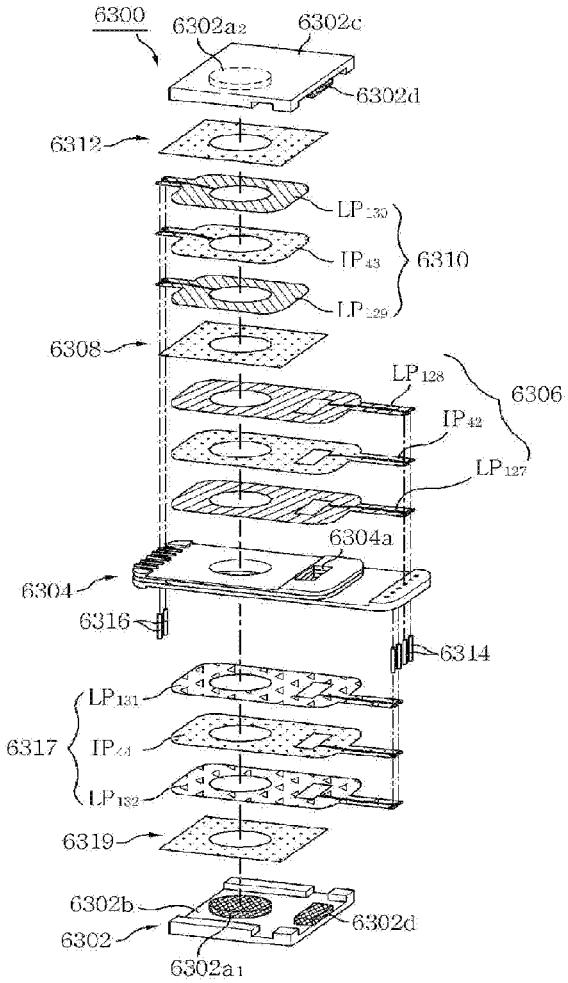
FIG. 63 is an exploded perspective view illustrating a planar transformer according to a thirty second exemplary embodiment of the present invention.
Figure 64:
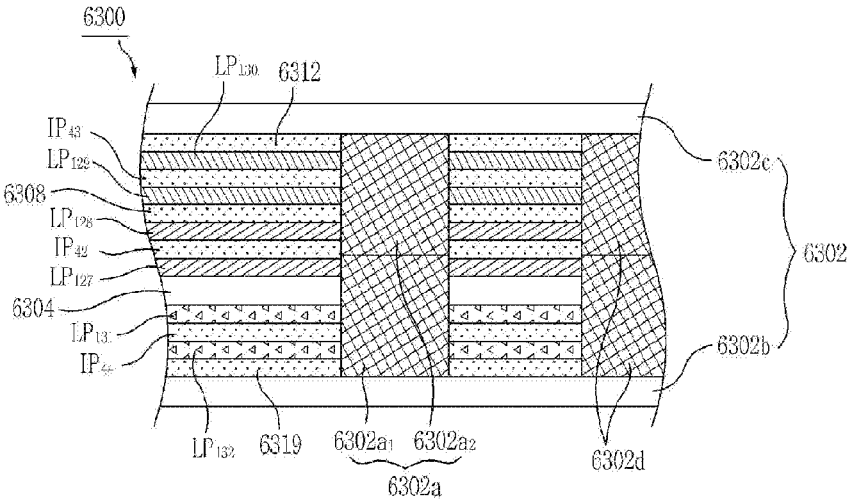
FIG. 64 is a coupled cross-sectional view illustrating a planar transformer according to a thirty second exemplary embodiment of the present invention.

FIG. 63 is an exploded perspective view illustrating a planar transformer according to a thirty second exemplary embodiment of the present invention, and FIG. 64 is a coupled cross-sectional view illustrating a planar transformer according to a thirty second exemplary embodiment of the present invention.

First, referring to FIGS. 63 and 64, a planar transformer (6300) according to the thirty second exemplary embodiment of the present invention includes a core (6302), a bobbin (6304), at least one primary winding (6306), a first insulation unit (6308), at least one secondary winding (6310), a second insulation unit (6312), at least another primary winding (6317) and a fourth insulation unit (6319).

The core (6302) includes a first fastening unit (6302*a*) and is provided to induce formation of a magnetic field, where the core (6302) may include a bottom core (6302*b*) and an upper core (6302*c*). The bobbin (6304) is so provided as to be coupled to the core (6302) by the first fastening unit (6302*a*). The first fastening unit (6302*a*) may include first fastening lugs (6302*a*1, 6302*a*2).

The first fastening lug (6302*a*1) may be provided to the bottom core (6302*b*), and the first fastening lug (6302*a*2) may be provided to the upper core (6302*c*) to be coupled to the first fastening lug (6302*a*1).

Furthermore, the bobbin (6304) may include a second fastening unit (6304*a*) discrete from the first fastening unit (6302*a*), and the core (6302) may include a third fastening unit (6302*d*) to be coupled to the second fastening unit (6304*a*). At this time, the second fastening unit (6304*a*) may be provided as a second fastening hole (6304*a*), and the third fastening unit (6302*d*) may be provided to the bottom core (6302*b*) and the upper core (6302*c*), and may be provided as a third fastening lug (6302*d*) so as to be coupled to the second fastening hole (6304*a*) The at least one primary winding (6306) is provided between the core (6302) and the bobbin (6304), and provided at an upper surface of the bobbin (6304) to be coupled to the first fastening unit (6302*a*) for supply of a power signal.

At this time, the at least one primary winding (6306) may include metal thin film pattern layers (LP127, LP128) having at least two or more inductance components, and at least one primary insulation layer (IP42) provided between the metal thin film pattern layers (LP127, LP128) having at least two or more inductance components to insulate the metal thin film pattern layers (LP127, LP128) having at least two or more inductance components.

The metal thin film pattern layers (LP127, LP128) having at least two or more inductance components may be provided in a metal material having a high conductivity to smoothly and efficiently supply a power signal supplied by a power signal supply unit (6314, described later).

The metal thin film pattern layers (LP127, LP128) having at least two or more inductance components may be formed by at least one engineering method of a photo-lithography method using a photo mask and an etching solution, or an injection molding method using a press. The at least one primary winding (6306) may be provided in at least one of a circular shape, an oval shape and a polygon shape.

The first insulation unit (6308) is provided to an upper surface of the at least one primary winding (6306) and coupled to the first fastening unit (6302*a*) to insulate the at least one primary winding (6306). At this time, the first insulation unit (6308) may be provided as an insulation sheet, and may be provided in at least one of a circular shape, an oval shape and a polygon shape.

The at least one secondary winding (6310) is provided to an upper surface of the first insulation unit (6308), coupled to the first fastening unit (6302*a*) and insulated by the first insulation unit (6308) to transform a power signal.

At this time, the at least one secondary winding (6310) may include metal thin film pattern layers (LP129, LP130) having at least two or more inductance components, and at least one secondary insulation layer (IP43) provided between the metal thin film pattern layers (LP129, LP130) having at least two or more inductance components to insulate the metal thin film pattern layers (LP129, LP130) having at least two or more inductance components.

Furthermore, the metal thin film pattern layers (LP129, LP130) having at least two or more inductance components may be provided in a metal material having a high conductivity to smoothly and efficiently output a power signal transformed by the at least one secondary winding (6310).

The metal thin film pattern layers (LP129, LP130) having at least two or more inductance components may be formed by at least one engineering method of a photo-lithography method using a photo mask and an etching solution, or an injection molding method using a press. The at least one secondary winding (6310) may be provided in at least one of a circular shape, an oval shape and a polygon shape.

The second insulation unit (6312) is provided to an upper surface of the at least one secondary winding (6310), and coupled to the first fastening unit (6302*a*) to insulate the at least one secondary winding (6310). At this time, the second insulation unit (6312) may be provided as an insulation sheet, and may be provided in at least one of a circular shape, an oval shape and a polygon shape.

The at least another primary winding (6317) is provided between the core (6302) and the bobbin (6304), and provided to a bottom surface of the bobbin (6304) to be coupled to the first fastening unit (6302*a*) for supply of a power signal.

At this time, the at least another primary winding (6317) may include metal thin film pattern layers (LP131, LP132) having at least two or more inductance components, and at least another primary insulation layer (IP44) provided between the metal thin film pattern layers (LP131, LP132) having at least two or more inductance components to insulate the metal thin film pattern layers (LP131, LP132) having at least two or more inductance components.

The metal thin film pattern layers (LP131, LP132) having at least two or more inductance components may be provided in a metal material having a high conductivity to smoothly and efficiently supply a power signal supplied by a power signal supply unit (6314, described later).

The metal thin film pattern layers (LP131, LP132) having at least two or more inductance components may be formed by at least one engineering method of a photo-lithography method using a photo mask and an etching solution, or an injection molding method using a press. The at least another primary winding (6317) may be provided in at least one of a circular shape, an oval shape and a polygon shape.

The fourth insulation unit (6319) is provided to a bottom surface of the at least another primary winding (6317), and coupled to the first fastening unit (6302*a*) to insulate the at least another primary winding (6317). The fourth insulation unit (6319) may be provided as an insulation sheet, and may be provided in at least one of a circular shape, an oval shape and a polygon shape.

A power signal supply unit (6314) may be coupled to one side of the bobbin (6304) to be electrically connected to the at least one primary winding (6306), whereby a power signal can be supplied to the at least one primary winding (6306). At this time, the power signal supply unit (6314) may be electrically connected to a distal end of one side of the bobbin (6304) and a distal end of the at least one primary winding (6306).

Furthermore, the power signal supply unit (6314) may be coupled to another side of the bobbin (6304) to be electrically connected to the at least another primary winding (6317), whereby a power signal can be supplied to the at least another primary winding (6317). At this time, the power signal supply unit (6314) may be electrically connected to a distal end of another side of the bobbin (6304) and a distal end of the at least another primary winding (6317).

The power signal supply unit (6314) may be provided in a metal material having a high conductivity to smoothly and efficiently supply a power signal to the at least one primary winding (6306) or to the at least another primary winding (6317). At this time, the power signal supply unit (6314) may be provided as a terminal lug.

A power signal output unit (6316) may be coupled to the other side of the bobbin (6304) to be electrically connected to the at least one secondary winding (6310), whereby a power signal transformed by the at least one secondary winding (6310) can be outputted. At this time, the power signal output unit (6316) may be electrically connected to a distal end of the other side of the bobbin (6304) and a distal end of the at least one secondary winding (6310).

Furthermore, the power signal output unit (6316) may be provided in a metal material having a high conductivity to smoothly and efficiently output a power signal transformed by the at least one secondary winding (6310). The power signal output unit (6316) may be provided as a terminal lug.

As apparent from the foregoing, the planar transformer (6300) according to the thirty second exemplary embodiment of the present invention includes the core (6302), the bobbin (6304), the at least one primary winding (6306), the first insulation unit (6308), the at least one secondary winding (6310), the second insulation unit (6312), the at least another primary winding (6317) and the fourth insulation unit (6319).

Therefore, a planar transformer (6300) can be manufactured in a slim size using the technical feature of the planar transformer (6300) according to the thirty second exemplary embodiment of the present invention, such that a power supply unit (not shown) that is manufactured along with the planar transformer (6300) can be manufactured in a slim size. Furthermore, the planar transformer (6300) according to the thirty second exemplary embodiment of the present invention can reduce the manufacturing cost of the planar transformer (6300) to enhance the efficiency of transformation.

Thirty Third Exemplary Embodiment

Figure 65:
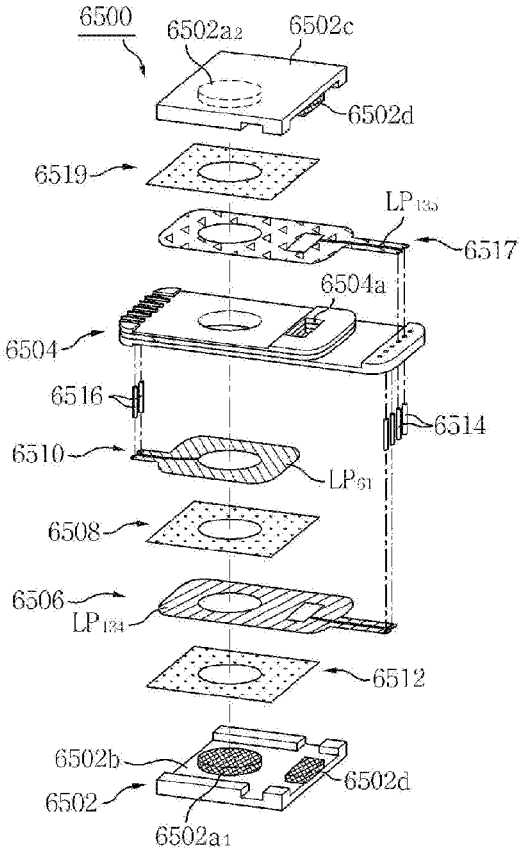
FIG. 65 is an exploded perspective view illustrating a planar transformer according to a thirty third exemplary embodiment of the present invention.
Figure 66:
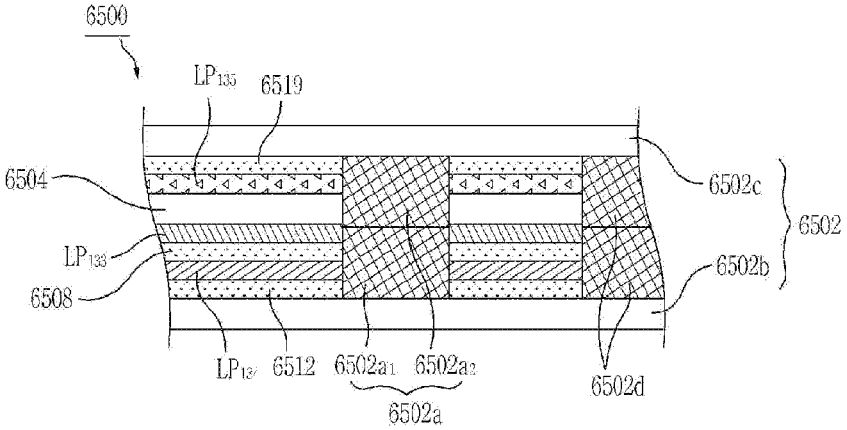
FIG. 66 is a coupled cross-sectional view illustrating a planar transformer according to a thirty third exemplary embodiment of the present invention.

FIG. 65 is an exploded perspective view illustrating a planar transformer according to a thirty third exemplary embodiment of the present invention, and FIG. 66 is a coupled cross-sectional view illustrating a planar transformer according to a thirty third exemplary embodiment of the present invention.

First, referring to FIGS. 65 and 66, a planar transformer (6500) according to the thirty third exemplary embodiment of the present invention includes a core (6502), a bobbin (6504), at least one primary winding (6506), a first insulation unit (6508), at least one secondary winding (6510), a second insulation unit (6512), at least another primary winding (6517) and a fourth insulation unit (6519).

The core (6502) includes a first fastening unit (6502*a*) and is provided to induce formation of a magnetic field, where the core (6502) may include a bottom core (6502*b*) and an upper core (6502*c*). The bobbin (6504) is so provided as to be coupled to the core (6502) by the first fastening unit (6502*a*). The first fastening unit (6502*a*) may include first fastening lugs (6502*a*1, 6502*a*2).

Furthermore, the bobbin (6504) may include a second fastening unit (6504*a*) discrete from the first fastening unit (6502*a*), and the core (6502) may include a third fastening unit (6502*d*) to be coupled to the second fastening unit (6504*a*). At this time, the second fastening unit (6504*a*) may be provided as a second fastening hole (6504*a*), and the third fastening unit (6502*d*) may be provided to the bottom core (6502*b*) and the upper core (6502*c*), and may be provided as a third fastening lug (6502*d*) so as to be coupled to the second fastening hole (6504*a*) The at least one secondary winding (6510) is provided between the core (6502) and the bobbin (6504), and provided at a bottom surface of the bobbin (6504) to be coupled to the first fastening unit (6502*a*) for supply of a power signal.

At this time, the at least one secondary winding (6510) may include a metal thin film pattern layer (LP133) having an inductance components. The metal thin film pattern layer (LP133) having an inductance component may be provided in a metal material having a high conductivity to smoothly and efficiently supply a power signal transformed by the at least one secondary winding (6510).

The metal thin film pattern layer (LP133) having an inductance component may be formed by at least one engineering method of a photo-lithography method using a photo mask and an etching solution, or an injection molding method using a press. The at least one secondary winding (6510) may be provided in at least one shape of a circular shape, an oval shape and a polygon shape.

The first insulation unit (6508) is provided to a bottom surface of the at least one secondary winding (6510) and coupled to the first fastening unit (6502*a*) to insulate the at least one secondary winding (6510). At this time, the first insulation unit (6508) may be provided as an insulation sheet, and may be provided in at least one shape of a circular shape, an oval shape and a polygon shape.

The at least one primary winding (6506) is provided to a bottom surface of the first insulation unit (6508), coupled to the first fastening unit (6502*a*) and insulated by the first insulation unit (6508) to supply a power signal.

At this time, the at least one primary winding (6506) may include a metal thin film pattern layer (LP134) having an inductance component.

The metal thin film pattern layer (LP134) having an inductance component may be provided in a metal material having a high conductivity to smoothly and efficiently supply a power signal supplied by a power signal supply unit (6514, described later).

The metal thin film pattern layer (LP134) having an inductance component may be formed by at least one engineering method of a photo-lithography method using a photo mask and an etching solution, or an injection molding method using a press. The at least one primary winding (6506) may be provided in at least one shape of a circular shape, an oval shape and a polygon shape.

The second insulation unit (6512) is provided to a bottom surface of the at least one primary winding (6506), and coupled to the first fastening unit (6502*a*) to insulate the at least one primary winding (6506). At this time, the second insulation unit (6512) may be provided as an insulation sheet, and may be provided in at least one shape of a circular shape, an oval shape and a polygon shape.

The at least another primary winding (6517) is provided between the core (6502) and the bobbin (6504), and provided to an upper surface of the bobbin (6504) to be coupled to the first fastening unit (6502*a*) for supply of a power signal.

At this time, the at least another primary winding (6517) may include a metal thin film pattern layer (LP135) having an inductance component. The metal thin film pattern layer (LP135) having an inductance component may be provided in a metal material having a high conductivity to smoothly and efficiently supply a power signal supplied by a power signal supply unit (6514, described later).

The metal thin film pattern layer (LP135) having an inductance component may be formed by at least one engineering method of a photo-lithography method using a photo mask and an etching solution, or an injection molding method using a press. The at least another primary winding (6517) may be provided in at least one shape of a circular shape, an oval shape and a polygon shape.

The fourth insulation unit (6519) is provided to an upper surface of the at least another primary winding (6517), and coupled to the first fastening unit (6502*a*) to insulate the at least another primary winding (6517). The fourth insulation unit (6519) may be provided as an insulation sheet, and may be provided in at least one shape of a circular shape, an oval shape and a polygon shape.

A power signal supply unit (6514) may be coupled to one side of the bobbin (6504) to be electrically connected to the at least one primary winding (6506), whereby a power signal can be supplied to the at least one primary winding (6506). At this time, the power signal supply unit (6514) may be electrically connected to a distal end of one side of the bobbin (6504) and a distal end of the at least one primary winding (6506).

Furthermore, the power signal supply unit (6514) may be coupled to another side of the bobbin (6504) to be electrically connected to the at least another primary winding (6517), whereby a power signal can be supplied to the at least another primary winding (6517). At this time, the power signal supply unit (6514) may be electrically connected to a distal end of another side of the bobbin (6504) and a distal end of the at least another primary winding (6517).

The power signal supply unit (6514) may be provided in a metal material having a high conductivity to smoothly and efficiently supply a power signal to the at least one primary winding (6506) or to the at least another primary winding (6517). At this time, the power signal supply unit (6514) may be provided as a terminal lug.

A power signal output unit (6516) may be coupled to the other side of the bobbin (6504) to be electrically connected to the at least one secondary winding (6510), whereby a power signal transformed by the at least one secondary winding (6510) can be outputted. At this time, the power signal output unit (6516) may be electrically connected to a distal end of the other side of the bobbin (6504) and a distal end of the at least one secondary winding (6510).

Furthermore, the power signal output unit (6516) may be provided in a metal material having a high conductivity to smoothly and efficiently output a power signal transformed by the at least one secondary winding (6510). The power signal output unit (6516) may be provided as a terminal lug.

As apparent from the foregoing, the planar transformer (6500) according to the thirty third exemplary embodiment of the present invention includes the core (6502), the bobbin (6504), the at least one primary winding (6506), the first insulation unit (6508), the at least one secondary winding (6510), the second insulation unit (6512), the at least another primary winding (6517) and the fourth insulation unit (6519). Therefore, a planar transformer (6500) can be manufactured in a slim size using the technical feature of the planar transformer (6500) according to the thirty third exemplary embodiment of the present invention, such that a power supply unit (not shown) that is manufactured along with the planar transformer (6500) can be manufactured in a slim size. Furthermore, the planar transformer (6500) according to the thirty third exemplary embodiment of the present invention can reduce the manufacturing cost of the planar transformer (6500) to enhance the efficiency of transformation.

Thirty Fourth Exemplary Embodiment

Figure 67:
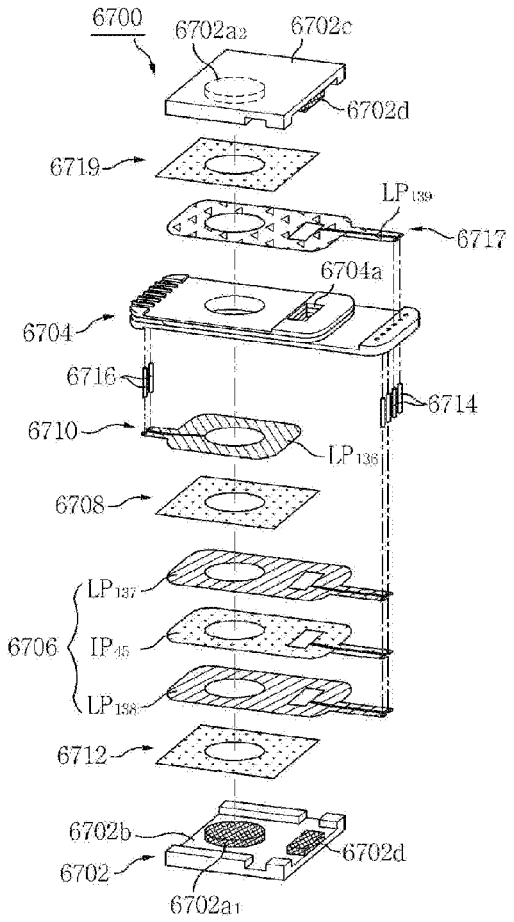
FIG. 67 is an exploded perspective view illustrating a planar transformer according to a thirty fourth exemplary embodiment of the present invention.
Figure 68:
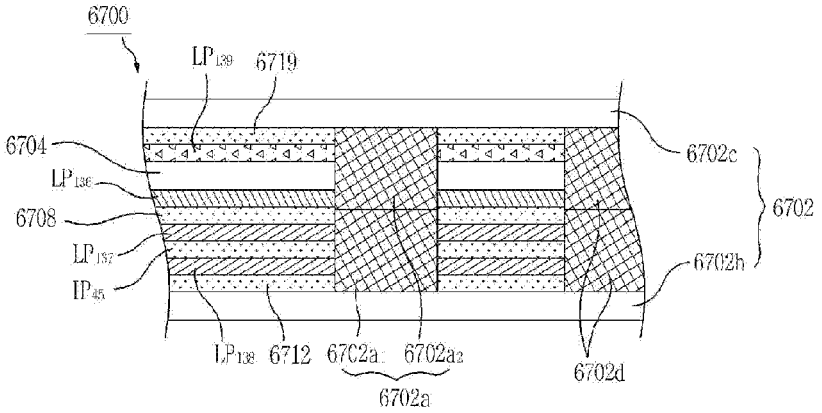
FIG. 68 is a coupled cross-sectional view illustrating a planar transformer according to a thirty fourth exemplary embodiment of the present invention.

FIG. 67 is an exploded perspective view illustrating a planar transformer according to a thirty fourth exemplary embodiment of the present invention, and FIG. 68 is a coupled cross-sectional view illustrating a planar transformer according to a thirty fourth exemplary embodiment of the present invention.

First, referring to FIGS. 67 and 68, a planar transformer (6700) according to the thirty fourth exemplary embodiment of the present invention includes a core (6702), a bobbin (6704), at least one primary winding (6706), a first insulation unit (6708), at least one secondary winding (6710), a second insulation unit (6712), at least another primary winding (6717) and a fourth insulation unit (6719).

The core (6702) includes a first fastening unit (6702*a*) and is provided to induce formation of a magnetic field, where the core (6702) may include a bottom core (6702*b*) and an upper core (6702*c*). The bobbin (6704) is so provided as to be coupled to the core (6702) by the first fastening unit (6702*a*). The first fastening unit (6702*a*) may include first fastening lugs (6702*a*1, 6702*a*2).

Furthermore, the bobbin (6704) may include a second fastening unit (6704*a*) discrete from the first fastening unit (6702*a*), and the core (6702) may include a third fastening unit (6702*d*) to be coupled to the second fastening unit (6704*a*). At this time, the second fastening unit (6704*a*) may be provided as a second fastening hole (6704*a*), and the third fastening unit (6702*d*) may be provided to the bottom core (6702*b*) and the upper core (6702*c*), and may be provided as a third fastening lug (6702*d*) so as to be coupled to the second fastening hole (6704*a*) The at least one secondary winding (6710) is provided between the core (6702) and the bobbin (6704), and provided at a bottom surface of the bobbin (6704) to be coupled to the first fastening unit (6702*a*) for supply of a transformed power signal.

At this time, the at least one secondary winding (6710) may include a metal thin film pattern layer (LP136) having an inductance component. The metal thin film pattern layer (LP136) having an inductance component may be provided in a metal material having a high conductivity to smoothly and efficiently supply a power signal transformed by the at least one secondary winding (6710).

The metal thin film pattern layer (LP136) having an inductance component may be formed by at least one engineering method of a photo-lithography method using a photo mask and an etching solution, or an injection molding method using a press. The at least one secondary winding (6710) may be provided in at least one shape of a circular shape, an oval shape and a polygon shape.

The first insulation unit (6708) is provided to a bottom surface of the at least one secondary winding (6710) and coupled to the first fastening unit (6702*a*) to insulate the at least one secondary winding (6710). At this time, the first insulation unit (6708) may be provided as an insulation sheet, and may be provided in at least one shape of a circular shape, an oval shape and a polygon shape.

The at least one primary winding (6706) is provided to a bottom surface of the first insulation unit (6708), coupled to the first fastening unit (6702*a*) and insulated by the first insulation unit (6708) to supply a power signal.

At this time, the at least one primary winding (6706) may include metal thin film pattern layers (LP137, LP138) having at least two or more inductance components, and at least one primary insulation layer (IP45) provided between the metal thin film pattern layers (LP137, LP138) having at least two or more inductance components to insulate the metal thin film pattern layers (LP137, LP138) having at least two or more inductance components.

The metal thin film pattern layers (LP137, LP138) having at least two or more inductance components may be provided in a metal material having a high conductivity to smoothly and efficiently supply a power signal supplied by a power signal supply unit (6714, described later).

The metal thin film pattern layers (LP137, LP138) having at least two or more inductance components may be formed by at least one engineering method of a photo-lithography method using a photo mask and an etching solution, or an injection molding method using a press. The at least one primary winding (6706) may be provided in at least one shape of a circular shape, an oval shape and a polygon shape.

The second insulation unit (6712) is provided to a bottom surface of the at least one primary winding (6706), and coupled to the first fastening unit (6702*a*) to insulate the at least one primary winding (6706). At this time, the second insulation unit (6712) may be provided as an insulation sheet, and may be provided in at least one shape of a circular shape, an oval shape and a polygon shape.

The at least another primary winding (6717) is provided between the core (6702) and the bobbin (6704), and provided to an upper surface of the bobbin (6704) to be coupled to the first fastening unit (6702*a*) for supply of a power signal.

At this time, the at least another primary winding (6717) may include a metal thin film pattern layer (LP139) having an inductance component. The metal thin film pattern layer having an inductance component may be provided in a metal material having a high conductivity to smoothly and efficiently supply a power signal supplied by a power signal supply unit (6714, described later).

The metal thin film pattern layer (LP139) having an inductance component may be formed by at least one engineering method of a photo-lithography method using a photo mask and an etching solution, or an injection molding method using a press. The at least another primary winding (6717) may be provided in at least one shape of a circular shape, an oval shape and a polygon shape.

The fourth insulation unit (6719) is provided to an upper surface of the at least another primary winding (6717), and coupled to the first fastening unit (6702*a*) to insulate the at least another primary winding (6717). The fourth insulation unit (6719) may be provided as an insulation sheet, and may be provided in at least one shape of a circular shape, an oval shape and a polygon shape.

A power signal supply unit (6714) may be coupled to one side of the bobbin (6704) to be electrically connected to the at least one primary winding (6706), whereby a power signal can be supplied to the at least one primary winding (6706). At this time, the power signal supply unit (6714) may be electrically connected to a distal end of one side of the bobbin (6704) and to a distal end of the at least one primary winding (6706).

Furthermore, the power signal supply unit (6714) may be coupled to another side of the bobbin (6704) to be electrically connected to the at least another primary winding (6717), whereby a power signal can be supplied to the at least another primary winding (6717). At this time, the power signal supply unit (6714) may be electrically connected to a distal end of another side of the bobbin (6704) and a distal end of the at least another primary winding (6717).

The power signal supply unit (6714) may be provided in a metal material having a high conductivity to smoothly and efficiently supply a power signal to the at least one primary winding (6706) or to the at least another primary winding (6717). At this time, the power signal supply unit (6714) may be provided as a terminal lug.

A power signal output unit (6716) may be coupled to the other side of the bobbin (6704) to be electrically connected to the at least one secondary winding (6710), whereby a power signal transformed by the at least one secondary winding (6710) can be outputted. At this time, the power signal output unit (6716) may be electrically connected to a distal end of the other side of the bobbin (6704) and a distal end of the at least one secondary winding (6710).

Furthermore, the power signal output unit (6716) may be provided in a metal material having a high conductivity to smoothly and efficiently output a power signal transformed by the at least one secondary winding (6710). The power signal output unit (6716) may be provided as a terminal lug.

As apparent from the foregoing, the planar transformer (6700) according to the thirty fourth exemplary embodiment of the present invention includes the core (6702), the bobbin (6704), the at least one primary winding (6706), the first insulation unit (6708), the at least one secondary winding (6710), the second insulation unit (6712), the at least another primary winding (6717) and the fourth insulation unit (6719).

Therefore, a planar transformer (6700) can be manufactured in a slim size using the technical feature of the planar transformer (6700) according to the thirty fourth exemplary embodiment of the present invention, such that a power supply unit (not shown) that is manufactured along with the planar transformer (6700) can be manufactured in a slim size.

Furthermore, the planar transformer (6700) according to the thirty fourth exemplary embodiment of the present invention can reduce the manufacturing cost of the planar transformer (6700) to enhance the efficiency of transformation.

Thirty Fifth Exemplary Embodiment

Figure 69:
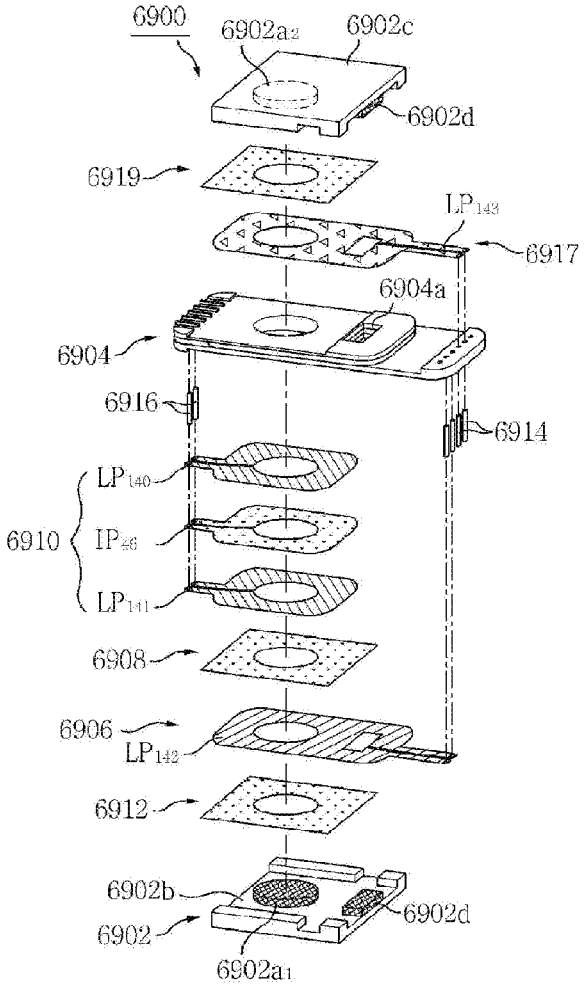
FIG. 69 is an exploded perspective view illustrating a planar transformer according to a thirty fifth exemplary embodiment of the present invention.
Figure 70:
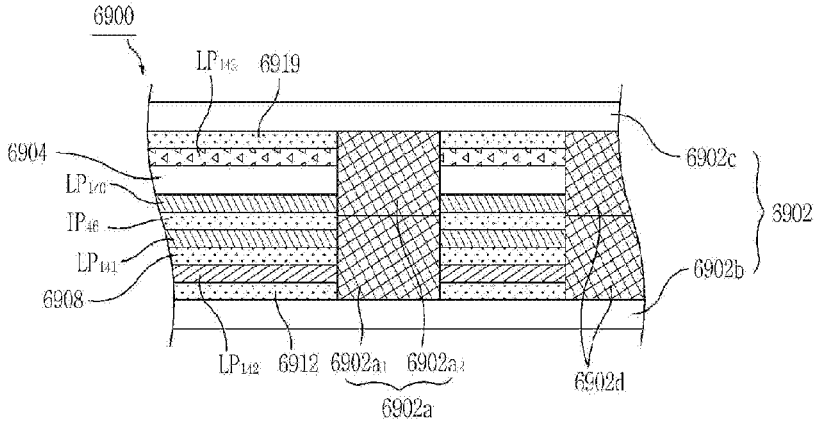
FIG. 70 is a coupled cross-sectional view illustrating a planar transformer according to a thirty fifth exemplary embodiment of the present invention.

FIG. 69 is an exploded perspective view illustrating a planar transformer according to a thirty fifth exemplary embodiment of the present invention, and FIG. 70 is a coupled cross-sectional view illustrating a planar transformer according to a thirty fifth exemplary embodiment of the present invention.

First, referring to FIGS. 69 and 70, a planar transformer (6900) according to the thirty fifth exemplary embodiment of the present invention includes a core (6902), a bobbin (6904), at least one primary winding (6906), a first insulation unit (6908), at least one secondary winding (6910), a second insulation unit (6912), at least another primary winding (6917) and a fourth insulation unit (6919).

The core (6902) includes a first fastening unit (6902*a*) and is provided to induce formation of a magnetic field, where the core (6902) may include a bottom core (6902*b*) and an upper core (6902*c*). The bobbin (6904) is so provided as to be coupled to the core (6902) by the first fastening unit (6902*a*). The first fastening unit (6902*a*) may include first fastening lugs (6902*a*1, 6902*a*2).

Furthermore, the bobbin (6904) may include a second fastening unit (6904*a*) discrete from the first fastening unit (6902*a*), and the core (6902) may include a third fastening unit (6902*d*) to be coupled to the second fastening unit (6904*a*). At this time, the second fastening unit (6904*a*) may be provided as a second fastening hole (6904*a*), and the third fastening unit (6902*d*) may be provided to the bottom core (6902*b*) and the upper core (6902*c*), and may be provided as a third fastening lug (6902*d*) so as to be coupled to the second fastening hole (6904*a*) The at least one secondary winding (6910) is provided between the core (6902) and the bobbin (6904), and provided at a bottom surface of the bobbin (6904) to be coupled to the first fastening unit (6902*a*) for supply of a transformed power signal.

At this time, the at least one secondary winding (6910) may include metal thin film pattern layers (LP140, LP141) having at least two or more inductance components, and at least one secondary insulation layer (IP46) provided between the metal thin film pattern layers (LP140, LP141) having at least two or more inductance components to insulate the metal thin film pattern layers (LP140, LP141) having at least two or more inductance components.

The metal thin film pattern layers (LP140, LP141) having at least two or more inductance components may be provided in a metal material having a high conductivity to smoothly and efficiently supply a power signal transformed by the at least one secondary winding (6910).

The metal thin film pattern layers (LP140, LP141) having at least two or more inductance components may be formed by at least one engineering method of a photo-lithography method using a photo mask and an etching solution, or an injection molding method using a press. The at least one secondary winding (6910) may be provided in at least one shape of a circular shape, an oval shape and a polygon shape.

The first insulation unit (6908) is provided to a bottom surface of the at least one secondary winding (6910) and coupled to the first fastening unit (6902*a*) to insulate the at least one secondary winding (6910). At this time, the first insulation unit (6908) may be provided as an insulation sheet, and may be provided in at least one shape of a circular shape, an oval shape and a polygon shape.

The at least one primary winding (6906) is provided to a bottom surface of the first insulation unit (6908), coupled to the first fastening unit (6902*a*) and insulated by the first insulation unit (6908) to supply a power signal.

At this time, the at least one primary winding (6906) may include a metal thin film pattern layer (LP142) having an inductance component. The metal thin film pattern layer (LP142) having an inductance component may be provided in a metal material having a high conductivity to smoothly and efficiently supply a power signal supplied by a power signal supply unit (6914, described later).

The metal thin film pattern layer (LP142) having an inductance component may be formed by at least one engineering method of a photo-lithography method using a photo mask and an etching solution, or an injection molding method using a press. The at least one primary winding (6906) may be provided in at least one shape of a circular shape, an oval shape and a polygon shape.

The second insulation unit (6912) is provided to a bottom surface of the at least one primary winding (6906), and coupled to the first fastening unit (6902*a*) to insulate the at least one primary winding (6906). At this time, the second insulation unit (6912) may be provided as an insulation sheet, and may be provided in at least one shape of a circular shape, an oval shape and a polygon shape.

The at least another primary winding (6917) is provided between the core (6902) and the bobbin (6904), and provided to an upper surface of the bobbin (6904) to be coupled to the first fastening unit (6902*a*) for supply of a power signal.

At this time, the at least another primary winding (6917) may include a metal thin film pattern layer (LP143) having an inductance component. The metal thin film pattern layer (LP143) having an inductance component may be provided in a metal material having a high conductivity to smoothly and efficiently supply a power signal supplied by a power signal supply unit (6914, described later).

The metal thin film pattern layer (LP143) having an inductance component may be formed by at least one engineering method of a photo-lithography method using a photo mask and an etching solution, or an injection molding method using a press. The at least another primary winding (6917) may be provided in at least one shape of a circular shape, an oval shape and a polygon shape.

The fourth insulation unit (6919) is provided to an upper surface of the at least another primary winding (6917), and coupled to the first fastening unit (6902*a*) to insulate the at least another primary winding (6917). The fourth insulation unit (6919) may be provided as an insulation sheet, and may be provided in at least one shape of a circular shape, an oval shape and a polygon shape.

A power signal supply unit (6914) may be coupled to one side of the bobbin (6904) to be electrically connected to the at least one primary winding (6906), whereby a power signal can be supplied to the at least one primary winding (6906). At this time, the power signal supply unit (6914) may be electrically connected to a distal end of one side of the bobbin (6904) and to a distal end of the at least one primary winding (6906).

Furthermore, the power signal supply unit (6914) may be coupled to another side of the bobbin (6904) to be electrically connected to the at least another primary winding (6917), whereby a power signal can be supplied to the at least another primary winding (6917). At this time, the power signal supply unit (6914) may be electrically connected to a distal end of another side of the bobbin (6904) and a distal end of the at least another primary winding (6917).

The power signal supply unit (6914) may be provided in a metal material having a high conductivity to smoothly and efficiently supply a power signal to the at least one primary winding (6906) or to the at least another primary winding (6917). At this time, the power signal supply unit (6914) may be provided as a terminal lug.

A power signal output unit (6916) may be coupled to the other side of the bobbin (6904) to be electrically connected to the at least one secondary winding (6910), whereby a power signal transformed by the at least one secondary winding (6910) can be outputted. At this time, the power signal output unit (6916) may be electrically connected to a distal end of the other side of the bobbin (6904) and a distal end of the at least one secondary winding (6910).

Furthermore, the power signal output unit (6916) may be provided in a metal material having a high conductivity to smoothly and efficiently output a power signal transformed by the at least one secondary winding (6910). The power signal output unit (6916) may be provided as a terminal lug.

As apparent from the foregoing, the planar transformer (6900) according to the thirty fifth exemplary embodiment of the present invention includes the core (6902), the bobbin (6904), the at least one primary winding (6906), the first insulation unit (6908), the at least one secondary winding (6910), the second insulation unit (6912), the at least another primary winding (6917) and the fourth insulation unit (6919).

Therefore, a planar transformer (6900) can be manufactured in a slim size using the technical feature of the planar transformer (6900) according to the thirty fifth exemplary embodiment of the present invention, such that a power supply unit (not shown) that is manufactured along with the planar transformer (6900) can be manufactured in a slim size. Furthermore, the planar transformer (6900) according to the thirty fifth exemplary embodiment of the present invention can reduce the manufacturing cost of the planar transformer (6900) to enhance the efficiency of transformation.

Thirty Sixth Exemplary Embodiment

Figure 71:
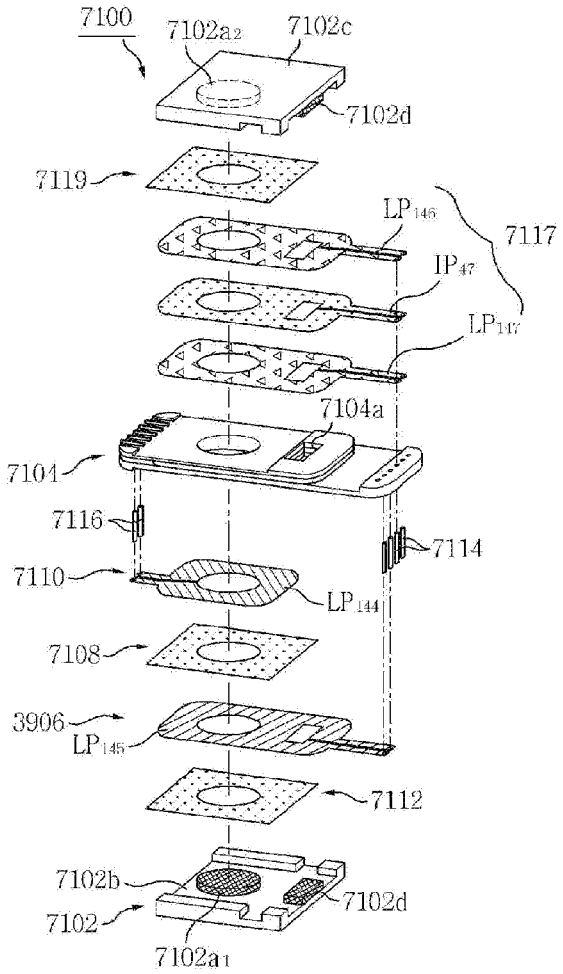
FIG. 71 is an exploded perspective view illustrating a planar transformer according to a thirty sixth exemplary embodiment of the present invention.
Figure 72:
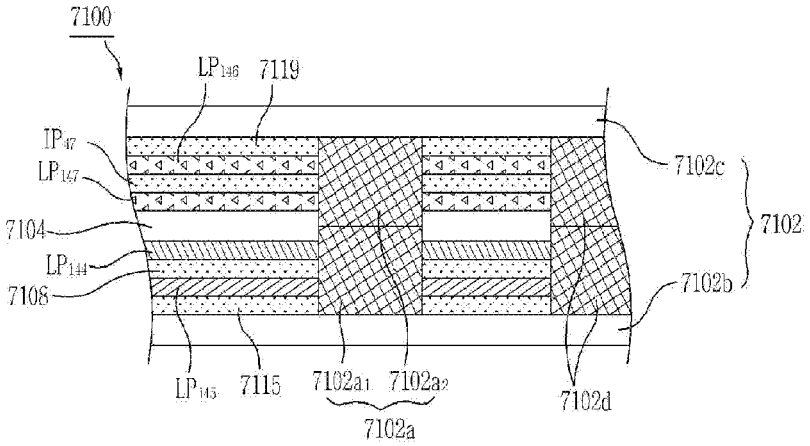
FIG. 72 is a coupled cross-sectional view illustrating a planar transformer according to a thirty sixth exemplary embodiment of the present invention.

FIG. 71 is an exploded perspective view illustrating a planar transformer according to a thirty sixth exemplary embodiment of the present invention, and FIG. 72 is a coupled cross-sectional view illustrating a planar transformer according to a thirty sixth exemplary embodiment of the present invention.

First, referring to FIGS. 71 and 72, a planar transformer (7100) according to the thirty sixth exemplary embodiment of the present invention includes a core (7102), a bobbin (7104), at least one primary winding (7106), a first insulation unit (7108), at least one secondary winding (7110), a second insulation unit (7112), at least another primary winding (7117) and a fourth insulation unit (7119).

The core (7102) includes a first fastening unit (7102*a*) and is provided to induce formation of a magnetic field, where the core (7102) may include a bottom core (7102*b*) and an upper core (7102*c*). The bobbin (7104) is so provided as to be coupled to the core (7102) by the first fastening unit (7102*a*). The first fastening unit (7102*a*) may include first fastening lugs (7102*a*1, 7102*a*2).

Furthermore, the bobbin (7104) may include a second fastening unit (7104*a*) discrete from the first fastening unit (7102*a*), and the core (7102) may include a third fastening unit (7102*d*) to be coupled to the second fastening unit (7104*a*). At this time, the second fastening unit (7104*a*) may be provided as a second fastening hole (7104*a*), and the third fastening unit (7102*d*) may be provided to the bottom core (7102*b*) and the upper core (7102*c*), and may be provided as a third fastening lug (7102*d*) so as to be coupled to the second fastening hole The at least one secondary winding (7110) is provided between the core (7102) and the bobbin (7104), and provided at a bottom surface of the bobbin (7104) to be coupled to the first fastening unit (7102*a*) for supply of a transformed power signal.

At this time, the at least one secondary winding (7110) may include a metal thin film pattern layer (LP144) having an inductance component. The metal thin film pattern layer (LP144) having an inductance component may be provided in a metal material having a high conductivity to smoothly and efficiently supply a power signal transformed by the at least one secondary winding (7110).

The metal thin film pattern layer (LP144) having an inductance component may be formed by at least one engineering method of a photo-lithography method using a photo mask and an etching solution, or an injection molding method using a press. The at least one secondary winding (7110) may be provided in at least one shape of a circular shape, an oval shape and a polygon shape.

The first insulation unit (7108) is provided to a bottom surface of the at least one secondary winding (7110) and coupled to the first fastening unit (7102*a*) to insulate the at least one secondary winding (7110). At this time, the first insulation unit (7108) may be provided as an insulation sheet, and may be provided in at least one shape of a circular shape, an oval shape and a polygon shape.

The at least one primary winding (7106) is provided to a bottom surface of the first insulation unit (7108), coupled to the first fastening unit (7102*a*) and insulated by the first insulation unit (7108) to supply a power signal.

At this time, the at least one primary winding (7106) may include a metal thin film pattern layer (LP145) having an inductance component. The metal thin film pattern layer (LP145) having an inductance component may be provided in a metal material having a high conductivity to smoothly and efficiently supply a power signal supplied by a power signal supply unit (7114, described later).

The metal thin film pattern layer (LP145) having an inductance component may be formed by at least one engineering method of a photo-lithography method using a photo mask and an etching solution, or an injection molding method using a press. The at least one primary winding (7106) may be provided in at least one shape of a circular shape, an oval shape and a polygon shape.

The second insulation unit (7112) is provided to a bottom surface of the at least one primary winding (7106), and coupled to the first fastening unit (7102*a*) to insulate the at least one primary winding (7106). At this time, the second insulation unit (7112) may be provided as an insulation sheet, and may be provided in at least one shape of a circular shape, an oval shape and a polygon shape.

The at least another primary winding (7117) is provided between the core (7102) and the bobbin (7104), and provided to an upper surface of the bobbin (7104) to be coupled to the first fastening unit (7102*a*) for supply of a power signal.

At this time, the at least another primary winding (7117) may include metal thin film pattern layers (LP146, LP147) having at least two or more inductance components, and at least another primary insulation layer (IP47) provided between the metal thin film pattern layers (LP146, LP147) having at least two or more inductance components to insulate the metal thin film pattern layers (LP146, LP147) having at least two or more inductance components.

The metal thin film pattern layers (LP146, LP147) having at least two or more inductance components may be provided in a metal material having a high conductivity to smoothly and efficiently supply a power signal supplied by a power signal supply unit (7114, described later).

The metal thin film pattern layers (LP146, LP147) having at least two or more inductance components may be formed by at least one engineering method of a photo-lithography method using a photo mask and an etching solution, or an injection molding method using a press. The at least another primary winding (7117) may be provided in at least one shape of a circular shape, an oval shape and a polygon shape.

The fourth insulation unit (7119) is provided to an upper surface of the at least another primary winding (7117), and coupled to the first fastening unit (7102*a*) to insulate the at least another primary winding (7117). The fourth insulation unit (7119) may be provided as an insulation sheet, and may be provided in at least one shape of a circular shape, an oval shape and a polygon shape.

A power signal supply unit (7114) may be coupled to one side of the bobbin (7104) to be electrically connected to the at least one primary winding (7106), whereby a power signal can be supplied to the at least one primary winding (7106). At this time, the power signal supply unit (7114) may be electrically connected to a distal end of one side of the bobbin (7104) and to a distal end of the at least one primary winding (7106).

Furthermore, the power signal supply unit (7114) may be coupled to another side of the bobbin (7104) to be electrically connected to the at least another primary winding (7117), whereby a power signal can be supplied to the at least another primary winding (7117). At this time, the power signal supply unit (7114) may be electrically connected to a distal end of another side of the bobbin (7104) and a distal end of the at least another primary winding (7117).

The power signal supply unit (7114) may be provided in a metal material having a high conductivity to smoothly and efficiently supply a power signal to the at least one primary winding (7106) or to the at least another primary winding (7117). At this time, the power signal supply unit (7114) may be provided as a terminal lug.

A power signal output unit (7116) may be coupled to the other side of the bobbin (7104) to be electrically connected to the at least one secondary winding (7110), whereby a power signal transformed by the at least one secondary winding (7110) can be outputted. At this time, the power signal output unit (7116) may be electrically connected to a distal end of the other side of the bobbin (7104) and a distal end of the at least one secondary winding (7110).

Furthermore, the power signal output unit (7116) may be provided in a metal material having a high conductivity to smoothly and efficiently output a power signal transformed by the at least one secondary winding (7110). The power signal output unit (7116) may be provided as a terminal lug.

As apparent from the foregoing, the planar transformer (7100) according to the thirty sixth exemplary embodiment of the present invention includes the core (7102), the bobbin (7104), the at least one primary winding (7106), the first insulation unit (7108), the at least one secondary winding (7110), the second insulation unit (7112), the at least another primary winding (7117) and the fourth insulation unit (7119).

Therefore, a planar transformer (7100) can be manufactured in a slim size using the technical feature of the planar transformer (7100) according to the thirty sixth exemplary embodiment of the present invention, such that a power supply unit (not shown) that is manufactured along with the planar transformer (7100) can be manufactured in a slim size. Furthermore, the planar transformer (7100) according to the thirty sixth exemplary embodiment of the present invention can reduce the manufacturing cost of the planar transformer (7100) to enhance the efficiency of transformation.

Thirty Seventh Exemplary Embodiment

Figure 73:
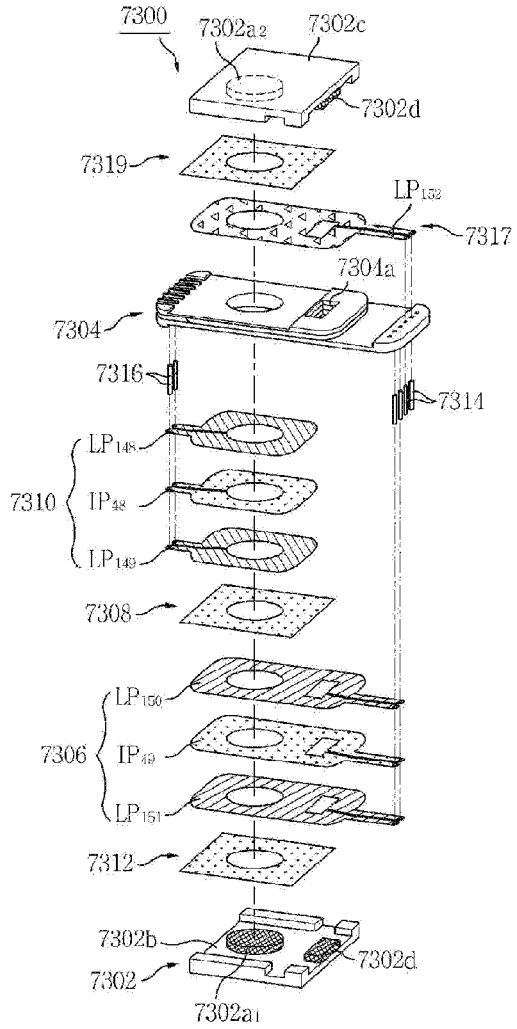
FIG. 73 is an exploded perspective view illustrating a planar transformer according to a thirty seventh exemplary embodiment of the present invention.
Figure 74:
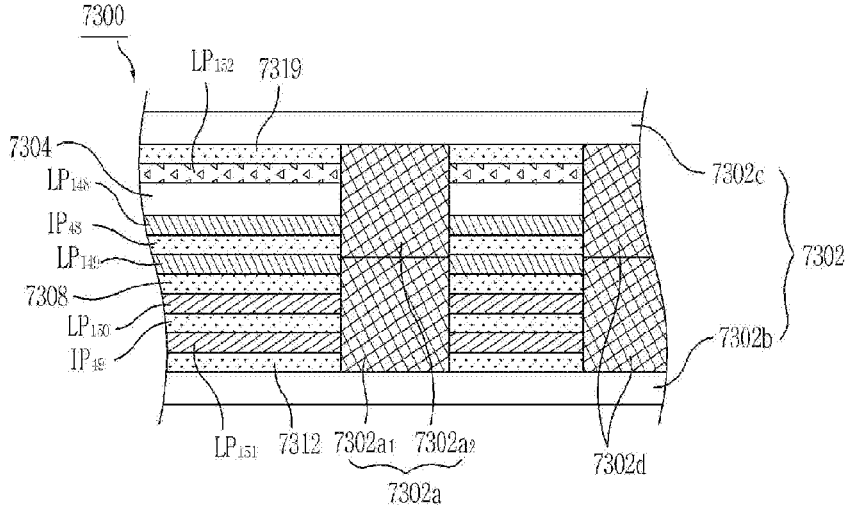
FIG. 74 is a coupled cross-sectional view illustrating a planar transformer according to a thirty seventh exemplary embodiment of the present invention.

FIG. 73 is an exploded perspective view illustrating a planar transformer according to a thirty seventh exemplary embodiment of the present invention, and FIG. 74 is a coupled cross-sectional view illustrating a planar transformer according to a thirty seventh exemplary embodiment of the present invention.

First, referring to FIGS. 73 and 74, a planar transformer (7300) according to the thirty seventh exemplary embodiment of the present invention includes a core (7302), a bobbin (7304), at least one primary winding (7306), a first insulation unit (7308), at least one secondary winding (7310), a second insulation unit (7312), at least another primary winding (7317) and a fourth insulation unit (7319).

The core (7302) includes a first fastening unit (7302*a*) and is provided to induce formation of a magnetic field, where the core (7302) may include a bottom core (7302*b*) and an upper core (7302*c*). The bobbin (7304) is so provided as to be coupled to the core (7302) by the first fastening unit (7302*a*). The first fastening unit (7302*a*) may include first fastening lugs (7302*a*1, 7302*a*2).

Furthermore, the bobbin (7304) may include a second fastening unit (7304*a*) discrete from the first fastening unit (7302*a*), and the core (7302) may include a third fastening unit (7302*d*) to be coupled to the second fastening unit (7304*a*). At this time, the second fastening unit (7304*a*) may be provided as a second fastening hole (7304*a*), and the third fastening unit (7302*d*) may be provided to the bottom core (7302*b*) and the upper core (7302*c*), and may be provided as a third fastening lug (7302*d*) so as to be coupled to the second fastening hole (7304*a*).

The at least one secondary winding (7310) is provided between the core (7302) and the bobbin (7304), and provided at a bottom surface of the bobbin (7304) to be coupled to the first fastening unit (7302*a*) for supply of a transformed power signal.

At this time, the at least one secondary winding (7310) may include metal thin film pattern layers (LP148, LP149) having at least two or more inductance components, and at least one secondary insulation layer (IP48) provided between the metal thin film pattern layers (LP148, LP149) having at least two or more inductance components to insulate the metal thin film pattern layers (LP148, LP149) having at least two or more inductance components.

The metal thin film pattern layers (LP148, LP149) having at least two or more inductance components may be provided in a metal material having a high conductivity to smoothly and efficiently output a power signal transformed by the at least one secondary winding (7310).

The metal thin film pattern layers (LP148, LP149) having at least two or more inductance components may be formed by at least one engineering method of a photo-lithography method using a photo mask and an etching solution, or an injection molding method using a press. The at least one secondary winding (7310) may be provided in at least one shape of a circular shape, an oval shape and a polygon shape.

The first insulation unit (7308) is provided to a bottom surface of the at least one secondary winding (7310) and coupled to the first fastening unit (7302*a*) to insulate the at least one secondary winding (7310). At this time, the first insulation unit (7308) may be provided as an insulation sheet, and may be provided in at least one shape of a circular shape, an oval shape and a polygon shape.

The at least one primary winding (7306) is provided to a bottom surface of the first insulation unit (7308), coupled to the first fastening unit (7302*a*) and insulated by the first insulation unit (7308) to supply a power signal.

At this time, the at least one primary winding (7306) may include metal thin film pattern layers (LP150, LP151) having at least two or more inductance components, and at least one primary insulation layer (IP49) provided between metal thin film pattern layers (LP150, LP151) having at least two or more inductance components to insulate the metal thin film pattern layers (LP150, LP151) having at least two or more inductance components.

The metal thin film pattern layers (LP150, LP151) having at least two or more inductance components may be provided in a metal material having a high conductivity to smoothly and efficiently supply a power signal supplied by a power signal supply unit (7314, described later).

The metal thin film pattern layers (LP150, LP151) having at least two or more inductance components may be formed by at least one engineering method of a photo-lithography method using a photo mask and an etching solution, or an injection molding method using a press. The at least one primary winding (7306) may be provided in at least one shape of a circular shape, an oval shape and a polygon shape.

The second insulation unit (7312) is provided to a bottom surface of the at least one primary winding (7306), and coupled to the first fastening unit (7302*a*) to insulate the at least one primary winding (7306). At this time, the second insulation unit (7312) may be provided as an insulation sheet, and may be provided in at least one shape of a circular shape, an oval shape and a polygon shape.

The at least another primary winding (7317) is provided between the core (7302) and the bobbin (7304), and provided to an upper surface of the bobbin (7304) to be coupled to the first fastening unit (7302*a*) for supply of a power signal.

At this time, the at least another primary winding (7317) may include a metal thin film pattern layer (LP152) having an inductance component. The metal thin film pattern layer (LP152) having an inductance component may be provided in a metal material having a high conductivity to smoothly and efficiently supply a power signal supplied by a power signal supply unit (7314, described later).

The metal thin film pattern layer (LP152) having an inductance component may be formed by at least one engineering method of a photo-lithography method using a photo mask and an etching solution, or an injection molding method using a press. The at least another primary winding (7317) may be provided in at least one shape of a circular shape, an oval shape and a polygon shape.

The fourth insulation unit (7319) is provided to an upper surface of the at least another primary winding (7317), and coupled to the first fastening unit (7302*a*) to insulate the at least another primary winding (7317). The fourth insulation unit (7319) may be provided as an insulation sheet, and may be provided in at least one shape of a circular shape, an oval shape and a polygon shape.

A power signal supply unit (7314) may be coupled to one side of the bobbin (7304) to be electrically connected to the at least one primary winding (7306), whereby a power signal can be supplied to the at least one primary winding (7306). At this time, the power signal supply unit (7314) may be electrically connected to a distal end of one side of the bobbin (7304) and to a distal end of the at least one primary winding (7306).

Furthermore, the power signal supply unit (7314) may be coupled to another side of the bobbin (7304) to be electrically connected to the at least another primary winding (7317), whereby a power signal can be supplied to the at least another primary winding (7317). At this time, the power signal supply unit (7314) may be electrically connected to a distal end of another side of the bobbin (7304) and a distal end of the at least another primary winding (7317).

The power signal supply unit (7314) may be provided in a metal material having a high conductivity to smoothly and efficiently supply a power signal to the at least one primary winding (7306) or to the at least another primary winding (7317). At this time, the power signal supply unit (7314) may be provided as a terminal lug.

A power signal output unit (7316) may be coupled to the other side of the bobbin (7304) to be electrically connected to the at least one secondary winding (7310), whereby a power signal transformed by the at least one secondary winding (7310) can be outputted. At this time, the power signal output unit (7316) may be electrically connected to a distal end of the other side of the bobbin (7304) and a distal end of the at least one secondary winding (7310).

Furthermore, the power signal output unit (7316) may be provided in a metal material having a high conductivity to smoothly and efficiently output a power signal transformed by the at least one secondary winding (7310). The power signal output unit (7316) may be provided as a terminal lug.

As apparent from the foregoing, the planar transformer (7300) according to the thirty seventh exemplary embodiment of the present invention includes the core (7302), the bobbin (7304), the at least one primary winding (7306), the first insulation unit (7308), the at least one secondary winding (7310), the second insulation unit (7312), the at least another primary winding (7317) and the fourth insulation unit (7319).

Therefore, a planar transformer (7300) can be manufactured in a slim size using the technical feature of the planar transformer (7300) according to the thirty seventh exemplary embodiment of the present invention, such that a power supply unit (not shown) that is manufactured along with the planar transformer (7300) can be manufactured in a slim size. Furthermore, the planar transformer (7300) according to the thirty seventh exemplary embodiment of the present invention can reduce the manufacturing cost of the planar transformer (7300) to enhance the efficiency of transformation.

Thirty Eighth Exemplary Embodiment

Figure 75:
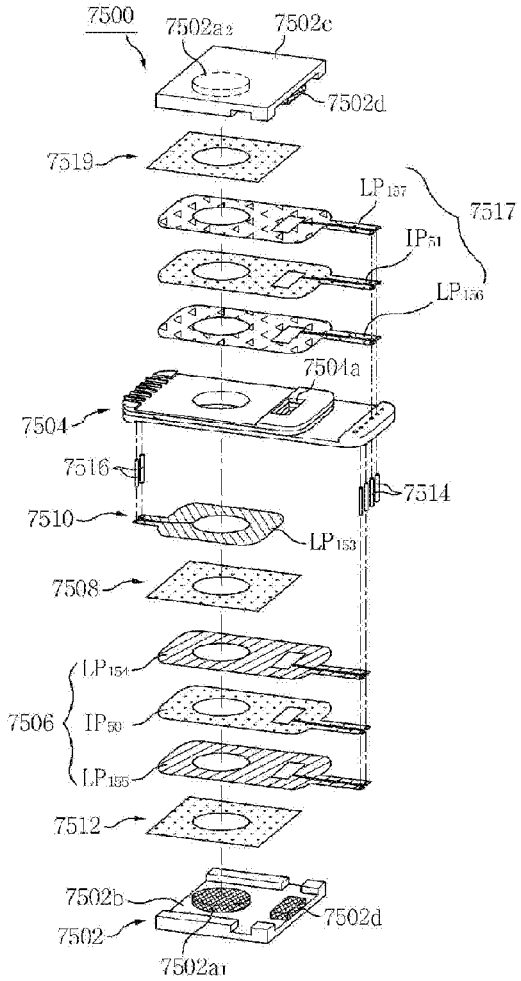
FIG. 75 is an exploded perspective view illustrating a planar transformer according to a thirty eighth exemplary embodiment of the present invention.
Figure 76:
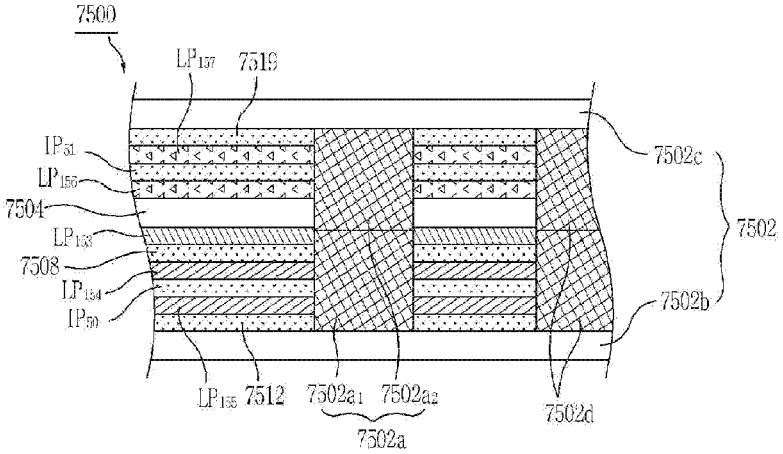
FIG. 76 is a coupled cross-sectional view illustrating a planar transformer according to a thirty eighth exemplary embodiment of the present invention.

FIG. 75 is an exploded perspective view illustrating a planar transformer according to a thirty eighth exemplary embodiment of the present invention, and FIG. 76 is a coupled cross-sectional view illustrating a planar transformer according to a thirty eighth exemplary embodiment of the present invention.

First, referring to FIGS. 75 and 76, a planar transformer (7500) according to the thirty eighth exemplary embodiment of the present invention includes a core (7502), a bobbin (7504), at least one primary winding (7506), a first insulation unit (7508), at least one secondary winding (7510), a second insulation unit (7512), at least another primary winding (7517) and a fourth insulation unit (7519).

The core (7502) includes a first fastening unit (7502*a*) and is provided to induce formation of a magnetic field, where the core (7502) may include a bottom core (7502*b*) and an upper core (7502*c*). The bobbin (7504) is so provided as to be coupled to the core (7502) by the first fastening unit (7502*a*). The first fastening unit (7502*a*) may include first fastening lugs (7502*a*1, 7502*a*2).

Furthermore, the bobbin (7504) may include a second fastening unit (7504*a*) discrete from the first fastening unit (7502*a*), and the core (7502) may include a third fastening unit (7502*d*) to be coupled to the second fastening unit (7504*a*). At this time, the second fastening unit (7504*a*) may be provided as a second fastening hole (7504*a*), and the third fastening unit (7502*d*) may be provided to the bottom core (7502*b*) and the upper core (7502*c*), and may be provided as a third fastening lug (7502*d*) so as to be coupled to the second fastening hole (7504*a*).

The at least one secondary winding (7510) is provided between the core (7502) and the bobbin (7504), and provided at a bottom surface of the bobbin (7504) to be coupled to the first fastening unit (7502*a*) for supply of a transformed power signal.

At this time, the at least one secondary winding (7510) may include a metal thin film pattern layer (LP153) having an inductance component. The metal thin film pattern layer (LP153) having an inductance component may be provided in a metal material having a high conductivity to smoothly and efficiently output a power signal transformed by the at least one secondary winding (7510).

The metal thin film pattern layer (LP153) having an inductance component may be formed by at least one engineering method of a photo-lithography method using a photo mask and an etching solution, or an injection molding method using a press. The at least one secondary winding (7510) may be provided in at least one shape of a circular shape, an oval shape and a polygon shape.

The first insulation unit (7508) is provided to a bottom surface of the at least one secondary winding (7510) and coupled to the first fastening unit (7502*a*) to insulate the at least one secondary winding (7510). At this time, the first insulation unit (7508) may be provided as an insulation sheet, and may be provided in at least one shape of a circular shape, an oval shape and a polygon shape.

The at least one primary winding (7506) is provided to a bottom surface of the first insulation unit (7508), coupled to the first fastening unit (7502*a*) and insulated by the first insulation unit (7508) to supply a power signal.

At this time, the at least one primary winding (7506) may include metal thin film pattern layers (LP154, LP155) having at least two or more inductance components, and at least one primary insulation layer (IPSO) provided between metal thin film pattern layers (LP154, LP155) having at least two or more inductance components to insulate the metal thin film pattern layers (LP154, LP155) having at least two or more inductance components.

The metal thin film pattern layers (LP154, LP155) having at least two or more inductance components may be provided in a metal material having a high conductivity to smoothly and efficiently supply a power signal supplied by a power signal supply unit (7514, described later).

The metal thin film pattern layers (LP154, LP155) having at least two or more inductance components may be formed by at least one engineering method of a photo-lithography method using a photo mask and an etching solution, or an injection molding method using a press. The at least one primary winding (7506) may be provided in at least one shape of a circular shape, an oval shape and a polygon shape.

The second insulation unit (7512) is provided to a bottom surface of the at least one primary winding (7506), and coupled to the first fastening unit (7502*a*) to insulate the at least one primary winding (7506). At this time, the second insulation unit (7512) may be provided as an insulation sheet, and may be provided in at least one shape of a circular shape, an oval shape and a polygon shape.

The at least another primary winding (7517) is provided between the core (7502) and the bobbin (7504), and provided to an upper surface of the bobbin (7504) to be coupled to the first fastening unit (7502*a*) for supply of a power signal.

At this time, the at least another primary winding (7517) may include metal thin film pattern layers (LP156, LP157) having at least two or more inductance components, and at least one primary insulation layer (IP51) provided between the metal thin film pattern layers (LP156, LP157) having at least two or more inductance components to insulate the metal thin film pattern layers (LP156, LP157) having at least two or more inductance components.

The metal thin film pattern layers (LP156, LP157) having at least two or more inductance components may be provided in a metal material having a high conductivity to smoothly and efficiently supply a power signal supplied by a power signal supply unit (7514, described later).

The metal thin film pattern layers (LP156, LP157) having at least two or more inductance components may be formed by at least one engineering method of a photo-lithography method using a photo mask and an etching solution, or an injection molding method using a press. The at least another primary winding (7517) may be provided in at least one shape of a circular shape, an oval shape and a polygon shape.

The fourth insulation unit (7519) is provided to an upper surface of the at least another primary winding (7517), and coupled to the first fastening unit (7502*a*) to insulate the at least another primary winding (7517). The fourth insulation unit (7519) may be provided as an insulation sheet, and may be provided in at least one shape of a circular shape, an oval shape and a polygon shape.

A power signal supply unit (7514) may be coupled to one side of the bobbin (7504) to be electrically connected to the at least one primary winding (7506), whereby a power signal can be supplied to the at least one primary winding (7506). At this time, the power signal supply unit (7514) may be electrically connected to a distal end of one side of the bobbin (7504) and to a distal end of the at least one primary winding (7506).

Furthermore, the power signal supply unit (7514) may be coupled to another side of the bobbin (7504) to be electrically connected to the at least another primary winding (7517), whereby a power signal can be supplied to the at least another primary winding (7517). At this time, the power signal supply unit (7514) may be electrically connected to a distal end of another side of the bobbin (7504) and a distal end of the at least another primary winding (7517).

The power signal supply unit (7514) may be provided in a metal material having a high conductivity to smoothly and efficiently supply a power signal to the at least one primary winding (7506) or to the at least another primary winding (7517). At this time, the power signal supply unit (7514) may be provided as a terminal lug.

A power signal output unit (7516) may be coupled to the other side of the bobbin (7504) to be electrically connected to the at least one secondary winding (7510), whereby a power signal transformed by the at least one secondary winding (7510) can be outputted. At this time, the power signal output unit (7516) may be electrically connected to a distal end of the other side of the bobbin (7504) and a distal end of the at least one secondary winding (7510).

Furthermore, the power signal output unit (7516) may be provided in a metal material having a high conductivity to smoothly and efficiently output a power signal transformed by the at least one secondary winding (7510). The power signal output unit (7516) may be provided as a terminal lug.

As apparent from the foregoing, the planar transformer (7500) according to the thirty eighth exemplary embodiment of the present invention includes the core (7502), the bobbin (7504), the at least one primary winding (7506), the first insulation unit (7508), the at least one secondary winding (7510), the second insulation unit (7512), the at least another primary winding (7517) and the fourth insulation unit (7519).

Therefore, a planar transformer (7500) can be manufactured in a slim size using the technical feature of the planar transformer (7500) according to the thirty eighth exemplary embodiment of the present invention, such that a power supply unit (not shown) that is manufactured along with the planar transformer (7500) can be manufactured in a slim size. Furthermore, the planar transformer (7500) according to the thirty eighth exemplary embodiment of the present invention can reduce the manufacturing cost of the planar transformer (7500) to enhance the efficiency of transformation.

Thirty Ninth Exemplary Embodiment

Figure 77:
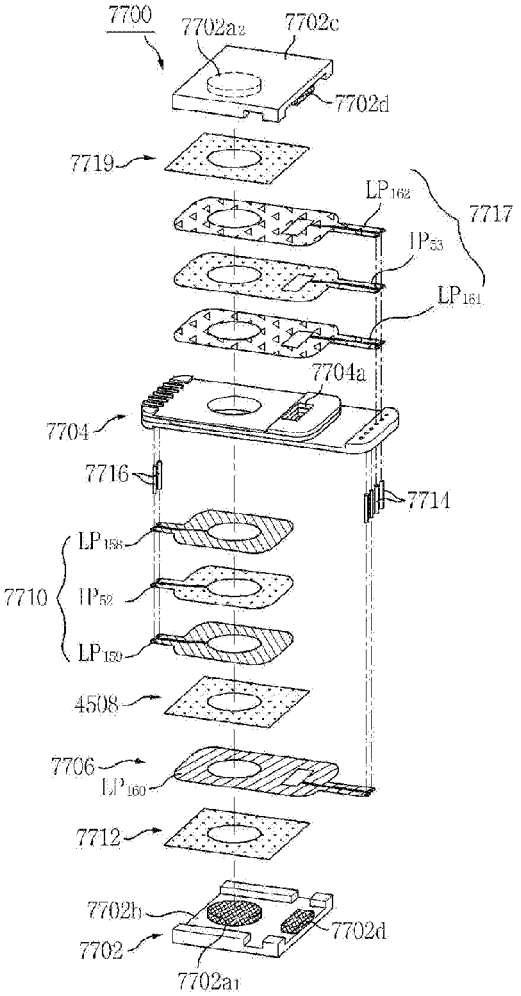
FIG. 77 is an exploded perspective view illustrating a planar transformer according to a thirty ninth exemplary embodiment of the present invention.
Figure 78:
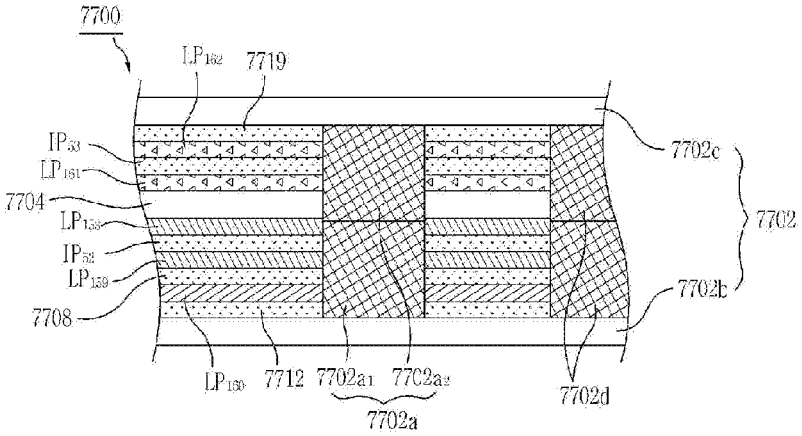
FIG. 78 is a coupled cross-sectional view illustrating a planar transformer according to a thirty ninth exemplary embodiment of the present invention.

FIG. 77 is an exploded perspective view illustrating a planar transformer according to a thirty ninth exemplary embodiment of the present invention, and FIG. 78 is a coupled cross-sectional view illustrating a planar transformer according to a thirty ninth exemplary embodiment of the present invention.

First, referring to FIGS. 77 and 78, a planar transformer (7700) according to the thirty ninth exemplary embodiment of the present invention includes a core (7702), a bobbin (7704), at least one primary winding (7706), a first insulation unit (7708), at least one secondary winding (7710), a second insulation unit (7712), at least another primary winding (7717) and a fourth insulation unit (7719).

The core (7702) includes a first fastening unit (7702*a*) and is provided to induce formation of a magnetic field, where the core (7702) may include a bottom core (7702*b*) and an upper core (7702*c*). The bobbin (7704) is so provided as to be coupled to the core (7702) by the first fastening unit (7702*a*). The first fastening unit (7702*a*) may include first fastening lugs (7702*a*1, 7702*a*2).

Furthermore, the bobbin (7704) may include a second fastening unit (7704*a*) discrete from the first fastening unit (7702*a*), and the core (7702) may include a third fastening unit (7702*d*) to be coupled to the second fastening unit (7704*a*). At this time, the second fastening unit (7704*a*) may be provided as a second fastening hole (7704*a*), and the third fastening unit (7702*d*) may be provided to the bottom core (7702*b*) and the upper core (7702*c*), and may be provided as a third fastening lug (7702*d*) so as to be coupled to the second fastening hole (7704*a*).

The at least one secondary winding (7710) is provided between the core (7702) and the bobbin (7704), and provided at a bottom surface of the bobbin (7704) to be coupled to the first fastening unit (7702*a*) for supply of a transformed power signal.

At this time, the at least one secondary winding (7710) may include metal thin film pattern layers (LP158, LP159) having at least two or more inductance components, and at least one secondary insulation layer (IP52) provided between the metal thin film pattern layers (LP158, LP159) having at least two or more inductance components to insulate the metal thin film pattern layers (LP158, LP159) having at least two or more inductance components.

The metal thin film pattern layers (LP158, LP159) having at least two or more inductance components may be provided in a metal material having a high conductivity to smoothly and efficiently output a power signal transformed by the at least one secondary winding (7710).

The metal thin film pattern layers (LP158, LP159) having at least two or more inductance components may be formed by at least one engineering method of a photo-lithography method using a photo mask and an etching solution, or an injection molding method using a press. The at least one secondary winding (7710) may be provided in at least one shape of a circular shape, an oval shape and a polygon shape.

The first insulation unit (7708) is provided to a bottom surface of the at least one secondary winding (7710) and coupled to the first fastening unit (7702*a*) to insulate the at least one secondary winding (7710). At this time, the first insulation unit (7708) may be provided as an insulation sheet, and may be provided in at least one shape of a circular shape, an oval shape and a polygon shape.

The at least one primary winding (7706) is provided to a bottom surface of the first insulation unit (7708), coupled to the first fastening unit (7702*a*) and insulated by the first insulation unit (7708) to supply a power signal.

At this time, the at least one primary winding (7706) may include a metal thin film pattern layer (LP160) having an inductance component. The metal thin film pattern layer (LP160) having an inductance component may be provided in a metal material having a high conductivity to smoothly and efficiently supply a power signal supplied by a power signal supply unit (7714, described later).

The metal thin film pattern layer (LP160) having an inductance component may be formed by at least one engineering method of a photo-lithography method using a photo mask and an etching solution, or an injection molding method using a press. The at least one primary winding (7706) may be provided in at least one shape of a circular shape, an oval shape and a polygon shape.

The second insulation unit (7712) is provided to a bottom surface of the at least one primary winding (7706), and coupled to the first fastening unit (7702*a*) to insulate the at least one primary winding (7706). At this time, the second insulation unit (7712) may be provided as an insulation sheet, and may be provided in at least one shape of a circular shape, an oval shape and a polygon shape.

The at least another primary winding (7717) is provided between the core (7702) and the bobbin (7704), and provided to an upper surface of the bobbin (7704) to be coupled to the first fastening unit (7702*a*) for supply of a power signal.

At this time, the at least another primary winding (7717) may include metal thin film pattern layers (LP161, LP162) having at least two or more inductance components, and at least one primary insulation layer (IP53) provided between the metal thin film pattern layers (LP161, LP162) having at least two or more inductance components to insulate the metal thin film pattern layers (LP161, LP162) having at least two or more inductance components.

The metal thin film pattern layers (LP161, LP162) having at least two or more inductance components may be provided in a metal material having a high conductivity to smoothly and efficiently supply a power signal supplied by a power signal supply unit (7714, described later).

The metal thin film pattern layers (LP161, LP162) having at least two or more inductance components may be formed by at least one engineering method of a photo-lithography method using a photo mask and an etching solution, or an injection molding method using a press. The at least another primary winding (7717) may be provided in at least one shape of a circular shape, an oval shape and a polygon shape.

The fourth insulation unit (7719) is provided to an upper surface of the at least another primary winding (7717), and coupled to the first fastening unit (7702*a*) to insulate the at least another primary winding (7717). The fourth insulation unit (7719) may be provided as an insulation sheet, and may be provided in at least one shape of a circular shape, an oval shape and a polygon shape.

A power signal supply unit (7714) may be coupled to one side of the bobbin (7704) to be electrically connected to the at least one primary winding (7706), whereby a power signal can be supplied to the at least one primary winding (7706). At this time, the power signal supply unit (7714) may be electrically connected to a distal end of one side of the bobbin (7704) and to a distal end of the at least one primary winding (7706).

Furthermore, the power signal supply unit (7714) may be coupled to another side of the bobbin (7704) to be electrically connected to the at least another primary winding (7717), whereby a power signal can be supplied to the at least another primary winding (7717). At this time, the power signal supply unit (7714) may be electrically connected to a distal end of another side of the bobbin (7704) and a distal end of the at least another primary winding (7717).

The power signal supply unit (7714) may be provided in a metal material having a high conductivity to smoothly and efficiently supply a power signal to the at least one primary winding (7706) or to the at least another primary winding (7717). At this time, the power signal supply unit (7714) may be provided as a terminal lug.

A power signal output unit (7716) may be coupled to the other side of the bobbin (7704) to be electrically connected to the at least one secondary winding (7710), whereby a power signal transformed by the at least one secondary winding (7710) can be outputted. At this time, the power signal output unit (7716) may be electrically connected to a distal end of the other side of the bobbin (7704) and a distal end of the at least one secondary winding (7710).

Furthermore, the power signal output unit (7716) may be provided in a metal material having a high conductivity to smoothly and efficiently output a power signal transformed by the at least one secondary winding (7710). The power signal output unit (7716) may be provided as a terminal lug.

As apparent from the foregoing, the planar transformer (7700) according to the thirty ninth exemplary embodiment of the present invention includes the core (7702), the bobbin (7704), the at least one primary winding (7706), the first insulation unit (7708), the at least one secondary winding (7710), the second insulation unit (7712), the at least another primary winding (7717) and the fourth insulation unit (7719).

Therefore, a planar transformer (7700) can be manufactured in a slim size using the technical feature of the planar transformer (7700) according to the thirty ninth exemplary embodiment of the present invention, such that a power supply unit (not shown) that is manufactured along with the planar transformer (7700) can be manufactured in a slim size. Furthermore, the planar transformer (7700) according to the thirty ninth exemplary embodiment of the present invention can reduce the manufacturing cost of the planar transformer (7700) to enhance the efficiency of transformation.

Fortieth Exemplary Embodiment

Figure 79:
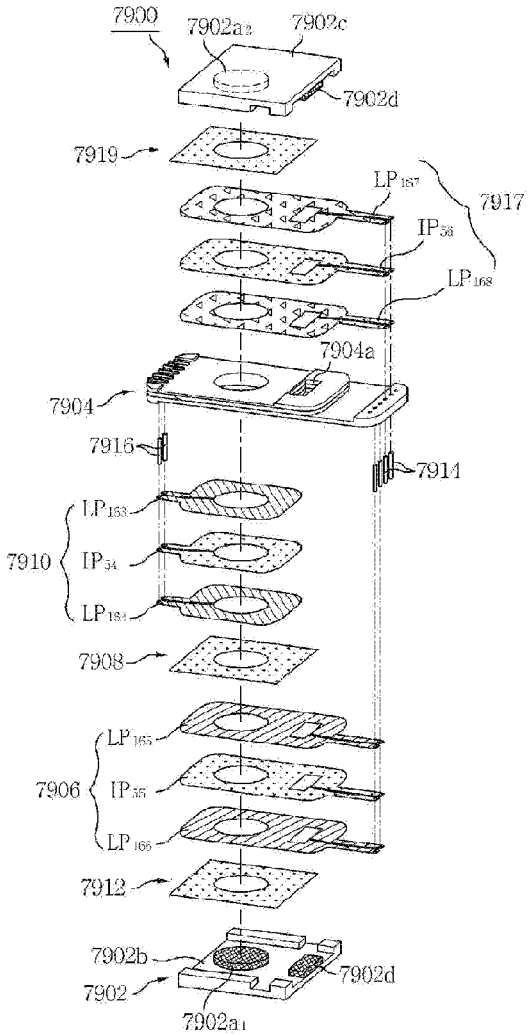
FIG. 79 is an exploded perspective view illustrating a planar transformer according to a fortieth exemplary embodiment of the present invention.
Figure 80:
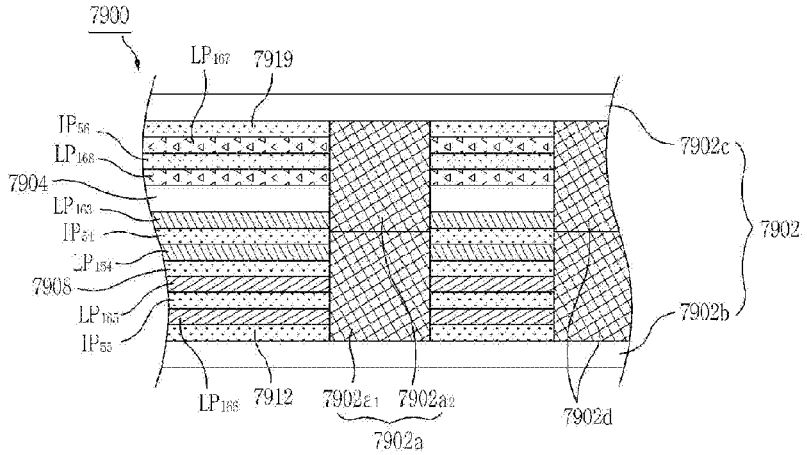
FIG. 80 is a coupled cross-sectional view illustrating a planar transformer according to a fortieth exemplary embodiment of the present invention.

FIG. 79 is an exploded perspective view illustrating a planar transformer according to a fortieth exemplary embodiment of the present invention, and FIG. 80 is a coupled cross-sectional view illustrating a planar transformer according to a fortieth exemplary embodiment of the present invention.

First, referring to FIGS. 79 and 80, a planar transformer (7900) according to the fortieth exemplary embodiment of the present invention includes a core (7902), a bobbin (7904), at least one primary winding (7906), a first insulation unit (7908), at least one secondary winding (7910), a second insulation unit (7912), at least another primary winding (7917) and a fourth insulation unit (7919).

The core (7902) includes a first fastening unit (7902*a*) and is provided to induce formation of a magnetic field, where the core (7902) may include a bottom core (7902*b*) and an upper core (7802*c*). The bobbin (7904) is so provided as to be coupled to the core (7902) by the first fastening unit (7902*a*). The first fastening unit (7902*a*) may include first fastening lugs (7902*a*1, 7902*a*2).

Furthermore, the bobbin (7904) may include a second fastening unit (7904*a*) discrete from the first fastening unit (7902*a*), and the core (7902) may include a third fastening unit (7902*d*) to be coupled to the second fastening unit (7904*a*). At this time, the second fastening unit (7904*a*) may be provided as a second fastening hole (7904*a*), and the third fastening unit (7902*d*) may be provided to the bottom core (7902*b*) and the upper core (7902*c*), and may be provided as a third fastening lug (7902*d*) so as to be coupled to the second fastening hole (7904*a*).

The at least one secondary winding (7910) is provided between the core (7902) and the bobbin (7904), and provided at a bottom surface of the bobbin (7904) to be coupled to the first fastening unit (7902*a*) for supply of a transformed power signal.

At this time, the at least one secondary winding (7910) may include metal thin film pattern layers (LP163, LP164) having at least two or more inductance components, and at least one secondary insulation layer (IP54) provided between the metal thin film pattern layers (LP163, LP164) having at least two or more inductance components to insulate the metal thin film pattern layers (LP163, LP164) having at least two or more inductance components.

The metal thin film pattern layers (LP163, LP164) having at least two or more inductance components may be provided in a metal material having a high conductivity to smoothly and efficiently output a power signal transformed by the at least one secondary winding (7910).

The metal thin film pattern layers (LP163, LP164) having at least two or more inductance components may be formed by at least one engineering method of a photo-lithography method using a photo mask and an etching solution, or an injection molding method using a press. The at least one secondary winding (7910) may be provided in at least one shape of a circular shape, an oval shape and a polygon shape.

The first insulation unit (7908) is provided to a bottom surface of the at least one secondary winding (7910) and coupled to the first fastening unit (7902*a*) to insulate the at least one secondary winding (7910). At this time, the first insulation unit (7908) may be provided as an insulation sheet, and may be provided in at least one shape of a circular shape, an oval shape and a polygon shape.

The at least one primary winding (7906) is provided to a bottom surface of the first insulation unit (7908), coupled to the first fastening unit (7902*a*) and insulated by the first insulation unit (7908) to supply a power signal.

At this time, the at least one primary winding (7906) may include metal thin film pattern layers (LP165, LP166) having at least two or more inductance components, and at least one primary insulation layer (IP55) provided between the metal thin film pattern layers (LP165, LP166) having at least two or more inductance components to insulate the metal thin film pattern layers (LP165, LP166) having at least two or more inductance components.

The metal thin film pattern layers (LP165, LP166) having at least two or more inductance components may be provided in a metal material having a high conductivity to smoothly and efficiently supply a power signal supplied by a power signal supply unit (7914, described later).

The metal thin film pattern layers (LP165, LP166) having at least two or more inductance components may be formed by at least one engineering method of a photo-lithography method using a photo mask and an etching solution, or an injection molding method using a press. The at least one primary winding (7906) may be provided in at least one shape of a circular shape, an oval shape and a polygon shape.

The second insulation unit (7912) is provided to a bottom surface of the at least one primary winding (7906), and coupled to the first fastening unit (7902*a*) to insulate the at least one primary winding (7906). At this time, the second insulation unit (7912) may be provided as an insulation sheet, and may be provided in at least one shape of a circular shape, an oval shape and a polygon shape.

The at least another primary winding (7917) is provided between the core (7902) and the bobbin (7904), and provided to an upper surface of the bobbin (7904) to be coupled to the first fastening unit (7902*a*) for supply of a power signal.

At this time, the at least another primary winding (7917) may include metal thin film pattern layers (LP167, LP168) having at least two or more inductance components, and at least one primary insulation layer (IP56) provided between the metal thin film pattern layers (LP167, LP168) having at least two or more inductance components to insulate the metal thin film pattern layers (LP167, LP168) having at least two or more inductance components.

The metal thin film pattern layers (LP167, LP168) having at least two or more inductance components may be provided in a metal material having a high conductivity to smoothly and efficiently supply a power signal supplied by a power signal supply unit (7914, described later).

The metal thin film pattern layers (LP167, LP168) having at least two or more inductance components may be formed by at least one engineering method of a photo-lithography method using a photo mask and an etching solution, or an injection molding method using a press. The at least another primary winding (7917) may be provided in at least one shape of a circular shape, an oval shape and a polygon shape.

The fourth insulation unit (7919) is provided to an upper surface of the at least another primary winding (7917), and coupled to the first fastening unit (7902*a*) to insulate the at least another primary winding (7917). The fourth insulation unit (7919) may be provided as an insulation sheet, and may be provided in at least one shape of a circular shape, an oval shape and a polygon shape.

A power signal supply unit (7914) may be coupled to one side of the bobbin (7904) to be electrically connected to the at least one primary winding (7906), whereby a power signal can be supplied to the at least one primary winding (7906). At this time, the power signal supply unit (7914) may be electrically connected to a distal end of one side of the bobbin (7904) and to a distal end of the at least one primary winding (7906).

Furthermore, the power signal supply unit (7914) may be coupled to another side of the bobbin (7904) to be electrically connected to the at least another primary winding (7917), whereby a power signal can be supplied to the at least another primary winding (7917). At this time, the power signal supply unit (7914) may be electrically connected to a distal end of another side of the bobbin (7904) and a distal end of the at least another primary winding (7917).

The power signal supply unit (7914) may be provided in a metal material having a high conductivity to smoothly and efficiently supply a power signal to the at least one primary winding (7906) or to the at least another primary winding (7917). At this time, the power signal supply unit (7914) may be provided as a terminal lug.

A power signal output unit (7916) may be coupled to the other side of the bobbin (7904) to be electrically connected to the at least one secondary winding (7910), whereby a power signal transformed by the at least one secondary winding (7910) can be outputted. At this time, the power signal output unit (7916) may be electrically connected to a distal end of the other side of the bobbin (7904) and a distal end of the at least one secondary winding (7910).

Furthermore, the power signal output unit (7916) may be provided in a metal material having a high conductivity to smoothly and efficiently output a power signal transformed by the at least one secondary winding (7910). The power signal output unit (7916) may be provided as a terminal lug.

As apparent from the foregoing, the planar transformer (7900) according to the fortieth exemplary embodiment of the present invention includes the core (7902), the bobbin (7904), the at least one primary winding (7906), the first insulation unit (7908), the at least one secondary winding (7910), the second insulation unit (7912), the at least another primary winding (7917) and the fourth insulation unit (7919).

Therefore, a planar transformer (7900) can be manufactured in a slim size using the technical feature of the planar transformer (7900) according to the fortieth exemplary embodiment of the present invention, such that a power supply unit (not shown) that is manufactured along with the planar transformer (7900) can be manufactured in a slim size. Furthermore, the planar transformer (7900) according to the fortieth exemplary embodiment of the present invention can reduce the manufacturing cost of the planar transformer (7900) to enhance the efficiency of transformation.

Forty First Exemplary Embodiment

Figure 81:
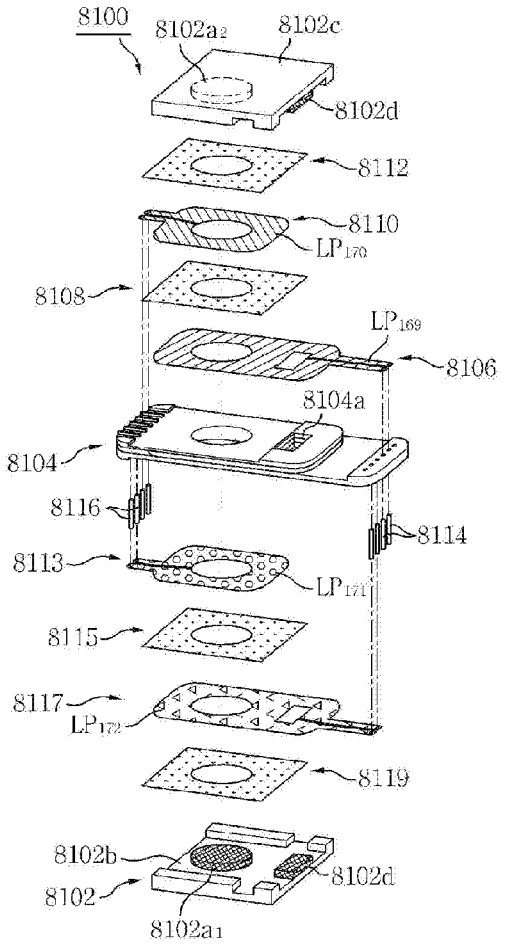
FIG. 81 is an exploded perspective view illustrating a planar transformer according to a forty first exemplary embodiment of the present invention.
Figure 82:
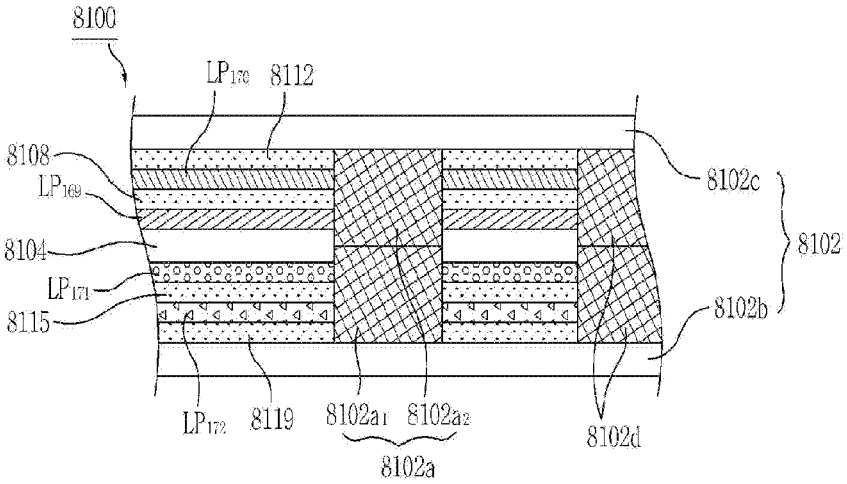
FIG. 82 is a coupled cross-sectional view illustrating a planar transformer according to a forty first exemplary embodiment of the present invention.

FIG. 81 is an exploded perspective view illustrating a planar transformer according to a forty first exemplary embodiment of the present invention, and FIG. 82 is a coupled cross-sectional view illustrating a planar transformer according to a forty first exemplary embodiment of the present invention.

First, referring to FIGS. 81 and 82, a planar transformer (8100) according to the forty first exemplary embodiment of the present invention includes a core (8102), a bobbin (8104), at least one primary winding (8106), a first insulation unit (8108), at least one secondary winding (8110), a second insulation unit (8112), at least another secondary winding (8113), a third insulation unit (8115), at least another primary winding (8117) and a fourth insulation unit (8119). The core (8102) includes a first fastening unit (8102*a*) and is provided to induce formation of a magnetic field, where the core (8102) may include a bottom core (8102*b*) and an upper core (8102*c*). The bobbin (8104) is so provided as to be coupled to the core (8102) by the first fastening unit (8102*a*). The first fastening unit (8102*a*) may include first fastening lugs (8102*a*1, 8102*a*2).

Furthermore, the bobbin (8104) may include a second fastening unit (8104*a*) discrete from the first fastening unit (8102*a*), and the core (8102) may include a third fastening unit (8102*d*) to be coupled to the second fastening unit (8104*a*). At this time, the second fastening unit (8104*a*) may be provided as a second fastening hole (8104*a*), and the third fastening unit (8102*d*) may be provided to the bottom core (8102*b*) and the upper core (8102*c*), and may be provided as a third fastening lug (8102*d*) so as to be coupled to the second fastening hole The at least one primary winding (8106) is provided between the core (8102) and the bobbin (8104), and provided at an upper surface of the bobbin (8104) to be coupled to the first fastening unit (8102*a*) for supply of a power signal.

At this time, the at least one primary winding (8106) may include a metal thin film pattern layer (LP169) having an inductance component. The metal thin film pattern layer (LP169) having an inductance component may be provided in a metal material having a high conductivity to smoothly and efficiently output a power signal supplied by a power signal supply unit (8114). The metal thin film pattern layer (LP169) having an inductance components may be formed by at least one engineering method of a photo-lithography method using a photo mask and an etching solution, or an injection molding method using a press. The at least one primary winding (8106) may be provided in at least one shape of a circular shape, an oval shape and a polygon shape.

The first insulation unit (8108) is provided to an upper surface of the at least one primary winding (8106) and coupled to the first fastening unit (8102*a*) to insulate the at least one primary winding (8106). At this time, the first insulation unit (8108) may be provided as an insulation sheet, and may be provided in at least one shape of a circular shape, an oval shape and a polygon shape.

The at least one secondary winding (8110) is provided to an upper surface of the first insulation unit (8108), coupled to the first fastening unit (8102*a*) and insulated by the first insulation unit (8108) to transform a power signal.

At this time, the at least one secondary winding (8110) may include a metal thin film pattern layer (LP170) having an inductance component. The metal thin film pattern layer (LP170) having an inductance component may be provided in a metal material having a high conductivity to smoothly and efficiently output a power signal transformed by the at least one secondary winding (8110).

The metal thin film pattern layer (LP170) having an inductance component may be formed by at least one engineering method of a photo-lithography method using a photo mask and an etching solution, or an injection molding method using a press. The at least one secondary winding (8110) may be provided in at least one shape of a circular shape, an oval shape and a polygon shape.

The second insulation unit (8112) is provided to an upper surface of the at least one secondary winding (8110), and coupled to the first fastening unit (8102*a*) to insulate the at least one secondary winding (8110). At this time, the second insulation unit (8112) may be provided as an insulation sheet, and may be provided in at least one shape of a circular shape, an oval shape and a polygon shape.

The at least another secondary winding (8113) is provided between the core (8102) and the bobbin (8104), and provided to a bottom surface of the bobbin (8104) to be coupled to the first fastening unit (8102*a*) for transformation of a power signal.

At this time, the at least another secondary winding (8113) may include a metal thin film pattern layer (LP171) having an inductance component. The a metal thin film pattern layer (LP171) having an inductance component may be provided in a metal material having a high conductivity to smoothly and efficiently output a power signal transformed by the at least another secondary winding (8113).

The metal thin film pattern layer (LP171) having an inductance component may be formed by at least one engineering method of a photo-lithography method using a photo mask and an etching solution, or an injection molding method using a press. The at least another secondary winding (8113) may be provided in at least one shape of a circular shape, an oval shape and a polygon shape.

The third insulation unit (8115) may be provided to a bottom surface of the at least another secondary winding (8113), and may be coupled to the first fastening unit (8102*a*) to insulate the at least another secondary winding (8113). At this time, the third insulation unit (8115) may be provided as an insulation sheet, and may be provided in at least one shape of a circular shape, an oval shape and a polygon shape.

The at least another primary winding (8117) is provided to a bottom surface of the third insulation unit (8115), and coupled to the first fastening unit (8102*a*) to be insulated by the third insulation unit (8115) for supply of a power signal.

At this time, the at least another primary winding (8117) may include a metal thin film pattern layer (LP172) having an inductance component. The metal thin film pattern layer having an inductance component may be provided in a metal material having a high conductivity to smoothly and efficiently supply a power signal supplied by a power signal supply unit (8114, described later).

The metal thin film pattern layer (LP172) having an inductance component may be formed by at least one engineering method of a photo-lithography method using a photo mask and an etching solution, or an injection molding method using a press. The at least another primary winding (8117) may be provided in at least one shape of a circular shape, an oval shape and a polygon shape.

The fourth insulation unit (8119) is provided to a bottom surface of the at least another primary winding (8117), and coupled to the first fastening unit (8102*a*) to insulate the at least another primary winding (8117). The fourth insulation unit (8119) may be provided as an insulation sheet, and may be provided in at least one shape of a circular shape, an oval shape and a polygon shape.

A power signal supply unit (8114) may be coupled to one side of the bobbin (8104) to be electrically connected to the at least one primary winding (8106), whereby a power signal can be supplied to the at least one primary winding (8106). At this time, the power signal supply unit (8114) may be electrically connected to a distal end of one side of the bobbin (8104) and to a distal end of the at least one primary winding (8106).

Furthermore, the power signal supply unit (8114) may be coupled to another side of the bobbin (8104) to be electrically connected to the at least another primary winding (8117), whereby a power signal can be supplied to the at least another primary winding (8117). At this time, the power signal supply unit (8114) may be electrically connected to a distal end of another side of the bobbin (8104) and a distal end of the at least another primary winding (8117).

The power signal supply unit (8114) may be provided in a metal material having a high conductivity to smoothly and efficiently supply a power signal to the at least one primary winding (8106) or to the at least another primary winding (8117). At this time, the power signal supply unit (8114) may be provided as a terminal lug.

A power signal output unit (8116) may be coupled to the other side of the bobbin (8104) to be electrically connected to the at least one secondary winding (8110), whereby a power signal transformed by the at least one secondary winding (8110) can be outputted. At this time, the power signal output unit (8116) may be electrically connected to a distal end of the other side of the bobbin (8104) and a distal end of the at least one secondary winding (8110).

The power signal output unit (8116) may be coupled to another other side of the bobbin (8104) to be electrically coupled to the at least another secondary winding (8113), whereby a power signal transformed by the at least another secondary winding (8113) can be outputted. At this time, the power signal output unit (8116) may be electrically coupled to a distal end of another other side of the bobbin (8104) and to a distal end of the at least another secondary winding (8113).

Furthermore, the power signal output unit (8116) may be provided in a metal material having a high conductivity to smoothly and efficiently output a power signal transformed by the at least one secondary winding (8110) or the at least another secondary winding (8113). The power signal output unit (8116) may be provided as a terminal lug.

As apparent from the foregoing, the planar transformer (8100) according to the forty first exemplary embodiment of the present invention includes the core (8102), the bobbin (8104), the at least one primary winding (8106), the first insulation unit (8108), the at least one secondary winding (8110), the second insulation unit (8112), the at least another secondary winding (8113), the third insulation unit (8115), the at least another primary winding (8117) and the fourth insulation unit (8119).

Therefore, a planar transformer (8100) can be manufactured in a slim size using the technical feature of the planar transformer (8100) according to the forty first exemplary embodiment of the present invention, such that a power supply unit (not shown) that is manufactured along with the planar transformer (8100) can be manufactured in a slim size. Furthermore, the planar transformer (8100) according to the forty first exemplary embodiment of the present invention can reduce the manufacturing cost of the planar transformer (8100) to enhance the efficiency of transformation.

Forty Second Exemplary Embodiment

Figure 83:
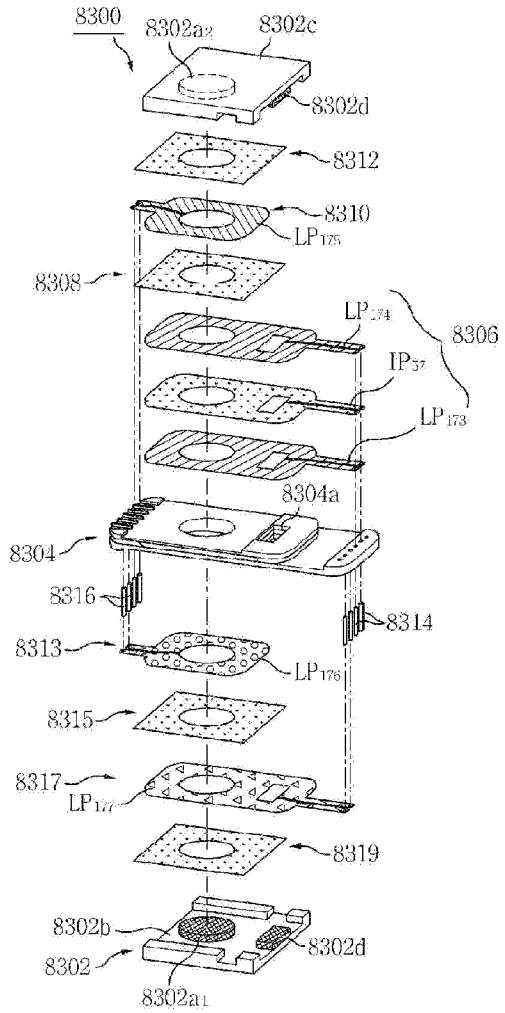
FIG. 83 is an exploded perspective view illustrating a planar transformer according to a forty second exemplary embodiment of the present invention.
Figure 84:
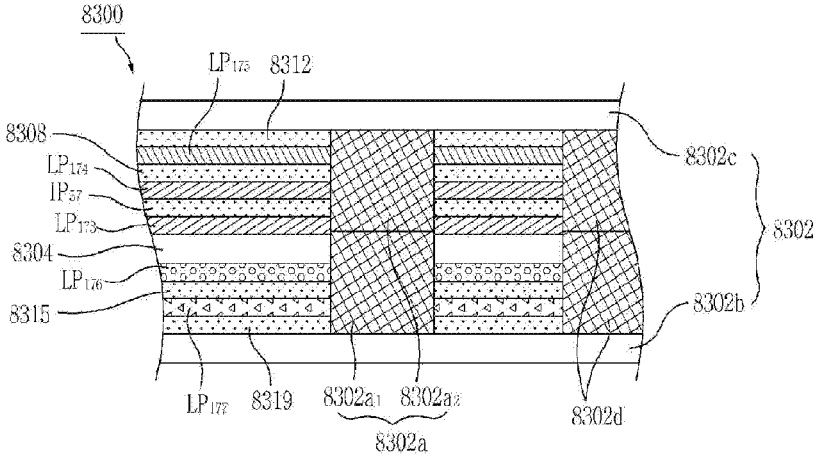
FIG. 84 is a coupled cross-sectional view illustrating a planar transformer according to a forty second exemplary embodiment of the present invention.

FIG. 83 is an exploded perspective view illustrating a planar transformer according to a forty second exemplary embodiment of the present invention, and FIG. 84 is a coupled cross-sectional view illustrating a planar transformer according to a forty second exemplary embodiment of the present invention.

First, referring to FIGS. 83 and 84, a planar transformer (8300) according to the forty second exemplary embodiment of the present invention includes a core (8302), a bobbin (8304), at least one primary winding (8306), a first insulation unit (8308), at least one secondary winding (8310), a second insulation unit (8312), at least another secondary winding (8313), a third insulation unit (8315), at least another primary winding (8317) and a fourth insulation unit (8319).

The core (8302) includes a first fastening unit (8302*a*) and is provided to induce formation of a magnetic field, where the core (8302) may include a bottom core (8302*b*) and an upper core (8302*c*). The bobbin (8304) is so provided as to be coupled to the core (8302) by the first fastening unit (8302*a*). The first fastening unit (8302*a*) may include first fastening lugs (8302*a*1, 8302*a*2).

Furthermore, the bobbin (8304) may include a second fastening unit (8304*a*) discrete from the first fastening unit (8302*a*), and the core (8302) may include a third fastening unit (8302*d*) to be coupled to the second fastening unit (8304*a*). At this time, the second fastening unit (8304*a*) may be provided as a second fastening hole (8304*a*), and the third fastening unit (8302*d*) may be provided to the bottom core (8302*b*) and the upper core (8302*c*), and may be provided as a third fastening lug (8302*d*) so as to be coupled to the second fastening hole (8304*a*) The at least one primary winding (8306) is provided between the core (8302) and the bobbin (8304), and provided at an upper surface of the bobbin (8304) to be coupled to the first fastening unit (8302*a*) for supply of a power signal.

At this time, the at least one primary winding (8306) may include metal thin film pattern layers (LP173, LP174) having at least two or more inductance components, and at least one primary insulation layer (IP57) provided between the metal thin film pattern layers (LP173, LP174) having at least two or more inductance components to insulate the metal thin film pattern layers (LP173, LP174) having at least two or more inductance components.

At this time, the metal thin film pattern layers (LP173, LP174) having at least two or more inductance components may be provided in a metal material having a high conductivity to smoothly and efficiently supply a power signal supplied by a power signal supply unit (8314, described later).

The metal thin film pattern layers (LP173, LP174) having at least two or more inductance components may be formed by at least one engineering method of a photo-lithography method using a photo mask and an etching solution, or an injection molding method using a press. The at least one primary winding (8306) may be provided in at least one shape of a circular shape, an oval shape and a polygon shape.

The first insulation unit (8308) is provided to an upper surface of the at least one primary winding (8306) and coupled to the first fastening unit (8302*a*) to insulate the at least one primary winding (8306). At this time, the first insulation unit (8308) may be provided as an insulation sheet, and may be provided in at least one shape of a circular shape, an oval shape and a polygon shape.

The at least one secondary winding (8310) is provided to an upper surface of the first insulation unit (8308), coupled to the first fastening unit (8302*a*) and insulated by the first insulation unit (8308) to transform a power signal.

At this time, the at least one secondary winding (8310) may include a metal thin film pattern layer (LP175) having an inductance component. The metal thin film pattern layer (LP175) having an inductance component may be provided in a metal material having a high conductivity to smoothly and efficiently output a power signal transformed by the at least one secondary winding (8310).

The metal thin film pattern layer (LP175) having an inductance component may be formed by at least one engineering method of a photo-lithography method using a photo mask and an etching solution, or an injection molding method using a press. The at least one secondary winding (8310) may be provided in at least one shape of a circular shape, an oval shape and a polygon shape.

The second insulation unit (8312) is provided to an upper surface of the at least one secondary winding (8310), and coupled to the first fastening unit (8302*a*) to insulate the at least one secondary winding (8310). At this time, the second insulation unit (8312) may be provided as an insulation sheet, and may be provided in at least one shape of a circular shape, an oval shape and a polygon shape.

The at least another secondary winding (8313) is provided between the core (8302) and the bobbin (8304), and provided to a bottom surface of the bobbin (8304) to be coupled to the first fastening unit (8302*a*) for transformation of a power signal.

At this time, the at least another secondary winding (8313) may include a metal thin film pattern layer (LP176) having an inductance component. The metal thin film pattern layer (LP176) having an inductance component may be provided in a metal material having a high conductivity to smoothly and efficiently output a power signal transformed by the at least another secondary winding (8313).

The metal thin film pattern layer (LP176) having an inductance component may be formed by at least one engineering method of a photo-lithography method using a photo mask and an etching solution, or an injection molding method using a press. The at least another secondary winding (8313) may be provided in at least one shape of a circular shape, an oval shape and a polygon shape.

The third insulation unit (8315) may be provided to a bottom surface of the at least another secondary winding (8313), and may be coupled to the first fastening unit (8302*a*) to insulate the at least another secondary winding (8313). At this time, the third insulation unit (8315) may be provided as an insulation sheet, and may be provided in at least one shape of a circular shape, an oval shape and a polygon shape.

The at least another primary winding (8317) is provided to a bottom surface of the third insulation unit (8315), and coupled to the first fastening unit (8302*a*) to be insulated by the third insulation unit (8315) for supply of a power signal.

At this time, the at least another primary winding (8317) may include a metal thin film pattern layer (LP177) having an inductance component. The metal thin film pattern layer (LP177) having an inductance component may be provided in a metal material having a high conductivity to smoothly and efficiently supply a power signal supplied by a power signal supply unit (8314, described later).

The metal thin film pattern layer (LP177) having an inductance component may be formed by at least one engineering method of a photo-lithography method using a photo mask and an etching solution, or an injection molding method using a press. The at least another primary winding (8317) may be provided in at least one shape of a circular shape, an oval shape and a polygon shape.

The fourth insulation unit (8319) is provided to a bottom surface of the at least another primary winding (8317), and coupled to the first fastening unit (8302*a*) to insulate the at least another primary winding (8317). The fourth insulation unit (8319) may be provided as an insulation sheet, and may be provided in at least one shape of a circular shape, an oval shape and a polygon shape.

A power signal supply unit (8314) may be coupled to one side of the bobbin (8304) to be electrically connected to the at least one primary winding (8306), whereby a power signal can be supplied to the at least one primary winding (8306). At this time, the power signal supply unit (8314) may be electrically connected to a distal end of one side of the bobbin (8304) and to a distal end of the at least one primary winding (8306).

Furthermore, the power signal supply unit (8314) may be coupled to another side of the bobbin (8304) to be electrically connected to the at least another primary winding (8317), whereby a power signal can be supplied to the at least another primary winding (8317). At this time, the power signal supply unit (8314) may be electrically connected to a distal end of another side of the bobbin (8304) and a distal end of the at least another primary winding (8317).

The power signal supply unit (8314) may be provided in a metal material having a high conductivity to smoothly and efficiently supply a power signal to the at least one primary winding (8306) or to the at least another primary winding (8317). At this time, the power signal supply unit (8314) may be provided as a terminal lug.

A power signal output unit (8316) may be coupled to the other side of the bobbin (8304) to be electrically connected to the at least one secondary winding (8310), whereby a power signal transformed by the at least one secondary winding (8310) can be outputted. At this time, the power signal output unit (8316) may be electrically connected to a distal end of the other side of the bobbin (8304) and to a distal end of the at least one secondary winding (8310).

The power signal output unit (8316) may be coupled to another other side of the bobbin (8304) to be electrically coupled to the at least another secondary winding (8313), whereby a power signal transformed by the at least another secondary winding (8313) can be outputted. At this time, the power signal output unit (8316) may be electrically coupled to a distal end of another other side of the bobbin (8304) and to a distal end of the at least another secondary winding (8313).

Furthermore, the power signal output unit (8316) may be provided in a metal material having a high conductivity to smoothly and efficiently output a power signal transformed by the at least one secondary winding (8310) or the at least another secondary winding (8313). The power signal output unit (8316) may be provided as a terminal lug.

As apparent from the foregoing, the planar transformer (8300) according to the forty second exemplary embodiment of the present invention includes the core (8302), the bobbin (8304), the at least one primary winding (8306), the first insulation unit (8308), the at least one secondary winding (8310), the second insulation unit (8312), the at least another secondary winding (8313), the third insulation unit (8315), the at least another primary winding (8317) and the fourth insulation unit (8319).

Therefore, a planar transformer (8300) can be manufactured in a slim size using the technical feature of the planar transformer (8300) according to the forty second exemplary embodiment of the present invention, such that a power supply unit (not shown) that is manufactured along with the planar transformer (8300) can be manufactured in a slim size. Furthermore, the planar transformer (8300) according to the forty second exemplary embodiment of the present invention can reduce the manufacturing cost of the planar transformer (8300) to enhance the efficiency of transformation.

Forty Third Exemplary Embodiment

Figure 85:
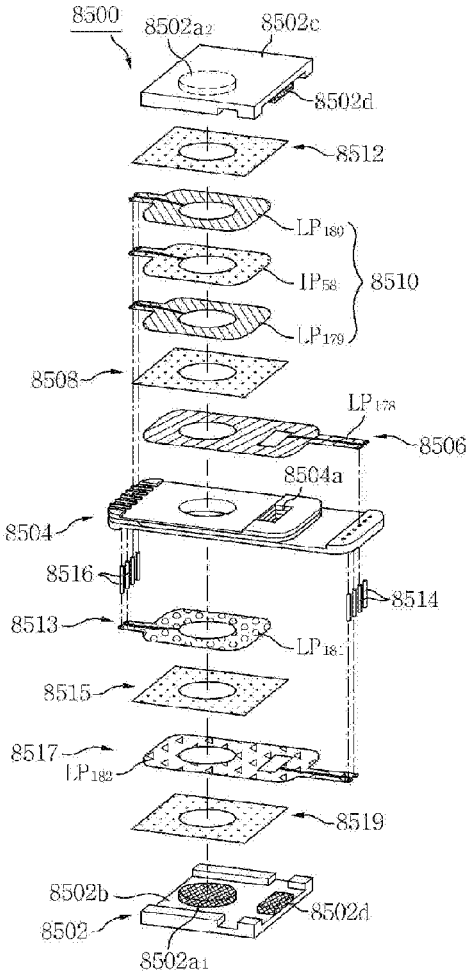
FIG. 85 is an exploded perspective view illustrating a planar transformer according to a forty third exemplary embodiment of the present invention.
Figure 86:
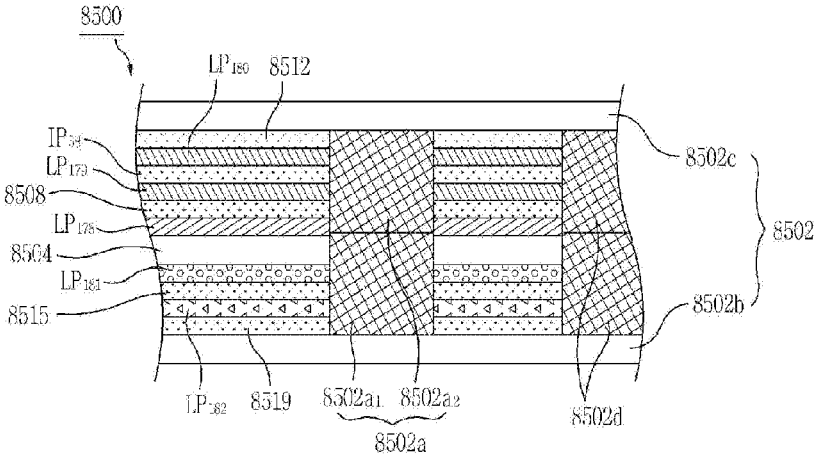
FIG. 86 is a coupled cross-sectional view illustrating a planar transformer according to a forty third exemplary embodiment of the present invention.

FIG. 85 is an exploded perspective view illustrating a planar transformer according to a forty third exemplary embodiment of the present invention, and FIG. 86 is a coupled cross-sectional view illustrating a planar transformer according to a forty third exemplary embodiment of the present invention.

First, referring to FIGS. 85 and 86, a planar transformer (8500) according to the forty third exemplary embodiment of the present invention includes a core (8502), a bobbin (8504), at least one primary winding (8506), a first insulation unit (8508), at least one secondary winding (8510), a second insulation unit (8512), at least another secondary winding (8513), a third insulation unit (8515), at least another primary winding (8517) and a fourth insulation unit (8519).

The core (8502) includes a first fastening unit (8502*a*) and is provided to induce formation of a magnetic field, where the core (8502) may include a bottom core (8502*b*) and an upper core (8502*c*). The bobbin (8504) is so provided as to be coupled to the core (8502) by the first fastening unit (8502*a*). The first fastening unit (8502*a*) may include first fastening lugs (8502*a*1, 8502*a*2).

Furthermore, the bobbin (8504) may include a second fastening unit (8504*a*) discrete from the first fastening unit (8502*a*), and the core (8502) may include a third fastening unit (8502*d*) to be coupled to the second fastening unit (8504*a*). At this time, the second fastening unit (8504*a*) may be provided as a second fastening hole (8504*a*), and the third fastening unit (8502*d*) may be provided to the bottom core (8502*b*) and the upper core (8502*c*), and may be provided as a third fastening lug (8502*d*) so as to be coupled to the second fastening hole (8504*a*) The at least one primary winding (8506) is provided between the core (8502) and the bobbin (8504), and provided at an upper surface of the bobbin (8504) to be coupled to the first fastening unit (8502*a*) for supply of a power signal.

At this time, the at least one primary winding (8506) may include a metal thin film pattern layer (LP178) having an inductance component. The metal thin film pattern layer (LP178) having an inductance component may be provided in a metal material having a high conductivity to smoothly and efficiently supply a power signal supplied by a power signal supply unit (8514, described later).

The metal thin film pattern layer (LP178) having an inductance component may be formed by at least one engineering method of a photo-lithography method using a photo mask and an etching solution, or an injection molding method using a press. The at least one primary winding (8506) may be provided in at least one shape of a circular shape, an oval shape and a polygon shape.

The first insulation unit (8508) is provided to an upper surface of the at least one primary winding (8506) and coupled to the first fastening unit (8502*a*) to insulate the at least one primary winding (8506). At this time, the first insulation unit (8508) may be provided as an insulation sheet, and may be provided in at least one shape of a circular shape, an oval shape and a polygon shape.

The at least one secondary winding (8510) is provided to an upper surface of the first insulation unit (8508), coupled to the first fastening unit (8502*a*) and insulated by the first insulation unit (8508) to transform a power signal.

At this time, the at least one secondary winding (8510) may include metal thin film pattern layers (LP179, LP180) having at least two or more inductance components, and at least one secondary insulation layer (IP58) provided between the metal thin film pattern layers (LP179, LP180) having at least two or more inductance components to insulate the metal thin film pattern layers (LP179, LP180) having at least two or more inductance components.

Furthermore, the metal thin film pattern layers (LP179, LP180) having at least two or more inductance components may be provided in a metal material having a high conductivity to smoothly and efficiently output a power signal transformed by the at least one secondary winding (8510).

The metal thin film pattern layers (LP179, LP180) having at least two or more inductance components may be formed by at least one engineering method of a photo-lithography method using a photo mask and an etching solution, or an injection molding method using a press. The at least one secondary winding (8510) may be provided in at least one shape of a circular shape, an oval shape and a polygon shape.

The second insulation unit (8512) is provided to an upper surface of the at least one secondary winding (8510), and coupled to the first fastening unit (8502*a*) to insulate the at least one secondary winding (8510). At this time, the second insulation unit (8512) may be provided as an insulation sheet, and may be provided in at least one shape of a circular shape, an oval shape and a polygon shape.

The at least another secondary winding (8513) is provided between the core (8502) and the bobbin (8504), and provided to a bottom surface of the bobbin (8504) to be coupled to the first fastening unit (8502*a*) for transformation of a power signal.

At this time, the at least another secondary winding (8513) may include a metal thin film pattern layer (LP181) having an inductance component. The metal thin film pattern layer (LP181) having an inductance component may be provided in a metal material having a high conductivity to smoothly and efficiently output a power signal transformed by the at least another secondary winding (8513).

The metal thin film pattern layer (LP181) having an inductance component may be formed by at least one engineering method of a photo-lithography method using a photo mask and an etching solution, or an injection molding method using a press. The at least another secondary winding (8513) may be provided in at least one shape of a circular shape, an oval shape and a polygon shape.

The third insulation unit (8515) may be provided to a bottom surface of the at least another secondary winding (8513), and may be coupled to the first fastening unit (8502*a*) to insulate the at least another secondary winding (8513). At this time, the third insulation unit (8515) may be provided as an insulation sheet, and may be provided in at least one shape of a circular shape, an oval shape and a polygon shape.

The at least another primary winding (8517) is provided to a bottom surface of the third insulation unit (8515), and coupled to the first fastening unit (8502*a*) to be insulated by the third insulation unit (8515) for supply of a power signal.

At this time, the at least another primary winding (8517) may include a metal thin film pattern layer (LP182) having an inductance component. The metal thin film pattern layer (LP182) having an inductance component may be provided in a metal material having a high conductivity to smoothly and efficiently supply a power signal supplied by a power signal supply unit (8514, described later).

The metal thin film pattern layer (LP182) having an inductance component may be formed by at least one engineering method of a photo-lithography method using a photo mask and an etching solution, or an injection molding method using a press. The at least another primary winding (8517) may be provided in at least one shape of a circular shape, an oval shape and a polygon shape.

The fourth insulation unit (8519) is provided to a bottom surface of the at least another primary winding (8517), and coupled to the first fastening unit (8502*a*) to insulate the at least another primary winding (8517). The fourth insulation unit (8519) may be provided as an insulation sheet, and may be provided in at least one shape of a circular shape, an oval shape and a polygon shape.

A power signal supply unit (8514) may be coupled to one side of the bobbin (8504) to be electrically connected to the at least one primary winding (8506), whereby a power signal can be supplied to the at least one primary winding (8506). At this time, the power signal supply unit (8514) may be electrically connected to a distal end of one side of the bobbin (8504) and to a distal end of the at least one primary winding (8506).

Furthermore, the power signal supply unit (8514) may be coupled to another side of the bobbin (8504) to be electrically connected to the at least another primary winding (8517), whereby a power signal can be supplied to the at least another primary winding (8517). At this time, the power signal supply unit (8514) may be electrically connected to a distal end of another side of the bobbin (8504) and a distal end of the at least another primary winding (8517).

The power signal supply unit (8514) may be provided in a metal material having a high conductivity to smoothly and efficiently supply a power signal to the at least one primary winding (8506) or to the at least another primary winding (8517). At this time, the power signal supply unit (8514) may be provided as a terminal lug.

A power signal output unit (8516) may be coupled to the other side of the bobbin (8504) to be electrically connected to the at least one secondary winding (8510), whereby a power signal transformed by the at least one secondary winding (8510) can be outputted. At this time, the power signal output unit (8516) may be electrically connected to a distal end of the other side of the bobbin (8504) and to a distal end of the at least one secondary winding (8510).

The power signal output unit (8516) may be coupled to another other side of the bobbin (8504) to be electrically coupled to the at least another secondary winding (8513), whereby a power signal transformed by the at least another secondary winding (8513) can be outputted. At this time, the power signal output unit (8516) may be electrically coupled to a distal end of another other side of the bobbin (8504) and to a distal end of the at least another secondary winding (8513).

Furthermore, the power signal output unit (8516) may be provided in a metal material having a high conductivity to smoothly and efficiently output a power signal transformed by the at least one secondary winding (8510) or the at least another secondary winding (8513). The power signal output unit (8516) may be provided as a terminal lug.

As apparent from the foregoing, the planar transformer (8500) according to the forty third exemplary embodiment of the present invention includes the core (8502), the bobbin (8504), the at least one primary winding (8506), the first insulation unit (8508), the at least one secondary winding (8510), the second insulation unit (8512), the at least another secondary winding (8513), the third insulation unit (8515), the at least another primary winding (8517) and the fourth insulation unit (8519).

Therefore, a planar transformer (8500) can be manufactured in a slim size using the technical feature of the planar transformer (8500) according to the forty third exemplary embodiment of the present invention, such that a power supply unit (not shown) that is manufactured by including the planar transformer (8500) can be manufactured in a slim size. Furthermore, the planar transformer (8500) according to the forty third exemplary embodiment of the present invention can reduce the manufacturing cost of the planar transformer (8500) to enhance the efficiency of transformation.

Forty Fourth Exemplary Embodiment

Figure 87:
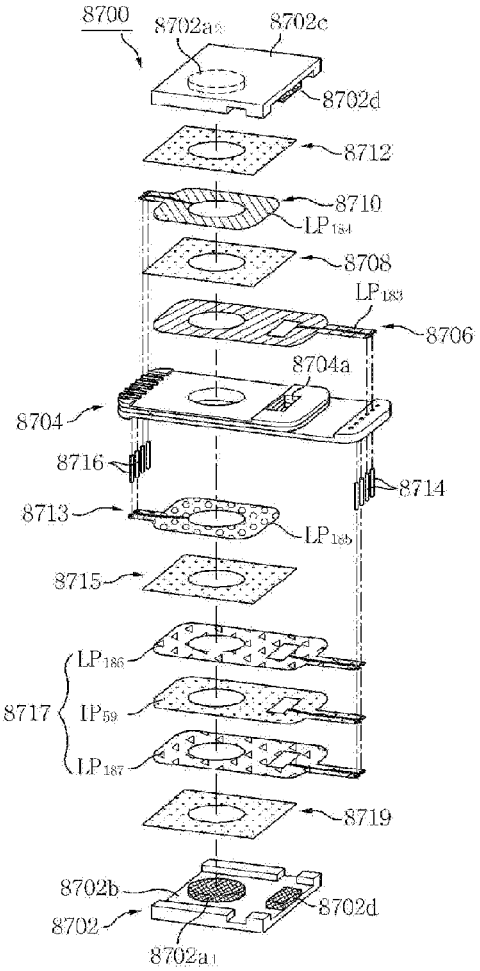
FIG. 87 is an exploded perspective view illustrating a planar transformer according to a forty fourth exemplary embodiment of the present invention.
Figure 88:
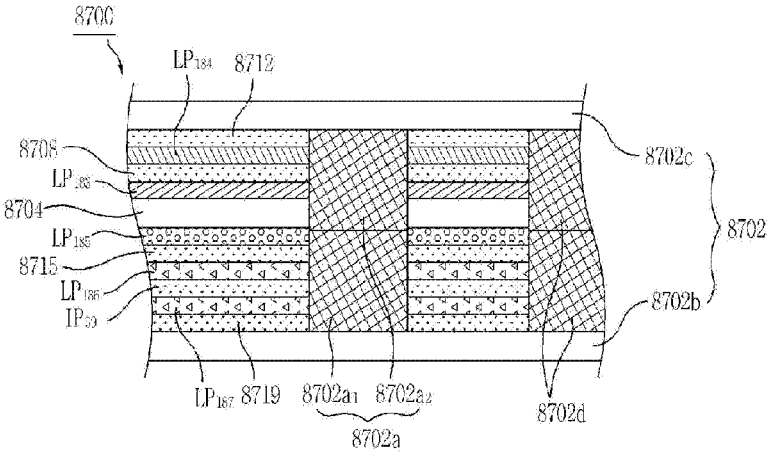
FIG. 88 is a coupled cross-sectional view illustrating a planar transformer according to a forty fourth exemplary embodiment of the present invention.

FIG. 87 is an exploded perspective view illustrating a planar transformer according to a forty fourth exemplary embodiment of the present invention, and FIG. 88 is a coupled cross-sectional view illustrating a planar transformer according to a forty fourth exemplary embodiment of the present invention.

First, referring to FIGS. 87 and 88, a planar transformer (8700) according to the forty fourth exemplary embodiment of the present invention includes a core (8702), a bobbin (8704), at least one primary winding (8706), a first insulation unit (8708), at least one secondary winding (8710), a second insulation unit (8712), at least another secondary winding (8513), a third insulation unit (8515), at least another primary winding (8717) and a fourth insulation unit (8719).

The core (8702) includes a first fastening unit (8702*a*) and is provided to induce formation of a magnetic field, where the core (8702) may include a bottom core (8702*b*) and an upper core (8702*c*). The bobbin (8704) is so provided as to be coupled to the core (8702) by the first fastening unit (8702*a*). The first fastening unit (8702*a*) may include first fastening lugs (8702*a*1, 8702*a*2).

Furthermore, the bobbin (8704) may include a second fastening unit (8704*a*) discrete from the first fastening unit (8702*a*), and the core (8702) may include a third fastening unit (8702*d*) to be coupled to the second fastening unit (8704*a*). At this time, the second fastening unit (8704*a*) may be provided as a second fastening hole (8704*a*), and the third fastening unit (8702*d*) may be provided to the bottom core (8702*b*) and the upper core (8702*c*), and may be provided as a third fastening lug (8702*d*) so as to be coupled to the second fastening hole The at least one primary winding (8706) is provided between the core (8702) and the bobbin (8704), and provided at an upper surface of the bobbin (8704) to be coupled to the first fastening unit (8702*a*) for supply of a power signal.

At this time, the at least one primary winding (8706) may include a metal thin film pattern layer (LP183) having an inductance component. The metal thin film pattern layer (LP183) having an inductance component may be provided in a metal material having a high conductivity to smoothly and efficiently supply a power signal supplied by a power signal supply unit (8714, described later).

The metal thin film pattern layer (LP183) having an inductance component may be formed by at least one engineering method of a photo-lithography method using a photo mask and an etching solution, or an injection molding method using a press. The at least one primary winding (8706) may be provided in at least one shape of a circular shape, an oval shape and a polygon shape.

The first insulation unit (8708) is provided to an upper surface of the at least one primary winding (8706) and coupled to the first fastening unit (8702*a*) to insulate the at least one primary winding (8706). At this time, the first insulation unit (8708) may be provided as an insulation sheet, and may be provided in at least one shape of a circular shape, an oval shape and a polygon shape.

The at least one secondary winding (8710) is provided to an upper surface of the first insulation unit (8708), coupled to the first fastening unit (8702*a*) and insulated by the first insulation unit (8708) to transform a power signal.

At this time, the at least one secondary winding (8710) may include a metal thin film pattern layer (LP184) having an inductance component. The metal thin film pattern layer (LP184) having an inductance component may be provided in a metal material having a high conductivity to smoothly and efficiently output a power signal transformed by the at least one secondary winding (8710).

The metal thin film pattern layer (LP184) having an inductance component may be formed by at least one engineering method of a photo-lithography method using a photo mask and an etching solution, or an injection molding method using a press. The at least one secondary winding (8710) may be provided in at least one shape of a circular shape, an oval shape and a polygon shape.

The second insulation unit (8712) is provided to an upper surface of the at least one secondary winding (8710), and coupled to the first fastening unit (8702*a*) to insulate the at least one secondary winding (8710). At this time, the second insulation unit (8712) may be provided as an insulation sheet, and may be provided in at least one shape of a circular shape, an oval shape and a polygon shape.

The at least another secondary winding (8713) is provided between the core (8702) and the bobbin (8704), and provided to a bottom surface of the bobbin (8704) to be coupled to the first fastening unit (8702*a*) for transformation of a power signal.

At this time, the at least another secondary winding (8713) may include a metal thin film pattern layer (LP185) having an inductance component. The metal thin film pattern layer (LP185) having an inductance component may be provided in a metal material having a high conductivity to smoothly and efficiently output a power signal transformed by the at least another secondary winding (8713).

The metal thin film pattern layer (LP185) having an inductance component may be formed by at least one engineering method of a photo-lithography method using a photo mask and an etching solution, or an injection molding method using a press. The at least another secondary winding (8713) may be provided in at least one shape of a circular shape, an oval shape and a polygon shape.

The third insulation unit (8715) may be provided to a bottom surface of the at least another secondary winding (8713), and may be coupled to the first fastening unit (8702*a*) to insulate the at least another secondary winding (8713). At this time, the third insulation unit (8715) may be provided as an insulation sheet, and may be provided in at least one shape of a circular shape, an oval shape and a polygon shape.

The at least another primary winding (8717) is provided to a bottom surface of the third insulation unit (8715), and coupled to the first fastening unit (8702*a*) to be insulated by the third insulation unit (8715) for supply of a power signal.

At this time, the at least another primary winding (8717) may include metal thin film pattern layers (LP186, LP187) having at least two or more inductance components, and at least another primary winding (IP59) provided between the metal thin film pattern layers (LP186, LP187) having at least two or more inductance components to insulate the metal thin film pattern layers (LP186, LP187) having at least two or more inductance components.

The metal thin film pattern layers (LP186, LP187) having at least two or more inductance components may be provided in a metal material having a high conductivity to smoothly and efficiently supply a power signal supplied by a power signal supply unit (8714, described later).

The metal thin film pattern layers (LP186, LP187) having at least two or more inductance components may be formed by at least one engineering method of a photo-lithography method using a photo mask and an etching solution, or an injection molding method using a press. The at least another primary winding (8717) may be provided in at least one shape of a circular shape, an oval shape and a polygon shape.

The fourth insulation unit (8719) is provided to a bottom surface of the at least another primary winding (8717), and coupled to the first fastening unit (8702*a*) to insulate the at least another primary winding (8717). The fourth insulation unit (8719) may be provided as an insulation sheet, and may be provided in at least one shape of a circular shape, an oval shape and a polygon shape.

A power signal supply unit (8714) may be coupled to one side of the bobbin (8704) to be electrically connected to the at least one primary winding (8706), whereby a power signal can be supplied to the at least one primary winding (8706). At this time, the power signal supply unit (8714) may be electrically connected to a distal end of one side of the bobbin (8704) and to a distal end of the at least one primary winding (8706).

Furthermore, the power signal supply unit (8714) may be coupled to another side of the bobbin (8704) to be electrically connected to the at least another primary winding (8717), whereby a power signal can be supplied to the at least another primary winding (8717). At this time, the power signal supply unit (8714) may be electrically connected to a distal end of another side of the bobbin (8704) and a distal end of the at least another primary winding (8717).

The power signal supply unit (8714) may be provided in a metal material having a high conductivity to smoothly and efficiently supply a power signal to the at least one primary winding (8706) or to the at least another primary winding (8717). At this time, the power signal supply unit (8714) may be provided as a terminal lug.

A power signal output unit (8716) may be coupled to the other side of the bobbin (8704) to be electrically connected to the at least one secondary winding (8710), whereby a power signal transformed by the at least one secondary winding (8710) can be outputted. At this time, the power signal output unit (8716) may be electrically connected to a distal end of the other side of the bobbin (8704) and to a distal end of the at least one secondary winding (8710).

The power signal output unit (8716) may be coupled to another other side of the bobbin (8704) to be electrically coupled to the at least another secondary winding (8713), whereby a power signal transformed by the at least another secondary winding (8713) can be outputted. At this time, the power signal output unit (8716) may be electrically coupled to a distal end of another other side of the bobbin (8704) and to a distal end of the at least another secondary winding (8713).

Furthermore, the power signal output unit (8716) may be provided in a metal material having a high conductivity to smoothly and efficiently output a power signal transformed by the at least one secondary winding (8710) or the at least another secondary winding (8713). The power signal output unit (8716) may be provided as a terminal lug.

As apparent from the foregoing, the planar transformer (8700) according to the forty fourth exemplary embodiment of the present invention includes the core (8702), the bobbin (8704), the at least one primary winding (8706), the first insulation unit (8708), the at least one secondary winding (8710), the second insulation unit (8712), the at least another secondary winding (8713), the third insulation unit (8715), the at least another primary winding (8717) and the fourth insulation unit (8719).

Therefore, a planar transformer (8700) can be manufactured in a slim size using the technical feature of the planar transformer (8700) according to the forty fourth exemplary embodiment of the present invention, such that a power supply unit (not shown) that is manufactured by including the planar transformer (8700) can be manufactured in a slim size. Furthermore, the planar transformer (8700) according to the forty fourth exemplary embodiment of the present invention can reduce the manufacturing cost of the planar transformer (8700) to enhance the efficiency of transformation.

Forty Fifth Exemplary Embodiment

Figure 89:
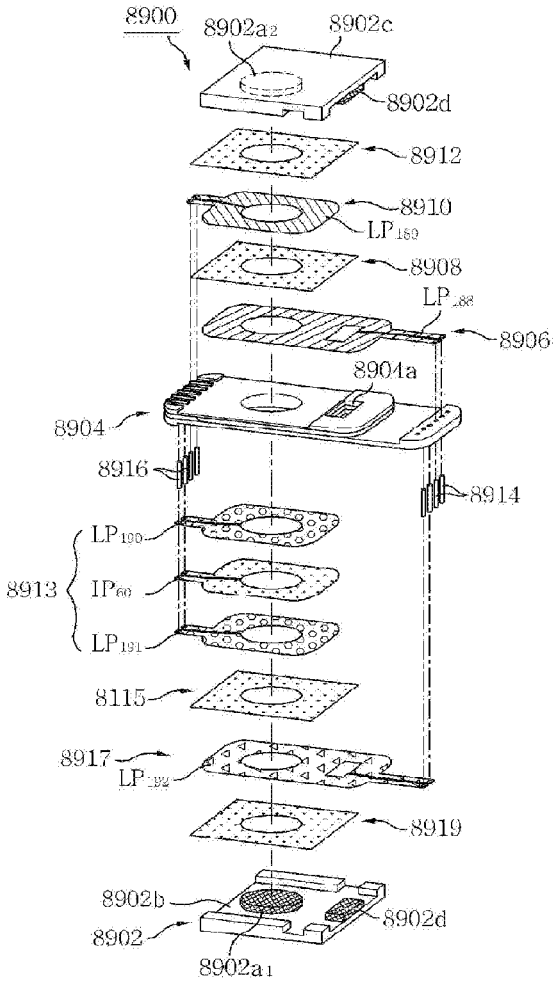
FIG. 89 is an exploded perspective view illustrating a planar transformer according to a forty fifth exemplary embodiment of the present invention.
Figure 90:
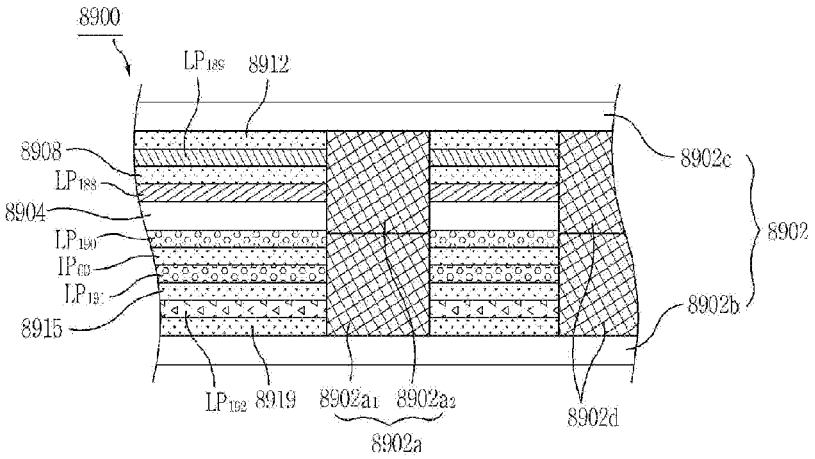
FIG. 90 is a coupled cross-sectional view illustrating a planar transformer according to a forty fifth exemplary embodiment of the present invention.

FIG. 89 is an exploded perspective view illustrating a planar transformer according to a forty fifth exemplary embodiment of the present invention, and FIG. 90 is a coupled cross-sectional view illustrating a planar transformer according to a forty fifth exemplary embodiment of the present invention.

First, referring to FIGS. 89 and 90, a planar transformer (8900) according to the forty fifth exemplary embodiment of the present invention includes a core (8902), a bobbin (8904), at least one primary winding (8906), a first insulation unit (8908), at least one secondary winding (8910), a second insulation unit (8912), at least another secondary winding (8913), a third insulation unit (8915), at least another primary winding (8917) and a fourth insulation unit (8919).

The core (8902) includes a first fastening unit (8902*a*) and is provided to induce formation of a magnetic field, where the core (8902) may include a bottom core (8902*b*) and an upper core (8902*c*). The bobbin (8904) is so provided as to be coupled to the core (8902) by the first fastening unit (8902*a*). The first fastening unit (8902*a*) may include first fastening lugs (8902*a*1, 8902*a*2).

Furthermore, the bobbin (8904) may include a second fastening unit (8904*a*) discrete from the first fastening unit (8902*a*), and the core (8902) may include a third fastening unit (8902*d*) to be coupled to the second fastening unit (8904*a*). At this time, the second fastening unit (8904*a*) may be provided as a second fastening hole (8904*a*), and the third fastening unit (8902*d*) may be provided to the bottom core (8902*b*) and the upper core (8902*c*), and may be provided as a third fastening lug (8902*d*) so as to be coupled to the second fastening hole (8904*a*) The at least one primary winding (8906) is provided between the core (8902) and the bobbin (8904), and provided at an upper surface of the bobbin (8904) to be coupled to the first fastening unit (8902*a*) for supply of a power signal.

At this time, the at least one primary winding (8906) may include a metal thin film pattern layer (LP188) having an inductance component. The metal thin film pattern layer (LP188) having an inductance component may be provided in a metal material having a high conductivity to smoothly and efficiently supply a power signal supplied by a power signal supply unit (8914, described later).

The metal thin film pattern layer (LP188) having an inductance component may be formed by at least one engineering method of a photo-lithography method using a photo mask and an etching solution, or an injection molding method using a press. The at least one primary winding (8906) may be provided in at least one shape of a circular shape, an oval shape and a polygon shape.

The first insulation unit (8908) is provided to an upper surface of the at least one primary winding (8906) and coupled to the first fastening unit (8902*a*) to insulate the at least one primary winding (8906). At this time, the first insulation unit (8908) may be provided as an insulation sheet, and may be provided in at least one shape of a circular shape, an oval shape and a polygon shape.

The at least one secondary winding (8910) is provided to an upper surface of the first insulation unit (8908), coupled to the first fastening unit (8902*a*) and insulated by the first insulation unit (8908) to transform a power signal.

At this time, the at least one secondary winding (8910) may include a metal thin film pattern layer (LP189) having an inductance component. The metal thin film pattern layer (LP189) having an inductance component may be provided in a metal material having a high conductivity to smoothly and efficiently output a power signal transformed by the at least one secondary winding (8910).

The metal thin film pattern layer (LP189) having an inductance component may be formed by at least one engineering method of a photo-lithography method using a photo mask and an etching solution, or an injection molding method using a press. The at least one secondary winding (8910) may be provided in at least one shape of a circular shape, an oval shape and a polygon shape.

The second insulation unit (8912) is provided to an upper surface of the at least one secondary winding (8910), and coupled to the first fastening unit (8902*a*) to insulate the at least one secondary winding (8910). At this time, the second insulation unit (8912) may be provided as an insulation sheet, and may be provided in at least one shape of a circular shape, an oval shape and a polygon shape.

The at least another secondary winding (8913) is provided between the core (8902) and the bobbin (8904), and provided to a bottom surface of the bobbin (8904) to be coupled to the first fastening unit (8902*a*) for transformation of a power signal.

At this time, the at least another secondary winding (8913) may include metal thin film pattern layers (LP190, LP191) having at least two or more inductance components, and at least another secondary insulation layer (IP60) provided between the metal thin film pattern layers (LP190, LP191) having at least two or more inductance components to insulate the metal thin film pattern layers (LP190, LP191) having at least two or more inductance components.

The metal thin film pattern layers (LP190, LP191) having at least two or more inductance components may be provided in a metal material having a high conductivity to smoothly and efficiently output a power signal transformed by the at least another secondary winding (8913).

The metal thin film pattern layers (LP190, LP191) having at least two or more inductance components may be formed by at least one engineering method of a photo-lithography method using a photo mask and an etching solution, or an injection molding method using a press. The at least another secondary winding (8913) may be provided in at least one shape of a circular shape, an oval shape and a polygon shape.

The third insulation unit (8915) may be provided to a bottom surface of the at least another secondary winding (8913), and may be coupled to the first fastening unit (8902*a*) to insulate the at least another secondary winding (8913). At this time, the third insulation unit (8915) may be provided as an insulation sheet, and may be provided in at least one shape of a circular shape, an oval shape and a polygon shape.

The at least another primary winding (8917) is provided to a bottom surface of the third insulation unit (8915), and coupled to the first fastening unit (8902*a*) to be insulated by the third insulation unit (8915) for supply of a power signal.

At this time, the at least another primary winding (8917) may include a metal thin film pattern layer (LP192) having an inductance component. The metal thin film pattern layer (LP192) having an inductance component may be provided in a metal material having a high conductivity to smoothly and efficiently supply a power signal supplied by a power signal supply unit (8914, described later).

The metal thin film pattern layer (LP192) having an inductance component may be formed by at least one engineering method of a photo-lithography method using a photo mask and an etching solution, or an injection molding method using a press. The at least another primary winding (8917) may be provided in at least one shape of a circular shape, an oval shape and a polygon shape.

The fourth insulation unit (8919) is provided to a bottom surface of the at least another primary winding (8917), and coupled to the first fastening unit (8902*a*) to insulate the at least another primary winding (8917). The fourth insulation unit (8919) may be provided as an insulation sheet, and may be provided in at least one shape of a circular shape, an oval shape and a polygon shape.

A power signal supply unit (8914) may be coupled to one side of the bobbin (8904) to be electrically connected to the at least one primary winding (8906), whereby a power signal can be supplied to the at least one primary winding (8906). At this time, the power signal supply unit (8914) may be electrically connected to a distal end of one side of the bobbin (8904) and to a distal end of the at least one primary winding (8906).

Furthermore, the power signal supply unit (8914) may be coupled to another side of the bobbin (8904) to be electrically connected to the at least another primary winding (8917), whereby a power signal can be supplied to the at least another primary winding (8917). At this time, the power signal supply unit (8914) may be electrically connected to a distal end of another side of the bobbin (8904) and a distal end of the at least another primary winding (8917).

The power signal supply unit (8914) may be provided in a metal material having a high conductivity to smoothly and efficiently supply a power signal to the at least one primary winding (8906) or to the at least another primary winding (8917). At this time, the power signal supply unit (8914) may be provided as a terminal lug.

A power signal output unit (8916) may be coupled to the other side of the bobbin (8904) to be electrically connected to the at least one secondary winding (8910), whereby a power signal transformed by the at least one secondary winding (8910) can be outputted. At this time, the power signal output unit (8916) may be electrically connected to a distal end of the other side of the bobbin (8904) and to a distal end of the at least one secondary winding (8910).

The power signal output unit (8916) may be coupled to another other side of the bobbin (8904) to be electrically coupled to the at least another secondary winding (8913), whereby a power signal transformed by the at least another secondary winding (8913) can be outputted. At this time, the power signal output unit (8916) may be electrically coupled to a distal end of another other side of the bobbin (8904) and to a distal end of the at least another secondary winding (8913).

Furthermore, the power signal output unit (8916) may be provided in a metal material having a high conductivity to smoothly and efficiently output a power signal transformed by the at least one secondary winding (8910) or the at least another secondary winding (8913). The power signal output unit (8916) may be provided as a terminal lug.

As apparent from the foregoing, the planar transformer (8900) according to the forty fifth exemplary embodiment of the present invention includes the core (8902), the bobbin (8904), the at least one primary winding (8906), the first insulation unit (8908), the at least one secondary winding (8910), the second insulation unit (8912), the at least another secondary winding (8913), the third insulation unit (8915), the at least another primary winding (8917) and the fourth insulation unit (8919).

Therefore, a planar transformer (8900) can be manufactured in a slim size using the technical feature of the planar transformer (8900) according to the forty fifth exemplary embodiment of the present invention, such that a power supply unit (not shown) that is manufactured by including the planar transformer (8900) can be manufactured in a slim size. Furthermore, the planar transformer (8900) according to the forty fifth exemplary embodiment of the present invention can reduce the manufacturing cost of the planar transformer (8900) to enhance the efficiency of transformation.

Forty Sixth Exemplary Embodiment

Figure 91:
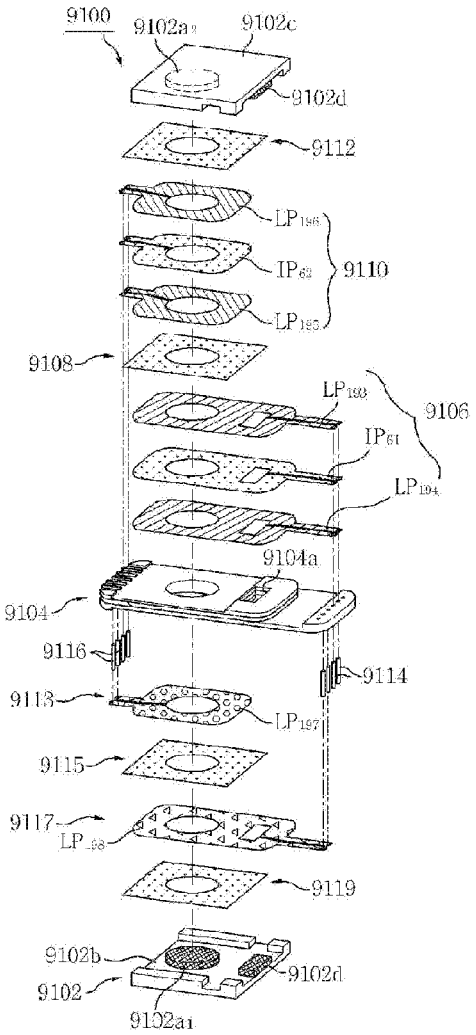
FIG. 91 is an exploded perspective view illustrating a planar transformer according to a forty sixth exemplary embodiment of the present invention.
Figure 92:
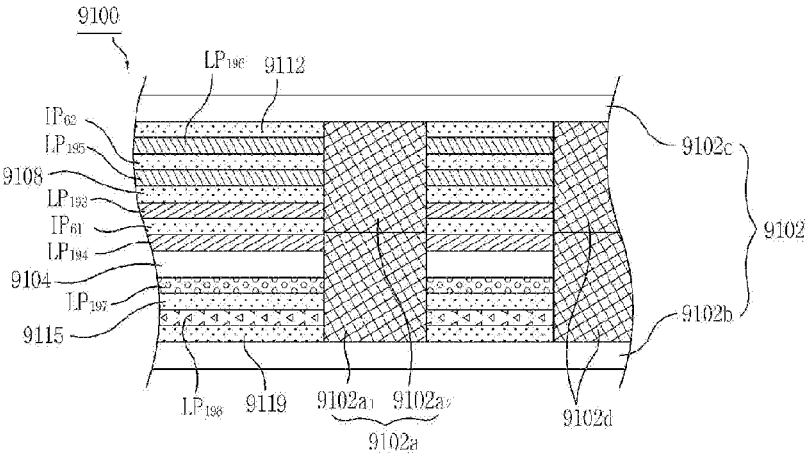
FIG. 92 is a coupled cross-sectional view illustrating a planar transformer according to a forty sixth exemplary embodiment of the present invention.

FIG. 91 is an exploded perspective view illustrating a planar transformer according to a forty sixth exemplary embodiment of the present invention, and FIG. 92 is a coupled cross-sectional view illustrating a planar transformer according to a forty sixth exemplary embodiment of the present invention.

First, referring to FIGS. 91 and 92, a planar transformer (9100) according to the forty sixth exemplary embodiment of the present invention includes a core (9102), a bobbin (9104), at least one primary winding (9106), a first insulation unit (9108), at least one secondary winding (9110), a second insulation unit (9112), at least another secondary winding (9113), a third insulation unit (9115), at least another primary winding (9117) and a fourth insulation unit (9119).

The core (9102) includes a first fastening unit (9102*a*) and is provided to induce formation of a magnetic field, where the core (9102) may include a bottom core (9102*b*) and an upper core (9102*c*). The bobbin (9104) is so provided as to be coupled to the core (9102) by the first fastening unit (9102*a*). The first fastening unit (9102*a*) may include first fastening lugs (9102*a*1, 9102*a*2).

Furthermore, the bobbin (9104) may include a second fastening unit (9104*a*) discrete from the first fastening unit (9102*a*), and the core (9102) may include a third fastening unit (9102*d*) to be coupled to the second fastening unit (9104*a*). At this time, the second fastening unit (9104*a*) may be provided as a second fastening hole (9104*a*), and the third fastening unit (9102*d*) may be provided to the bottom core (9102*b*) and the upper core (9102*c*), and may be provided as a third fastening lug (9102*d*) so as to be coupled to the second fastening hole (9104*a*) The at least one primary winding (9106) is provided between the core (9102) and the bobbin (9104), and provided at an upper surface of the bobbin (9104) to be coupled to the first fastening unit (9102*a*) for supply of a power signal.

At this time, the at least one primary winding (9106) may include metal thin film pattern layers (LP193, LP194) having at least two or more inductance components, and at least one secondary insulation layer (IP61) provided between the metal thin film pattern layers (LP193, LP194) having at least two or more inductance components to insulate the metal thin film pattern layers (LP193, LP194) having at least two or more inductance components.

The metal thin film pattern layers (LP193, LP194) having at least two or more inductance components may be provided in a metal material having a high conductivity to smoothly and efficiently supply a power signal supplied by a power signal supply unit (9114, described later).

The metal thin film pattern layers (LP193, LP194) having at least two or more inductance components may be formed by at least one engineering method of a photo-lithography method using a photo mask and an etching solution, or an injection molding method using a press. The at least one primary winding (9106) may be provided in at least one shape of a circular shape, an oval shape and a polygon shape.

The first insulation unit (9108) is provided to an upper surface of the at least one primary winding (9106) and coupled to the first fastening unit (9102*a*) to insulate the at least one primary winding (9106). At this time, the first insulation unit (9108) may be provided as an insulation sheet, and may be provided in at least one shape of a circular shape, an oval shape and a polygon shape.

The at least one secondary winding (9110) is provided to an upper surface of the first insulation unit (9108), coupled to the first fastening unit (9102*a*) and insulated by the first insulation unit (9108) to transform a power signal.

At this time, the at least one secondary winding (9110) may include metal thin film pattern layers (LP195, LP196) having at least two or more inductance components, and at least one secondary insulation layer (IP62) provided between the metal thin film pattern layers (LP195, LP196) having at least two or more inductance components to insulate the metal thin film pattern layers (LP195, LP196) having at least two or more inductance components.

Furthermore, the metal thin film pattern layers (LP195, LP196) having at least two or more inductance components may be provided in a metal material having a high conductivity to smoothly and efficiently output a power signal transformed by the at least one secondary winding (9110).

The metal thin film pattern layers (LP195, LP196) having at least two or more inductance components may be formed by at least one engineering method of a photo-lithography method using a photo mask and an etching solution, or an injection molding method using a press. The at least one secondary winding (9110) may be provided in at least one shape of a circular shape, an oval shape and a polygon shape.

The second insulation unit (9112) is provided to an upper surface of the at least one secondary winding (9110), and coupled to the first fastening unit (9102*a*) to insulate the at least one secondary winding (9110). At this time, the second insulation unit (9112) may be provided as an insulation sheet, and may be provided in at least one shape of a circular shape, an oval shape and a polygon shape.

The at least another secondary winding (9113) is provided between the core (9102) and the bobbin (9104), and provided to a bottom surface of the bobbin (9104) to be coupled to the first fastening unit (9102*a*) for transformation of a power signal.

At this time, the at least another secondary winding (9113) may include a metal thin film pattern layer (LP197) having an inductance component. The metal thin film pattern layer (LP197) having an inductance component may be provided in a metal material having a high conductivity to smoothly and efficiently output a power signal transformed by the at least another secondary winding (9113).

The metal thin film pattern layer (LP197) having an inductance component may be formed by at least one engineering method of a photo-lithography method using a photo mask and an etching solution, or an injection molding method using a press. The at least another secondary winding (9113) may be provided in at least one shape of a circular shape, an oval shape and a polygon shape.

The third insulation unit (9115) may be provided to a bottom surface of the at least another secondary winding (9113), and may be coupled to the first fastening unit (9102*a*) to insulate the at least another secondary winding (9113). At this time, the third insulation unit (9115) may be provided as an insulation sheet, and may be provided in at least one shape of a circular shape, an oval shape and a polygon shape.

The at least another primary winding (9117) is provided to a bottom surface of the third insulation unit (9115), and coupled to the first fastening unit (9102*a*) to be insulated by the third insulation unit (9115) for supply of a power signal.

At this time, the at least another primary winding (9117) may include a metal thin film pattern layer (LP198) having an inductance component. The metal thin film pattern layer (LP198) having an inductance component may be provided in a metal material having a high conductivity to smoothly and efficiently supply a power signal supplied by a power signal supply unit (9114, described later).

The metal thin film pattern layer (LP198) having an inductance component may be formed by at least one engineering method of a photo-lithography method using a photo mask and an etching solution, or an injection molding method using a press. The at least another primary winding (9117) may be provided in at least one shape of a circular shape, an oval shape and a polygon shape.

The fourth insulation unit (9119) is provided to a bottom surface of the at least another primary winding (9117), and coupled to the first fastening unit (9102*a*) to insulate the at least another primary winding (9117). The fourth insulation unit (9119) may be provided as an insulation sheet, and may be provided in at least one shape of a circular shape, an oval shape and a polygon shape.

A power signal supply unit (9114) may be coupled to one side of the bobbin (9104) to be electrically connected to the at least one primary winding (9106), whereby a power signal can be supplied to the at least one primary winding (9106). At this time, the power signal supply unit (9114) may be electrically connected to a distal end of one side of the bobbin (9104) and to a distal end of the at least one primary winding (9106).

Furthermore, the power signal supply unit (9114) may be coupled to another side of the bobbin (9104) to be electrically connected to the at least another primary winding (9117), whereby a power signal can be supplied to the at least another primary winding (9117). At this time, the power signal supply unit (9114) may be electrically connected to a distal end of another side of the bobbin (9104) and a distal end of the at least another primary winding (9117).

The power signal supply unit (9114) may be provided in a metal material having a high conductivity to smoothly and efficiently supply a power signal to the at least one primary winding (9106) or to the at least another primary winding (9117). At this time, the power signal supply unit (9114) may be provided as a terminal lug.

A power signal output unit (9116) may be coupled to the other side of the bobbin (9104) to be electrically connected to the at least one secondary winding (9110), whereby a power signal transformed by the at least one secondary winding (9110) can be outputted. At this time, the power signal output unit (9116) may be electrically connected to a distal end of the other side of the bobbin (9104) and to a distal end of the at least one secondary winding (9110).

The power signal output unit (9116) may be coupled to another other side of the bobbin (9104) to be electrically coupled to the at least another secondary winding (9113), whereby a power signal transformed by the at least another secondary winding (9113) can be outputted. At this time, the power signal output unit (9116) may be electrically coupled to a distal end of another other side of the bobbin (9104) and to a distal end of the at least another secondary winding (9113).

Furthermore, the power signal output unit (9116) may be provided in a metal material having a high conductivity to smoothly and efficiently output a power signal transformed by the at least one secondary winding (9110) or the at least another secondary winding (9113). The power signal output unit (9116) may be provided as a terminal lug.

As apparent from the foregoing, the planar transformer (9100) according to the forty sixth exemplary embodiment of the present invention includes the core (9102), the bobbin (9104), the at least one primary winding (9106), the first insulation unit (9108), the at least one secondary winding (9110), the second insulation unit (9112), the at least another secondary winding (9113), the third insulation unit (9115), the at least another primary winding (9117) and the fourth insulation unit (9119).

Therefore, a planar transformer (9100) can be manufactured in a slim size using the technical feature of the planar transformer (9100) according to the forty sixth exemplary embodiment of the present invention, such that a power supply unit (not shown) that is manufactured along with the planar transformer (9100) can be manufactured in a slim size. Furthermore, the planar transformer (9100) according to the forty sixth exemplary embodiment of the present invention can reduce the manufacturing cost of the planar transformer (9100) to enhance the efficiency of transformation.

Forty Seventh Exemplary Embodiment

Figure 93:
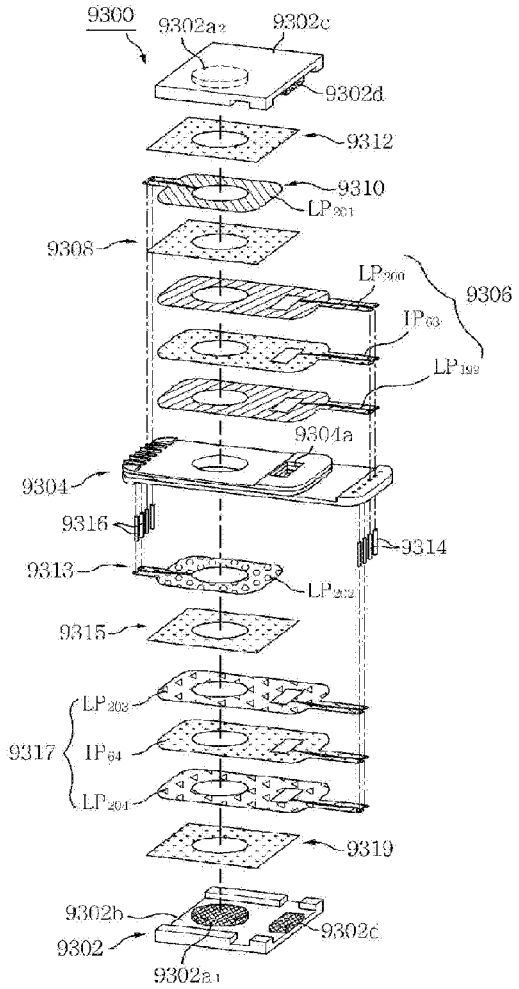
FIG. 93 is an exploded perspective view illustrating a planar transformer according to a forty seventh exemplary embodiment of the present invention.
Figure 94:
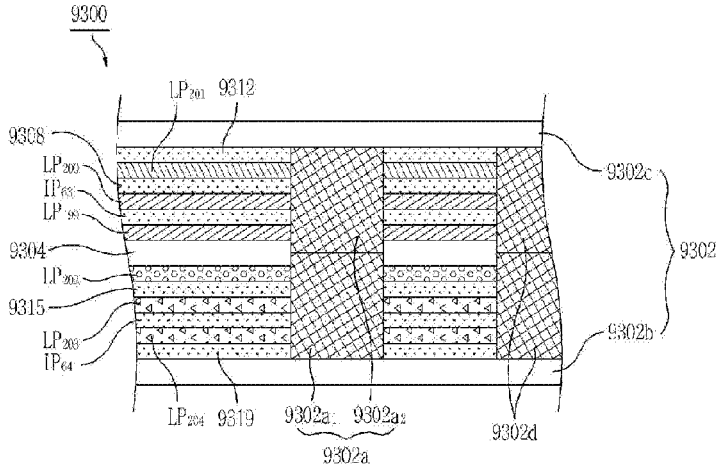
FIG. 94 is a coupled cross-sectional view illustrating a planar transformer according to a forty seventh exemplary embodiment of the present invention.

FIG. 93 is an exploded perspective view illustrating a planar transformer according to a forty seventh exemplary embodiment of the present invention, and FIG. 94 is a coupled cross-sectional view illustrating a planar transformer according to a forty seventh exemplary embodiment of the present invention.

First, referring to FIGS. 93 and 94, a planar transformer (9300) according to the forty seventh exemplary embodiment of the present invention includes a core (9302), a bobbin (9304), at least one primary winding (9306), a first insulation unit (9308), at least one secondary winding (9310), a second insulation unit (9312), at least another secondary winding (9313), a third insulation unit (9315), at least another primary winding (9317) and a fourth insulation unit (9319).

The core (9302) includes a first fastening unit (9302*a*) and is provided to induce formation of a magnetic field, where the core (9302) may include a bottom core (9302*b*) and an upper core (9302*c*). The bobbin (9304) is so provided as to be coupled to the core (9302) by the first fastening unit (9302*a*). The first fastening unit (9302*a*) may include first fastening lugs (9302*a*1, 9302*a*2).

Furthermore, the bobbin (9304) may include a second fastening unit (9304*a*) discrete from the first fastening unit (9302*a*), and the core (9302) may include a third fastening unit (9302*d*) to be coupled to the second fastening unit (9304*a*). At this time, the second fastening unit (9304*a*) may be provided as a second fastening hole (9304*a*), and the third fastening unit (9302*d*) may be provided to the bottom core (9302*b*) and the upper core (9302*c*), and may be provided as a third fastening lug (9302*d*) so as to be coupled to the second fastening hole (9304*a*) The at least one primary winding (9306) is provided between the core (9302) and the bobbin (9304), and provided at an upper surface of the bobbin (9304) to be coupled to the first fastening unit (9302*a*) for supply of a power signal.

At this time, the at least one primary winding (9306) may include metal thin film pattern layers (LP199, LP200) having at least two or more inductance components, and at least one secondary insulation layer (IP63) provided between the metal thin film pattern layers (LP199, LP200) having at least two or more inductance components to insulate the metal thin film pattern layers (LP199, LP200) having at least two or more inductance components.

The metal thin film pattern layers (LP199, LP200) having at least two or more inductance components may be provided in a metal material having a high conductivity to smoothly and efficiently supply a power signal supplied by a power signal supply unit (9314, described later). The metal thin film pattern layers (LP199, LP200) having at least two or more inductance components may be formed by at least one engineering method of a photo-lithography method using a photo mask and an etching solution, or an injection molding method using a press. The at least one primary winding (9306) may be provided in at least one shape of a circular shape, an oval shape and a polygon shape.

The first insulation unit (9308) is provided to an upper surface of the at least one primary winding (9306) and coupled to the first fastening unit (9302*a*) to insulate the at least one primary winding (9306). At this time, the first insulation unit (9308) may be provided as an insulation sheet, and may be provided in at least one shape of a circular shape, an oval shape and a polygon shape.

The at least one secondary winding (9310) is provided to an upper surface of the first insulation unit (9308), coupled to the first fastening unit (9302*a*) and insulated by the first insulation unit (9308) to transform a power signal.

At this time, the at least one secondary winding (9310) may include a metal thin film pattern layer (LP201) having an inductance component. The metal thin film pattern layer (LP201) having an inductance component may be provided in a metal material having a high conductivity to smoothly and efficiently output a power signal transformed by the at least one secondary winding (9310).

The metal thin film pattern layer (LP201) having an inductance component may be formed by at least one engineering method of a photo-lithography method using a photo mask and an etching solution, or an injection molding method using a press. The at least one secondary winding (9310) may be provided in at least one shape of a circular shape, an oval shape and a polygon shape.

The second insulation unit (9312) is provided to an upper surface of the at least one secondary winding (9310), and coupled to the first fastening unit (9302*a*) to insulate the at least one secondary winding (9310). At this time, the second insulation unit (9312) may be provided as an insulation sheet, and may be provided in at least one shape of a circular shape, an oval shape and a polygon shape.

The at least another secondary winding (9313) is provided between the core (9302) and the bobbin (9304), and provided to a bottom surface of the bobbin (9304) to be coupled to the first fastening unit (9302*a*) for transformation of a power signal.

At this time, the at least another secondary winding (9313) may include a metal thin film pattern layer (LP202) having an inductance component.

The metal thin film pattern layer (LP202) having an inductance component may be provided in a metal material having a high conductivity to smoothly and efficiently output a power signal transformed by the at least another secondary winding (9313).

The metal thin film pattern layer (LP202) having an inductance component may be formed by at least one engineering method of a photo-lithography method using a photo mask and an etching solution, or an injection molding method using a press. The at least another secondary winding (9313) may be provided in at least one shape of a circular shape, an oval shape and a polygon shape.

The third insulation unit (9315) may be provided to a bottom surface of the at least another secondary winding (9313), and may be coupled to the first fastening unit (9302*a*) to insulate the at least another secondary winding (9313). At this time, the third insulation unit (9315) may be provided as an insulation sheet, and may be provided in at least one shape of a circular shape, an oval shape and a polygon shape.

The at least another primary winding (9317) is provided to a bottom surface of the third insulation unit (9315), and coupled to the first fastening unit (9302*a*) to be insulated by the third insulation unit (9315) for supply of a power signal.

At this time, the at least another primary winding (9317) may include metal thin film pattern layers (LP203, LP204) having at least two or more inductance components, and at least one secondary insulation layer (IP64) provided between the metal thin film pattern layers (LP203, LP204) having at least two or more inductance components to insulate the metal thin film pattern layers (LP203, LP204) having at least two or more inductance components.

Furthermore, the metal thin film pattern layers (LP203, LP204) having at least two or more inductance components may be provided in a metal material having a high conductivity to smoothly and efficiently supply a power signal supplied by a power signal supply unit (9314, described later).

The metal thin film pattern layers (LP203, LP204) having at least two or more inductance components may be formed by at least one engineering method of a photo-lithography method using a photo mask and an etching solution, or an injection molding method using a press. The at least another primary winding (9317) may be provided in at least one shape of a circular shape, an oval shape and a polygon shape.

The fourth insulation unit (9319) is provided to a bottom surface of the at least another primary winding (9317), and coupled to the first fastening unit (9302*a*) to insulate the at least another primary winding (9317). The fourth insulation unit (9319) may be provided as an insulation sheet, and may be provided in at least one shape of a circular shape, an oval shape and a polygon shape.

A power signal supply unit (9314) may be coupled to one side of the bobbin (9304) to be electrically connected to the at least one primary winding (9306), whereby a power signal can be supplied to the at least one primary winding (9306). At this time, the power signal supply unit (9314) may be electrically connected to a distal end of one side of the bobbin (9304) and to a distal end of the at least one primary winding (9306).

Furthermore, the power signal supply unit (9314) may be coupled to another side of the bobbin (9304) to be electrically connected to the at least another primary winding (9317), whereby a power signal can be supplied to the at least another primary winding (9317). At this time, the power signal supply unit (9314) may be electrically connected to a distal end of another side of the bobbin (9304) and a distal end of the at least another primary winding (9317).

The power signal supply unit (9314) may be provided in a metal material having a high conductivity to smoothly and efficiently supply a power signal to the at least one primary winding (9306) or to the at least another primary winding (9317). At this time, the power signal supply unit (9314) may be provided as a terminal lug.

A power signal output unit (9316) may be coupled to the other side of the bobbin (9304) to be electrically connected to the at least one secondary winding (9310), whereby a power signal transformed by the at least one secondary winding (9310) can be outputted. At this time, the power signal output unit (9316) may be electrically connected to a distal end of the other side of the bobbin (9304) and to a distal end of the at least one secondary winding (9310).

The power signal output unit (9316) may be coupled to another other side of the bobbin (9304) to be electrically coupled to the at least another secondary winding (9313), whereby a power signal transformed by the at least another secondary winding (9313) can be outputted. At this time, the power signal output unit (9316) may be electrically coupled to a distal end of another other side of the bobbin (9304) and to a distal end of the at least another secondary winding (9313).

Furthermore, the power signal output unit (9316) may be provided in a metal material having a high conductivity to smoothly and efficiently output a power signal transformed by the at least one secondary winding (9310) or the at least another secondary winding (9313). The power signal output unit (9316) may be provided as a terminal lug.

As apparent from the foregoing, the planar transformer (9300) according to the forty seventh exemplary embodiment of the present invention includes the core (9302), the bobbin (9304), the at least one primary winding (9306), the first insulation unit (9308), the at least one secondary winding (9310), the second insulation unit (9312), the at least another secondary winding (9313), the third insulation unit (9315), the at least another primary winding (9317) and the fourth insulation unit (9319).

Therefore, a planar transformer (9300) can be manufactured in a slim size using the technical feature of the planar transformer (9300) according to the forty seventh exemplary embodiment of the present invention, such that a power supply unit (not shown) that is manufactured along with the planar transformer (9300) can be manufactured in a slim size.

Furthermore, the planar transformer (9300) according to the forty seventh exemplary embodiment of the present invention can reduce the manufacturing cost of the planar transformer (9300) to enhance the efficiency of transformation.

Forty Eighth Exemplary Embodiment

Figure 95:
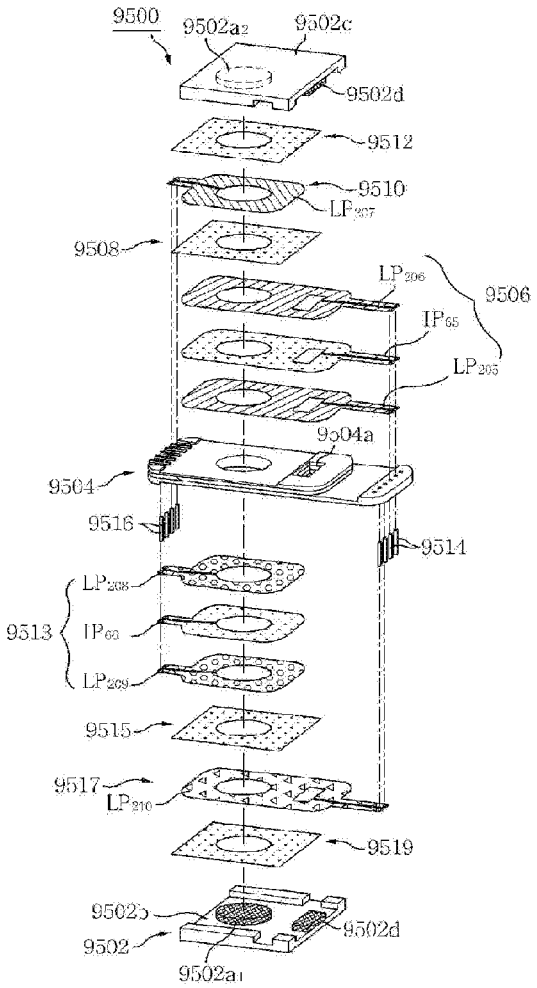
FIG. 95 is an exploded perspective view illustrating a planar transformer according to a forty eighth exemplary embodiment of the present invention.
Figure 96:
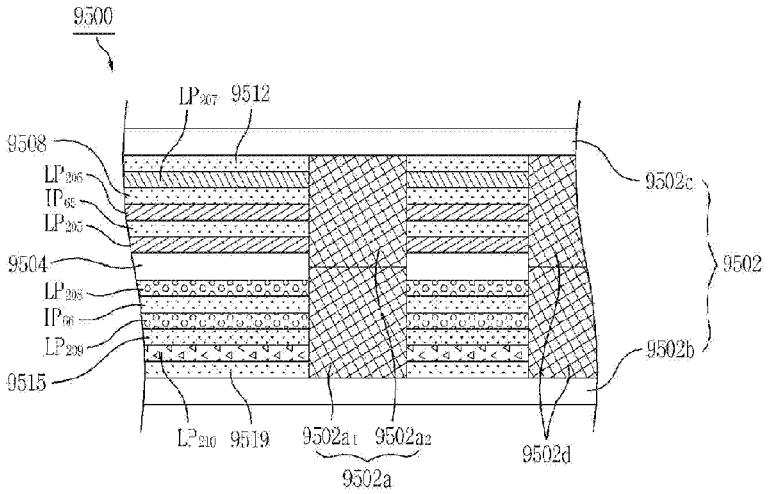
FIG. 96 is a coupled cross-sectional view illustrating a planar transformer according to a forty eighth exemplary embodiment of the present invention.

FIG. 95 is an exploded perspective view illustrating a planar transformer according to a forty eighth exemplary embodiment of the present invention, and FIG. 96 is a coupled cross-sectional view illustrating a planar transformer according to a forty eighth exemplary embodiment of the present invention.

First, referring to FIGS. 95 and 96, a planar transformer (9500) according to the forty eighth exemplary embodiment of the present invention includes a core (9502), a bobbin (9504), at least one primary winding (9506), a first insulation unit (9508), at least one secondary winding (9510), a second insulation unit (9512), at least another secondary winding (9513), a third insulation unit (9515), at least another primary winding (9517) and a fourth insulation unit (9519).

The core (9502) includes a first fastening unit (9502*a*) and is provided to induce formation of a magnetic field, where the core (9502) may include a bottom core (9502*b*) and an upper core (9502*c*). The bobbin (9504) is so provided as to be coupled to the core (9502) by the first fastening unit (9502*a*). The first fastening unit (9502*a*) may include first fastening lugs (9502*a*1, 9502*a*2).

Furthermore, the bobbin (9504) may include a second fastening unit (9504*a*) discrete from the first fastening unit (9502*a*), and the core (9502) may include a third fastening unit (9502*d*) to be coupled to the second fastening unit (9504*a*). At this time, the second fastening unit (9504*a*) may be provided as a second fastening hole (9504*a*), and the third fastening unit (9502*d*) may be provided to the bottom core (9502*b*) and the upper core (9502*c*), and may be provided as a third fastening lug (9502*d*) so as to be coupled to the second fastening hole (9504*a*) The at least one primary winding (9506) is provided between the core (9502) and the bobbin (9504), and provided at an upper surface of the bobbin (9504) to be coupled to the first fastening unit (9502*a*) for supply of a power signal.

At this time, the at least one primary winding (9506) may include metal thin film pattern layers (LP205, LP206) having at least two or more inductance components, and at least one secondary insulation layer (IP65) provided between the metal thin film pattern layers (LP205, LP206) having at least two or more inductance components to insulate the metal thin film pattern layers (LP205, LP206) having at least two or more inductance components.

The metal thin film pattern layers (LP205, LP206) having at least two or more inductance components may be provided in a metal material having a high conductivity to smoothly and efficiently supply a power signal supplied by a power signal supply unit (9514, described later). The metal thin film pattern layers (LP205, LP206) having at least two or more inductance components may be formed by at least one engineering method of a photo-lithography method using a photo mask and an etching solution, or an injection molding method using a press. The at least one primary winding (9506) may be provided in at least one shape of a circular shape, an oval shape and a polygon shape.

The first insulation unit (9508) is provided to an upper surface of the at least one primary winding (9506) and coupled to the first fastening unit (9502*a*) to insulate the at least one primary winding (9506). At this time, the first insulation unit (9508) may be provided as an insulation sheet, and may be provided in at least one shape of a circular shape, an oval shape and a polygon shape.

The at least one secondary winding (9510) is provided to an upper surface of the first insulation unit (9508), coupled to the first fastening unit (9502*a*) and insulated by the first insulation unit (9508) to transform a power signal.

At this time, the at least one secondary winding (9510) may include a metal thin film pattern layer (LP207) having an inductance component. The metal thin film pattern layer (LP207) having an inductance component may be provided in a metal material having a high conductivity to smoothly and efficiently output a power signal transformed by the at least one secondary winding (9510).

The metal thin film pattern layer (LP207) having an inductance component may be formed by at least one engineering method of a photo-lithography method using a photo mask and an etching solution, or an injection molding method using a press. The at least one secondary winding (9510) may be provided in at least one shape of a circular shape, an oval shape and a polygon shape.

The second insulation unit (9512) is provided to an upper surface of the at least one secondary winding (9510), and coupled to the first fastening unit (9502*a*) to insulate the at least one secondary winding (9510). At this time, the second insulation unit (9512) may be provided as an insulation sheet, and may be provided in at least one shape of a circular shape, an oval shape and a polygon shape.

The at least another secondary winding (9513) is provided between the core (9502) and the bobbin (9504), and provided to a bottom surface of the bobbin (9504) to be coupled to the first fastening unit (9502*a*) for transformation of a power signal.

At this time, the at least another secondary winding (9513) may include metal thin film pattern layers (LP208, LP209) having at least two or more inductance components, and at least one secondary insulation layer (IP66) provided between the metal thin film pattern layers (LP208, LP209) having at least two or more inductance components to insulate the metal thin film pattern layers (LP208, LP209) having at least two or more inductance components.

The metal thin film pattern layers (LP208, LP209) having at least two or more inductance components may be provided in a metal material having a high conductivity to smoothly and efficiently output a power signal transformed by the at least another secondary winding (9513).

The metal thin film pattern layers (LP208, LP209) having at least two or more inductance components may be formed by at least one engineering method of a photo-lithography method using a photo mask and an etching solution, or an injection molding method using a press. The at least another secondary winding (9513) may be provided in at least one shape of a circular shape, an oval shape and a polygon shape.

The third insulation unit (9515) may be provided to a bottom surface of the at least another secondary winding (9513), and may be coupled to the first fastening unit (9502*a*) to insulate the at least another secondary winding (9513). At this time, the third insulation unit (9515) may be provided as an insulation sheet, and may be provided in at least one shape of a circular shape, an oval shape and a polygon shape.

The at least another primary winding (9517) is provided to a bottom surface of the third insulation unit (9515), and coupled to the first fastening unit (9502*a*) to be insulated by the third insulation unit (9515) for supply of a power signal.

At this time, the at least another primary winding (9517) may include a metal thin film pattern layer (LP210) having an inductance component. The metal thin film pattern layer (LP210) having an inductance component may be provided in a metal material having a high conductivity to smoothly and efficiently supply a power signal supplied by a power signal supply unit (9514, described later).

The metal thin film pattern layer (LP210) having an inductance component may be formed by at least one engineering method of a photo-lithography method using a photo mask and an etching solution, or an injection molding method using a press. The at least another primary winding (9517) may be provided in at least one shape of a circular shape, an oval shape and a polygon shape.

The fourth insulation unit (9519) is provided to a bottom surface of the at least another primary winding (9517), and coupled to the first fastening unit (9502*a*) to insulate the at least another primary winding (9517). The fourth insulation unit (9519) may be provided as an insulation sheet, and may be provided in at least one shape of a circular shape, an oval shape and a polygon shape.

A power signal supply unit (9514) may be coupled to one side of the bobbin (9504) to be electrically connected to the at least one primary winding (9506), whereby a power signal can be supplied to the at least one primary winding (9506). At this time, the power signal supply unit (9514) may be electrically connected to a distal end of one side of the bobbin (9504) and to a distal end of the at least one primary winding (9506).

Furthermore, the power signal supply unit (9514) may be coupled to another side of the bobbin (9504) to be electrically connected to the at least another primary winding (9517), whereby a power signal can be supplied to the at least another primary winding (9517). At this time, the power signal supply unit (9514) may be electrically connected to a distal end of another side of the bobbin (9504) and a distal end of the at least another primary winding (9517).

The power signal supply unit (9514) may be provided in a metal material having a high conductivity to smoothly and efficiently supply a power signal to the at least one primary winding (9506) or to the at least another primary winding (9517). At this time, the power signal supply unit (9514) may be provided as a terminal lug. A power signal output unit (9516) may be coupled to the other side of the bobbin (9504) to be electrically connected to the at least one secondary winding (9510), whereby a power signal transformed by the at least one secondary winding (9510) can be outputted. At this time, the power signal output unit (9516) may be electrically connected to a distal end of the other side of the bobbin (9504) and to a distal end of the at least one secondary winding (9510).

The power signal output unit (9516) may be coupled to another other side of the bobbin (9504) to be electrically coupled to the at least another secondary winding (9513), whereby a power signal transformed by the at least another secondary winding (9513) can be outputted. At this time, the power signal output unit (9516) may be electrically coupled to a distal end of another other side of the bobbin (9504) and to a distal end of the at least another secondary winding (9513).

Furthermore, the power signal output unit (9516) may be provided in a metal material having a high conductivity to smoothly and efficiently output a power signal transformed by the at least one secondary winding (9510) or the at least another secondary winding (9513). The power signal output unit (9516) may be provided as a terminal lug.

As apparent from the foregoing, the planar transformer (9500) according to the forty eighth exemplary embodiment of the present invention includes the core (9502), the bobbin (9504), the at least one primary winding (9506), the first insulation unit (9508), the at least one secondary winding (9510), the second insulation unit (9512), the at least another secondary winding (9513), the third insulation unit (9515), the at least another primary winding (9517) and the fourth insulation unit (9519).

Therefore, a planar transformer (9500) can be manufactured in a slim size using the technical feature of the planar transformer (9500) according to the forty eighth exemplary embodiment of the present invention, such that a power supply unit (not shown) that is manufactured along with the planar transformer (9500) can be manufactured in a slim size. Furthermore, the planar transformer (9500) according to the forty eighth exemplary embodiment of the present invention can reduce the manufacturing cost of the planar transformer (9500) to enhance the efficiency of transformation.

Forty Ninth Exemplary Embodiment

Figure 97:
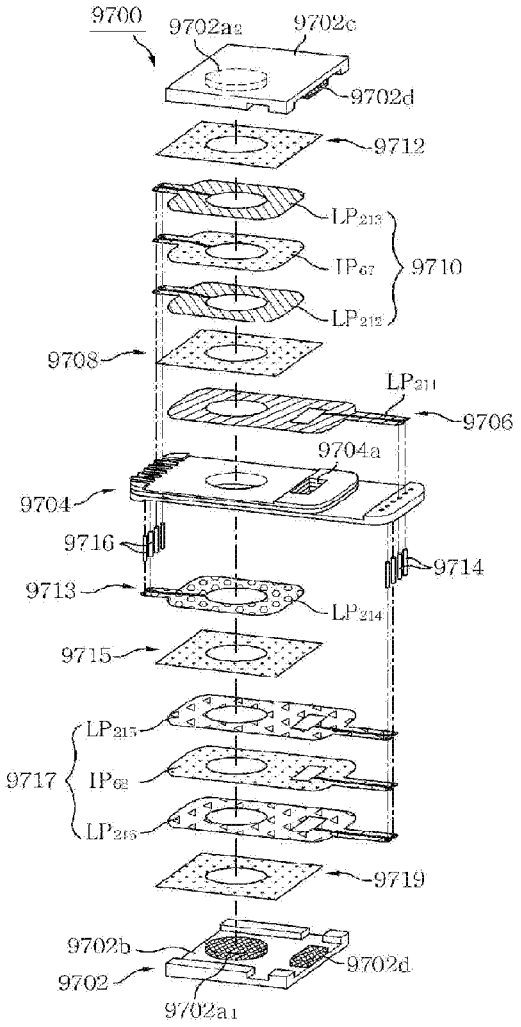
FIG. 97 is an exploded perspective view illustrating a planar transformer according to a forty ninth exemplary embodiment of the present invention.
Figure 98:
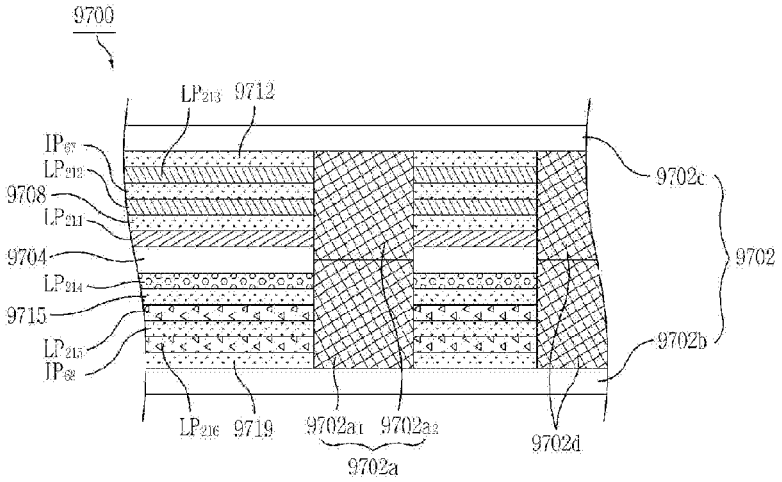
FIG. 98 is a coupled cross-sectional view illustrating a planar transformer according to a forty ninth exemplary embodiment of the present invention.

FIG. 97 is an exploded perspective view illustrating a planar transformer according to a forty ninth exemplary embodiment of the present invention, and FIG. 98 is a coupled cross-sectional view illustrating a planar transformer according to a forty ninth exemplary embodiment of the present invention.

First, referring to FIGS. 97 and 98, a planar transformer (9700) according to the forty ninth exemplary embodiment of the present invention includes a core (9702), a bobbin (9704), at least one primary winding (9706), a first insulation unit (9708), at least one secondary winding (9710), a second insulation unit (9712), at least another secondary winding (9713), a third insulation unit (9715), at least another primary winding (9717) and a fourth insulation unit (9719).

The core (9702) includes a first fastening unit (9702*a*) and is provided to induce formation of a magnetic field, where the core (9702) may include a bottom core (9702*b*) and an upper core (9702*c*). The bobbin (9704) is so provided as to be coupled to the core (9702) by the first fastening unit (9702*a*). The first fastening unit (9702*a*) may include first fastening lugs (9702*a*1, 9702*a*2).

Furthermore, the bobbin (9704) may include a second fastening unit (9704*a*) discrete from the first fastening unit (9702*a*), and the core (9702) may include a third fastening unit (9702*d*) to be coupled to the second fastening unit (9704*a*). At this time, the second fastening unit (9704*a*) may be provided as a second fastening hole (9704*a*), and the third fastening unit (9702*d*) may be provided to the bottom core (9702*b*) and the upper core (9702*c*), and may be provided as a third fastening lug (9702*d*) so as to be coupled to the second fastening hole (9704*a*).

The at least one primary winding (9706) is provided between the core (9702) and the bobbin (9704), and provided at an upper surface of the bobbin (9704) to be coupled to the first fastening unit (9702*a*) for supply of a power signal.

At this time, the at least one primary winding (9706) may include a metal thin film pattern layer (LP211) having an inductance component. The metal thin film pattern layer (LP211) having an inductance component may be provided in a metal material having a high conductivity to smoothly and efficiently supply a power signal supplied by a power signal supply unit (9714, described later).

The metal thin film pattern layer (LP211) having an inductance component may be formed by at least one engineering method of a photo-lithography method using a photo mask and an etching solution, or an injection molding method using a press. The at least one primary winding (9706) may be provided in at least one shape of a circular shape, an oval shape and a polygon shape.

The first insulation unit (9708) is provided to an upper surface of the at least one primary winding (9706) and coupled to the first fastening unit (9702*a*) to insulate the at least one primary winding (9706). At this time, the first insulation unit (9708) may be provided as an insulation sheet, and may be provided in at least one shape of a circular shape, an oval shape and a polygon shape.

The at least one secondary winding (9710) is provided to an upper surface of the first insulation unit (9708), coupled to the first fastening unit (9702*a*) and insulated by the first insulation unit (9708) to transform a power signal.

At this time, the at least one secondary winding (9710) may include metal thin film pattern layers (LP212, LP213) having at least two or more inductance components, and at least one secondary insulation layer (IP67) provided between the metal thin film pattern layers (LP212, LP213) having at least two or more inductance components to insulate the metal thin film pattern layers (LP212, LP213) having at least two or more inductance components.

The metal thin film pattern layers (LP212, LP213) having at least two or more inductance components may be provided in a metal material having a high conductivity to smoothly and efficiently output a power signal transformed by the at least one secondary winding (9710).

The metal thin film pattern layers (LP212, LP213) having at least two or more inductance components may be formed by at least one engineering method of a photo-lithography method using a photo mask and an etching solution, or an injection molding method using a press. The at least one secondary winding (9710) may be provided in at least one shape of a circular shape, an oval shape and a polygon shape.

The second insulation unit (9712) is provided to an upper surface of the at least one secondary winding (9710), and coupled to the first fastening unit (9702*a*) to insulate the at least one secondary winding (9710). At this time, the second insulation unit (9712) may be provided as an insulation sheet, and may be provided in at least one shape of a circular shape, an oval shape and a polygon shape.

The at least another secondary winding (9713) is provided between the core (9702) and the bobbin (9704), and provided to a bottom surface of the bobbin (9704) to be coupled to the first fastening unit (9702*a*) for transformation of a power signal.

At this time, the at least another secondary winding (9713) may include a metal thin film pattern layer (LP214) having an inductance component.

The metal thin film pattern layer (LP214) having an inductance component may be provided in a metal material having a high conductivity to smoothly and efficiently output a power signal transformed by the at least another secondary winding (9713).

The metal thin film pattern layer (LP214) having an inductance component may be formed by at least one engineering method of a photo-lithography method using a photo mask and an etching solution, or an injection molding method using a press. The at least another secondary winding (9713) may be provided in at least one shape of a circular shape, an oval shape and a polygon shape.

The third insulation unit (9715) may be provided to a bottom surface of the at least another secondary winding (9713), and may be coupled to the first fastening unit (9702*a*) to insulate the at least another secondary winding (9713). At this time, the third insulation unit (9715) may be provided as an insulation sheet, and may be provided in at least one shape of a circular shape, an oval shape and a polygon shape.

The at least another primary winding (9717) is provided to a bottom surface of the third insulation unit (9715), and coupled to the first fastening unit (9702*a*) to be insulated by the third insulation unit (9715) for supply of a power signal.

At this time, the at least another primary winding (9717) may include metal thin film pattern layers (LP215, LP216) having at least two or more inductance components, and at least another primary insulation layer (IP68) provided between the metal thin film pattern layers (LP215, LP216) having at least two or more inductance components to insulate the metal thin film pattern layers (LP215, LP216) having at least two or more inductance components.

The metal thin film pattern layers (LP215, LP216) having at least two or more inductance components may be provided in a metal material having a high conductivity to smoothly and efficiently supply a power signal supplied by a power signal supply unit (9714, described later).

The metal thin film pattern layers (LP215, LP216) having at least two or more inductance components may be formed by at least one engineering method of a photo-lithography method using a photo mask and an etching solution, or an injection molding method using a press. The at least another primary winding (9717) may be provided in at least one shape of a circular shape, an oval shape and a polygon shape.

The fourth insulation unit (9719) is provided to a bottom surface of the at least another primary winding (9717), and coupled to the first fastening unit (9702*a*) to insulate the at least another primary winding (9717). The fourth insulation unit (9719) may be provided as an insulation sheet, and may be provided in at least one shape of a circular shape, an oval shape and a polygon shape.

A power signal supply unit (9714) may be coupled to one side of the bobbin (9704) to be electrically connected to the at least one primary winding (9706), whereby a power signal can be supplied to the at least one primary winding (9706). At this time, the power signal supply unit (9714) may be electrically connected to a distal end of one side of the bobbin (9704) and to a distal end of the at least one primary winding (9706).

Furthermore, the power signal supply unit (9714) may be coupled to another side of the bobbin (9704) to be electrically connected to the at least another primary winding (9717), whereby a power signal can be supplied to the at least another primary winding (9717). At this time, the power signal supply unit (9714) may be electrically connected to a distal end of another side of the bobbin (9704) and a distal end of the at least another primary winding (9717).

The power signal supply unit (9714) may be provided in a metal material having a high conductivity to smoothly and efficiently supply a power signal to the at least one primary winding (9706) or to the at least another primary winding (9717). At this time, the power signal supply unit (9714) may be provided as a terminal lug.

A power signal output unit (9716) may be coupled to the other side of the bobbin (9704) to be electrically connected to the at least one secondary winding (9710), whereby a power signal transformed by the at least one secondary winding (9710) can be outputted. At this time, the power signal output unit (9716) may be electrically connected to a distal end of the other side of the bobbin (9704) and to a distal end of the at least one secondary winding (9710).

The power signal output unit (9716) may be coupled to another other side of the bobbin (9704) to be electrically coupled to the at least another secondary winding (9713), whereby a power signal transformed by the at least another secondary winding (9713) can be outputted. At this time, the power signal output unit (9716) may be electrically coupled to a distal end of another other side of the bobbin (9704) and to a distal end of the at least another secondary winding (9713).

Furthermore, the power signal output unit (9716) may be provided in a metal material having a high conductivity to smoothly and efficiently output a power signal transformed by the at least one secondary winding (9710) or the at least another secondary winding (9713). The power signal output unit (9716) may be provided as a terminal lug.

As apparent from the foregoing, the planar transformer (9700) according to the forty ninth exemplary embodiment of the present invention includes the core (9702), the bobbin (9704), the at least one primary winding (9706), the first insulation unit (9708), the at least one secondary winding (9710), the second insulation unit (9712), the at least another secondary winding (9713), the third insulation unit (9715), the at least another primary winding (9717) and the fourth insulation unit (9719).

Therefore, a planar transformer (9700) can be manufactured in a slim size using the technical feature of the planar transformer (9700) according to the forty ninth exemplary embodiment of the present invention, such that a power supply unit (not shown) that is manufactured along with the planar transformer (9700) can be manufactured in a slim size. Furthermore, the planar transformer (9700) according to the forty ninth exemplary embodiment of the present invention can reduce the manufacturing cost of the planar transformer (9700) to enhance the efficiency of transformation.

Fiftieth Exemplary Embodiment

Figure 99:
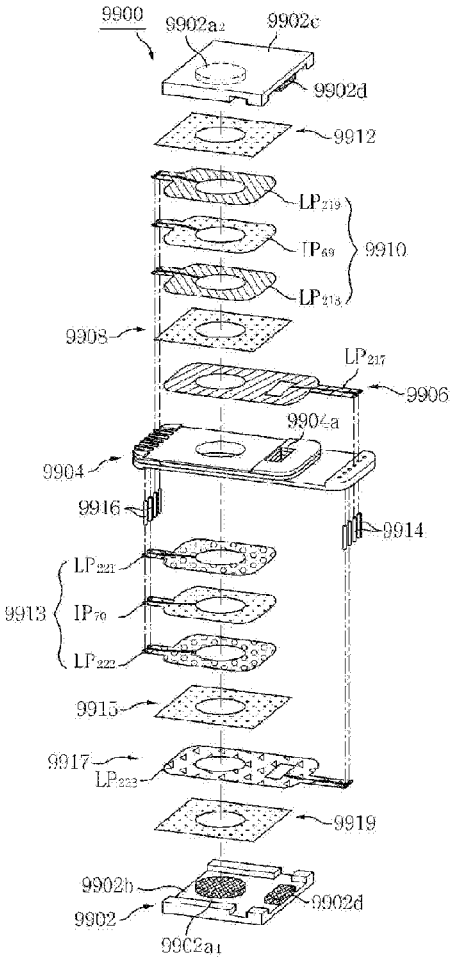
FIG. 99 is an exploded perspective view illustrating a planar transformer according to a fiftieth exemplary embodiment of the present invention.
Figure 100:
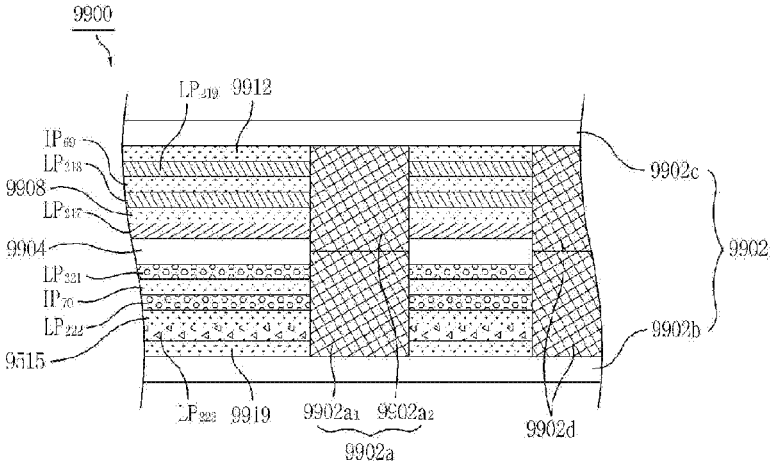
FIG. 100 is a coupled cross-sectional view illustrating a planar transformer according to a fiftieth exemplary embodiment of the present invention.

FIG. 99 is an exploded perspective view illustrating a planar transformer according to a fiftieth exemplary embodiment of the present invention, and FIG. 100 is a coupled cross-sectional view illustrating a planar transformer according to a fiftieth exemplary embodiment of the present invention.

First, referring to FIGS. 99 and 100, a planar transformer (9900) according to the fiftieth exemplary embodiment of the present invention includes a core (9902), a bobbin (9904), at least one primary winding (9906), a first insulation unit (9908), at least one secondary winding (9910), a second insulation unit (9912), at least another secondary winding (9913), a third insulation unit (9915), at least another primary winding (9917) and a fourth insulation unit (9919). The core (9902) includes a first fastening unit (9902*a*) and is provided to induce formation of a magnetic field, where the core (9902) may include a bottom core (9902*b*) and an upper core (9902*c*). The bobbin (9904) is so provided as to be coupled to the core (9902) by the first fastening unit (9902*a*). The first fastening unit (9902*a*) may include first fastening lugs (9902*a*1, 9902*a*2).

Furthermore, the bobbin (9904) may include a second fastening unit (9904*a*) discrete from the first fastening unit (9902*a*), and the core (9902) may include a third fastening unit (9902*d*) to be coupled to the second fastening unit (9904*a*). At this time, the second fastening unit (9904*a*) may be provided as a second fastening hole (9904*a*), and the third fastening unit (9902*d*) may be provided to the bottom core (9902*b*) and the upper core (9902*c*), and may be provided as a third fastening lug (9902*d*) so as to be coupled to the second fastening hole (9904*a*) The at least one primary winding (9906) is provided between the core (9902) and the bobbin (9904), and provided at an upper surface of the bobbin (9904) to be coupled to the first fastening unit (9902*a*) for supply of a power signal.

At this time, the at least one primary winding (9906) may include a metal thin film pattern layer (LP217) having an inductance component. The metal thin film pattern layer having an inductance component may be provided in a metal material having a high conductivity to smoothly and efficiently supply a power signal supplied by a power signal supply unit (9914, described later).

The metal thin film pattern layer (LP217) having an inductance component may be formed by at least one engineering method of a photo-lithography method using a photo mask and an etching solution, or an injection molding method using a press. The at least one primary winding (9906) may be provided in at least one shape of a circular shape, an oval shape and a polygon shape.

The first insulation unit (9908) is provided to an upper surface of the at least one primary winding (9906) and coupled to the first fastening unit (9902*a*) to insulate the at least one primary winding (9906). At this time, the first insulation unit (9908) may be provided as an insulation sheet, and may be provided in at least one shape of a circular shape, an oval shape and a polygon shape.

The at least one secondary winding (9910) is provided to an upper surface of the first insulation unit (9908), coupled to the first fastening unit (9902*a*) and insulated by the first insulation unit (9908) to transform a power signal.

At this time, the at least one secondary winding (9910) may include metal thin film pattern layers (LP218, LP219) having at least two or more inductance components, and at least one secondary insulation layer (IP69) provided between the metal thin film pattern layers (LP218, LP219) having at least two or more inductance components to insulate the metal thin film pattern layers (LP218, LP219) having at least two or more inductance components.

The metal thin film pattern layers (LP218, LP219) having at least two or more inductance components may be provided in a metal material having a high conductivity to smoothly and efficiently output a power signal transformed by the at least one secondary winding (9910).

The metal thin film pattern layers (LP218, LP219) having at least two or more inductance components may be formed by at least one engineering method of a photo-lithography method using a photo mask and an etching solution, or an injection molding method using a press. The at least one secondary winding (9910) may be provided in at least one shape of a circular shape, an oval shape and a polygon shape.

The second insulation unit (9912) is provided to an upper surface of the at least one secondary winding (9910), and coupled to the first fastening unit (9902*a*) to insulate the at least one secondary winding (9910). At this time, the second insulation unit (9912) may be provided as an insulation sheet, and may be provided in at least one shape of a circular shape, an oval shape and a polygon shape.

The at least another secondary winding (9913) is provided between the core (9902) and the bobbin (9904), and provided to a bottom surface of the bobbin (9904) to be coupled to the first fastening unit (9902*a*) for transformation of a power signal.

At this time, the at least another secondary winding (9913) may include metal thin film pattern layers (LP221, LP222) having at least two or more inductance components, and at least one secondary insulation layer (IP70) provided between the metal thin film pattern layers (LP221, LP222) having at least two or more inductance components to insulate the metal thin film pattern layers (LP221, LP222) having at least two or more inductance components.

The metal thin film pattern layers (LP221, LP222) having at least two or more inductance components may be provided in a metal material having a high conductivity to smoothly and efficiently output a power signal transformed by the at least another secondary winding (9913).

The metal thin film pattern layers (LP221, LP222) having at least two or more inductance components may be formed by at least one engineering method of a photo-lithography method using a photo mask and an etching solution, or an injection molding method using a press. The at least another secondary winding (9913) may be provided in at least one shape of a circular shape, an oval shape and a polygon shape.

The third insulation unit (9915) may be provided to a bottom surface of the at least another secondary winding (9913), and may be coupled to the first fastening unit (9902*a*) to insulate the at least another secondary winding (9913). At this time, the third insulation unit (9915) may be provided as an insulation sheet, and may be provided in at least one shape of a circular shape, an oval shape and a polygon shape.

The at least another primary winding (9917) is provided to a bottom surface of the third insulation unit (9915), and coupled to the first fastening unit (9902*a*) to be insulated by the third insulation unit (9915) for supply of a power signal.

At this time, the at least another primary winding (9917) may include a metal thin film pattern layer (LP223) having an inductance component. The metal thin film pattern layer (LP223) having an inductance component may be provided in a metal material having a high conductivity to smoothly and efficiently supply a power signal supplied by a power signal supply unit (9914, described later).

The metal thin film pattern layer (LP223) having an inductance component may be formed by at least one engineering method of a photo-lithography method using a photo mask and an etching solution, or an injection molding method using a press. The at least another primary winding (9917) may be provided in at least one shape of a circular shape, an oval shape and a polygon shape.

The fourth insulation unit (9919) is provided to a bottom surface of the at least another primary winding (9917), and coupled to the first fastening unit (9902*a*) to insulate the at least another primary winding (9917). The fourth insulation unit (9919) may be provided as an insulation sheet, and may be provided in at least one shape of a circular shape, an oval shape and a polygon shape.

A power signal supply unit (9914) may be coupled to one side of the bobbin (9904) to be electrically connected to the at least one primary winding (9906), whereby a power signal can be supplied to the at least one primary winding (9906). At this time, the power signal supply unit (9914) may be electrically connected to a distal end of one side of the bobbin (9904) and to a distal end of the at least one primary winding (9906).

Furthermore, the power signal supply unit (9914) may be coupled to another side of the bobbin (9904) to be electrically connected to the at least another primary winding (9917), whereby a power signal can be supplied to the at least another primary winding (9917). At this time, the power signal supply unit (9914) may be electrically connected to a distal end of another side of the bobbin (9904) and a distal end of the at least another primary winding (9917).

The power signal supply unit (9914) may be provided in a metal material having a high conductivity to smoothly and efficiently supply a power signal to the at least one primary winding (9906) or to the at least another primary winding (9917). At this time, the power signal supply unit (9914) may be provided as a terminal lug.

A power signal output unit (9916) may be coupled to the other side of the bobbin (9904) to be electrically connected to the at least one secondary winding (9910), whereby a power signal transformed by the at least one secondary winding (9910) can be outputted. At this time, the power signal output unit (9916) may be electrically connected to a distal end of the other side of the bobbin (9904) and to a distal end of the at least one secondary winding (9910).

The power signal output unit (9916) may be coupled to another other side of the bobbin (9904) to be electrically coupled to the at least another secondary winding (9913), whereby a power signal transformed by the at least another secondary winding (9913) can be outputted. At this time, the power signal output unit (9916) may be electrically coupled to a distal end of another other side of the bobbin (9904) and to a distal end of the at least another secondary winding (9913).

Furthermore, the power signal output unit (9916) may be provided in a metal material having a high conductivity to smoothly and efficiently output a power signal transformed by the at least one secondary winding (9910) or the at least another secondary winding (9913). The power signal output unit (9916) may be provided as a terminal lug.

As apparent from the foregoing, the planar transformer (9900) according to the fiftieth exemplary embodiment of the present invention includes the core (9902), the bobbin (9904), the at least one primary winding (9906), the first insulation unit (9908), the at least one secondary winding (9910), the second insulation unit (9912), the at least another secondary winding (9913), the third insulation unit (9915), the at least another primary winding (9917) and the fourth insulation unit (9919).

Therefore, a planar transformer (9900) can be manufactured in a slim size using the technical feature of the planar transformer (9900) according to the fiftieth exemplary embodiment of the present invention, such that a power supply unit (not shown) that is manufactured along with the planar transformer (9900) can be manufactured in a slim size. Furthermore, the planar transformer (9900) according to the fiftieth exemplary embodiment of the present invention can reduce the manufacturing cost of the planar transformer (9900) to enhance the efficiency of transformation.

Fifty First Exemplary Embodiment

Figure 101:
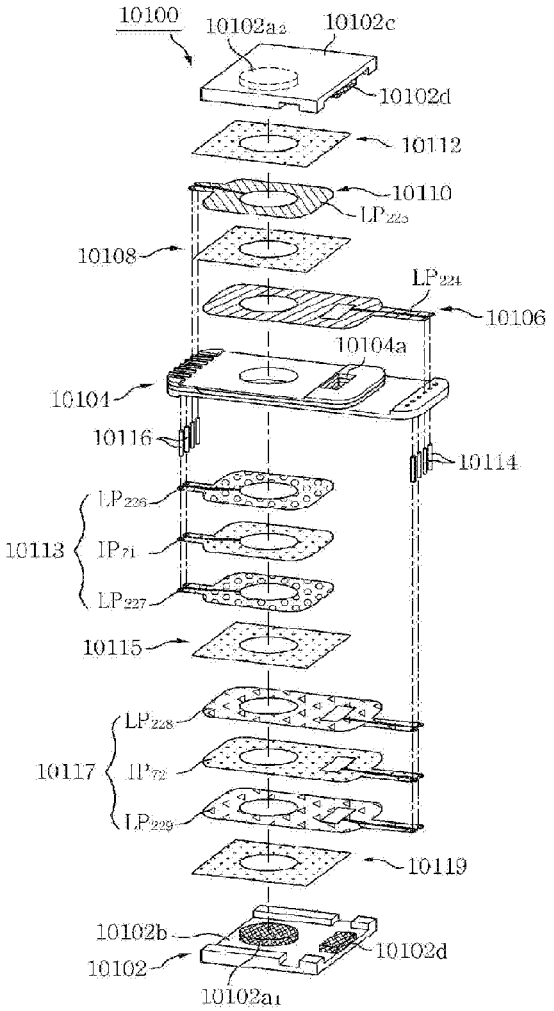
FIG. 101 is an exploded perspective view illustrating a planar transformer according to a fifty first exemplary embodiment of the present invention.
Figure 102:
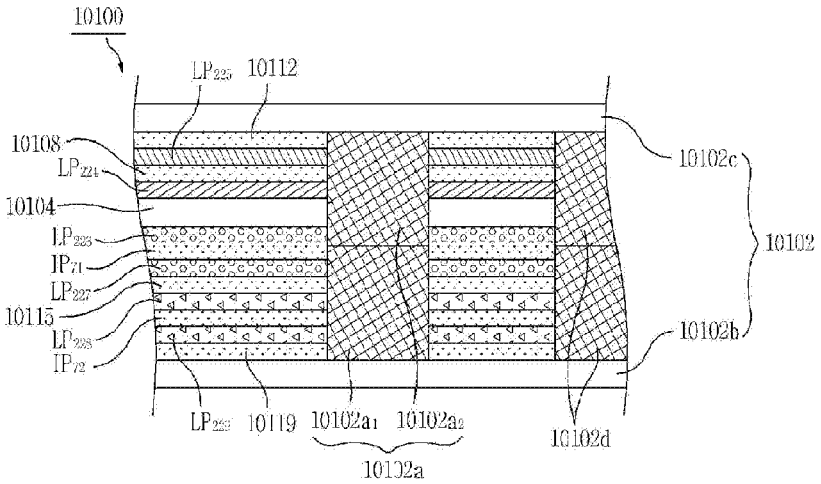
FIG. 102 is a coupled cross-sectional view illustrating a planar transformer according to a fifty first exemplary embodiment of the present invention.

FIG. 101 is an exploded perspective view illustrating a planar transformer according to a fifty first exemplary embodiment of the present invention, and FIG. 102 is a coupled cross-sectional view illustrating a planar transformer according to a fifty first exemplary embodiment of the present invention.

First, referring to FIGS. 101 and 102, a planar transformer (10100) according to the fifty first exemplary embodiment of the present invention includes a core (10102), a bobbin (10104), at least one primary winding (10106), a first insulation unit (10108), at least one secondary winding (10110), a second insulation unit (10112), at least another secondary winding (10113), a third insulation unit (10115), at least another primary winding (10117) and a fourth insulation unit (10119).

The core (10102) includes a first fastening unit (10102*a*) and is provided to induce formation of a magnetic field, where the core (10102) may include a bottom core (10102*b*) and an upper core (10102*c*). The bobbin (10104) is so provided as to be coupled to the core (10102) by the first fastening unit (10102*a*). The first fastening unit (10102*a*) may include first fastening lugs (10102*a*1, 10102*a*2).

Furthermore, the bobbin (10104) may include a second fastening unit (10104*a*) discrete from the first fastening unit (10102*a*), and the core (10102) may include a third fastening unit (10102*d*) to be coupled to the second fastening unit (10104*a*). At this time, the second fastening unit (10104*a*) may be provided as a second fastening hole (10104*a*), and the third fastening unit (10102*d*) may be provided to the bottom core (10102*b*) and the upper core (10102*c*), and may be provided as a third fastening lug (10102*d*) so as to be coupled to the second fastening hole (10104*a*).

The at least one primary winding (10106) is provided between the core (10102) and the bobbin (10104), and provided at an upper surface of the bobbin (10104) to be coupled to the first fastening unit (10102*a*) for supply of a power signal.

At this time, the at least one primary winding (10106) may include a metal thin film pattern layer (LP224) having an inductance component. The metal thin film pattern layer (LP2224) having an inductance component may be provided in a metal material having a high conductivity to smoothly and efficiently supply a power signal supplied by a power signal supply unit (10114, described later).

The metal thin film pattern layer (LP224) having an inductance component may be formed by at least one engineering method of a photo-lithography method using a photo mask and an etching solution, or an injection molding method using a press. The at least one primary winding (10106) may be provided in at least one shape of a circular shape, an oval shape and a polygon shape.

The first insulation unit (10108) is provided to an upper surface of the at least one primary winding (10106) and coupled to the first fastening unit (10102*a*) to insulate the at least one primary winding (10106). At this time, the first insulation unit (10108) may be provided as an insulation sheet, and may be provided in at least one shape of a circular shape, an oval shape and a polygon shape.

The at least one secondary winding (10110) is provided to an upper surface of the first insulation unit (10108), coupled to the first fastening unit (10102*a*) and insulated by the first insulation unit (10108) to transform a power signal.

At this time, the at least one secondary winding (10110) may include a metal thin film pattern layer (LP225) having an inductance component. The metal thin film pattern layer (LP225) having an inductance component may be provided in a metal material having a high conductivity to smoothly and efficiently output a power signal transformed by the at least one secondary winding (10110).

The metal thin film pattern layer (LP225) having an inductance component may be formed by at least one engineering method of a photo-lithography method using a photo mask and an etching solution, or an injection molding method using a press. The at least one secondary winding (10110) may be provided in at least one shape of a circular shape, an oval shape and a polygon shape.

The second insulation unit (10112) is provided to an upper surface of the at least one secondary winding (10110), and coupled to the first fastening unit (10102*a*) to insulate the at least one secondary winding (10110). At this time, the second insulation unit (10112) may be provided as an insulation sheet, and may be provided in at least one shape of a circular shape, an oval shape and a polygon shape.

The at least another secondary winding (10113) is provided between the core (10102) and the bobbin (10104), and provided to a bottom surface of the bobbin (10104) to be coupled to the first fastening unit (10102*a*) for transformation of a power signal.

At this time, the at least another secondary winding (10113) may include metal thin film pattern layers (LP226, LP227) having at least two or more inductance components, and at least another secondary insulation layer (IP71) provided between the metal thin film pattern layers (LP226, LP227) having at least two or more inductance components to insulate the metal thin film pattern layers (LP226, LP227) having at least two or more inductance components.

The metal thin film pattern layers (LP226, LP227) having at least two or more inductance components may be provided in a metal material having a high conductivity to smoothly and efficiently output a power signal transformed by the at least another secondary winding (10113).

The metal thin film pattern layers (LP226, LP227) having at least two or more inductance components may be formed by at least one engineering method of a photo-lithography method using a photo mask and an etching solution, or an injection molding method using a press. The at least another secondary winding (10113) may be provided in at least one shape of a circular shape, an oval shape and a polygon shape.

The third insulation unit (10115) may be provided to a bottom surface of the at least another secondary winding (10113), and may be coupled to the first fastening unit (10102*a*) to insulate the at least another secondary winding (10113). At this time, the third insulation unit (10115) may be provided as an insulation sheet, and may be provided in at least one shape of a circular shape, an oval shape and a polygon shape.

The at least another primary winding (10117) is provided to a bottom surface of the third insulation unit (10115), and coupled to the first fastening unit (10102*a*) to be insulated by the third insulation unit (10115) for supply of a power signal.

At this time, the at least another primary winding (10117) may include metal thin film pattern layers (LP228, LP229) having at least two or more inductance components, and at least one secondary insulation layer (IP72) provided between the metal thin film pattern layers (LP228, LP229) having at least two or more inductance components to insulate the metal thin film pattern layers (LP228, LP229) having at least two or more inductance components.

The metal thin film pattern layers (LP228, LP229) having at least two or more inductance components may be provided in a metal material having a high conductivity to smoothly and efficiently supply a power signal supplied by a power signal supply unit (10114, described later).

The metal thin film pattern layers (LP228, LP229) having at least two or more inductance components may be formed by at least one engineering method of a photo-lithography method using a photo mask and an etching solution, or an injection molding method using a press. The at least another primary winding (10117) may be provided in at least one shape of a circular shape, an oval shape and a polygon shape.

The fourth insulation unit (10119) is provided to a bottom surface of the at least another primary winding (10117), and coupled to the first fastening unit (10102*a*) to insulate the at least another primary winding (10117). The fourth insulation unit (10119) may be provided as an insulation sheet, and may be provided in at least one shape of a circular shape, an oval shape and a polygon shape.

A power signal supply unit (10114) may be coupled to one side of the bobbin (10104) to be electrically connected to the at least one primary winding (10106), whereby a power signal can be supplied to the at least one primary winding (10106). At this time, the power signal supply unit (10114) may be electrically connected to a distal end of one side of the bobbin (10104) and to a distal end of the at least one primary winding (10106).

Furthermore, the power signal supply unit (10114) may be coupled to another side of the bobbin (10104) to be electrically connected to the at least another primary winding (10117), whereby a power signal can be supplied to the at least another primary winding (10117). At this time, the power signal supply unit (10114) may be electrically connected to a distal end of another side of the bobbin (10104) and a distal end of the at least another primary winding (10117).

The power signal supply unit (10114) may be provided in a metal material having a high conductivity to smoothly and efficiently supply a power signal to the at least one primary winding (10106) or to the at least another primary winding (10117). At this time, the power signal supply unit (10114) may be provided as a terminal lug.

A power signal output unit (10116) may be coupled to the other side of the bobbin (10104) to be electrically connected to the at least one secondary winding (10110), whereby a power signal transformed by the at least one secondary winding (10110) can be outputted. At this time, the power signal output unit (10116) may be electrically connected to a distal end of the other side of the bobbin (10104) and to a distal end of the at least one secondary winding The power signal output unit (10116) may be coupled to another other side of the bobbin (10104) to be electrically coupled to the at least another secondary winding (10113), whereby a power signal transformed by the at least another secondary winding (10113) can be outputted. At this time, the power signal output unit (10116) may be electrically coupled to a distal end of another other side of the bobbin (10104) and to a distal end of the at least another secondary winding (10113).

Furthermore, the power signal output unit (10116) may be provided in a metal material having a high conductivity to smoothly and efficiently output a power signal transformed by the at least one secondary winding (10110) or the at least another secondary winding (10113). The power signal output unit (10116) may be provided as a terminal lug.

As apparent from the foregoing, the planar transformer (10100) according to the fifty first exemplary embodiment of the present invention includes the core (10102), the bobbin (10104), the at least one primary winding (10106), the first insulation unit (10108), the at least one secondary winding (10110), the second insulation unit (10112), the at least another secondary winding (10113), the third insulation unit (10115), the at least another primary winding (10117) and the fourth insulation unit (10119).

Therefore, a planar transformer (10100) can be manufactured in a slim size using the technical feature of the planar transformer (10100) according to the fifty first exemplary embodiment of the present invention, such that a power supply unit (not shown) that is manufactured along with the planar transformer (10100) can be manufactured in a slim size. Furthermore, the planar transformer (10100) according to the fifty first exemplary embodiment of the present invention can reduce the manufacturing cost of the planar transformer (10100) to enhance the efficiency of transformation.

Fifty Second Exemplary Embodiment

Figure 103:
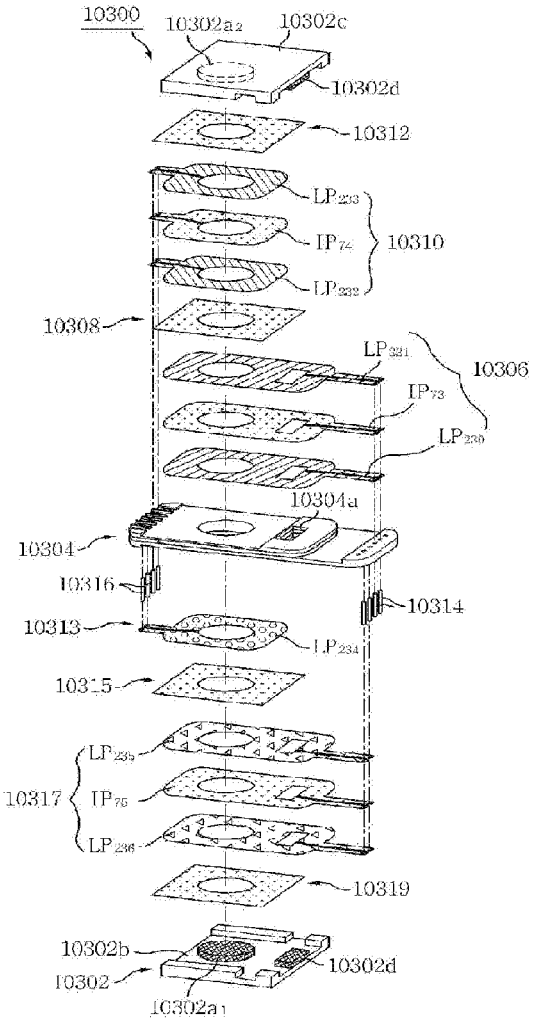
FIG. 103 is an exploded perspective view illustrating a planar transformer according to a fifty second exemplary embodiment of the present invention.
Figure 104:
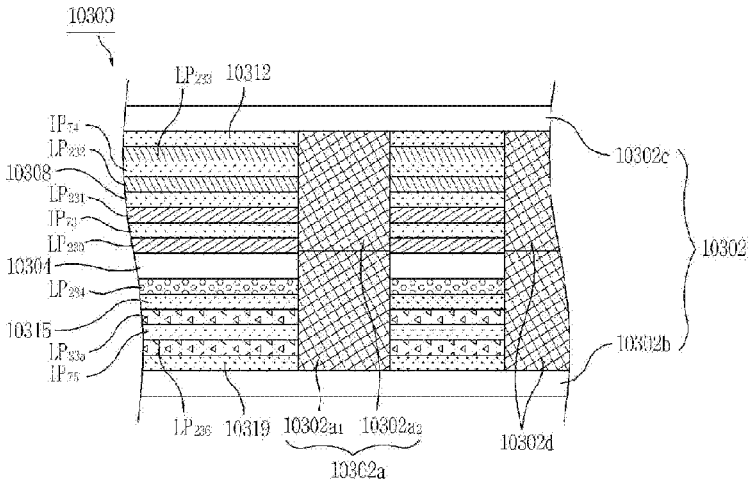
FIG. 104 is a coupled cross-sectional view illustrating a planar transformer according to a fifty second exemplary embodiment of the present invention.

FIG. 103 is an exploded perspective view illustrating a planar transformer according to a fifty second exemplary embodiment of the present invention, and FIG. 104 is a coupled cross-sectional view illustrating a planar transformer according to a fifty second exemplary embodiment of the present invention.

First, referring to FIGS. 103 and 104, a planar transformer (10300) according to the fifty second exemplary embodiment of the present invention includes a core (10302), a bobbin (10304), at least one primary winding (10306), a first insulation unit (10308), at least one secondary winding (10310), a second insulation unit (10312), at least another secondary winding (10313), a third insulation unit (10315), at least another primary winding (10317) and a fourth insulation unit (10319).

The core (10302) includes a first fastening unit (10302*a*) and is provided to induce formation of a magnetic field, where the core (10302) may include a bottom core (10302*b*) and an upper core (10302*c*). The bobbin (10304) is so provided as to be coupled to the core (10302) by the first fastening unit (10302*a*). The first fastening unit (10302*a*) may include first fastening lugs (10302*a*1, 10302*a*2).

Furthermore, the bobbin (10304) may include a second fastening unit (10304*a*) discrete from the first fastening unit (10302*a*), and the core (10302) may include a third fastening unit (10302*d*) to be coupled to the second fastening unit (10304*a*).

At this time, the second fastening unit (10304*a*) may be provided as a second fastening hole (10304*a*), and the third fastening unit (10302*d*) may be provided to the bottom core (10302*b*) and the upper core (10302*c*), and may be provided as a third fastening lug (10302*d*) so as to be coupled to the second fastening hole (10304*a*).

The at least one primary winding (10306) is provided between the core (10302) and the bobbin (10304), and provided at an upper surface of the bobbin (10304) to be coupled to the first fastening unit (10302*a*) for supply of a power signal.

At this time, the at least one primary winding (10306) may include metal thin film pattern layers (LP230, LP231) having at least two or more inductance components, and at least one secondary insulation layer (IP73) provided between the metal thin film pattern layers (LP230, LP231) having at least two or more inductance components to insulate the metal thin film pattern layers (LP230, LP231) having at least two or more inductance components.

The metal thin film pattern layers (LP230, LP231) having at least two or more inductance components may be provided in a metal material having a high conductivity to smoothly and efficiently supply a power signal supplied by a power signal supply unit (10314, described later).

The metal thin film pattern layers (LP230, LP231) having at least two or more inductance components may be formed by at least one engineering method of a photo-lithography method using a photo mask and an etching solution, or an injection molding method using a press. The at least one primary winding (10306) may be provided in at least one shape of a circular shape, an oval shape and a polygon shape.

The first insulation unit (10308) is provided to an upper surface of the at least one primary winding (10306) and coupled to the first fastening unit (10302*a*) to insulate the at least one primary winding (10306). At this time, the first insulation unit (10308) may be provided as an insulation sheet, and may be provided in at least one shape of a circular shape, an oval shape and a polygon shape.

The at least one secondary winding (10310) is provided to an upper surface of the first insulation unit (10308), coupled to the first fastening unit (10302*a*) and insulated by the first insulation unit (10308) to transform a power signal.

At this time, the at least one secondary winding (10310) may include metal thin film pattern layers (LP232, LP233) having at least two or more inductance components, and at least one secondary insulation layer (IP74) provided between the metal thin film pattern layers (LP232, LP233) having at least two or more inductance components to insulate the metal thin film pattern layers (LP232, LP233) having at least two or more inductance components.

The metal thin film pattern layers (LP232, LP233) having at least two or more inductance components may be provided in a metal material having a high conductivity to smoothly and efficiently output a power signal transformed by the at least one secondary winding (10310).

The metal thin film pattern layers (LP232, LP233) having at least two or more inductance components may be formed by at least one engineering method of a photo-lithography method using a photo mask and an etching solution, or an injection molding method using a press. The at least one secondary winding (10310) may be provided in at least one shape of a circular shape, an oval shape and a polygon shape.

The second insulation unit (10312) is provided to an upper surface of the at least one secondary winding (10310), and coupled to the first fastening unit (10302*a*) to insulate the at least one secondary winding (10310). At this time, the second insulation unit (10312) may be provided as an insulation sheet, and may be provided in at least one shape of a circular shape, an oval shape and a polygon shape.

The at least another secondary winding (10313) is provided between the core (10302) and the bobbin (10304), and provided to a bottom surface of the bobbin (10304) to be coupled to the first fastening unit (10302*a*) for transformation of a power signal.

At this time, the at least another secondary winding (10313) may include a metal thin film pattern layer (LP234) having an inductance component. The metal thin film pattern layer (LP234) having an inductance component may be provided in a metal material having a high conductivity to smoothly and efficiently output a power signal transformed by the at least another secondary winding (10313).

The metal thin film pattern layer (LP234) having an inductance component may be formed by at least one engineering method of a photo-lithography method using a photo mask and an etching solution, or an injection molding method using a press. The at least another secondary winding (10313) may be provided in at least one shape of a circular shape, an oval shape and a polygon shape.

The third insulation unit (10315) may be provided to a bottom surface of the at least another secondary winding (10313), and may be coupled to the first fastening unit (10302*a*) to insulate the at least another secondary winding (10313). At this time, the third insulation unit (10315) may be provided as an insulation sheet, and may be provided in at least one shape of a circular shape, an oval shape and a polygon shape.

The at least another primary winding (10317) is provided to a bottom surface of the third insulation unit (10315), and coupled to the first fastening unit (10302*a*) to be insulated by the third insulation unit (10315) for supply of a power signal.

At this time, the at least another primary winding (10317) may include metal thin film pattern layers (LP235, LP236) having at least two or more inductance components, and at least another primary insulation layer (IP75) provided between the metal thin film pattern layers (LP235, LP236) having at least two or more inductance components to insulate the metal thin film pattern layers (LP235, LP236) having at least two or more inductance components.

The metal thin film pattern layers (LP235, LP236) having at least two or more inductance components may be provided in a metal material having a high conductivity to smoothly and efficiently supply a power signal supplied by a power signal supply unit (10314, described later).

The metal thin film pattern layers (LP235, LP236) having at least two or more inductance components may be formed by at least one engineering method of a photo-lithography method using a photo mask and an etching solution, or an injection molding method using a press. The at least another primary winding (10317) may be provided in at least one shape of a circular shape, an oval shape and a polygon shape.

The fourth insulation unit (10319) is provided to a bottom surface of the at least another primary winding (10317), and coupled to the first fastening unit (10302*a*) to insulate the at least another primary winding (10317). The fourth insulation unit (10319) may be provided as an insulation sheet, and may be provided in at least one shape of a circular shape, an oval shape and a polygon shape.

A power signal supply unit (10314) may be coupled to one side of the bobbin (10304) to be electrically connected to the at least one primary winding (10306), whereby a power signal can be supplied to the at least one primary winding (10306). At this time, the power signal supply unit (10314) may be electrically connected to a distal end of one side of the bobbin (10304) and to a distal end of the at least one primary winding (10306).

Furthermore, the power signal supply unit (10314) may be coupled to another side of the bobbin (10304) to be electrically connected to the at least another primary winding (10317), whereby a power signal can be supplied to the at least another primary winding (10317). At this time, the power signal supply unit (10314) may be electrically connected to a distal end of another side of the bobbin (10304) and a distal end of the at least another primary winding (10317).

The power signal supply unit (10314) may be provided in a metal material having a high conductivity to smoothly and efficiently supply a power signal to the at least one primary winding (10306) or to the at least another primary winding (10317). At this time, the power signal supply unit (10314) may be provided as a terminal lug.

A power signal output unit (10316) may be coupled to the other side of the bobbin (10304) to be electrically connected to the at least one secondary winding (10310), whereby a power signal transformed by the at least one secondary winding (10310) can be outputted. At this time, the power signal output unit (10316) may be electrically connected to a distal end of the other side of the bobbin (10304) and to a distal end of the at least one secondary winding (10310) The power signal output unit (10316) may be coupled to another other side of the bobbin (10304) to be electrically coupled to the at least another secondary winding (10313), whereby a power signal transformed by the at least another secondary winding (10313) can be outputted. At this time, the power signal output unit (10316) may be electrically coupled to a distal end of another other side of the bobbin (10304) and to a distal end of the at least another secondary winding (10313).

Furthermore, the power signal output unit (10316) may be provided in a metal material having a high conductivity to smoothly and efficiently output a power signal transformed by the at least one secondary winding (10310) or the at least another secondary winding (10313). The power signal output unit (10316) may be provided as a terminal lug.

As apparent from the foregoing, the planar transformer (10300) according to the fifty second exemplary embodiment of the present invention includes the core (10302), the bobbin (10304), the at least one primary winding (10306), the first insulation unit (10308), the at least one secondary winding (10310), the second insulation unit (10312), the at least another secondary winding (10313), the third insulation unit (10315), the at least another primary winding (10317) and the fourth insulation unit (10319).

Therefore, a planar transformer (10300) can be manufactured in a slim size using the technical feature of the planar transformer (10300) according to the fifty second exemplary embodiment of the present invention, such that a power supply unit (not shown) that is manufactured along with the planar transformer (10300) can be manufactured in a slim size. Furthermore, the planar transformer (10300) according to the fifty second exemplary embodiment of the present invention can reduce the manufacturing cost of the planar transformer (10300) to enhance the efficiency of transformation.

Fifty Third Exemplary Embodiment

Figure 105:
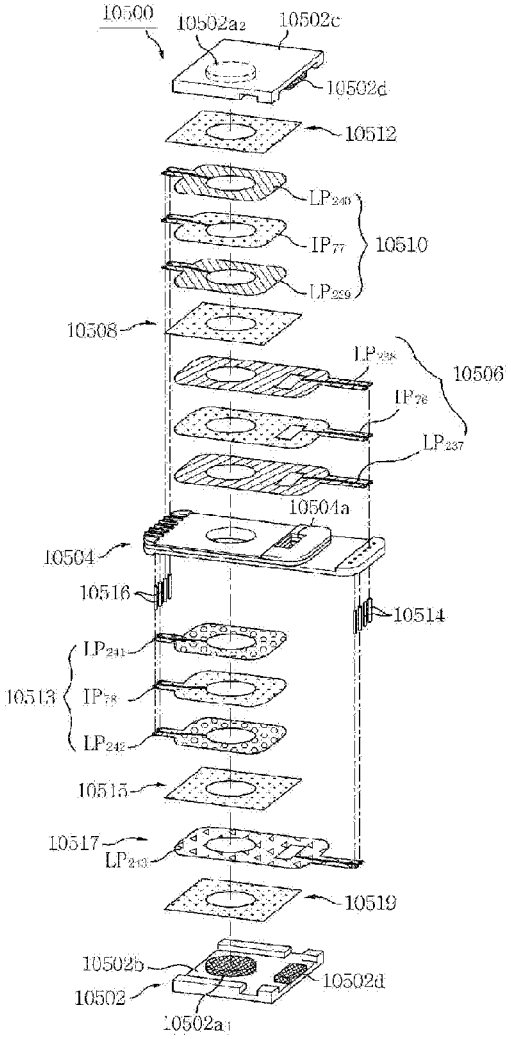
FIG. 105 is an exploded perspective view illustrating a planar transformer according to a fifty third exemplary embodiment of the present invention.
Figure 106:
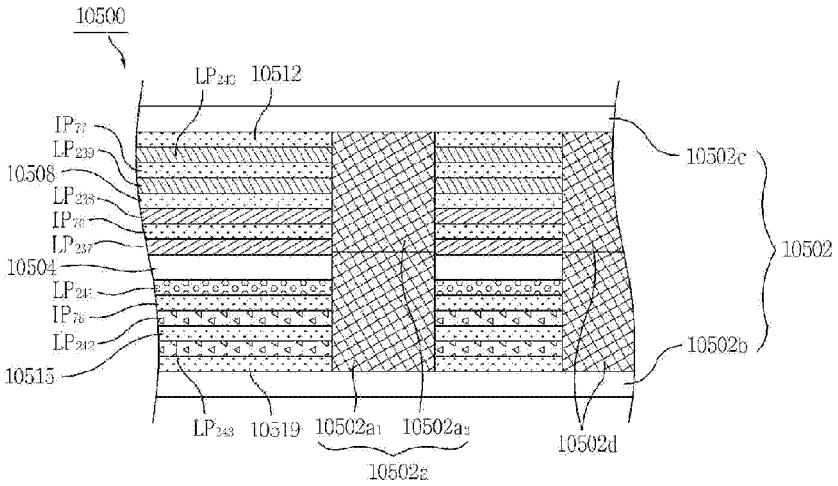
FIG. 106 is a coupled cross-sectional view illustrating a planar transformer according to a fifty third exemplary embodiment of the present invention.

FIG. 105 is an exploded perspective view illustrating a planar transformer according to a fifty third exemplary embodiment of the present invention, and FIG. 106 is a coupled cross-sectional view illustrating a planar transformer according to a fifty third exemplary embodiment of the present invention.

First, referring to FIGS. 105 and 106, a planar transformer (10500) according to the fifty third exemplary embodiment of the present invention includes a core (10502), a bobbin (10504), at least one primary winding (10506), a first insulation unit (10508), at least one secondary winding (10510), a second insulation unit (10512), at least another secondary winding (10513), a third insulation unit (10515), at least another primary winding (10517) and a fourth insulation unit (10519).

The core (10502) includes a first fastening unit (10502*a*) and is provided to induce formation of a magnetic field, where the core (10502) may include a bottom core (10502*b*) and an upper core (10502*c*). The bobbin (10504) is so provided as to be coupled to the core (10502) by the first fastening unit (10502*a*). The first fastening unit (10502*a*) may include first fastening lugs (10502*a*1, 10502*a*2).

Furthermore, the bobbin (10504) may include a second fastening unit (10504*a*) discrete from the first fastening unit (10502*a*), and the core (10502) may include a third fastening unit (10502*d*) to be coupled to the second fastening unit (10504*a*).

At this time, the second fastening unit (10504*a*) may be provided as a second fastening hole (10504*a*), and the third fastening unit (10502*d*) may be provided to the bottom core (10502*b*) and the upper core (10502*c*), and may be provided as a third fastening lug (10502*d*) so as to be coupled to the second fastening hole (10504*a*).

The at least one primary winding (10506) is provided between the core (10502) and the bobbin (10504), and provided at an upper surface of the bobbin (10504) to be coupled to the first fastening unit (10502*a*) for supply of a power signal.

At this time, the at least one primary winding (10506) may include metal thin film pattern layers (LP237, LP238) having at least two or more inductance components, and at least one primary insulation layer (IP76) provided between the metal thin film pattern layers (LP237, LP238) having at least two or more inductance components to insulate the metal thin film pattern layers (LP237, LP238) having at least two or more inductance components.

The metal thin film pattern layers (LP237, LP238) having at least two or more inductance components may be provided in a metal material having a high conductivity to smoothly and efficiently supply a power signal supplied by a power signal supply unit (10514, described later).

The metal thin film pattern layers (LP237, LP238) having at least two or more inductance components may be formed by at least one engineering method of a photo-lithography method using a photo mask and an etching solution, or an injection molding method using a press. The at least one primary winding (10506) may be provided in at least one shape of a circular shape, an oval shape and a polygon shape.

The first insulation unit (10508) is provided to an upper surface of the at least one primary winding (10506) and coupled to the first fastening unit (10502*a*) to insulate the at least one primary winding (10506). At this time, the first insulation unit (10508) may be provided as an insulation sheet, and may be provided in at least one shape of a circular shape, an oval shape and a polygon shape.

The at least one secondary winding (10510) is provided to an upper surface of the first insulation unit (10508), coupled to the first fastening unit (10502*a*) and insulated by the first insulation unit (10508) to transform a power signal.

At this time, the at least one secondary winding (10510) may include metal thin film pattern layers (LP239, LP240) having at least two or more inductance components, and at least one secondary insulation layer (IP77) provided between the metal thin film pattern layers (LP239, LP240) having at least two or more inductance components to insulate the metal thin film pattern layers (LP239, LP240) having at least two or more inductance components.

The metal thin film pattern layers (LP239, LP240) having at least two or more inductance components may be provided in a metal material having a high conductivity to smoothly and efficiently output a power signal transformed by the at least one secondary winding (10510).

The metal thin film pattern layers (LP239, LP240) having at least two or more inductance components may be formed by at least one engineering method of a photo-lithography method using a photo mask and an etching solution, or an injection molding method using a press. The at least one secondary winding (10510) may be provided in at least one shape of a circular shape, an oval shape and a polygon shape.

The second insulation unit (10512) is provided to an upper surface of the at least one secondary winding (10510), and coupled to the first fastening unit (10502*a*) to insulate the at least one secondary winding (10510). At this time, the second insulation unit (10512) may be provided as an insulation sheet, and may be provided in at least one shape of a circular shape, an oval shape and a polygon shape.

The at least another secondary winding (10513) is provided between the core (10502) and the bobbin (10504), and provided to a bottom surface of the bobbin (10504) to be coupled to the first fastening unit (10502*a*) for transformation of a power signal.

At this time, the at least another secondary winding (10513) may include metal thin film pattern layers (LP241, LP242) having at least two or more inductance components, and at least another secondary insulation layer (IP78) provided between the metal thin film pattern layers (LP241, LP242) having at least two or more inductance components to insulate the metal thin film pattern layers (LP241, LP242) having at least two or more inductance components.

The metal thin film pattern layers (LP241, LP242) having at least two or more inductance components may be provided in a metal material having a high conductivity to smoothly and efficiently output a power signal transformed by the at least another secondary winding (10513).

The metal thin film pattern layers (LP241, LP242) having at least two or more inductance components may be formed by at least one engineering method of a photo-lithography method using a photo mask and an etching solution, or an injection molding method using a press. The at least another secondary winding (10513) may be provided in at least one shape of a circular shape, an oval shape and a polygon shape.

The third insulation unit (10515) may be provided to a bottom surface of the at least another secondary winding (10513), and may be coupled to the first fastening unit (10502*a*) to insulate the at least another secondary winding (10513). At this time, the third insulation unit (10515) may be provided as an insulation sheet, and may be provided in at least one shape of a circular shape, an oval shape and a polygon shape.

The at least another primary winding (10517) is provided to a bottom surface of the third insulation unit (10515), and coupled to the first fastening unit (10502*a*) to be insulated by the third insulation unit (10515) for supply of a power signal.

At this time, the at least another primary winding (10517) may include a metal thin film pattern layer (LP243) having an inductance component. The metal thin film pattern layer (LP243) having an inductance component may be provided in a metal material having a high conductivity to smoothly and efficiently supply a power signal supplied by a power signal supply unit (10514, described later).

The metal thin film pattern layer (LP243) having an inductance component may be formed by at least one engineering method of a photo-lithography method using a photo mask and an etching solution, or an injection molding method using a press. The at least another primary winding (10517) may be provided in at least one shape of a circular shape, an oval shape and a polygon shape.

The fourth insulation unit (10519) is provided to a bottom surface of the at least another primary winding (10517), and coupled to the first fastening unit (10502*a*) to insulate the at least another primary winding (10517). The fourth insulation unit (10519) may be provided as an insulation sheet, and may be provided in at least one shape of a circular shape, an oval shape and a polygon shape.

A power signal supply unit (10514) may be coupled to one side of the bobbin (10504) to be electrically connected to the at least one primary winding (10506), whereby a power signal can be supplied to the at least one primary winding (10506). At this time, the power signal supply unit (10514) may be electrically connected to a distal end of one side of the bobbin (10504) and to a distal end of the at least one primary winding (10506).

Furthermore, the power signal supply unit (10514) may be coupled to another side of the bobbin (10504) to be electrically connected to the at least another primary winding (10517), whereby a power signal can be supplied to the at least another primary winding (10517). At this time, the power signal supply unit (10514) may be electrically connected to a distal end of another side of the bobbin (10504) and a distal end of the at least another primary winding (10517).

The power signal supply unit (10514) may be provided in a metal material having a high conductivity to smoothly and efficiently supply a power signal to the at least one primary winding (10506) or to the at least another primary winding (10517). At this time, the power signal supply unit (10514) may be provided as a terminal lug.

A power signal output unit (10516) may be coupled to the other side of the bobbin (10504) to be electrically connected to the at least one secondary winding (10510), whereby a power signal transformed by the at least one secondary winding (10510) can be outputted. At this time, the power signal output unit (10516) may be electrically connected to a distal end of the other side of the bobbin (10504) and to a distal end of the at least one secondary winding (10510) The power signal output unit (10516) may be coupled to another other side of the bobbin (10504) to be electrically coupled to the at least another secondary winding (10513), whereby a power signal transformed by the at least another secondary winding (10513) can be outputted. At this time, the power signal output unit (10516) may be electrically coupled to a distal end of another other side of the bobbin (10504) and to a distal end of the at least another secondary winding (10513).

Furthermore, the power signal output unit (10516) may be provided in a metal material having a high conductivity to smoothly and efficiently output a power signal transformed by the at least one secondary winding (10510) or the at least another secondary winding (10513). The power signal output unit (10516) may be provided as a terminal lug.

As apparent from the foregoing, the planar transformer (10500) according to the fifty third exemplary embodiment of the present invention includes the core (10502), the bobbin (10504), the at least one primary winding (10506), the first insulation unit (10508), the at least one secondary winding (10510), the second insulation unit (10512), the at least another secondary winding (10513), the third insulation unit (10515), the at least another primary winding (10517) and the fourth insulation unit (10519).

Therefore, a planar transformer (10500) can be manufactured in a slim size using the technical feature of the planar transformer (10500) according to the fifty third exemplary embodiment of the present invention, such that a power supply unit (not shown) that is manufactured along with the planar transformer (10500) can be manufactured in a slim size. Furthermore, the planar transformer (10500) according to the fifty third exemplary embodiment of the present invention can reduce the manufacturing cost of the planar transformer (10500) to enhance the efficiency of transformation.

Fifty Fourth Exemplary Embodiment

Figure 107:
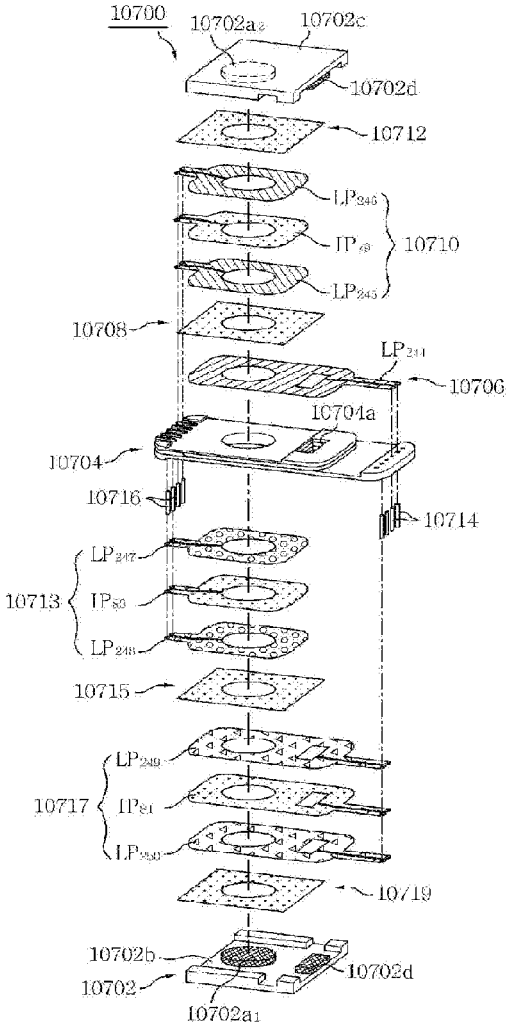
FIG. 107 is an exploded perspective view illustrating a planar transformer according to a fifty fourth exemplary embodiment of the present invention.
Figure 108:
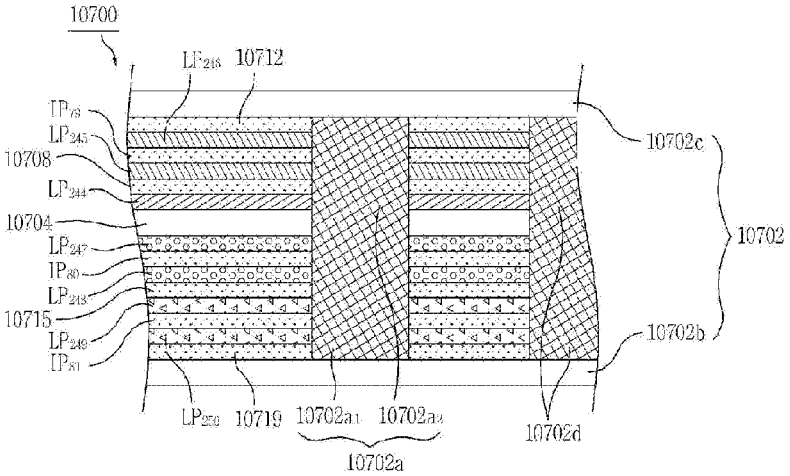
FIG. 108 is a coupled cross-sectional view illustrating a planar transformer according to a fifty fourth exemplary embodiment of the present invention.

FIG. 107 is an exploded perspective view illustrating a planar transformer according to a fifty fourth exemplary embodiment of the present invention, and FIG. 108 is a coupled cross-sectional view illustrating a planar transformer according to a fifty fourth exemplary embodiment of the present invention.

First, referring to FIGS. 107 and 108, a planar transformer (10700) according to the fifty fourth exemplary embodiment of the present invention includes a core (10702), a bobbin (10704), at least one primary winding (10706), a first insulation unit (10708), at least one secondary winding (10710), a second insulation unit (10712), at least another secondary winding (10713), a third insulation unit (10715), at least another primary winding (10717) and a fourth insulation unit (10719).

The core (10702) includes a first fastening unit (10702*a*) and is provided to induce formation of a magnetic field, where the core (10702) may include a bottom core (10702*b*) and an upper core (10702*c*). The bobbin (10704) is so provided as to be coupled to the core (10702) by the first fastening unit (10702*a*). The first fastening unit (10702*a*) may include first fastening lugs (10702*a*1, 10702*a*2).

Furthermore, the bobbin (10704) may include a second fastening unit (10704*a*) discrete from the first fastening unit (10702*a*), and the core (10702) may include a third fastening unit (10702*d*) to be coupled to the second fastening unit (10704*a*).

At this time, the second fastening unit (10704*a*) may be provided as a second fastening hole (10704*a*), and the third fastening unit (10702*d*) may be provided to the bottom core (10702*b*) and the upper core (10702*c*), and may be provided as a third fastening lug (10702*d*) so as to be coupled to the second fastening hole (10704*a*).

The at least one primary winding (10706) is provided between the core (10702) and the bobbin (10704), and provided at an upper surface of the bobbin (10704) to be coupled to the first fastening unit (10702*a*) for supply of a power signal.

At this time, the at least one primary winding (10706) may include a metal thin film pattern layer (LP244) having an inductance component. The metal thin film pattern layer having an inductance component may be provided in a metal material having a high conductivity to smoothly and efficiently supply a power signal supplied by a power signal supply unit (10714, described later).

The metal thin film pattern layer (LP244) having an inductance component may be formed by at least one engineering method of a photo-lithography method using a photo mask and an etching solution, or an injection molding method using a press. The at least one primary winding (10706) may be provided in at least one shape of a circular shape, an oval shape and a polygon shape.

The first insulation unit (10708) is provided to an upper surface of the at least one primary winding (10706) and coupled to the first fastening unit (10702*a*) to insulate the at least one primary winding (10706). At this time, the first insulation unit (10708) may be provided as an insulation sheet, and may be provided in at least one shape of a circular shape, an oval shape and a polygon shape.

The at least one secondary winding (10710) is provided to an upper surface of the first insulation unit (10708), coupled to the first fastening unit (10702*a*) and insulated by the first insulation unit (10708) to transform a power signal.

At this time, the at least one secondary winding (10710) may include metal thin film pattern layers (LP245, LP246) having at least two or more inductance components, and at least one secondary insulation layer (IP79) provided between the metal thin film pattern layers (LP245, LP246) having at least two or more inductance components to insulate the metal thin film pattern layers (LP245, LP246) having at least two or more inductance components.

The metal thin film pattern layers (LP244, LP246) having at least two or more inductance components may be provided in a metal material having a high conductivity to smoothly and efficiently output a power signal transformed by the at least one secondary winding (10710).

The metal thin film pattern layers (LP244, LP246) having at least two or more inductance components may be formed by at least one engineering method of a photo-lithography method using a photo mask and an etching solution, or an injection molding method using a press. The at least one secondary winding (10710) may be provided in at least one shape of a circular shape, an oval shape and a polygon shape.

The second insulation unit (10712) is provided to an upper surface of the at least one secondary winding (10710), and coupled to the first fastening unit (10702*a*) to insulate the at least one secondary winding (10710). At this time, the second insulation unit (10712) may be provided as an insulation sheet, and may be provided in at least one shape of a circular shape, an oval shape and a polygon shape.

The at least another secondary winding (10713) is provided between the core (10702) and the bobbin (10704), and provided to a bottom surface of the bobbin (10704) to be coupled to the first fastening unit (10702*a*) for transformation of a power signal.

At this time, the at least another secondary winding (10713) may include metal thin film pattern layers (LP247, LP248) having at least two or more inductance components, and at least one secondary insulation layer (IP80) provided between the metal thin film pattern layers (LP247, LP248) having at least two or more inductance components to insulate the metal thin film pattern layers (LP247, LP248) having at least two or more inductance components.

The metal thin film pattern layers (LP247, LP248) having at least two or more inductance components may be provided in a metal material having a high conductivity to smoothly and efficiently output a power signal transformed by the at least another secondary winding (10713).

The metal thin film pattern layers (LP247, LP248) having at least two or more inductance components may be formed by at least one engineering method of a photo-lithography method using a photo mask and an etching solution, or an injection molding method using a press. The at least another secondary winding (10713) may be provided in at least one shape of a circular shape, an oval shape and a polygon shape.

The third insulation unit (10715) may be provided to a bottom surface of the at least another secondary winding (10713), and may be coupled to the first fastening unit (10702*a*) to insulate the at least another secondary winding (10713). At this time, the third insulation unit (10715) may be provided as an insulation sheet, and may be provided in at least one shape of a circular shape, an oval shape and a polygon shape.

The at least another primary winding (10717) is provided to a bottom surface of the third insulation unit (10715), and coupled to the first fastening unit (10702*a*) to be insulated by the third insulation unit (10715) for supply of a power signal.

At this time, the at least another primary winding (10717) may include metal thin film pattern layers (LP249, LP250) having at least two or more inductance components, and at least another primary insulation layer (IP81) provided between the metal thin film pattern layers (LP249, LP250) having at least two or more inductance components to insulate the metal thin film pattern layers (LP249, LP250) having at least two or more inductance components.

The metal thin film pattern layers (LP249, LP250) having at least two or more inductance components may be provided in a metal material having a high conductivity to smoothly and efficiently supply a power signal supplied by a power signal supply unit (10714, described later).

The metal thin film pattern layers (LP249, LP250) having at least two or more inductance components may be formed by at least one engineering method of a photo-lithography method using a photo mask and an etching solution, or an injection molding method using a press. The at least another primary winding (10717) may be provided in at least one shape of a circular shape, an oval shape and a polygon shape.

The fourth insulation unit (10719) is provided to a bottom surface of the at least another primary winding (10717), and coupled to the first fastening unit (10702*a*) to insulate the at least another primary winding (10717). The fourth insulation unit (10719) may be provided as an insulation sheet, and may be provided in at least one shape of a circular shape, an oval shape and a polygon shape.

A power signal supply unit (10714) may be coupled to one side of the bobbin (10704) to be electrically connected to the at least one primary winding (10706), whereby a power signal can be supplied to the at least one primary winding (10706). At this time, the power signal supply unit (10714) may be electrically connected to a distal end of one side of the bobbin (10704) and to a distal end of the at least one primary winding (10706).

Furthermore, the power signal supply unit (10714) may be coupled to another side of the bobbin (10704) to be electrically connected to the at least another primary winding (10717), whereby a power signal can be supplied to the at least another primary winding (10717). At this time, the power signal supply unit (10714) may be electrically connected to a distal end of another side of the bobbin (10704) and a distal end of the at least another primary winding (10717).

The power signal supply unit (10714) may be provided in a metal material having a high conductivity to smoothly and efficiently supply a power signal to the at least one primary winding (10706) or to the at least another primary winding (10717). At this time, the power signal supply unit (10714) may be provided as a terminal lug.

A power signal output unit (10716) may be coupled to the other side of the bobbin (10704) to be electrically connected to the at least one secondary winding (10710), whereby a power signal transformed by the at least one secondary winding (10710) can be outputted. At this time, the power signal output unit (10716) may be electrically connected to a distal end of the other side of the bobbin (10704) and to a distal end of the at least one secondary winding (10710) The power signal output unit (10716) may be coupled to another other side of the bobbin (10704) to be electrically coupled to the at least another secondary winding (10713), whereby a power signal transformed by the at least another secondary winding (10713) can be outputted. At this time, the power signal output unit (10716) may be electrically coupled to a distal end of another other side of the bobbin (10704) and to a distal end of the at least another secondary winding (10713).

Furthermore, the power signal output unit (10716) may be provided in a metal material having a high conductivity to smoothly and efficiently output a power signal transformed by the at least one secondary winding (10710) or the at least another secondary winding (10713). The power signal output unit (10716) may be provided as a terminal lug.

As apparent from the foregoing, the planar transformer (10700) according to the fifty fourth exemplary embodiment of the present invention includes the core (10702), the bobbin (10704), the at least one primary winding (10706), the first insulation unit (10708), the at least one secondary winding (10710), the second insulation unit (10712), the at least another secondary winding (10713), the third insulation unit (10715), the at least another primary winding (10717) and the fourth insulation unit (10719).

Therefore, a planar transformer (10700) can be manufactured in a slim size using the technical feature of the planar transformer (10700) according to the fifty fourth exemplary embodiment of the present invention, such that a power supply unit (not shown) that is manufactured along with the planar transformer (10700) can be manufactured in a slim size. Furthermore, the planar transformer (10700) according to the fifty fourth exemplary embodiment of the present invention can reduce the manufacturing cost of the planar transformer (10700) to enhance the efficiency of transformation.

Fifty Fifth Exemplary Embodiment

Figure 109:
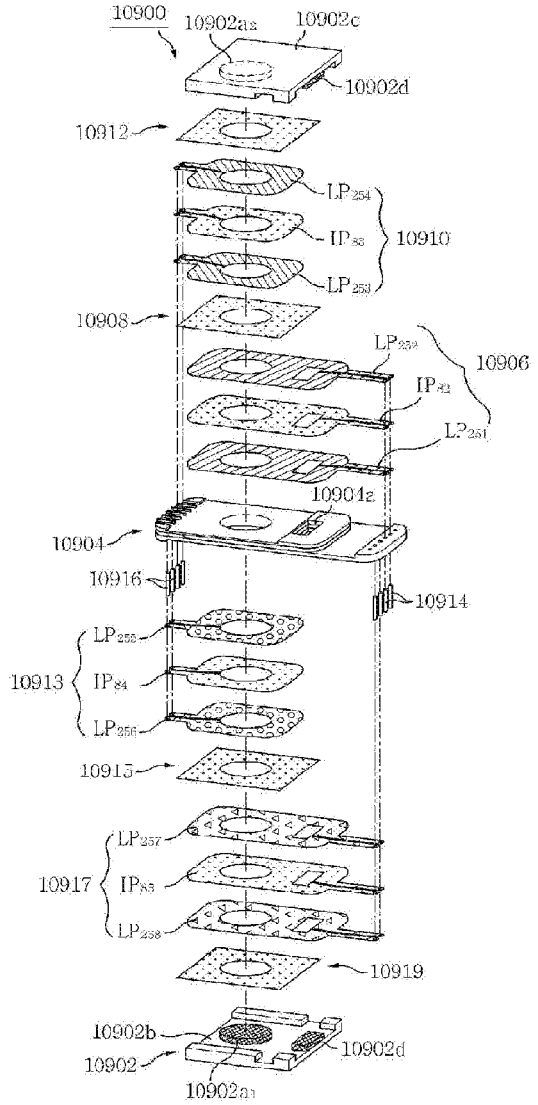
FIG. 109 is an exploded perspective view illustrating a planar transformer according to a fifty fifth exemplary embodiment of the present invention.
Figure 110:
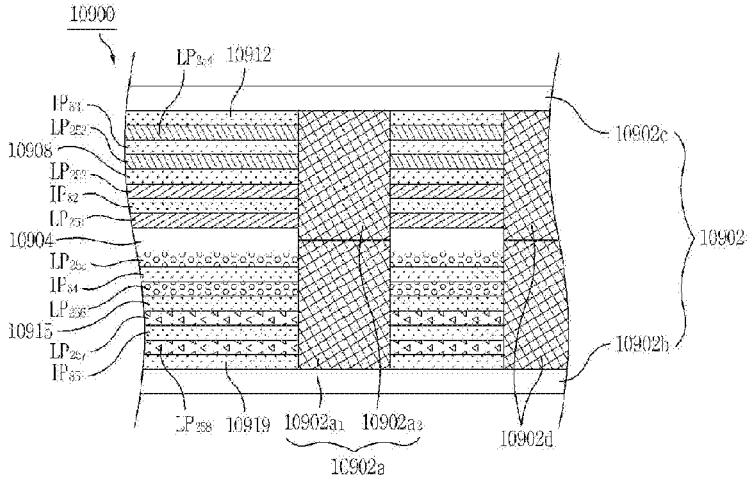
FIG. 110 is a coupled cross-sectional view illustrating a planar transformer according to a fifty fifth exemplary embodiment of the present invention.

FIG. 109 is an exploded perspective view illustrating a planar transformer according to a fifty fifth exemplary embodiment of the present invention, and FIG. 110 is a coupled cross-sectional view illustrating a planar transformer according to a fifty fifth exemplary embodiment of the present invention.

First, referring to FIGS. 109 and 110, a planar transformer (10900) according to the fifty fifth exemplary embodiment of the present invention includes a core (10902), a bobbin (10904), at least one primary winding (109706), a first insulation unit (10908), at least one secondary winding (10910), a second insulation unit (10912), at least another secondary winding (10913), a third insulation unit (10915), at least another primary winding (10917) and a fourth insulation unit (10919).

The core (10902) includes a first fastening unit (10902*a*) and is provided to induce formation of a magnetic field, where the core (10902) may include a bottom core (10902*b*) and an upper core (10902*c*). The bobbin (10904) is so provided as to be coupled to the core (10902) by the first fastening unit (10902*a*). The first fastening unit (10902*a*) may include first fastening lugs (10902*a*1, 10902*a*2).

Furthermore, the bobbin (10904) may include a second fastening unit (10904*a*) discrete from the first fastening unit (10902*a*), and the core (10902) may include a third fastening unit (10902*d*) to be coupled to the second fastening unit (10904*a*).

At this time, the second fastening unit (10904*a*) may be provided as a second fastening hole (10904*a*), and the third fastening unit (10902*d*) may be provided to the bottom core (10902*b*) and the upper core (10902*c*), and may be provided as a third fastening lug (10902*d*) so as to be coupled to the second fastening hole (10904*a*).

The at least one primary winding (10906) is provided between the core (10902) and the bobbin (10904), and provided at an upper surface of the bobbin (10904) to be coupled to the first fastening unit (10902*a*) for supply of a power signal.

At this time, the at least one primary winding (10906) may include metal thin film pattern layers (LP251, LP252) having at least two or more inductance components, and at least one primary insulation layer (IP82) provided between the metal thin film pattern layers (LP251, LP252) having at least two or more inductance components to insulate the metal thin film pattern layers (LP251, LP252) having at least two or more inductance components. The metal thin film pattern layers (LP251, LP252) having at least two or more inductance components may be provided in a metal material having a high conductivity to smoothly and efficiently supply a power signal supplied by a power signal supply unit (10914, described later).

The metal thin film pattern layers (LP251, LP252) having at least two or more inductance components may be formed by at least one engineering method of a photo-lithography method using a photo mask and an etching solution, or an injection molding method using a press. The at least one primary winding (10906) may be provided in at least one shape of a circular shape, an oval shape and a polygon shape.

The first insulation unit (10908) is provided to an upper surface of the at least one primary winding (10906) and coupled to the first fastening unit (10902*a*) to insulate the at least one primary winding (10906). At this time, the first insulation unit (10908) may be provided as an insulation sheet, and may be provided in at least one shape of a circular shape, an oval shape and a polygon shape.

The at least one secondary winding (10910) is provided to an upper surface of the first insulation unit (10908), coupled to the first fastening unit (10902*a*) and insulated by the first insulation unit (10908) to transform a power signal.

At this time, the at least one secondary winding (10910) may include metal thin film pattern layers (LP253, LP254) having at least two or more inductance components, and at least one secondary insulation layer (IP83) provided between the metal thin film pattern layers (LP253, LP254) having at least two or more inductance components to insulate the metal thin film pattern layers (LP253, LP254) having at least two or more inductance components.

The metal thin film pattern layers (LP253, LP254) having at least two or more inductance components may be provided in a metal material having a high conductivity to smoothly and efficiently output a power signal transformed by the at least one secondary winding (10910).

The metal thin film pattern layers (LP253, LP254) having at least two or more inductance components may be formed by at least one engineering method of a photo-lithography method using a photo mask and an etching solution, or an injection molding method using a press. The at least one secondary winding (10910) may be provided in at least one shape of a circular shape, an oval shape and a polygon shape.

The second insulation unit (10912) is provided to an upper surface of the at least one secondary winding (10910), and coupled to the first fastening unit (10902*a*) to insulate the at least one secondary winding (10910). At this time, the second insulation unit (10912) may be provided as an insulation sheet, and may be provided in at least one shape of a circular shape, an oval shape and a polygon shape.

The at least another secondary winding (10913) is provided between the core (10902) and the bobbin (10904), and provided to a bottom surface of the bobbin (10904) to be coupled to the first fastening unit (10902*a*) for transformation of a power signal.

At this time, the at least another secondary winding (10913) may include metal thin film pattern layers (LP255, LP256) having at least two or more inductance components, and at least one secondary insulation layer (IP84) provided between the metal thin film pattern layers (LP255, LP256) having at least two or more inductance components to insulate the metal thin film pattern layers (LP255, LP256) having at least two or more inductance components.

The metal thin film pattern layers (LP255, LP256) having at least two or more inductance components may be provided in a metal material having a high conductivity to smoothly and efficiently output a power signal transformed by the at least another secondary winding (10913).

The metal thin film pattern layers (LP255, LP256) having at least two or more inductance components may be formed by at least one engineering method of a photo-lithography method using a photo mask and an etching solution, or an injection molding method using a press. The at least another secondary winding (10913) may be provided in at least one shape of a circular shape, an oval shape and a polygon shape.

The third insulation unit (10915) may be provided to a bottom surface of the at least another secondary winding (10913), and may be coupled to the first fastening unit (10902*a*) to insulate the at least another secondary winding (10913). At this time, the third insulation unit (10915) may be provided as an insulation sheet, and may be provided in at least one shape of a circular shape, an oval shape and a polygon shape.

The at least another primary winding (10917) is provided to a bottom surface of the third insulation unit (10915), and coupled to the first fastening unit (10902*a*) to be insulated by the third insulation unit (10915) for supply of a power signal.

At this time, the at least another primary winding (10917) may include metal thin film pattern layers (LP257, LP258) having at least two or more inductance components, and at least another primary insulation layer (IP85) provided between the metal thin film pattern layers (LP257, LP258) having at least two or more inductance components to insulate the metal thin film pattern layers (LP257, LP258) having at least two or more inductance components.

The metal thin film pattern layers (LP257, LP258) having at least two or more inductance components may be provided in a metal material having a high conductivity to smoothly and efficiently supply a power signal supplied by a power signal supply unit (10914, described later).

The metal thin film pattern layers (LP257, LP258) having at least two or more inductance components may be formed by at least one engineering method of a photo-lithography method using a photo mask and an etching solution, or an injection molding method using a press. The at least another primary winding (10917) may be provided in at least one shape of a circular shape, an oval shape and a polygon shape.

The fourth insulation unit (10919) is provided to a bottom surface of the at least another primary winding (10917), and coupled to the first fastening unit (10902*a*) to insulate the at least another primary winding (10917). The fourth insulation unit (10919) may be provided as an insulation sheet, and may be provided in at least one shape of a circular shape, an oval shape and a polygon shape.

A power signal supply unit (10914) may be coupled to one side of the bobbin (10904) to be electrically connected to the at least one primary winding (10906), whereby a power signal can be supplied to the at least one primary winding (10906). At this time, the power signal supply unit (10914) may be electrically connected to a distal end of one side of the bobbin (10904) and to a distal end of the at least one primary winding (10906).

Furthermore, the power signal supply unit (10914) may be coupled to another side of the bobbin (10904) to be electrically connected to the at least another primary winding (10917), whereby a power signal can be supplied to the at least another primary winding (10917). At this time, the power signal supply unit (10914) may be electrically connected to a distal end of another side of the bobbin (10904) and a distal end of the at least another primary winding (10917).

The power signal supply unit (10914) may be provided in a metal material having a high conductivity to smoothly and efficiently supply a power signal to the at least one primary winding (10906) or to the at least another primary winding (10917). At this time, the power signal supply unit (10914) may be provided as a terminal lug.

A power signal output unit (10916) may be coupled to the other side of the bobbin (10904) to be electrically connected to the at least one secondary winding (10910), whereby a power signal transformed by the at least one secondary winding (10910) can be outputted. At this time, the power signal output unit (10916) may be electrically connected to a distal end of the other side of the bobbin (10904) and to a distal end of the at least one secondary winding (10910) The power signal output unit (10916) may be coupled to another other side of the bobbin (10904) to be electrically coupled to the at least another secondary winding (10913), whereby a power signal transformed by the at least another secondary winding (10913) can be outputted. At this time, the power signal output unit (10916) may be electrically coupled to a distal end of another other side of the bobbin (10904) and to a distal end of the at least another secondary winding (10913).

Furthermore, the power signal output unit (10916) may be provided in a metal material having a high conductivity to smoothly and efficiently output a power signal transformed by the at least one secondary winding (10910) or the at least another secondary winding (10913). The power signal output unit (10916) may be provided as a terminal lug.

As apparent from the foregoing, the planar transformer (10900) according to the fifty fifth exemplary embodiment of the present invention includes the core (10902), the bobbin (10904), the at least one primary winding (10906), the first insulation unit (10908), the at least one secondary winding (10910), the second insulation unit (10912), the at least another secondary winding (10913), the third insulation unit (10915), the at least another primary winding (10917) and the fourth insulation unit (10919).

Therefore, a planar transformer (10900) can be manufactured in a slim size using the technical feature of the planar transformer (10900) according to the fifty fifth exemplary embodiment of the present invention, such that a power supply unit (not shown) that is manufactured along with the planar transformer (10900) can be manufactured in a slim size. Furthermore, the planar transformer (10900) according to the fifty fifth exemplary embodiment of the present invention can reduce the manufacturing cost of the planar transformer (10900) to enhance the efficiency of transformation.

INDUSTRIAL APPLICABILITY

The present invention has an industrial applicability in that a planar transformer can be manufactured in a slim size using the technical feature of the planar transformer according to the present invention, such that a power supply unit that is manufactured along with the planar transformer can be manufactured in a slim size, and as a result, the planar transformer according to the present invention can reduce the manufacturing cost of the planar transformer to enhance the efficiency of transformation.

The previous description of the present invention is provided to enable any person skilled in the art to make or use the invention. Various modifications to the invention will be readily apparent to those skilled in the art, and the generic principles defined herein may be applied to other variations without departing from the spirit or scope of the invention. Thus, the invention is not intended to limit the examples described herein, but is to be accorded the widest scope consistent with the principles and novel features disclosed herein.

What is claimed is:

1. A planar transformer, comprising:

a core provided to induce formation of a magnetic field;

a bobbin coupled to the core;

at least one primary winding interposed between the core and the bobbin; and at least one secondary winding interposed between the core and the bobbin, and insulated from the at least one primary winding;

wherein the core includes a first fastening lug and a second fastening lug distanced from the first fastening lug, and wherein a shape of the first fastening lug is different from a shape of the second fastening lug, wherein the first fastening lug is formed with a geometric shape different from that of the second fastening lug, wherein the bobbin includes a first fastening hole to be coupled to the first fastening lug and a second fastening hole to be coupled to the second fastening lug, wherein the first fastening hole has a geometric shape corresponding to the geometric shape of the first fastening lug, and wherein the second fastening hole has a geometric shape corresponding to the geometric shape of the second fastening lug.

2. The planar transformer of claim 1, further comprising:

a first insulation unit provided to the at least one primary winding to insulate the at least one primary winding; and a second insulation unit provided to the at least one secondary winding to insulate the at least one secondary winding, wherein the at least one secondary winding is insulated from the at least one primary winding by the first and second insulation unit.

3. The planar transformer of claim 2, further comprising:

at least another secondary winding interposed between the core and the bobbin to be coupled to the first fastening unit and to transform the power signal by being distanced from the at least one primary winding and the at least one secondary winding, and a third insulation unit provided to the at least another secondary winding to insulate the at least another secondary winding by being coupled to the first fastening unit.

4. The planar transformer of claim 3, further comprising:

at least another primary winding interposed between the core and the bobbin to be coupled to the first fastening lug and to transform the power signal by being distanced from the at least one primary winding and the at least one secondary winding, and a fourth insulation unit provided to the at least another primary winding to insulate the at least another primary winding by being coupled to the first fastening lug.

5. The planar transformer of claim 2, wherein the at least one primary winding and the at least one secondary winding each includes a metal thin film pattern layer having an inductance component.

6. The planar transformer of claim 5, wherein the metal thin film pattern layer having an inductance component includes a metal material having a high conductivity.

7. The planar transformer of claim 2, wherein the at least one primary winding and the at least one secondary winding each is provided in at least one of a circular shape, an oval shape, and a polygon shape.

8. The planar transformer of claim 4, wherein the at least one primary winding or the at least one secondary winding includes a metal thin film pattern layer having at least two or more inductance components and at least one primary insulation layer provided to the metal thin film pattern layer having the at least two or more inductance components to insulate the metal thin film pattern layer having the at least two or more inductance components.

9. The planar transformer of claim 4, wherein the at least another primary winding or the at least another secondary winding includes a metal thin film pattern layer having at least two or more inductance components, and the at least another primary insulation layer provided to the metal thin film pattern layer having the at least two or more inductance components to insulate the metal thin film pattern layer having the at least two or more inductance components.

10. The planar transformer of claim 1, further comprising:

a power signal supply unit coupled to one side of the bobbin and electrically connected to the at least one primary winding to supply the power signal to the at least one primary winding, and a power signal output unit coupled to the other side of the bobbin and electrically connected to the at least another secondary winding to output a power signal transformed by the at least one secondary winding.

11. The planar transformer of claim 10, wherein the power signal supply unit and the power signal output unit each includes a metal material having a high conductivity.

12. The planar transformer claim 10, wherein power signal supply unit and the power signal output unit each is a terminal lug.

13. The planar transformer of claim 1, wherein the core includes a bottom core and an upper core.

14. The planar transformer of claim 4, wherein the at least one primary winding and the at least one secondary winding are provided at an upper surface of the bobbin or a bottom surface of the bobbin.

15. The planar transformer of claim 14, wherein the at least another secondary winding is provided at a bottom surface of the bobbin or an upper surface of the bobbin, and wherein the at least another primary winding is provided at a bottom surface of the bobbin or an upper surface of the bobbin.

16. The planar transformer of claim 1, wherein the at least one primary winding includes a third fastening hole to be coupled to the first fastening lug that is coupled with the first fastening hole and a fourth fastening hole to be coupled to the second fastening lug that is coupled with the second fastening hole.

17. The planar transformer of claim 16, wherein the at least one primary winding includes a first region having the third fastening hole and a second region having the fourth fastening hole; and wherein the first region is overlapped with the at least one secondary winding in the bobbin and the second region is not overlapped with the at least one secondary winding in the bobbin.

18. The planar transformer of claim 1, wherein the at least one secondary winding is coupled to the first fastening lug and is not coupled to the second fastening lug.

* * * * *